US007311133B2

(12) United States Patent
Anderson et al.

(10) Patent No.: US 7,311,133 B2
(45) Date of Patent: Dec. 25, 2007

(54) LIFT AND TILT STATION FOR A COVERING FOR AN ARCHITECTURAL OPENING

(75) Inventors: Richard Anderson, Whitesville, KY (US); Wendel B. Colson, Weston, MA (US); Steven R. Haarer, Whitesville, KY (US)

(73) Assignee: Hunter Douglas, Inc., Upper Saddle River, NJ (US)

( * ) Notice: Subject to any disclaimer, the term of this patent is extended or adjusted under 35 U.S.C. 154(b) by 47 days.

(21) Appl. No.: 11/194,990

(22) Filed: Aug. 2, 2005

(65) Prior Publication Data

US 2006/0000561 A1 Jan. 5, 2006

Related U.S. Application Data

(63) Continuation of application No. 10/184,008, filed on Jun. 26, 2002, now Pat. No. 6,968,884, which is a continuation of application No. 09/528,951, filed on Mar. 20, 2000, now Pat. No. 6,536,503.

(60) Provisional application No. 60/125,776, filed on Mar. 23, 1999.

(51) Int. Cl.
*E06B 9/322* (2006.01)

(52) U.S. Cl. ..... 160/170; 160/177 R

(58) Field of Classification Search ..... 160/170, 160/171, 168.1 R, 173 R, 176.1 R, 177 R, 160/178.1 R, 178.3
See application file for complete search history.

(56) References Cited

U.S. PATENT DOCUMENTS

| | | | | |
|---|---|---|---|---|
| 13,251 A | | 7/1855 | Bixler | |
| 210,129 A | | 11/1878 | Lake | |
| 211,673 A | | 1/1879 | Shaw | |
| 794,937 A | | 7/1905 | Hopkins | |
| 1,721,501 A | | 7/1929 | McKee | |
| 2,192,617 A | * | 3/1940 | North | 160/173 R |
| 2,262,949 A | | 11/1941 | Lorentzen | |
| 2,266,160 A | | 12/1941 | Burns | |
| 2,276,716 A | | 3/1942 | Cardona | |
| 2,324,536 A | | 7/1943 | Pratt | |
| 2,381,060 A | * | 8/1945 | Kahn | 160/170 |
| 2,390,826 A | | 12/1945 | Cohn | |
| 2,420,301 A | | 5/1947 | Cusumano | |
| 2,534,777 A | * | 12/1950 | Kesner | 160/170 |
| 2,535,751 A | | 12/1950 | Nardulli | |
| 2,614,623 A | | 10/1952 | Nelson | |
| 2,687,769 A | | 8/1954 | Gershuny | |
| 2,742,962 A | * | 4/1956 | Griesser | 160/170 |

(Continued)

FOREIGN PATENT DOCUMENTS

CA 2206932 12/1997

(Continued)

*Primary Examiner*—Blair M. Johnson
(74) *Attorney, Agent, or Firm*—Theresa Fritz Camoriano; Guillermo Camoriano; Camoriano and Associates

(57) ABSTRACT

A modular blind transport system for a window blind application. The complete system may be assembled form a relatively small number of individual modules to obtain working systems for a very wide range of applications, including especially a category of counterbalanced blinds wherein a relatively small external input force may be used to raise or lower the blind, and/or to open or close the blind.

18 Claims, 140 Drawing Sheets

U.S. PATENT DOCUMENTS

| | | | | | |
|---|---|---|---|---|---|
| 2,765,030 | A | * | 10/1956 | Bechtler | 160/170 |
| 2,769,511 | A | | 11/1956 | Hayes | |
| 2,824,608 | A | | 2/1958 | Etten | |
| 3,194,343 | A | | 7/1965 | Sindlinger | |
| 3,276,553 | A | | 10/1966 | Tilloy | |
| 3,352,349 | A | * | 11/1967 | Hennequin | 160/171 |
| 3,358,612 | A | | 12/1967 | Bleuer | |
| 3,447,585 | A | | 6/1969 | Lorentzen et al. | |
| 3,630,264 | A | | 12/1971 | Debs et al. | |
| 3,756,585 | A | | 9/1973 | Mihalcheon | |
| 3,866,656 | A | | 2/1975 | McCabe | |
| 3,984,063 | A | | 10/1976 | Knieriemen | |
| 4,005,764 | A | | 2/1977 | Terzian et al. | |
| 4,187,897 | A | | 2/1980 | Frentzel | |
| 4,200,135 | A | | 4/1980 | Hennequin | |
| 4,228,843 | A | | 10/1980 | Kobayashi | |
| 4,245,687 | A | | 1/1981 | Vecchiarelli | |
| 4,352,385 | A | | 10/1982 | Vecchiarelli | |
| 4,372,432 | A | | 2/1983 | Waine et al. | |
| 4,433,765 | A | | 2/1984 | Rude et al. | |
| 4,456,049 | A | | 6/1984 | Vecchiarelli | |
| 4,457,351 | A | | 7/1984 | Anderson | |
| 4,475,580 | A | | 10/1984 | Hennequin | |
| 4,480,674 | A | | 11/1984 | Anderson | |
| 4,513,805 | A | | 4/1985 | Mase | |
| 4,522,245 | A | | 6/1985 | Anderson | |
| 4,541,468 | A | | 9/1985 | Anderson | |
| 4,621,673 | A | | 11/1986 | Georgopoulos et al. | |
| 4,623,012 | A | | 11/1986 | Rude et al. | |
| 4,697,629 | A | | 10/1987 | Anderson | |
| 4,697,630 | A | * | 10/1987 | Rude | 160/177 R |
| 4,768,576 | A | | 9/1988 | Anderson | |
| 5,054,162 | A | | 10/1991 | Rogers | |
| 5,133,399 | A | | 7/1992 | Hiller et al. | |
| 5,157,808 | A | | 10/1992 | Sterner, Jr. | |
| 5,170,830 | A | | 12/1992 | Coslett | |
| 5,228,491 | A | | 7/1993 | Rude et al. | |
| 5,328,113 | A | | 7/1994 | De Chevron Villette et al. | |
| 5,341,865 | A | | 8/1994 | Fraser et al. | |
| 5,363,898 | A | | 11/1994 | Sprague | |
| 5,375,643 | A | | 12/1994 | Rude | |
| 5,390,721 | A | | 2/1995 | Oskam et al. | |
| 5,437,324 | A | | 8/1995 | Sternquist | |
| 5,482,100 | A | | 1/1996 | Kuhar | |
| 5,531,257 | A | | 7/1996 | Kuhar | |
| 5,706,876 | A | | 1/1998 | Lysyj | |
| 5,725,040 | A | | 3/1998 | Domel | |
| 5,853,039 | A | | 12/1998 | Fraser et al. | |
| 5,904,198 | A | | 5/1999 | Huang | |
| 5,908,062 | A | | 6/1999 | Fun | |
| 5,996,670 | A | | 12/1999 | Igarashi | |
| 6,012,506 | A | | 1/2000 | Wang et al. | |
| 6,024,154 | A | | 2/2000 | Wang et al. | |
| 6,029,734 | A | | 2/2000 | Wang et al. | |
| 6,056,036 | A | | 5/2000 | Todd et al. | |
| 6,079,471 | A | | 6/2000 | Kuhar | |
| 6,129,131 | A | | 10/2000 | Colson | |
| 6,149,094 | A | | 11/2000 | Martin et al. | |
| 6,173,825 | B1 | | 1/2001 | Liu | |
| 6,234,236 | B1 | | 5/2001 | Kuhar | |
| 6,318,661 | B1 | | 11/2001 | Martin et al. | |
| 6,571,853 | B1 | | 6/2003 | Ciuca et al. | |
| 6,575,223 | B1 | | 6/2003 | Chung et al. | |
| 6,786,270 | B2 | * | 9/2004 | Wen et al. | 160/170 |
| 6,843,302 | B2 | | 1/2005 | Nijs | |
| 6,948,544 | B2 | * | 9/2005 | Nien | 160/170 |
| 7,021,360 | B2 | * | 4/2006 | Schroder et al. | 160/168.1 P |
| 2002/0088562 | A1 | | 7/2002 | Palmer | |

FOREIGN PATENT DOCUMENTS

| | | |
|---|---|---|
| CH | 581 257 | 10/1976 |
| DE | 16269 | 2/1881 |
| EP | 0 796 994 A2 | 9/1997 |
| EP | 0803635 | 10/1997 |
| GB | 13798 | 0/1893 |
| GB | 670931 | 4/1952 |
| GB | 986529 | 3/1965 |
| GB | 2 120 716 A | 12/1983 |
| GB | 2 158 137 A | 11/1985 |
| GB | 2 262 324 A | 6/1993 |
| WO | WO 88/02055 | 3/1988 |

* cited by examiner 30A
462
462
400

462
464
462
424
430
464
424
426
426
420
422
450
410D
416
418
446
414
438
440
412
432
410B
406
410C
454
402A
408
410A
30A
400
444

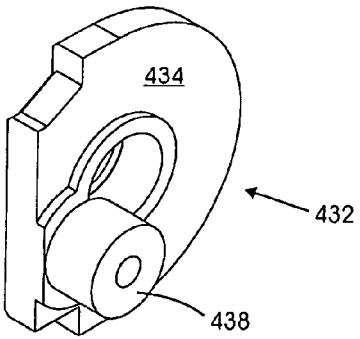
FIG. 79A
FIG. 79B
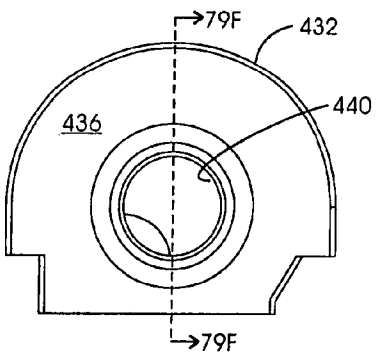
FIG. 79C
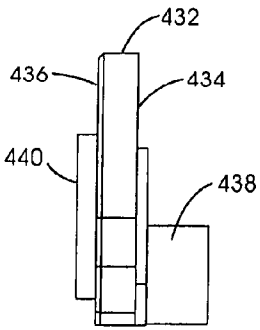
FIG. 79D
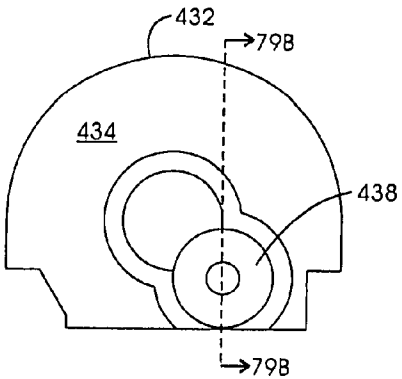
FIG. 79E
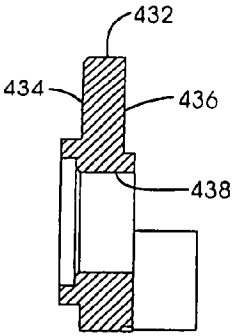
FIG. 79F

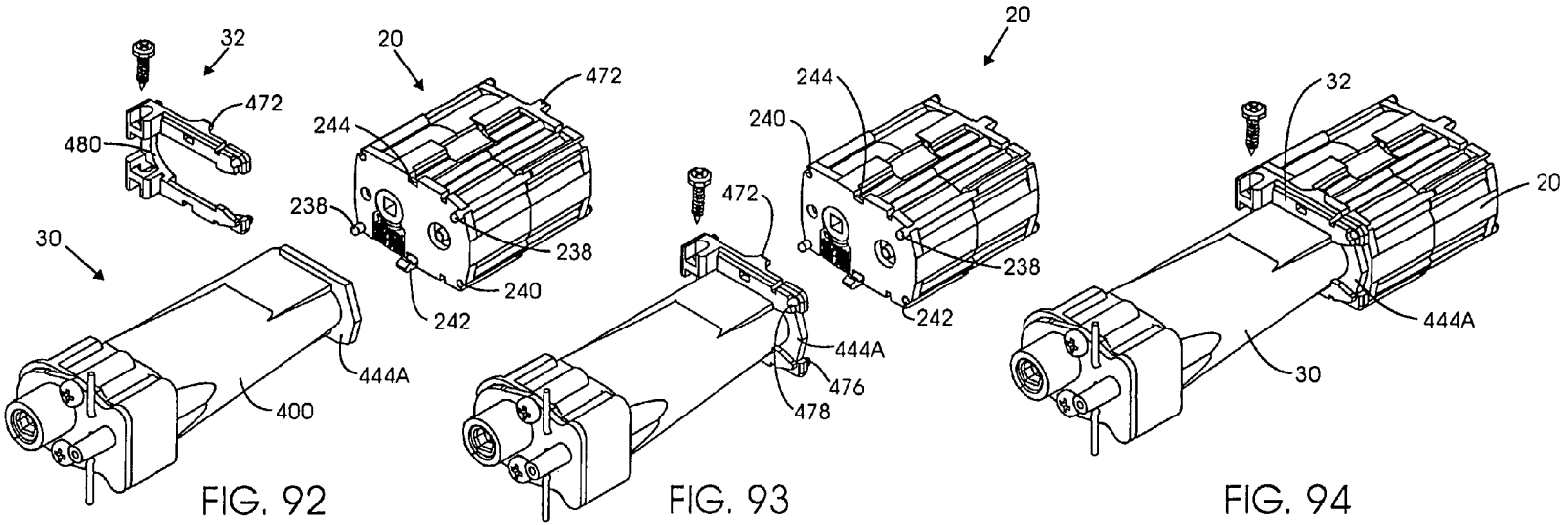
FIG. 92
FIG. 93
FIG. 94
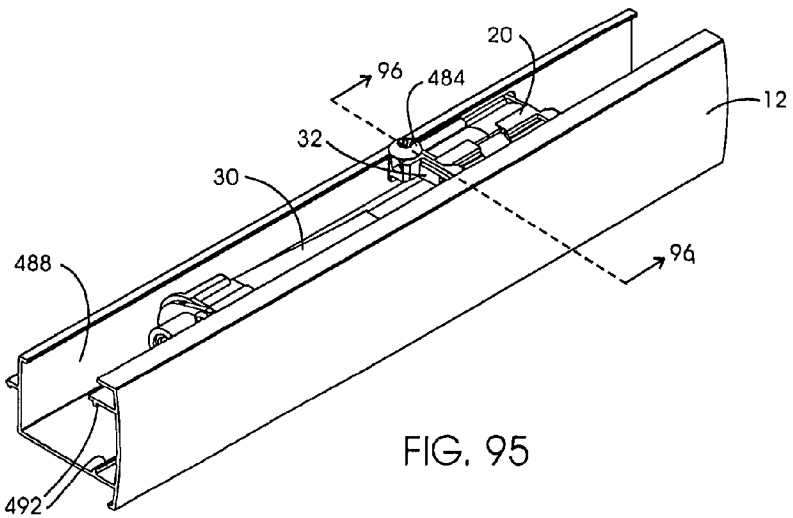
FIG. 95
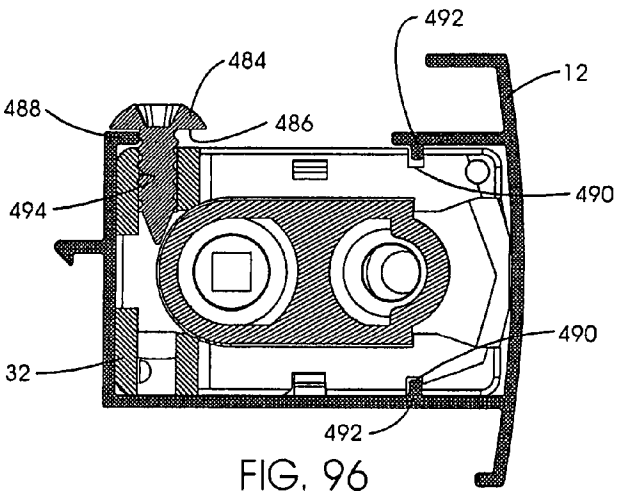
FIG. 96

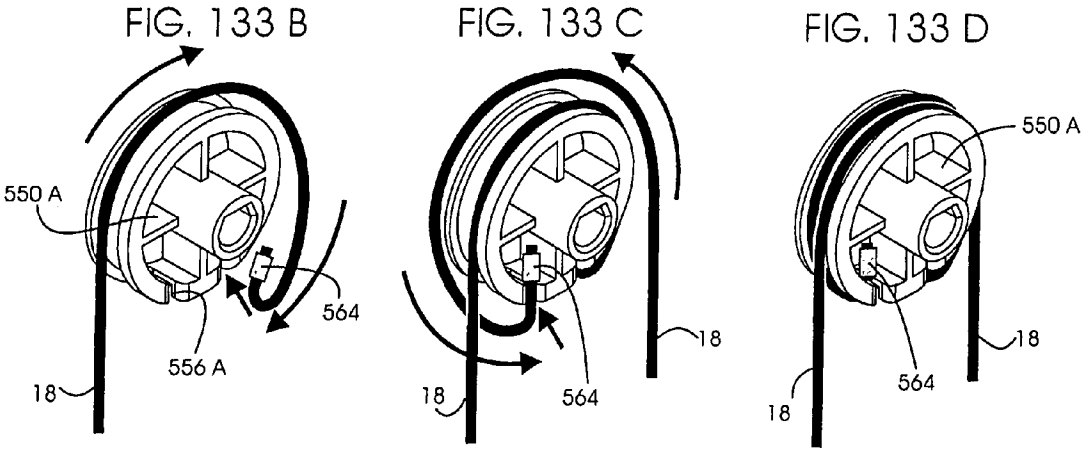
FIG. 133 D
FIG. 133 C
FIG. 133 B
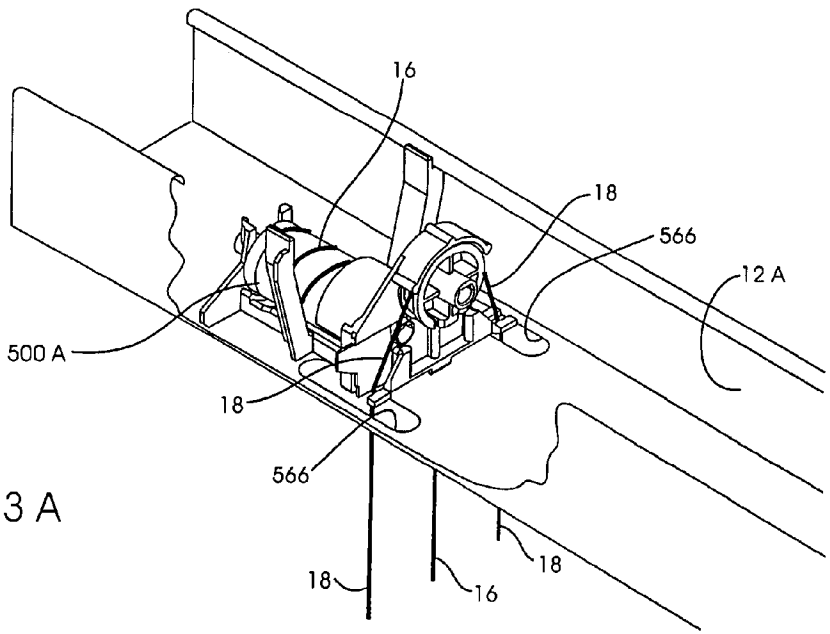
FIG. 133 A 900
926
914
238
242
913
928
913 A
956
242

926
244
914
242
956
238
240
242
954
900

238
240
242
914
926
922
913

944
954
242
956
913 A
964
928
900
930
238
240
242
914
918
916
932
934
936
938
936 A
938 A
940
940 A
922
920
924
913
238
944
952
954
926
950
956
958
923
959
960
913 A
964
928
942
946
948
900

954
926
914
240
242
238
913
928

944
954
964
928
922
926
914
238
240
242
913

900 A 944
954
964
940 A
940
936 A
938 A
926
928
942
948
922
936
938
914
214
238
240
242
913
916
932

LIFT AND TILT STATION FOR A COVERING FOR AN ARCHITECTURAL OPENING

BACKGROUND OF THE INVENTION

This application is a continuation of U.S. patent application Ser. No. 10/184,008, filed Jun. 26, 2002 now U.S. Pat No. 6,968,884, which is a continuation of U.S. patent application Ser. No. 09/528,951, now U.S. Pat. No. 6,536,503, filed Mar. 20, 2000, which is hereby incorporated herein by reference, and claims priority from U.S. Provisional Application Ser. No. 60/1 25,776, filed Mar. 23, 1999, which is also incorporated herein by reference. The present invention relates to a modular transport system for opening and closing Venetian blinds, pleated shades, and other blinds and shades. While the embodiments shown herein are of horizontal blinds, the transport system may also be used on vertical blinds.

In order to proceed, it is necessary to explain the operation of a blind transport system and to define some of the terms used. Typically, a blind transport system will have a top head rail which both supports the blind and hides the mechanisms used to raise and lower or open and close the blind. The raising and lowering is done by a lift cord attached to the bottom rail (or bottom slat). Thus, when raising a blind, at first only the bottom rail is being raised and the amount of force required is small. As the bottom rail is raised further, more of the slats are stacked on top of the bottom rail and thus progressively more force is required to continue to raise the blind. The largest amount of force will be required at the very top when literally the entire blind is being raised. By the same token, the greatest amount of force will be required to keep the blinds in this fully raised position, as one is fighting against the weight of the entire blind.

In contrast, when the blind is fully lowered, only the bottom rail is supported by the lift cord. The rest of the weight of the blind is supported by the ladder tape which has tilt cables running to, and supported by, the head rail. Since the weight of all slats not resting on the bottom rail is supported by the head rail (via the ladder tapes), this weight need not be overcome when raising the blind. Only the weight of the bottom rail, and the weight of each successive slat as it comes in contact with the bottom rail as the blind is raised, need to be overcome.

In essence, the lift cord and the ladder tapes exchange loads as the blind is raised and lowered. The ladder tapes do practically all of the supporting when the blind is down. As the blind is raised, the weight is shifted from the ladder tapes onto the lift cords as each successive slat is picked up by the rising bottom rail and thus is no longer supported by the ladder tapes. The implication is that the least amount of force is required to start raising a fully lowered blind, and also the least amount of force is required to keep the blind in this lowered position. Progressively larger force is required to lift and to maintain the position of the blind as the blind is raised until a maximum amount of force is reached at the topmost position, where the blind is fully raised.

The force required to raise the blind varies directly and approximately linearly with the raising of the blind, increasing from a minimum when the blind is fully lowered to a maximum when the blind is fully raised. This same force also varies directly and approximately linearly with the size and weight of the window covering.

The basic concept for a blind transport system is described in U.S. Pat. No. 13,251, "Bixler", issued Jul. 17, 1855, which is hereby incorporated by reference. However, the coiled spring motor used by Bixler is not a constant force motor. As the blind is pulled down, the spring is coiled tighter. Thus, the spring provides the strongest force when the blind is down, which is when the least force is required to assist in lifting the blind.

Other relevant blind transport systems provide a spring that gets stronger as the blind is lowered and weaker as the blind is raised, exactly the opposite of the desired effect. These systems may use a ratchet mechanism or brake to compensate for this shortcoming.

As the blind is lowered, its weight and the force of gravity are used to wind up the spring so that the unwinding of the spring may assist in the raising of the blind. In order to accomplish this raising of the blind, there is generally some type of mechanism to wind up the lift cord onto a shaft or spool. Preferably this mechanism will pull the lift cord vertically, with no horizontal component to upset the symmetry and functionality of the ladder tapes.

Many lift cord winding mechanisms have been used in the prior art. Typically they displace the wind-up spool axially as the lift cord is wound up, requiring a complicated mechanism, or they have problems with over wrapping and tangling of the cord. In order to prevent this over wrapping or tangling, some mechanisms guide the incoming coils of the lift cord axially along the spool using either a shoulder on the spool or a finger or kicker in close proximity to the surface of the spool. In the prior art, the kicker is located at the bottom of the spool, just before the point where the new lift cord enters. The weight of the blind pulls the spool downwardly, causing it to sag, and this can cause the gap between the kicker and the spool to be reduced to the point that there is interference between the spool and the kicker, creating friction.

As may be appreciated from the prior art, the purpose of the spring motors is primarily to assist in raising the blind. Thus, a mechanism must be found to transfer and control the force from the spring motor to the lift cords, and to do so such that all the cords are lifted the same amount simultaneously (so the blind is raised evenly), and such that the cords are pulled only vertically with no horizontal component.

A complete blind transport system must also include mechanisms to accomplish other tasks. Primary among these other tasks is the ability to open or close the blind via tilting of the individual slats. This is typically accomplished with ladder tapes (and/or tilt cables) which run along the front and back of the stack of blinds. The lift cords, in contrast to the tilt cables) typically run through slits in the middle of the slats and are only connected to the bottom rail.

When the blind is closed on a standard window shade, the slits through which the lift cords run become quite visible and allow light to pass through the blinds. It is desirable, for aesthetic reasons, to have a window covering product where there are no slits visible such that, when the blind is closed, there is no light passing through the blind. This is referred to as a "de-lighted" product and is a desirable product or feature.

The prior art shows that blind transport systems have traditionally been custom-designed and custom-built around the needs of a particular window covering. Each element in the transport system must be carefully fabricated and modified as required for it to meets its function as well as its physical placement within the system. All the different elements must be carefully mounted and placed so they will co-operate with each other and this is done at the expense of much time. Furthermore, changing even one single characteristic of the blind (such as going from lightweight vinyl to heavy wooden blinds, or simply increasing the width or the length of the window covering) necessitates going through the entire time consuming process of customizing the entire blind transport system. The nature of this process makes it expensive to truly customize a system in order to optimize its performance.

SUMMARY OF THE INVENTION

The primary objective of the present invention is to provide a modular blind transport system which overcomes the shortcomings of prior blind transport systems. Rather than having to design a completely new system for each size and weight of blind, the designs of the present invention provide a system comprised of individual modules which are readily interconnected to satisfy the requirements of a multitude of different blind systems, it also includes the individual modules which make the overall system possible.

Accordingly, modularity is an important feature of the present invention. The individual modules in the present invention are contained in housings which make each element an independent and self contained module. Each module is easily and readily installed, mounted, replaced, removed, and interconnected within the blind transport system with an absolute minimum of time and expense. Each housing provides the mounting mechanism for its module onto the blind transport system, and removal of the housing also removes all the individual components which make up the module, leaving the balance of the blind transport system essentially unaffected except perhaps for the need to use a longer or shorter connecting rod.

Likewise, interchangeability is another important feature of the present invention. Individual modules may be removed and replaced with other modules which fit in the same location and have the same method of interconnection and installation, but which have different performance characteristics. For instance, interchangeable transmission modules may have different transmission ratios, or may even be a different type of transmission than the ones disclosed in this specification such a gear-type transmission, or interchangeable power modules may have different strength coil springs or may even be other types of power modules such as low voltage electric motors or a manually driven cord drive.

The present invention overcomes the problem of the high friction and the interference fit between the wind-up spool and the kicker which acts as a shoulder to displace the coils of the lift cord such that there is no over-wrap. This is accomplished by moving the location of the kicker such that it no longer is immediately below the wind-up spool but rather is located beside the wind-up spool. Thus, any vertical displacement of the wind-up spool due to the weight of the blind will not adversely affect the clearance between the spool and the kicker.

A blind transport system in accordance with the present invention may have four functional groups, and each group may have a number of different modules to accomplish its function in different manners. The four groups are:

1—Power and power transmission group: may include a head rail, a lift rod, a tilt rod, a coaxial motor, a transaxial motor, a low power electrical motor, a ratchet-type drive mechanism, variable force coil spring motors, a worm gear lift mechanism, a cord loop lift mechanism, a variable brake, an adjustable brake, a transmission, and the adapters to interconnect these modules. More than one of any of these modules may be present and any one or more of these modules may be absent in a power transmission group for a particular blind.

2—Lift and/or tilt stations group

3—Tilt mechanisms group, which to a large extent is a specific subgroup of the power and power transmission group, but geared specifically at the tilting action of the blind.

4—The rest of the blind, which is essentially anything hanging off of the head rail including slats, ladder tapes, bottom rail, handles, pleated fabrics, handles, etc.

It is important to note that a particular blind transport system may include more than one of any of these groups, and it may also be that any one or more of these groups are absent in a particular blind transport system. For example, a pleated fabric shade system would have no need for a tilt mechanism.

Most blinds made in accordance with the present invention include a head rail and a power transmission rod. This does not mean that the head rail and the power transmission rod are always identical. For instance, the power transmission rod may be longer or shorter depending on the application, and the head rail may also be longer or shorter or it may be wider or narrower also depending on the application. However, the head rail is not always necessary, and in some cases the lift spool itself serves as the power transmission rod. Also, specific modules of this invention may be used in other applications without the presence of the head rail or of the power transmission rod.

By properly sizing and designing the individual modules, they can be made to work together interchangeably, permitting the development of a wide range of systems with a minimum number of different parts. For instance, a window covering may call for a certain size lightweight plastic blind including one coaxial coil spring motor, one transmission, and two lift stations. The same type of window covering but out of a much heavier wooden blind and for a much wider window may require two or more of the same coaxial coil springs motors connected in series, a similar transmission but with a different range, and several lift stations.

By using a modular concept at the system level, a relatively small number of modules can be arranged to achieve a very much larger number of combinations for an extremely wide range of applications. Furthermore, the modular concept is incorporated not only at the system level with the design and use of modular components; it is also carried out at the module level such that individual modules share parts, in as much as possible, with other modules. Thus, for example, the same housing for a coaxial motor may be used for a number of different coil springs, or the same housing for a transmission may be used with different configurations of input and output shafts to achieve different transmission ranges. Thus, again, a relatively small number of parts can be arranged to achieve a very much larger number of modules for an extremely wide range of applications.

The "de-lighted" product discussed earlier may be accomplished in the present invention by one of two possibilities:

1—The lift cords pass through every slat but not through a slit in the center of each slat (as in the standard rout design), but through a smaller slit offset, preferably toward the back of each slat, such that when the blind is closed, the overlap of each slat totally covers this slit on the adjacent slat. This works well especially for short blinds, lightweight blinds, and narrow blinds.

2—Instead of having a single lift cord at each lift station passing through a slit (or rout hole) in the center of each slat, there are no slits in the slats and there are preferably but not necessarily two lift cords at every lift station, one in front and the other in rear of the slat (the same as the ladder tapes for tilting the slats). As is the case with lift cords for standard rout products, the lift cords for de-lighted products are not attached to any of the slats, only to the bottom rail.

In some embodiments of the present invention, the coiled spring motor power unit provides sufficient force, in combination with the system inertia, to balance the weight of the blind so that, when a user touches the blind and urges it up or down, the blind easily moves in the direction it is urged and will then stop when the user stops urging it and will remain in that position. The spring motor preferably is a constant force motor, but the force required to balance the blind varies as the blind is moved up and down, with the greatest force required in the raised position and the least force required in the lowered position. This is especially the case for the type of window covering product that bundles up as it is raised to the head rail such as a Venetian blind (as opposed to one that rolls up, such as a roller blind, which in fact exhibits an opposite relationship of force required relative to blind position but which may also use the components of the present invention). For that reason, it is usually desirable to use a transmission, so that the proper amount of force is provided at all positions of the blind.

The modular blind transport system, including any of the first three groups (power and power transmission, lift and/or tilt stations, and the tilt mechanisms), is intended to work as a unit, often within the confines of a rail. This rail may be a head rail, a bottom rail, a moving rail, or an intermediate rail. For the purposes of this application only, we will use the term head rail with the understanding that we mean any of the aforementioned rails.

For heavier blinds, it can become difficult to fit all the components within the head rail, particularly the coil spring motor modules. Some solutions to that problem are presented here. One solution is to use one or more transaxial motors instead of a coaxial motor. Another solution is that a transmission cord has been discovered which can be made with a very small diameter and yet be strong enough to carry the load, which permits the shafts of the transmission to be short enough and strong enough to handle the job while still fitting in the head rail.

In an effort to logically and methodically cover the material of this invention, a typical first preferred embodiment of a complete modular blind transport system in accordance with this invention will be described in detail. Then, variations in particular modules will be described. Finally, having described these variations in particular modules, alternate preferred embodiments of complete blind transport systems using the various modules will be described

BRIEF DESCRIPTION OF THE DRAWINGS

FIG. 79A is a perspective view of the intermediate cap of the transmission of FIG. 65;

FIG. 79B is a sectional view taken along line 79B-79B of FIG. 79E, of the intermediate cap of FIG. 79A;

FIG. 79C is an input-end view of the intermediate cap of FIG. 79A;

FIG. 79D is a side view of the intermediate cap of FIG. 79A;

FIG. 79E is an output-end view of the intermediate cap of FIG. 79A;

FIG. 79F is a sectional view taken along line 79F-79F of FIG. 79C;

FIG. 89 is the same view as FIG. 87A except over-wrap has occurred;

FIG. 90A is an enlarged, broken away, plan view of a threaded output shaft, a frusto-conical input shaft, and the connecting cable of a transmission, where the depth and included angle of the threads on the output shaft constrain the cable, causing abrasion to the cable, especially if the cable leads ahead as it winds onto the input shaft;

FIG. 90B is the same view as FIG. 90A except the included angle of the threads on the output shaft has been opened so that the potential interference between the cable and the side walls of the threads is eliminated, thereby eliminating abrasion on the cable;

FIG. 91 is an exploded view of a transmission adapter for a one inch wide head rail as shown in FIG. 1;

FIG. 92 is an exploded perspective view of the coaxial motor of FIG. 14, the transmission of FIG. 64, and the transmission adapter of FIG. 91;

FIG. 93 is a partially exploded view of the same elements of FIG. 92 but further assembled;

FIG. 94 is a perspective view of the same elements of FIG. 93 but further assembled;

FIG. 95 is a perspective view of the assembly of FIG. 94 mounted in a one-inch head rail, as shown also in FIG. 1;

FIG. 96 is a view about the section 96-96 of the assembly of FIG. 95;

FIG. 97 is an exploded front view of a transmission adapter for a two inch wide head rail as shown in FIG. 7;

FIG. 98 is a perspective back view of the adapter of FIG. 97, without the screw;

FIG. 99 is an exploded view of a coaxial motor, a transmission, and the transmission adapter of FIG. 97;

Figure 1:
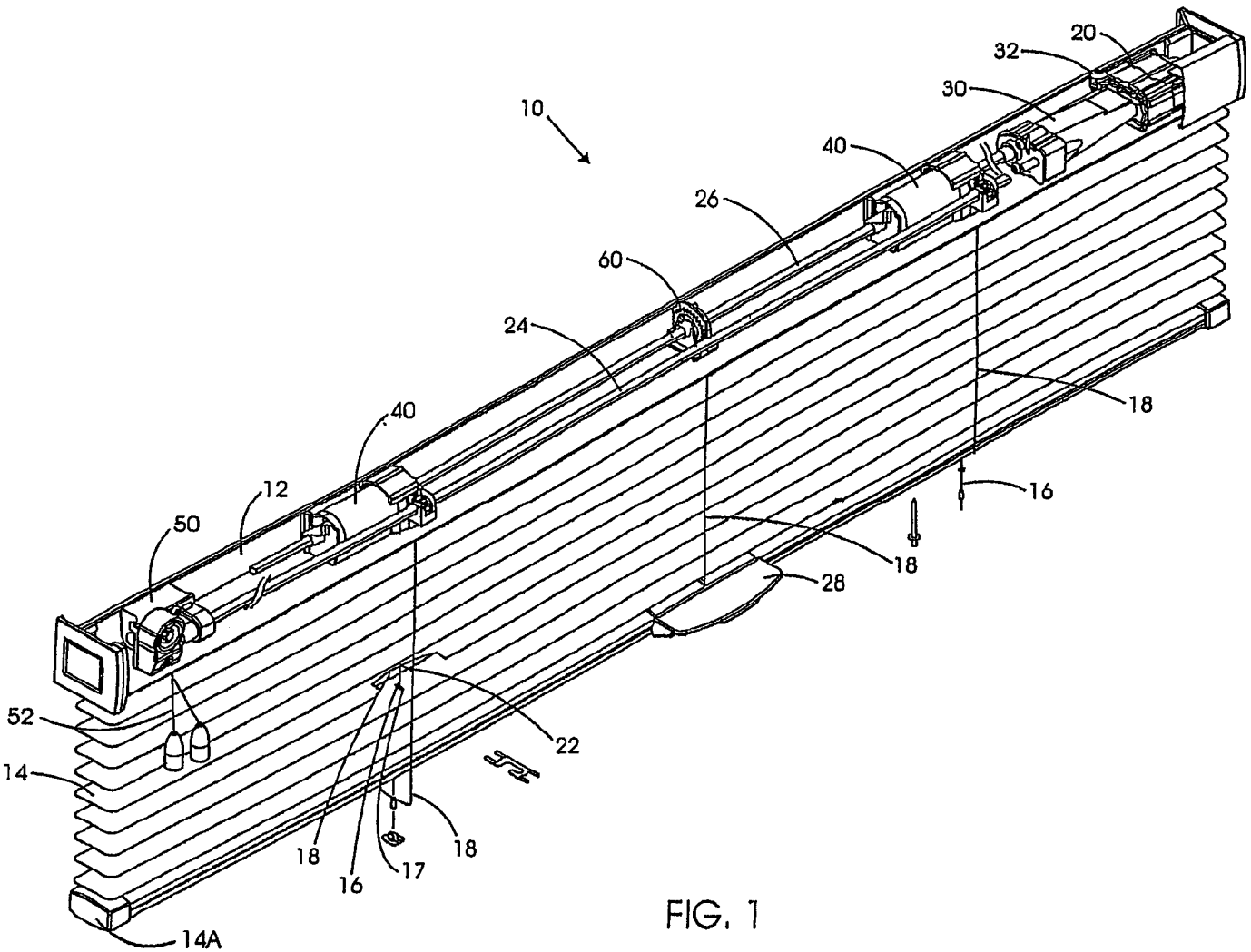
FIG. 1 is a partially broken away and partially exploded view of a blind transport system made in accordance with the present invention, including a coaxial coiled-spring motor, a transmission, lift stations, a cord tilter assembly, and a tilt roll assembly, in a standard rout, horizontal Venetian blind.
Figure 3:
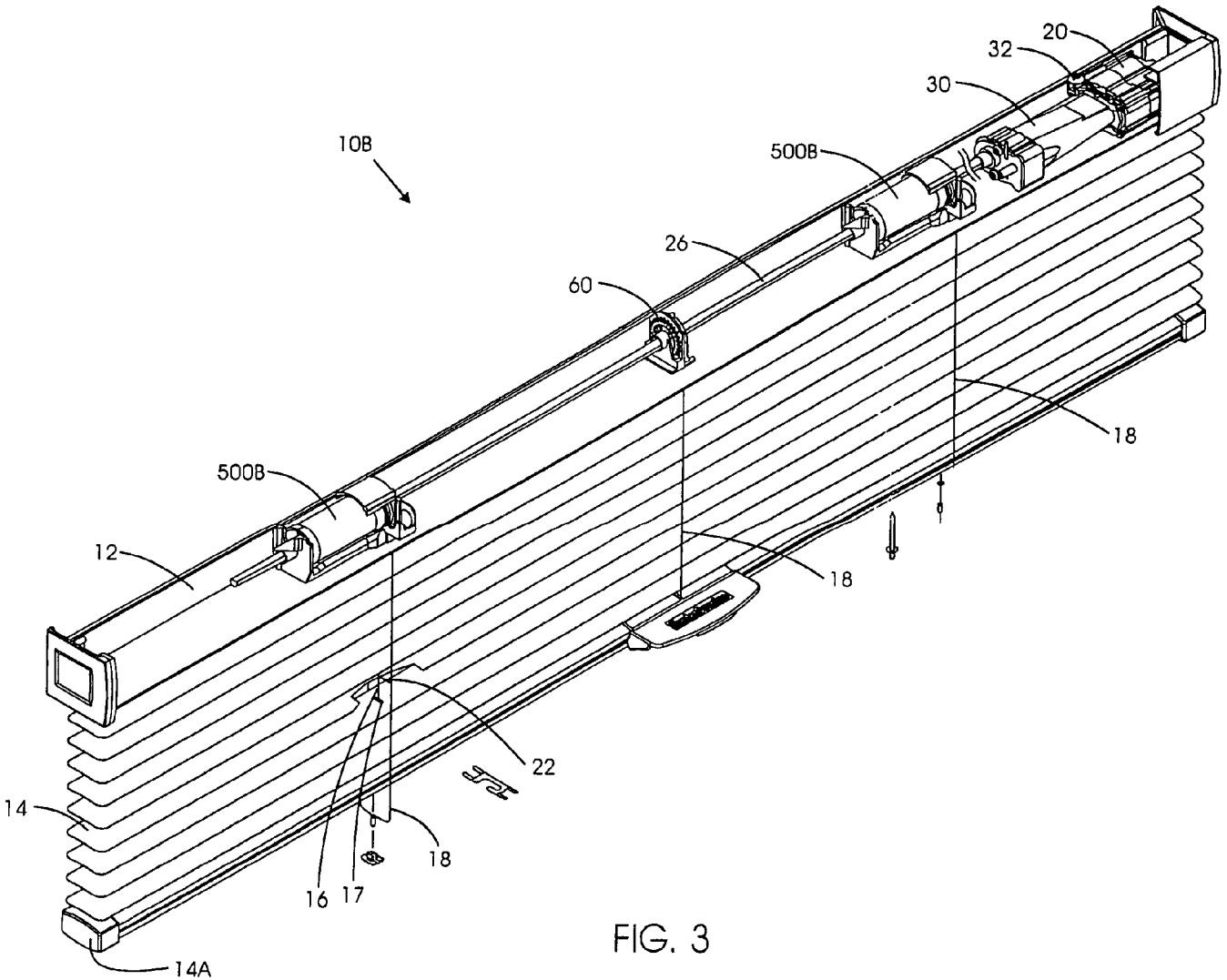
FIG. 3 is a partially broken away and partially exploded view of a third embodiment of the invention, similar to FIG. 1 except this is for a blind transport system which eliminates the separate tilter assembly and accomplished the tilting action by raising or lowering the blind.
Figure 5:
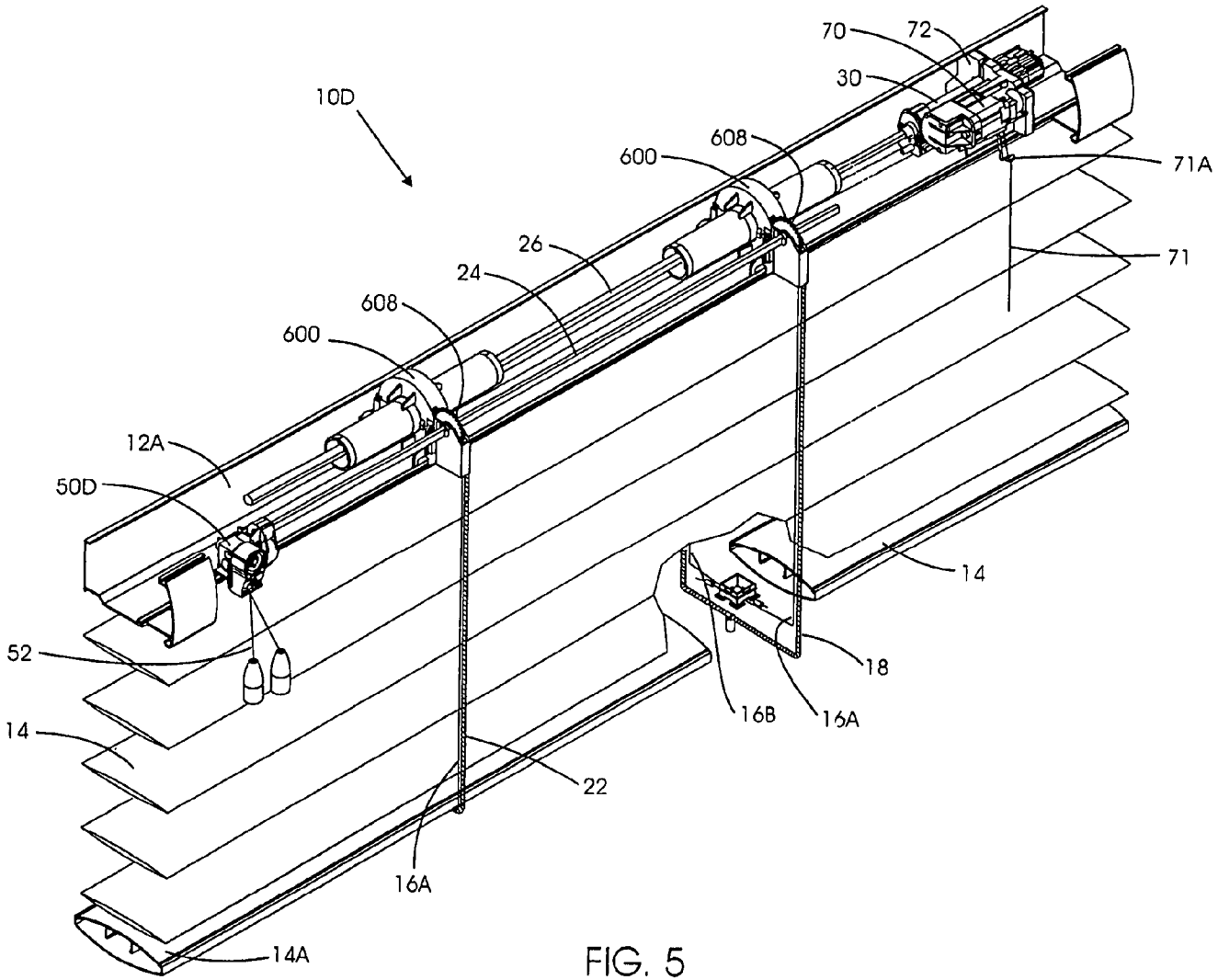
FIG. 5 is a partially broken away perspective view of a fifth embodiment of the invention, similar to FIG. 1 except this utilizes twin-spool lift stations to accomplish a de-lighted product, and the drive motor has been replaced with a ratchet-type drive mechanism in parallel with the transmission.
Figure 7:
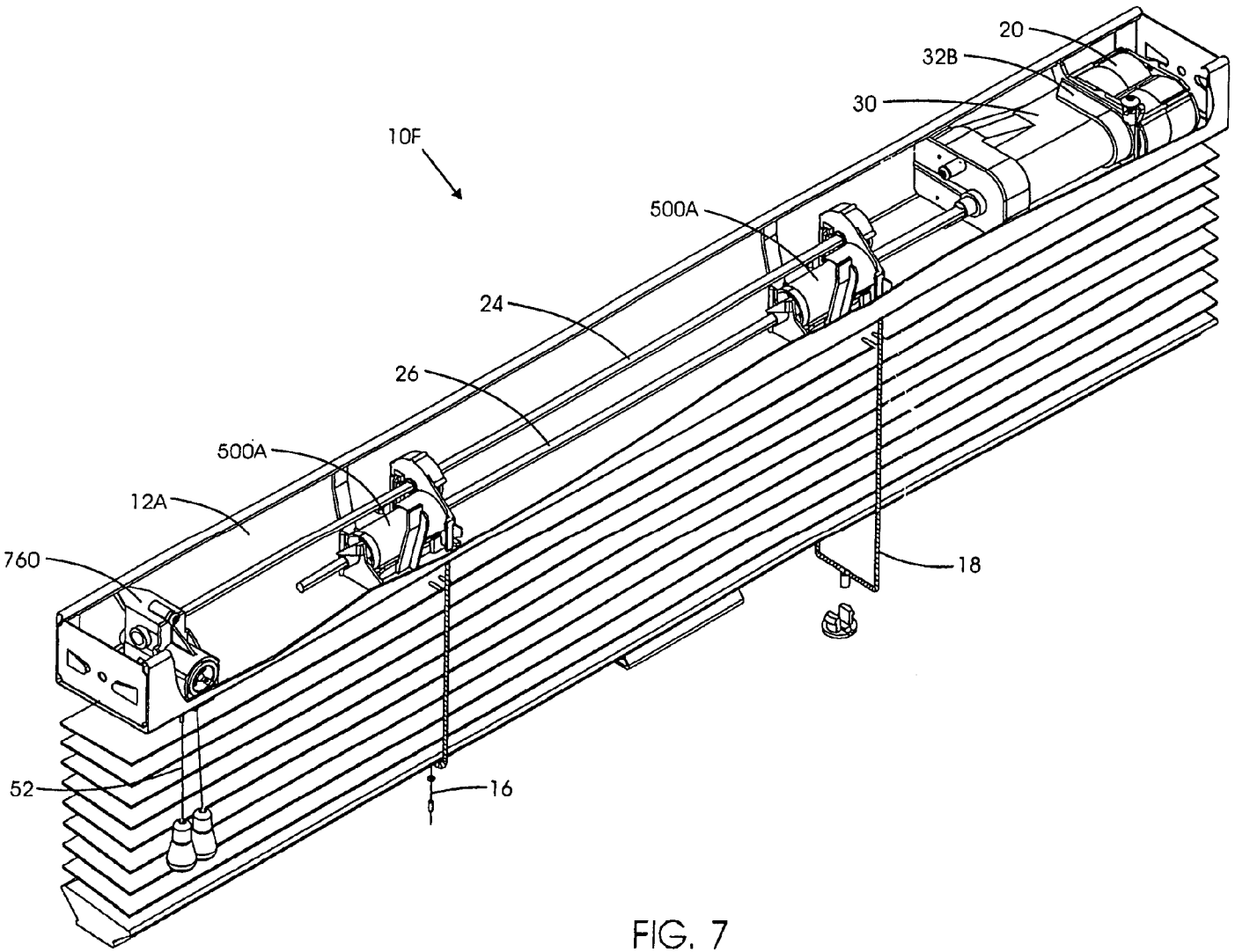
FIG. 7 is a partially broken away and partially exploded perspective view of a seventh embodiment of the invention, similar to FIG. 1 except this is for a wider (two-inch wide) horizontal blind.
Figure 8:
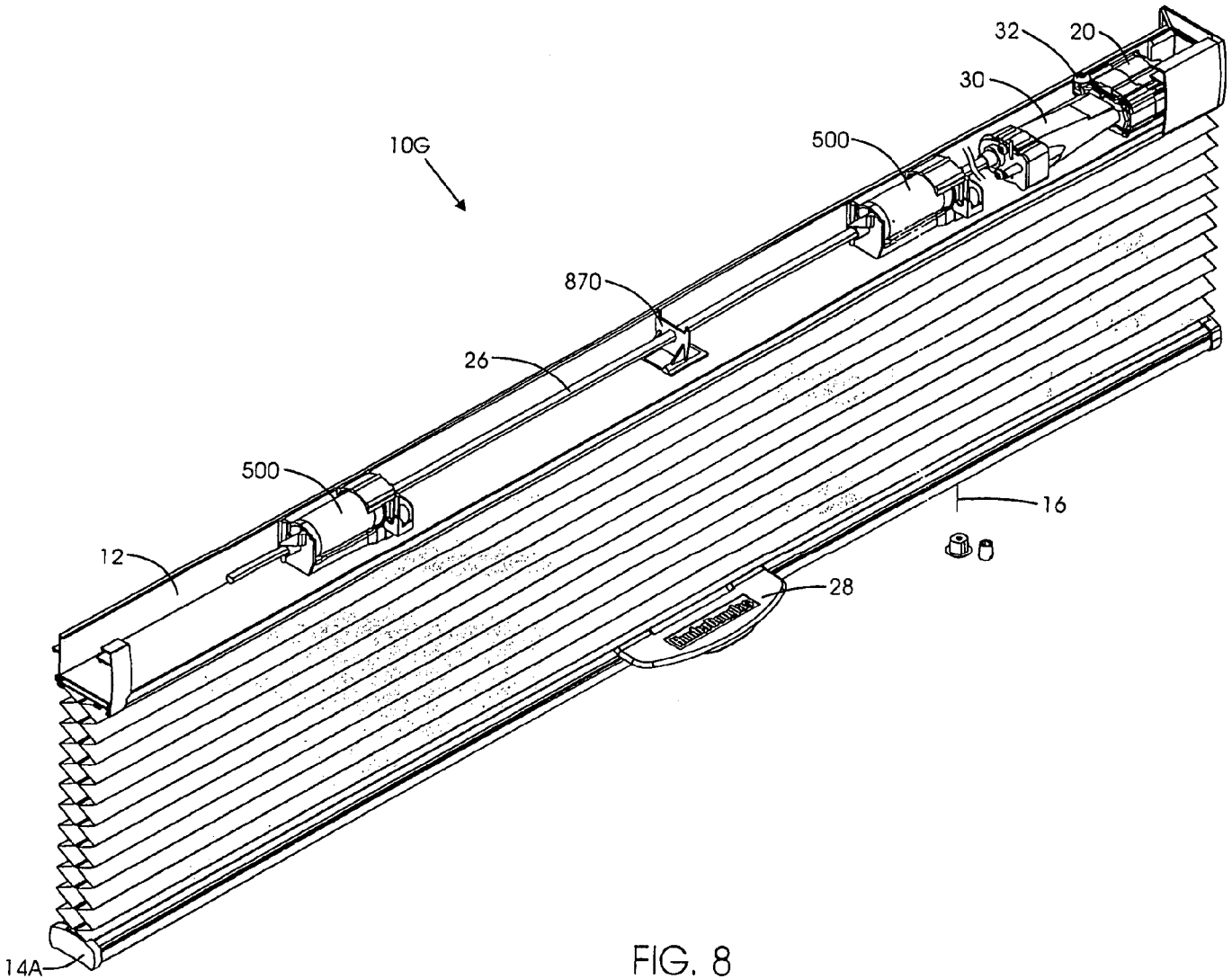
FIG. 8 is a partially broken away and partially exploded view of an eighth embodiment of the invention, similar to FIG. 1 except this is for a dual pleated fabric product where there is no need for a tilting action.
Figure 9:
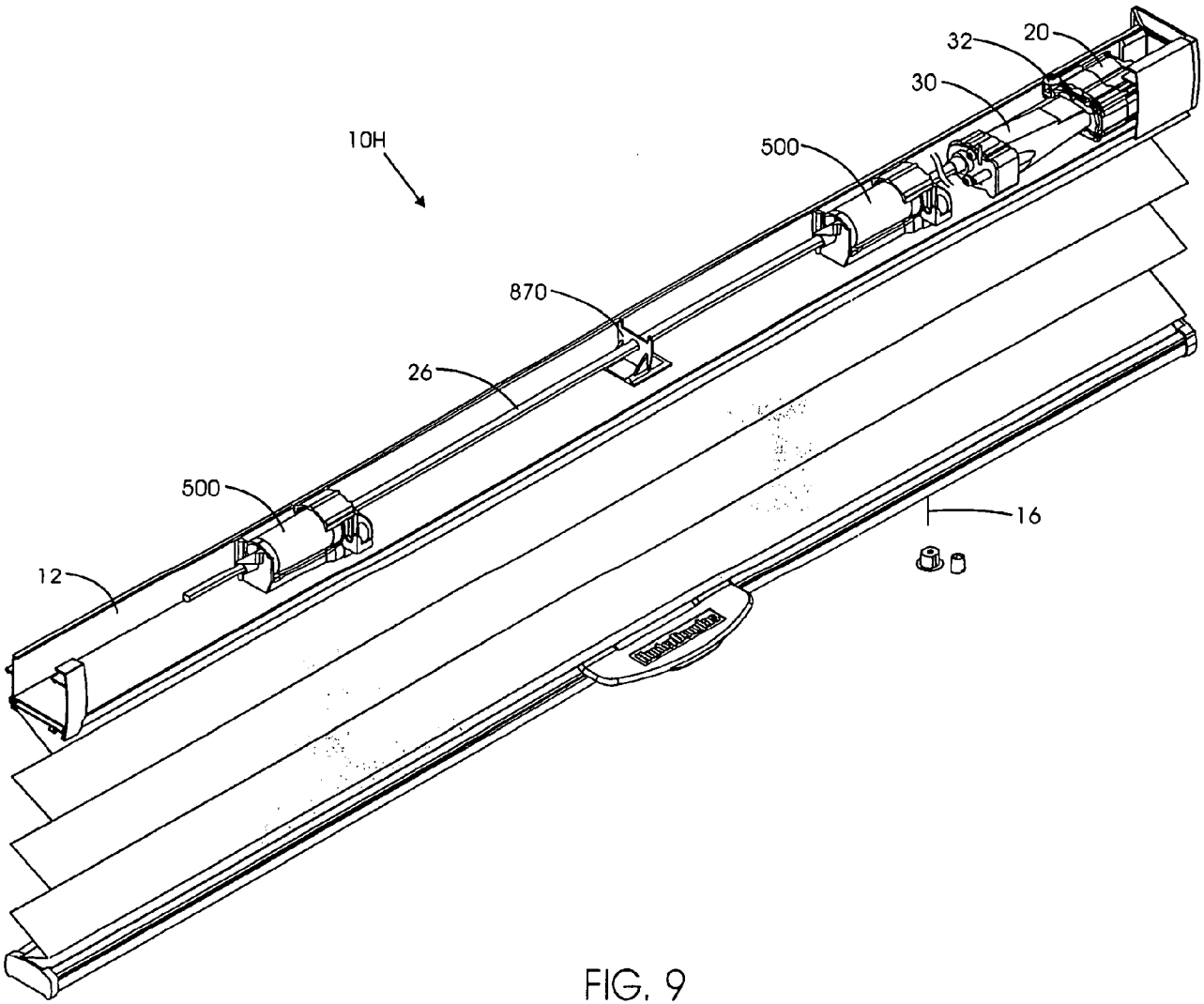
FIG. 9 is a partially broken away and partially exploded view of a ninth embodiment of the invention, similar to FIG. 8 except this is for a single pleated fabric product.
Figure 10:
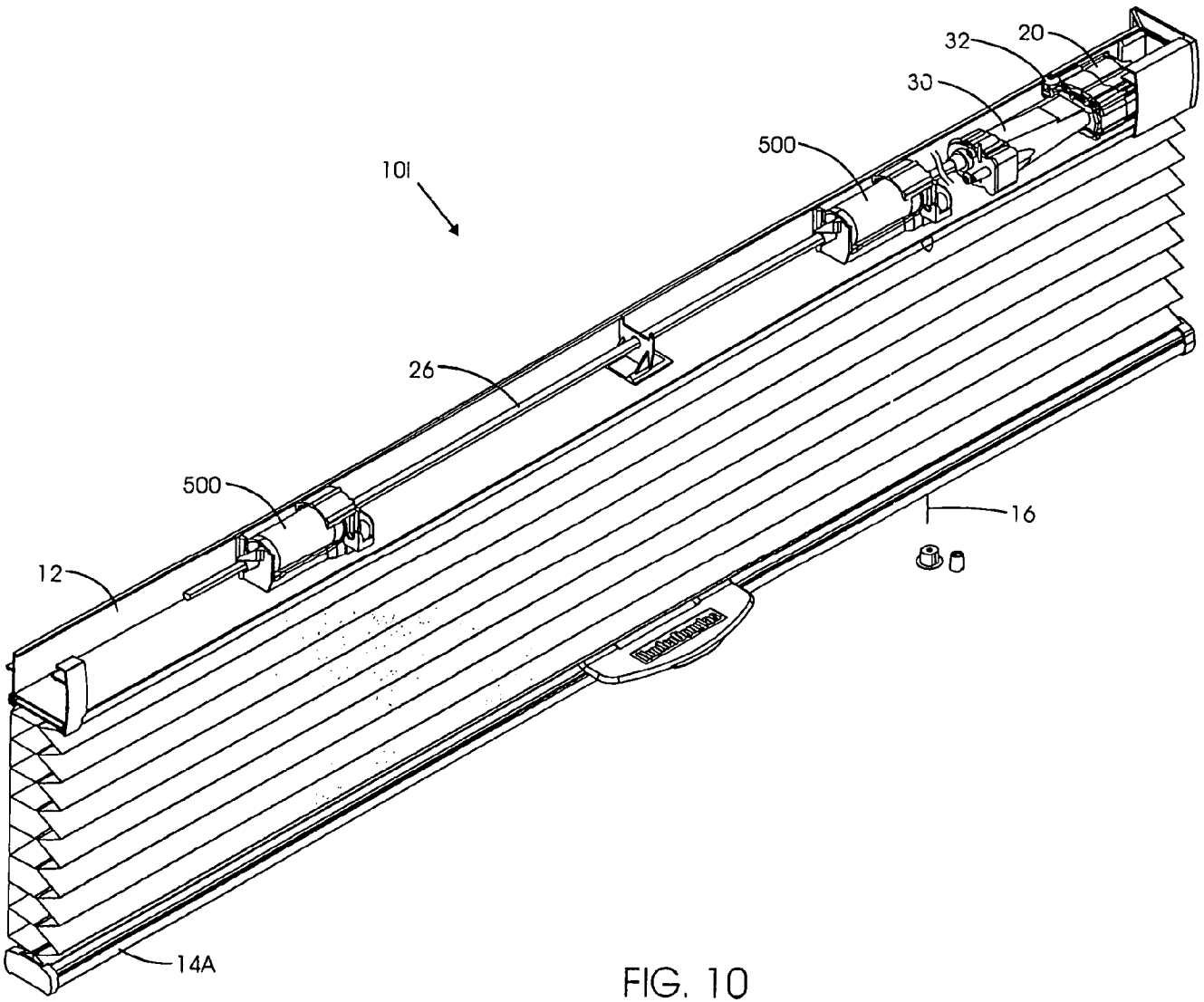
FIG. 10 is a partially broken away and partially exploded view of a tenth embodiment of the invention, similar to FIG. 8 except this is for a pleated-shade product.
Figure 11:
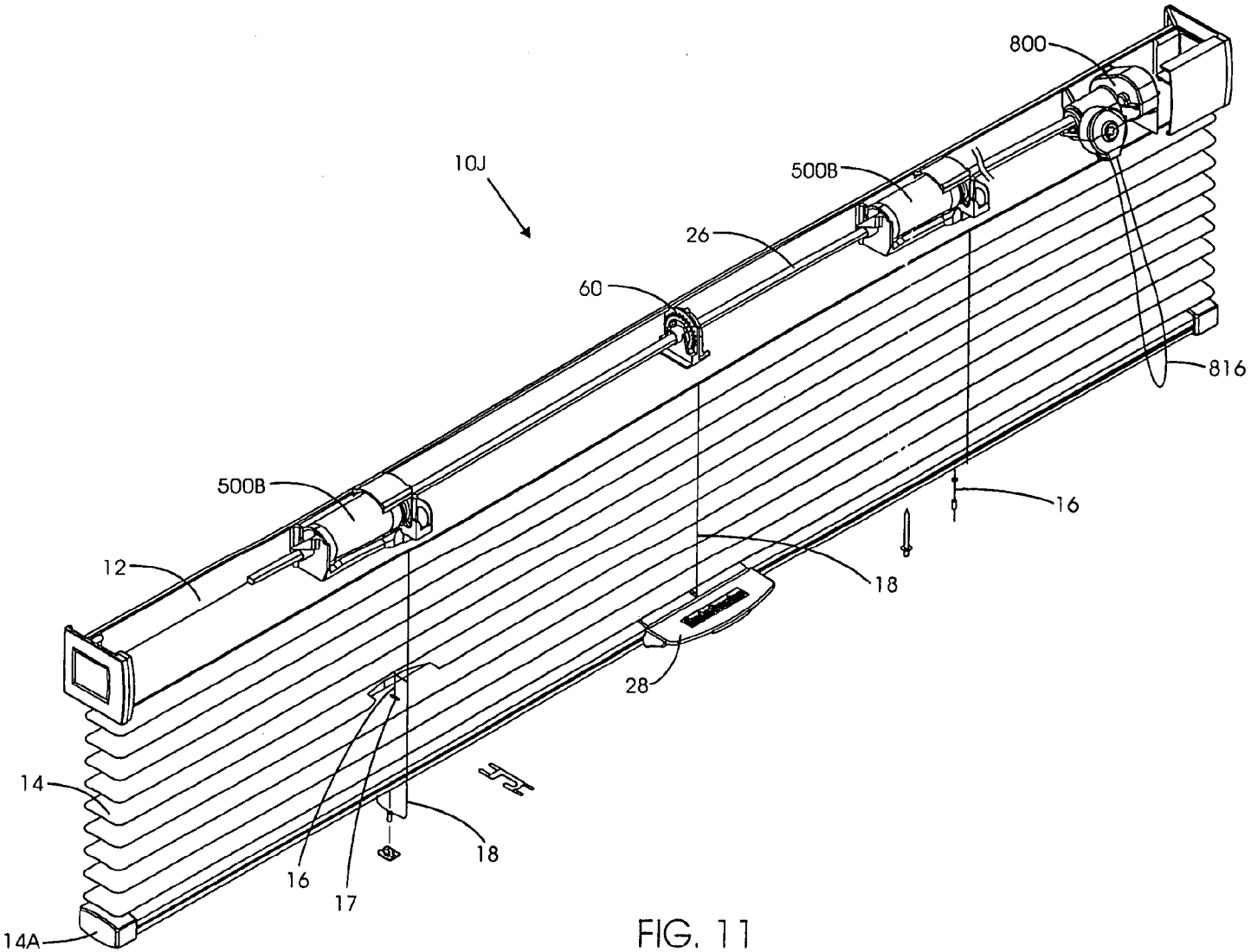
FIG. 11 is a partially broken away and partially exploded view of an eleventh embodiment of the invention, similar to FIG. 3 except that the motor and the transmission have been replaced by an endless loop cord drive.
Figure 13:
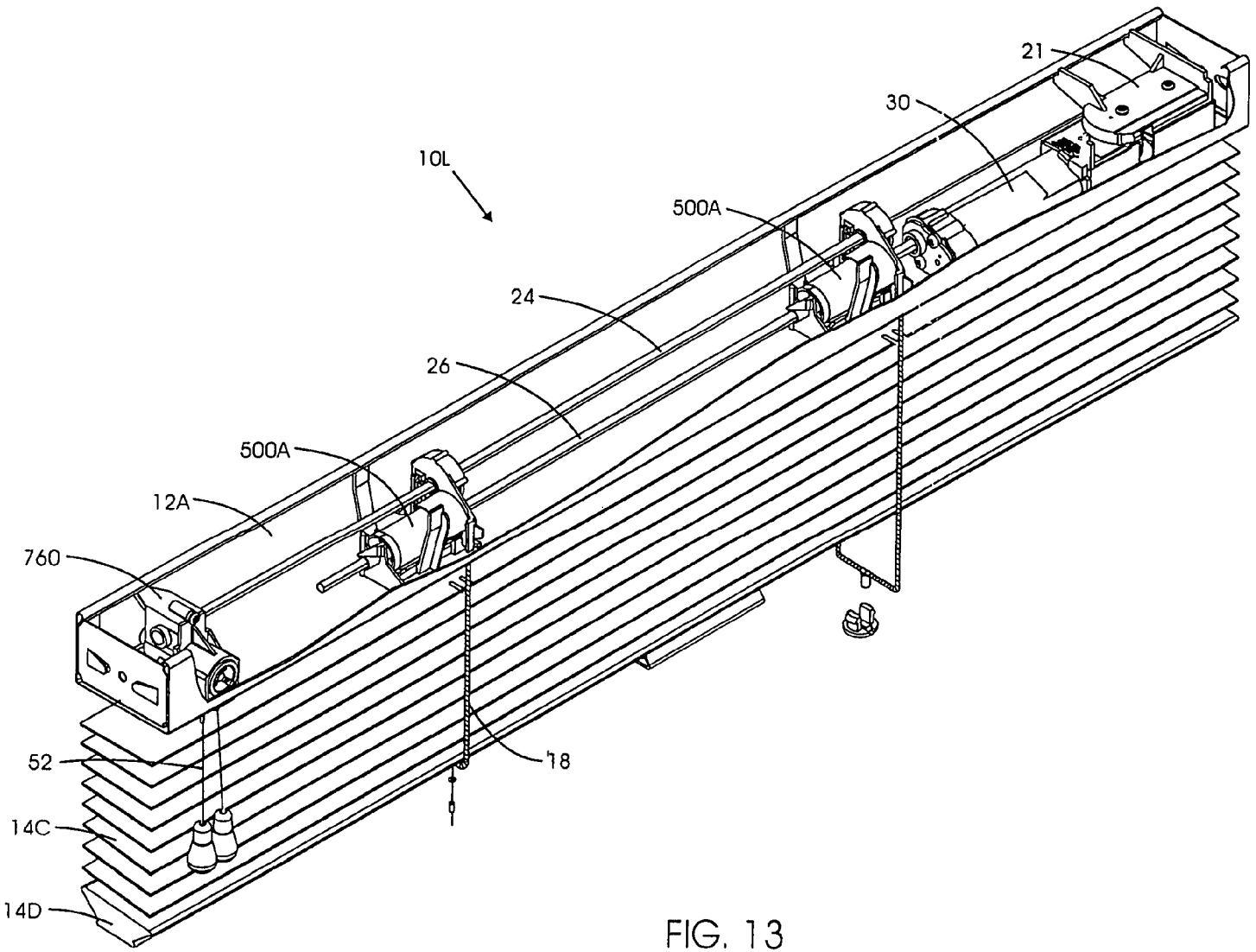
FIG. 13 is a partially broken away perspective view of a thirteenth embodiment of the invention, similar to FIG. 1 except the coaxial motor has been replaced by a transaxial coiled spring motor.
Figure 13A:
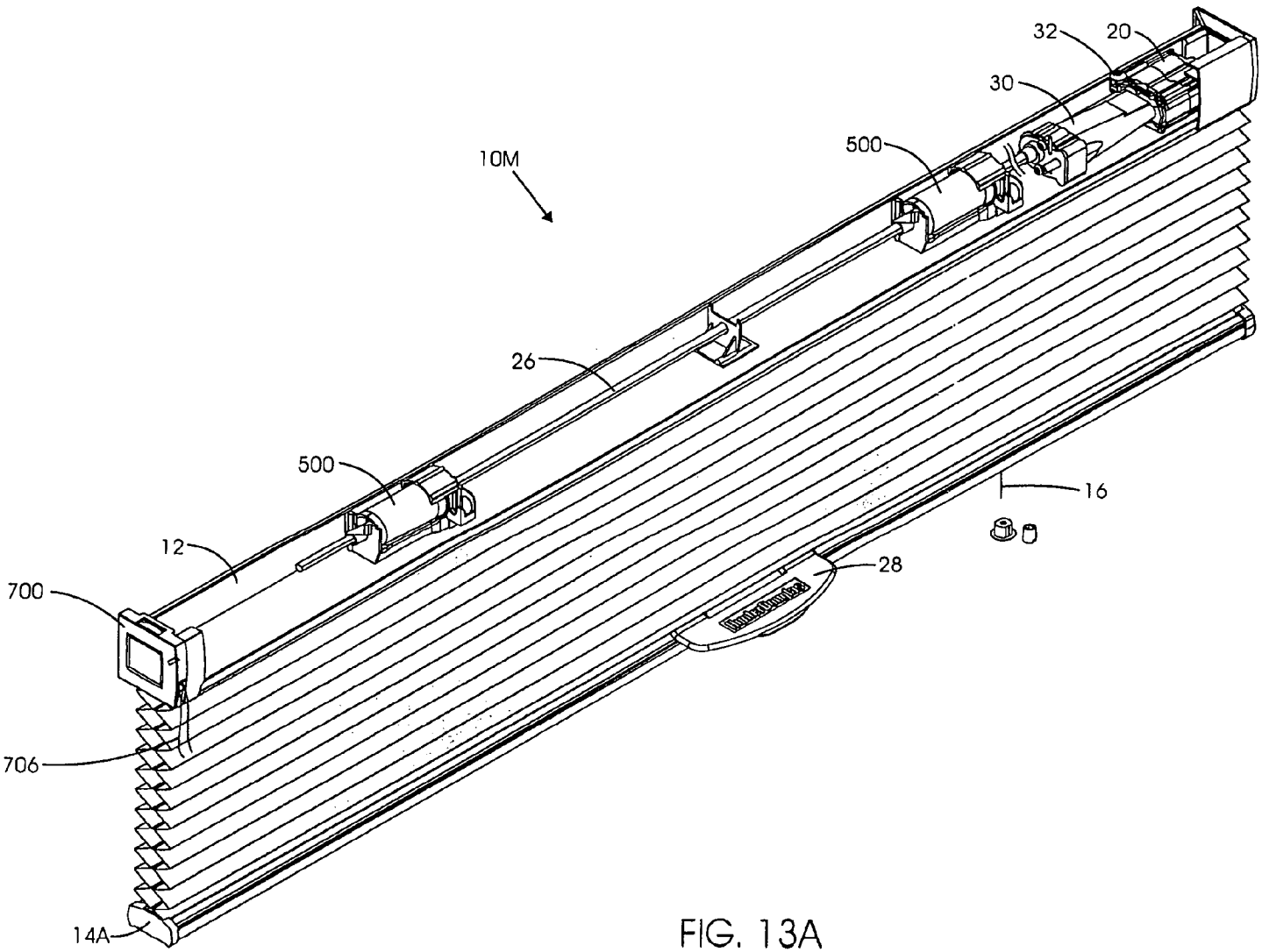
FIG. 13A is a partially broken away perspective view of a fourteenth embodiment of the invention, similar to FIG. 8 except an endless loop cord drive override has been added.
Figure 13B:
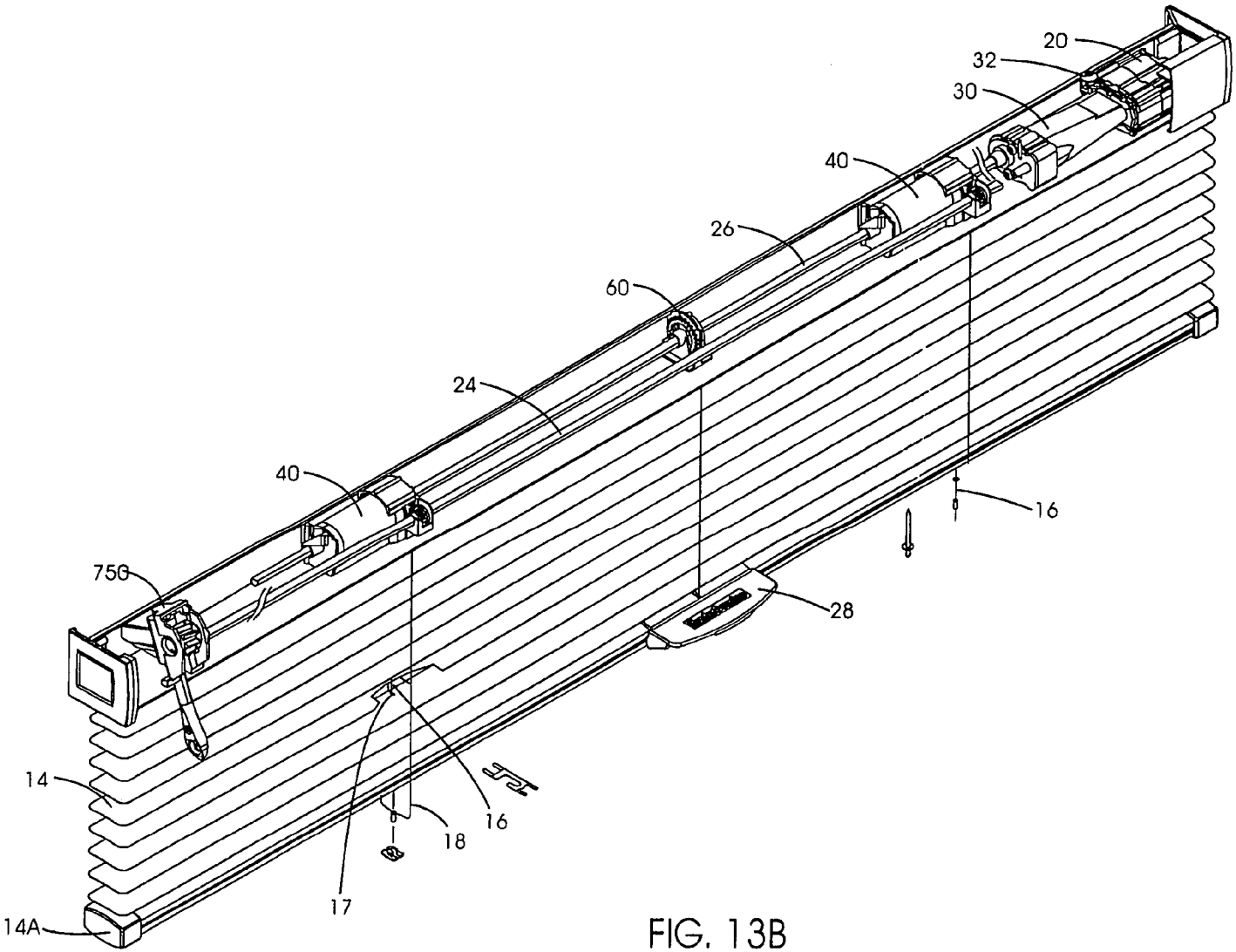
FIG. 13B is a partially broken away perspective view of a fifteenth embodiment of the invention, similar to FIG. 2 except a wand tilter has replaced the cord tilter.
Figures 99, 100, 101, 102, 103:
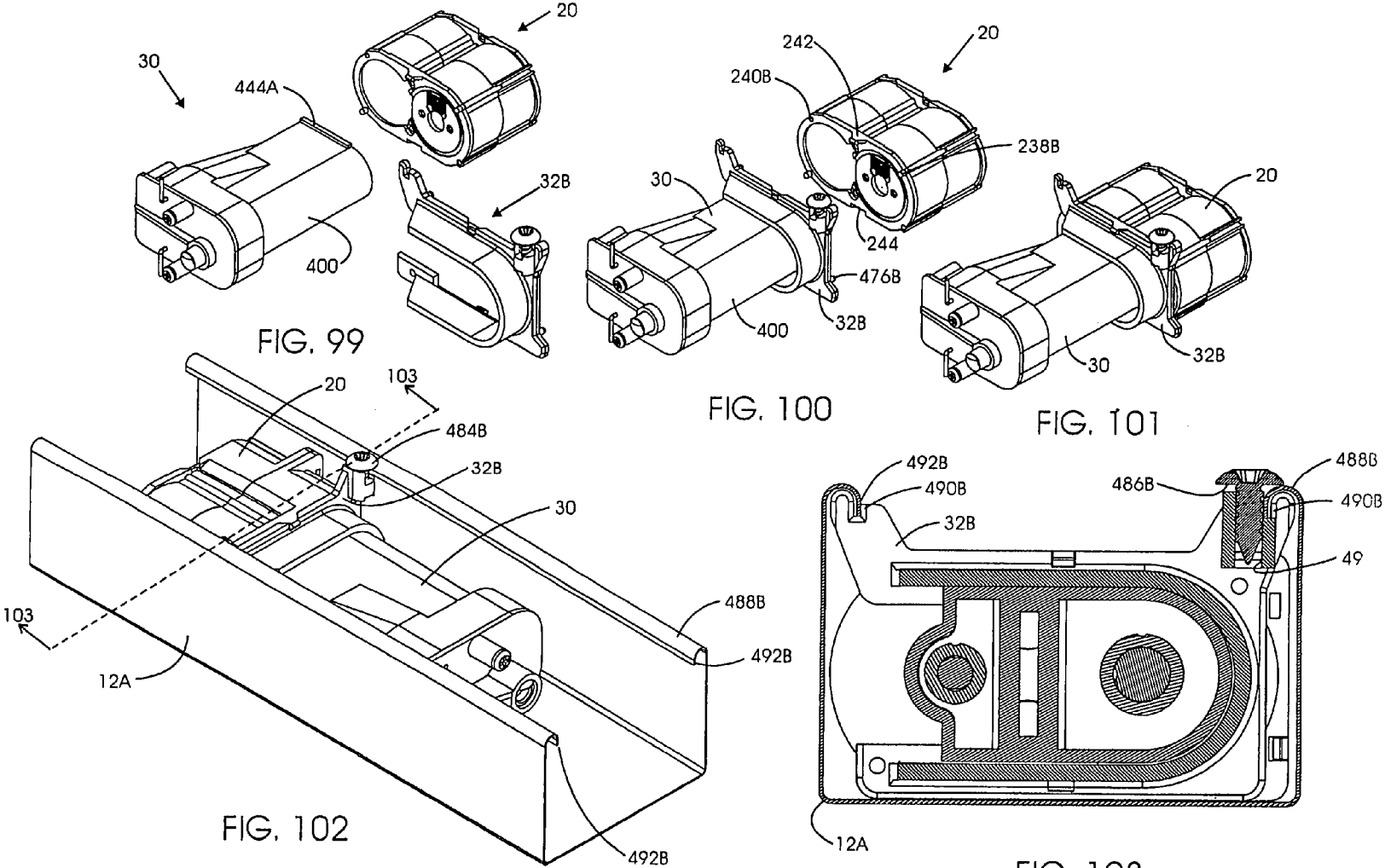
Figure 104:
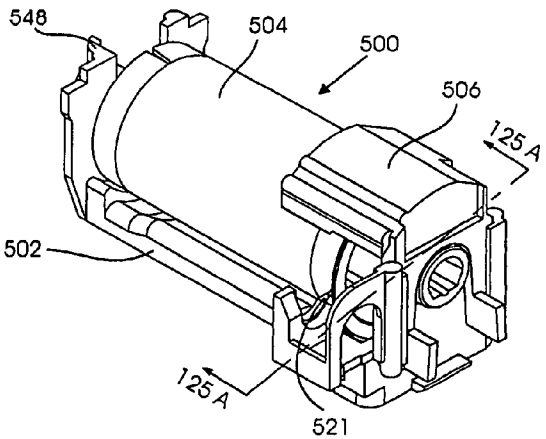
Figure 105:
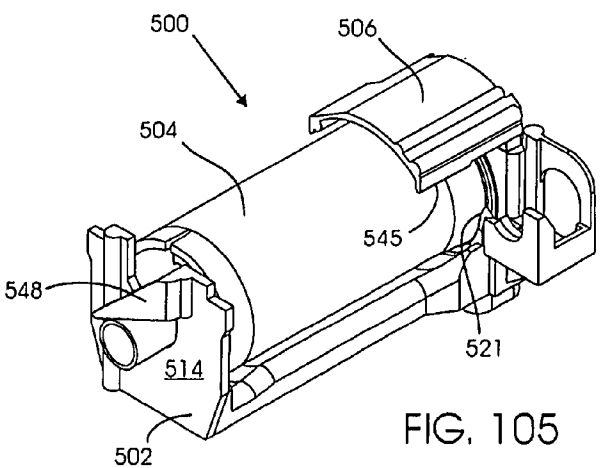
Figure 106:
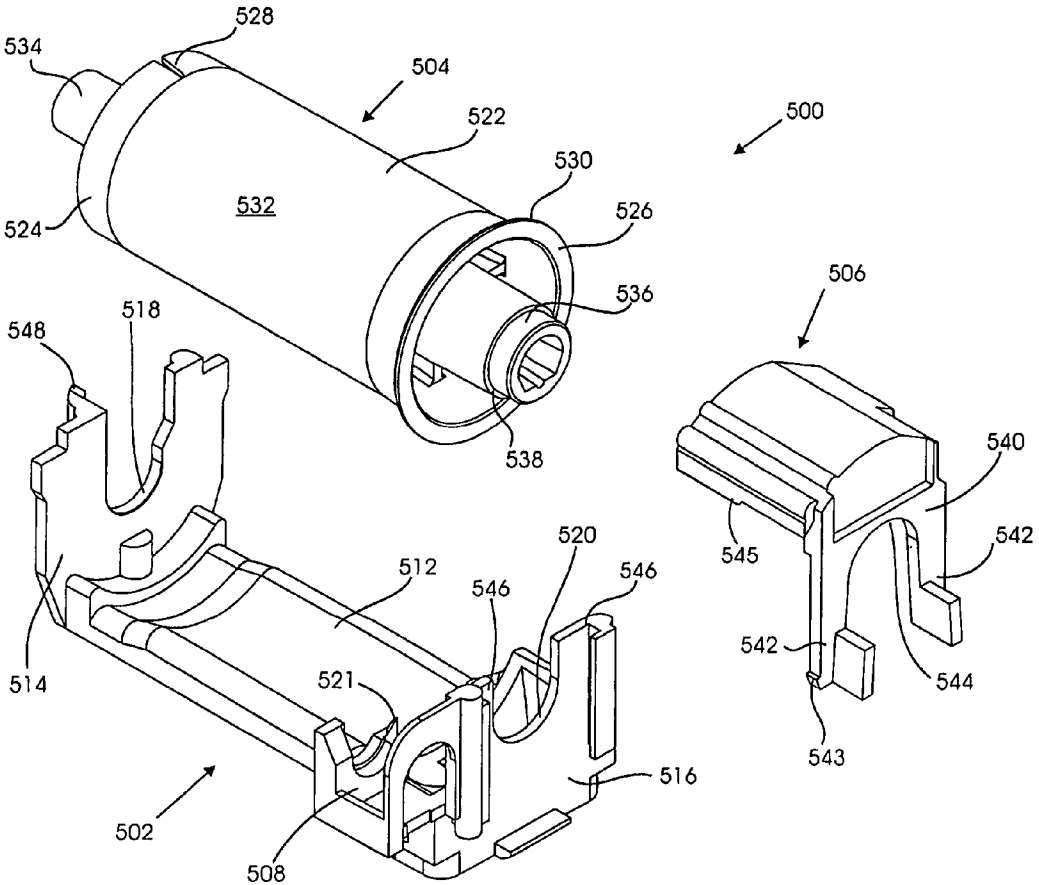
Figure 107:
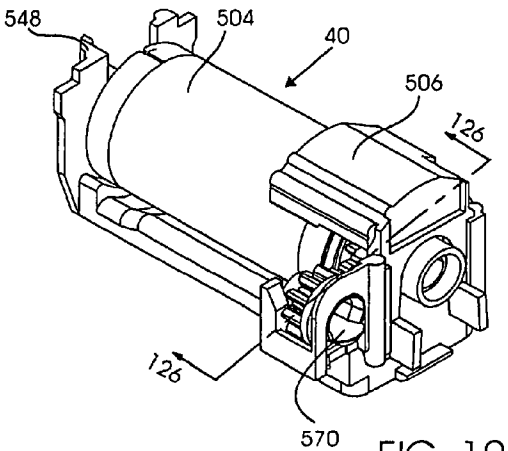
Figure 108:
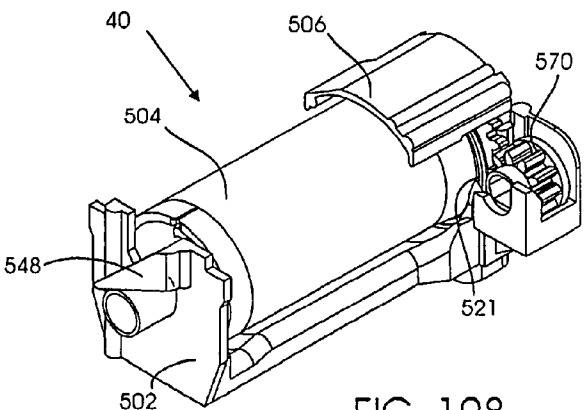
Figure 109:
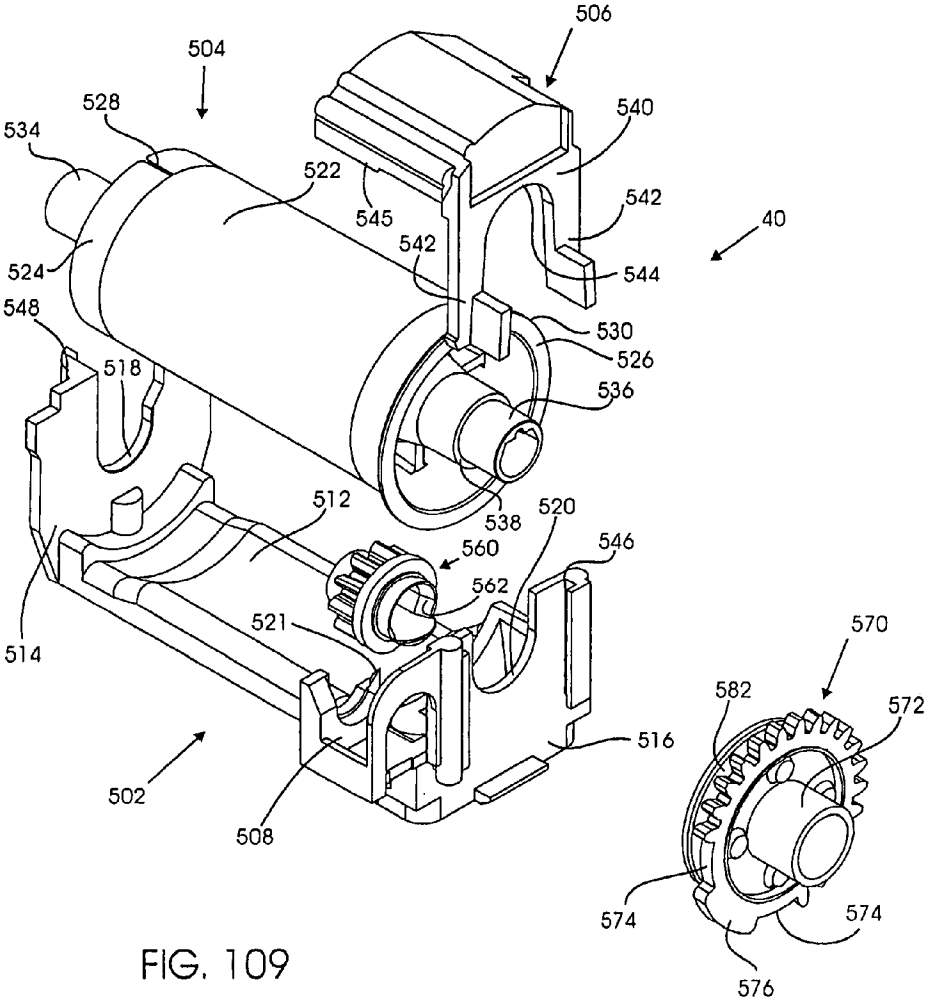
Figure 110:
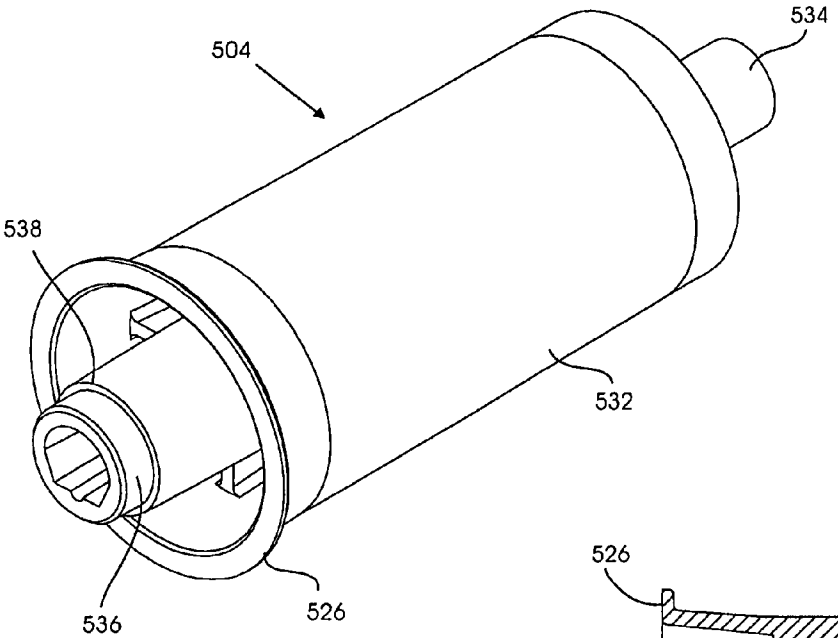
Figure 111:
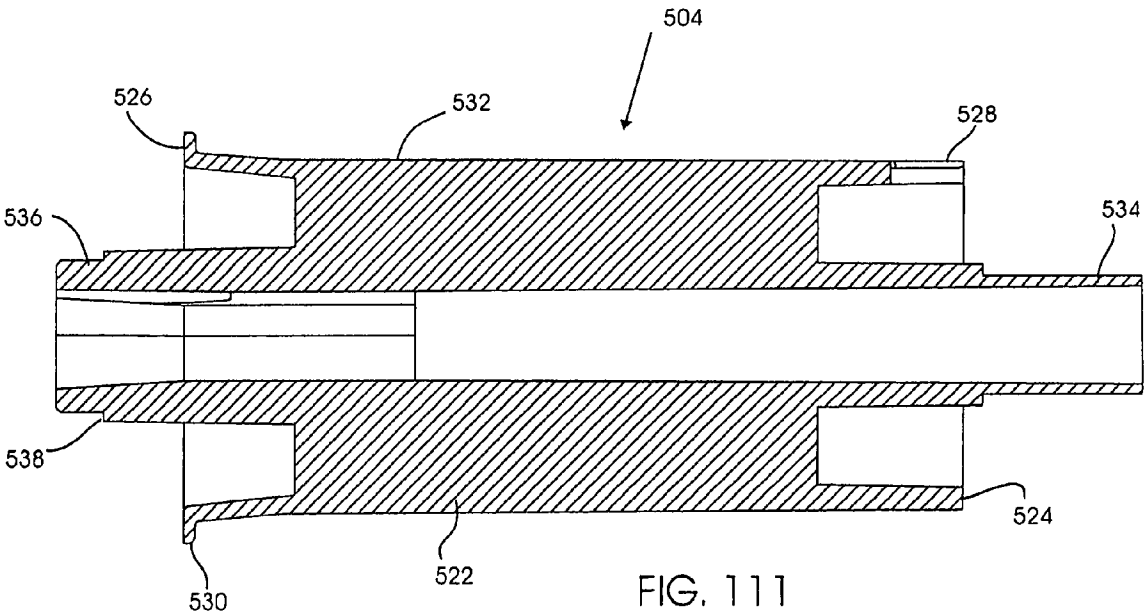
Figure 114:
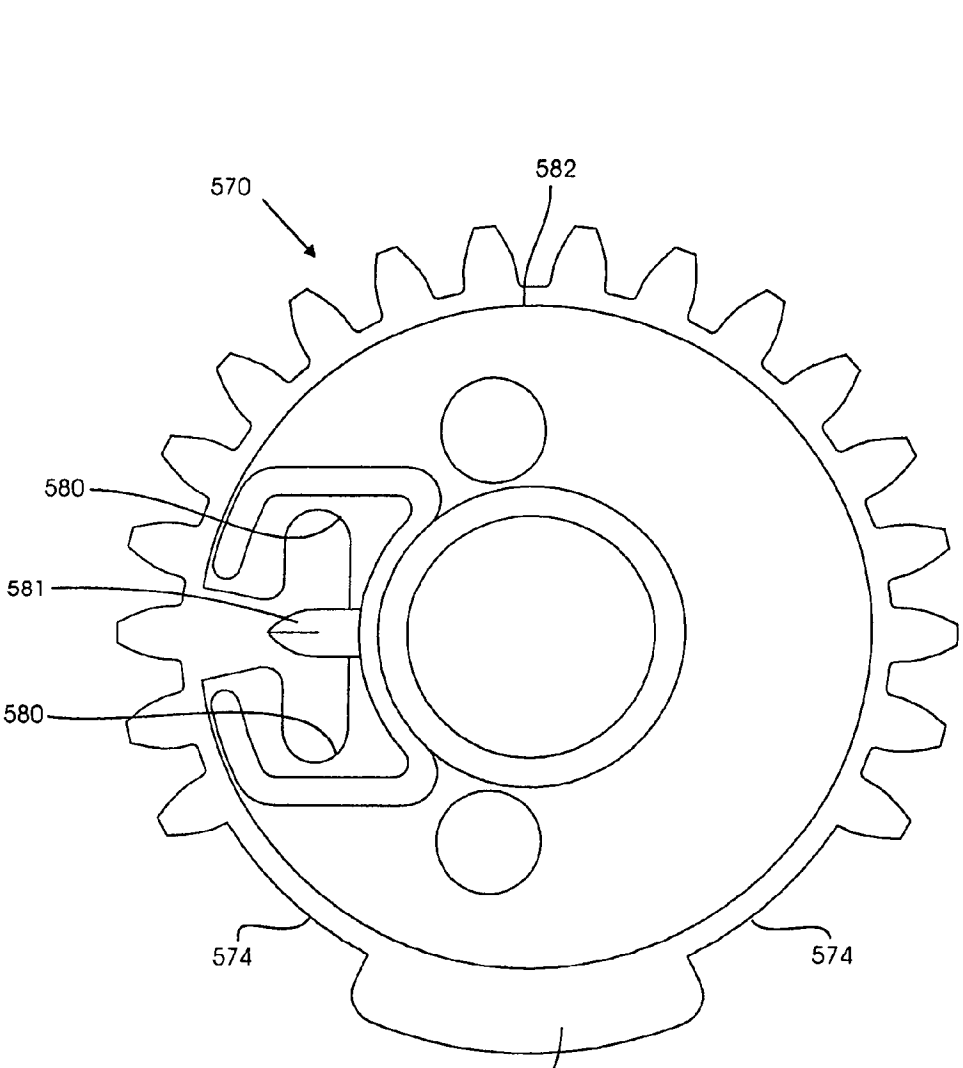
Figure 112:
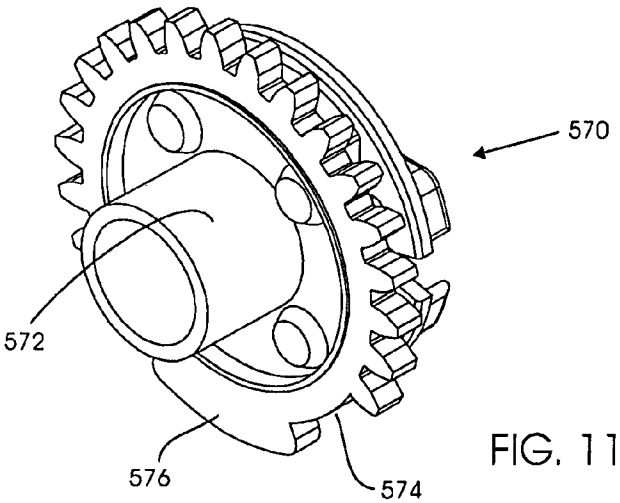
Figure 113:
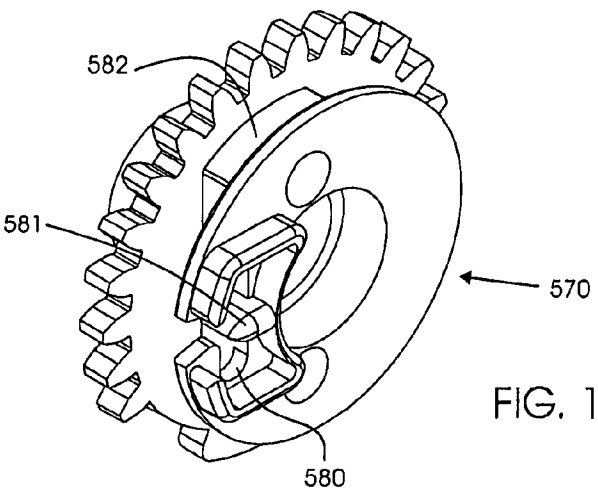
Figure 114A:
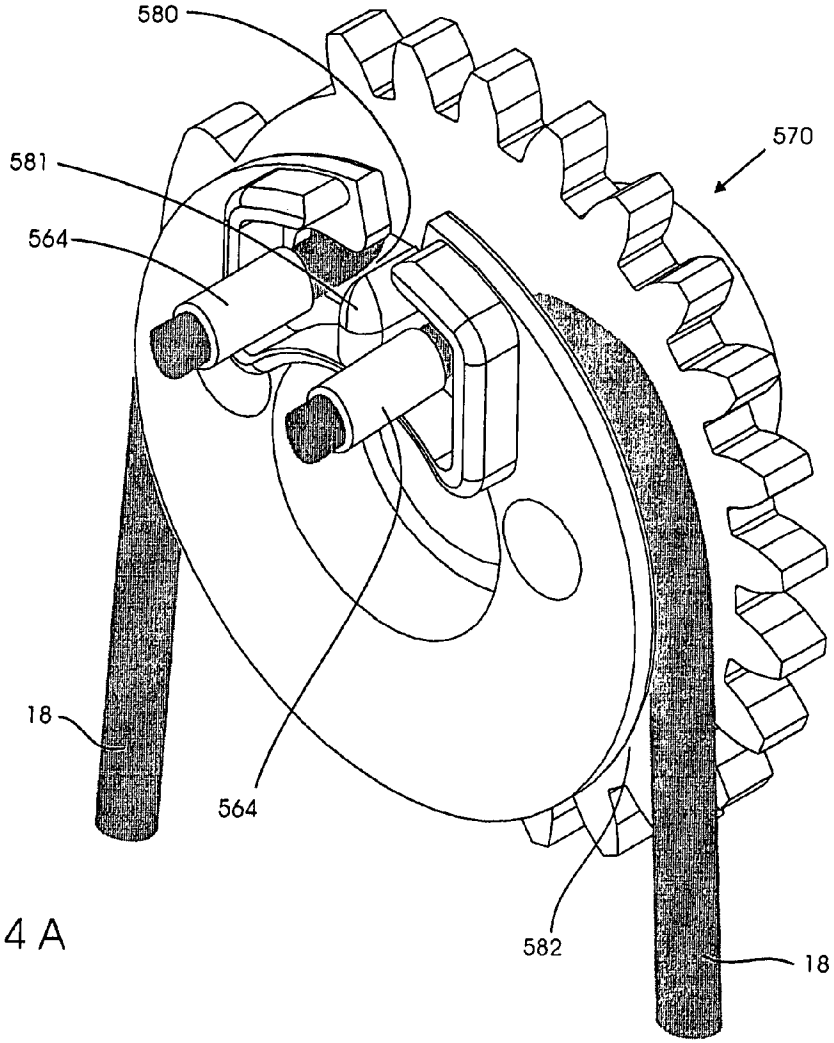
Figure 115:
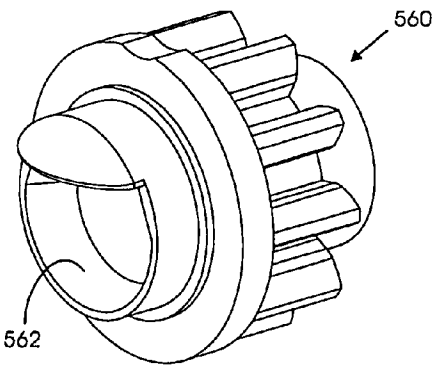
Figure 116:
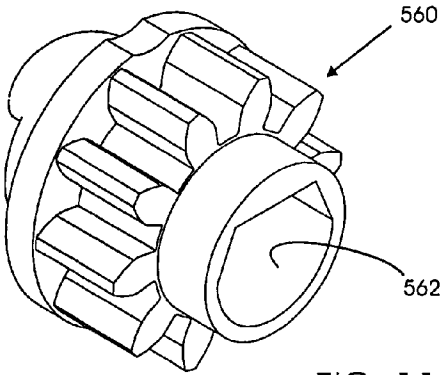
Figure 117:
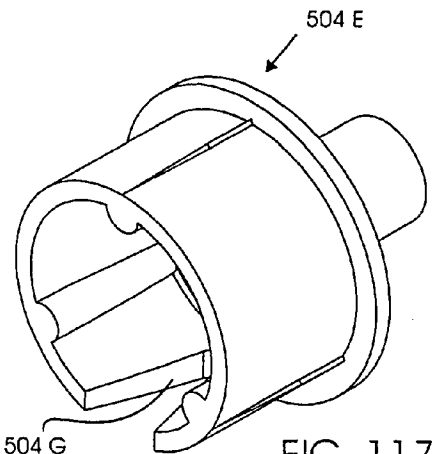
Figure 118:
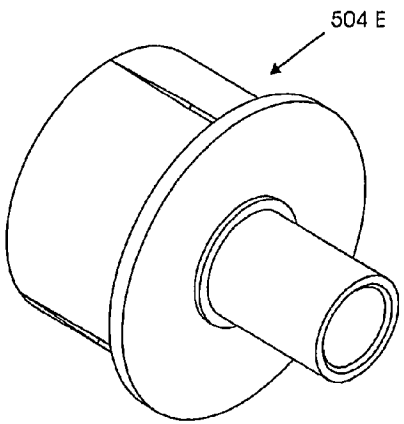
Figure 119:
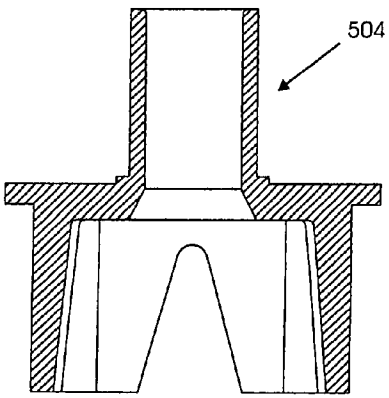
Figure 121:
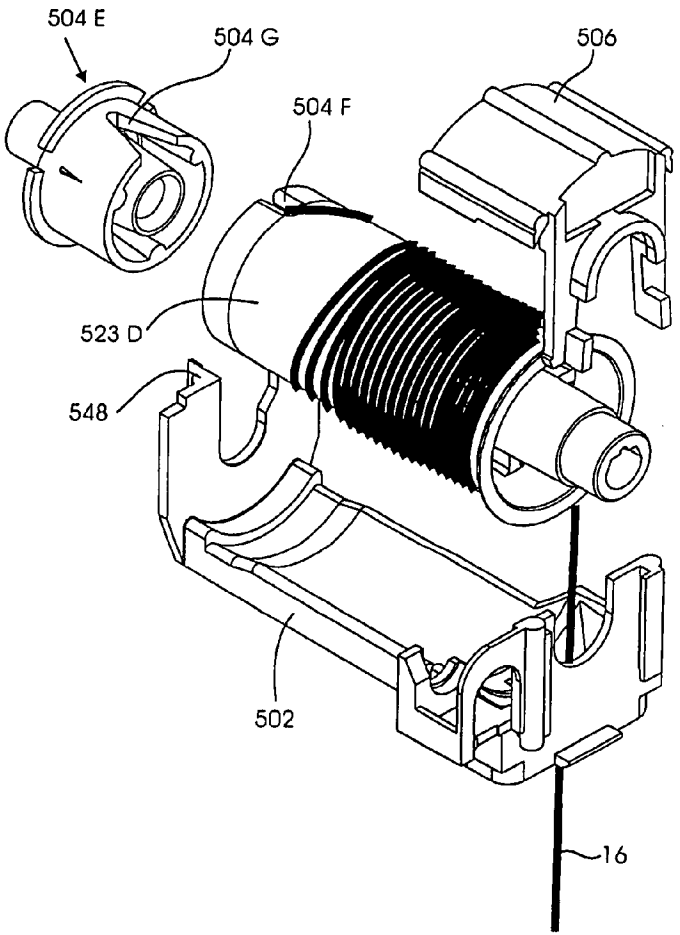
Figure 120:
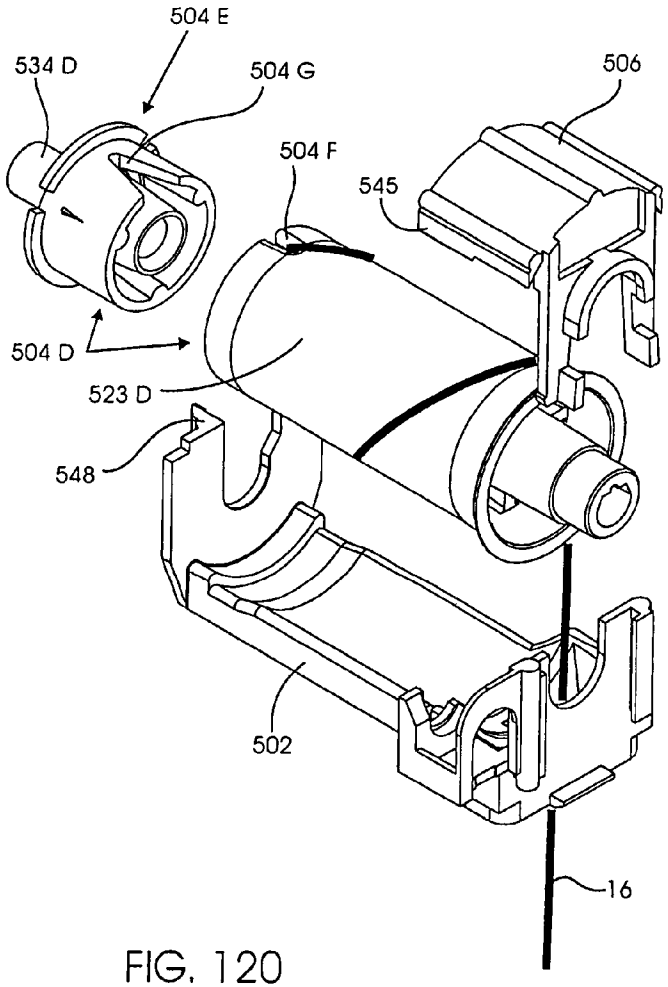
Figure 123:
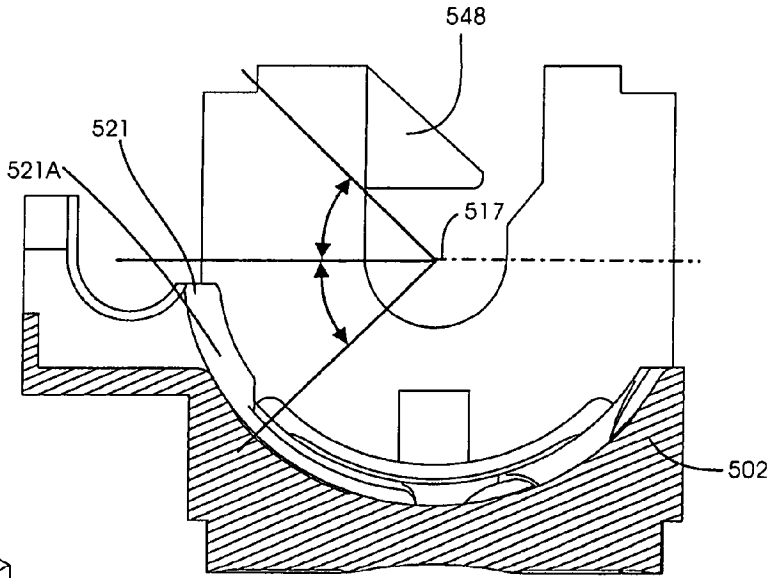
Figure 122:
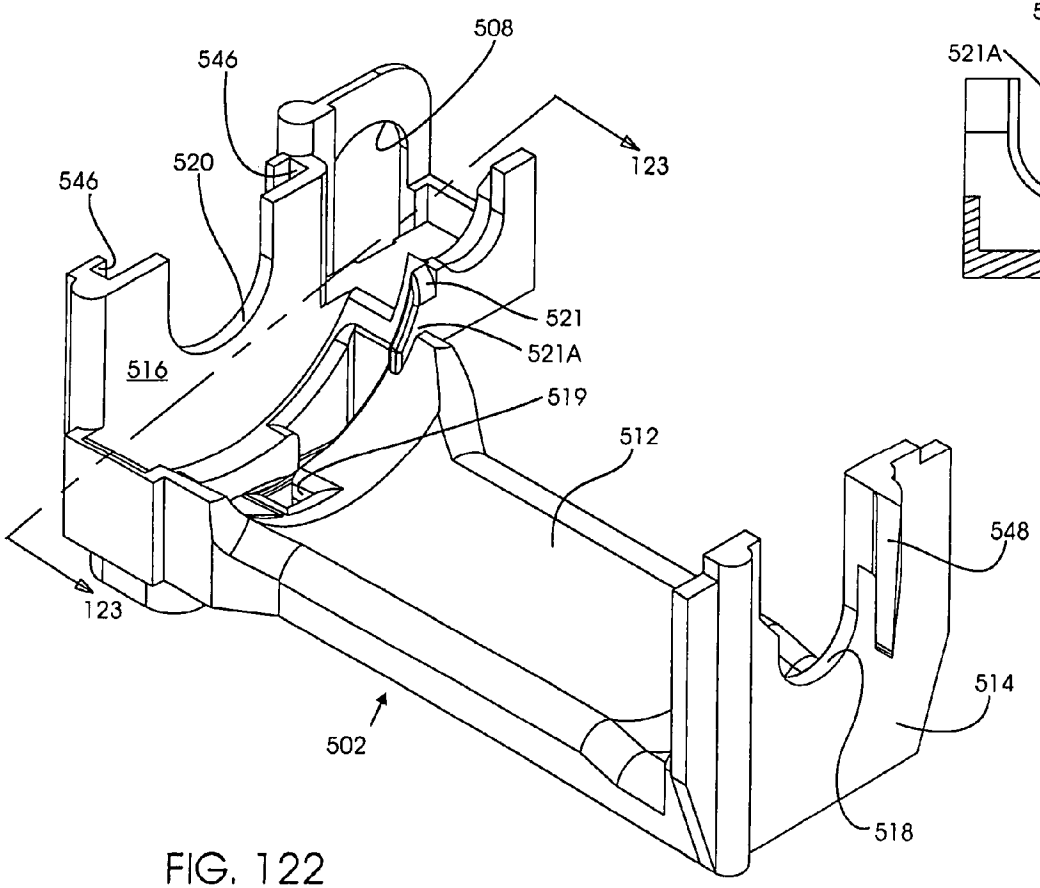
Figure 124:
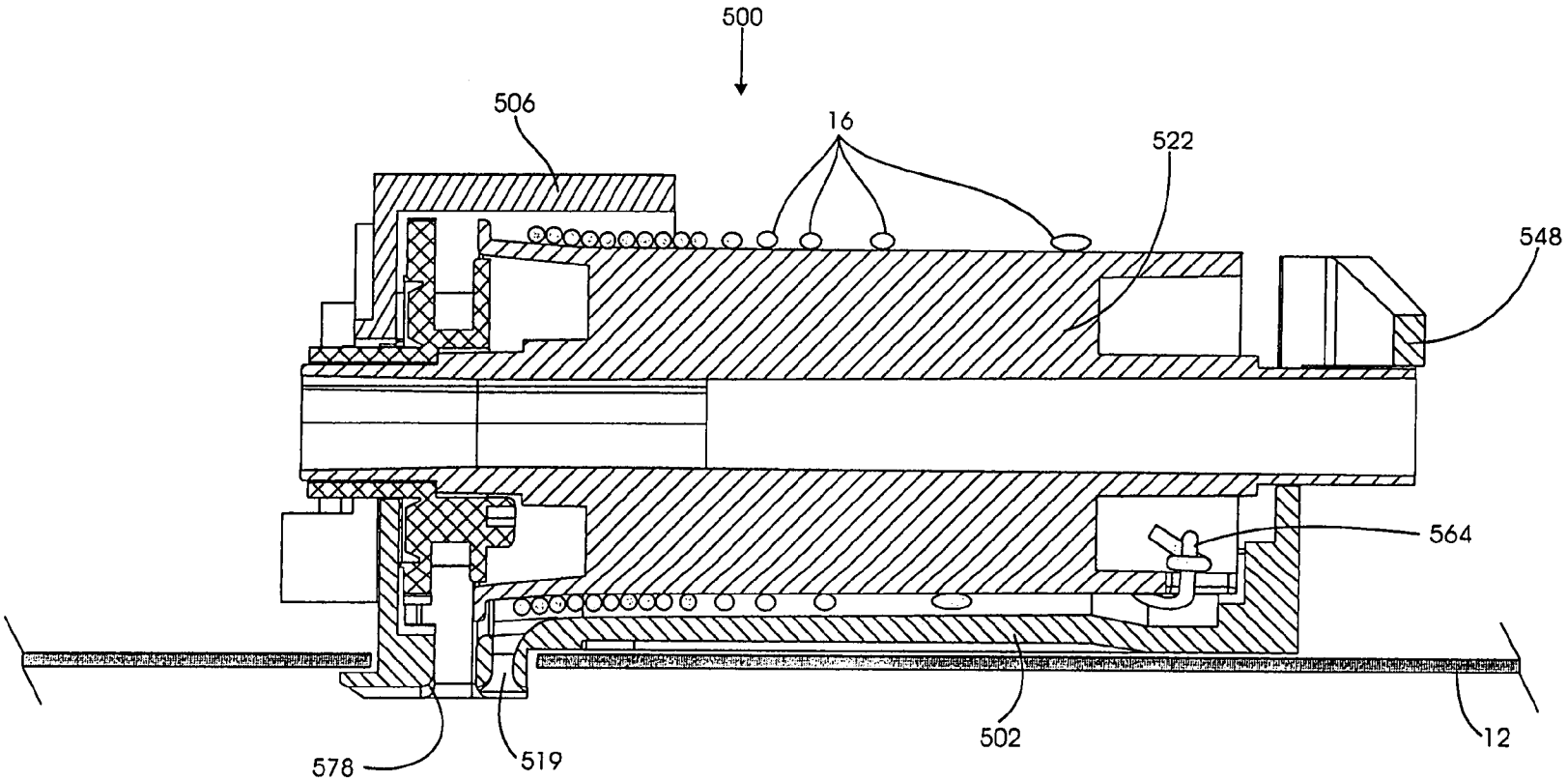
Figure 125A:
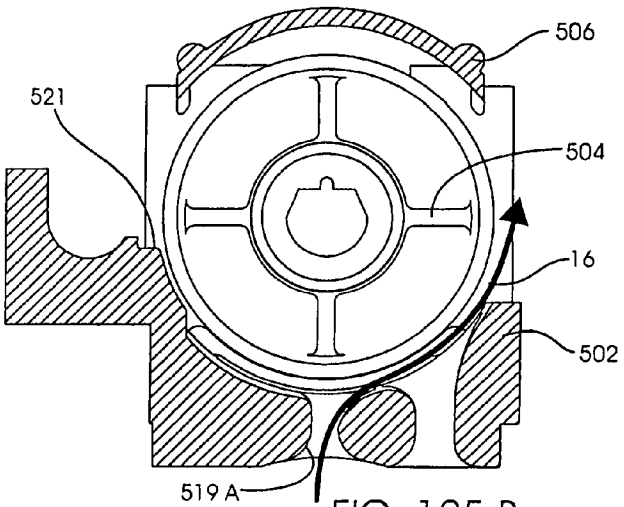
Figure 125B:
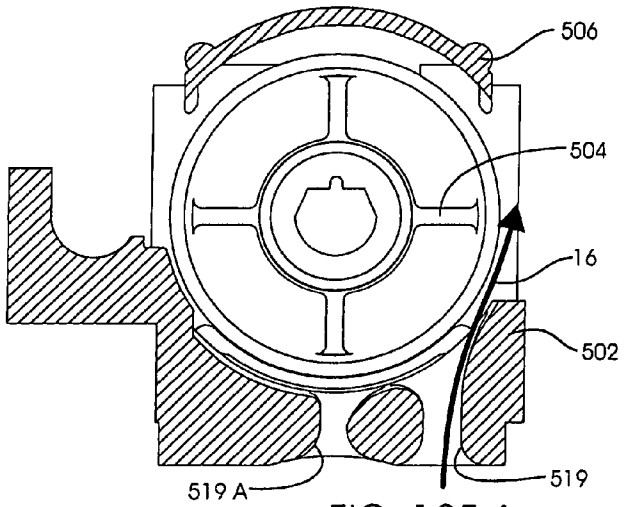
Figure 125C:
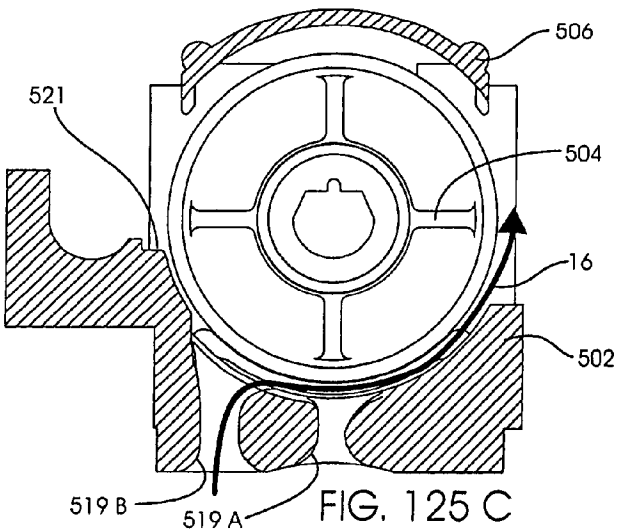
Figure 125D:
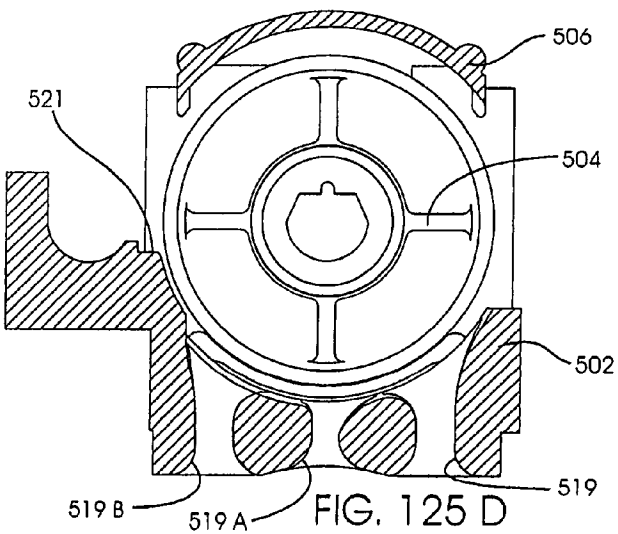
Figure 126:
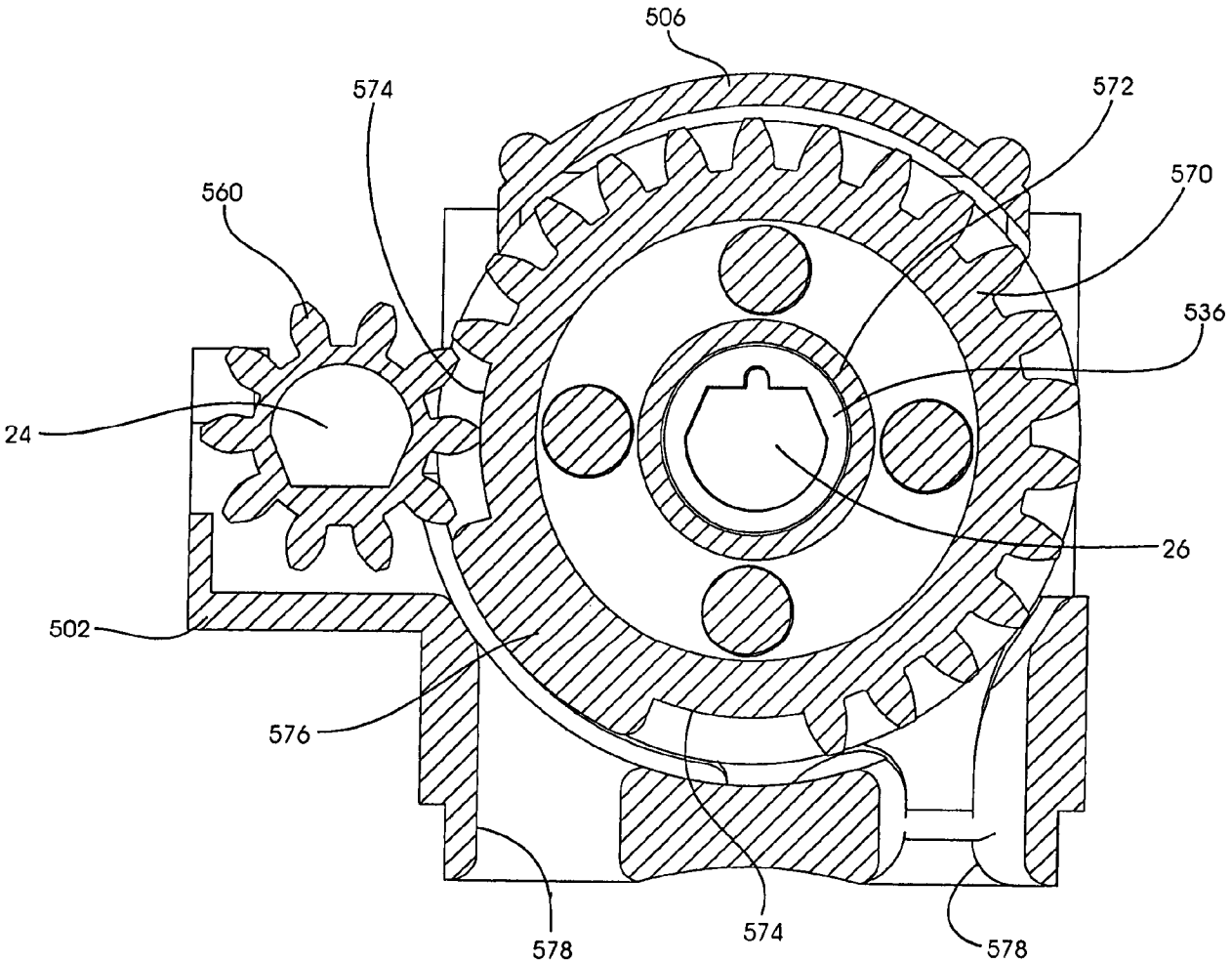
Figure 127:
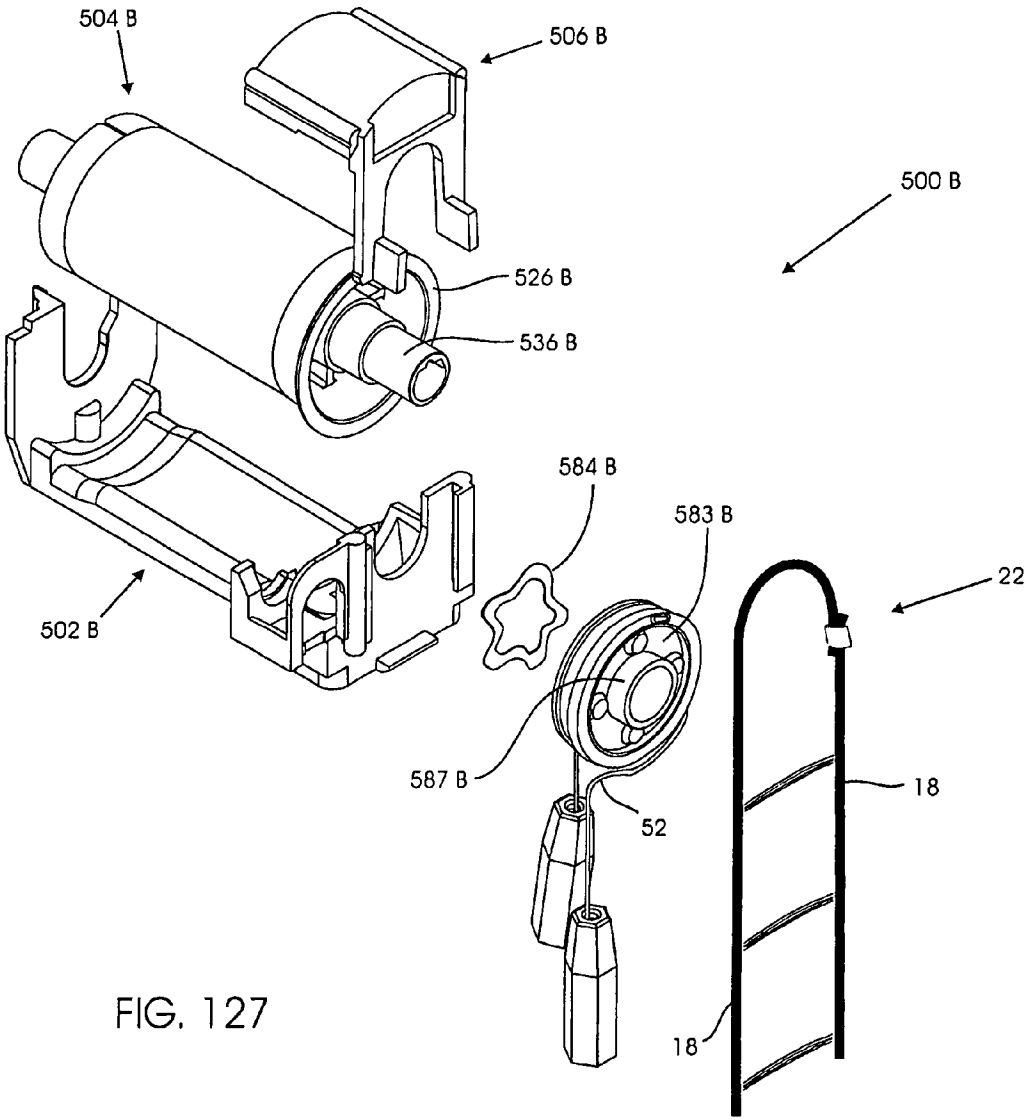
Figure 128:
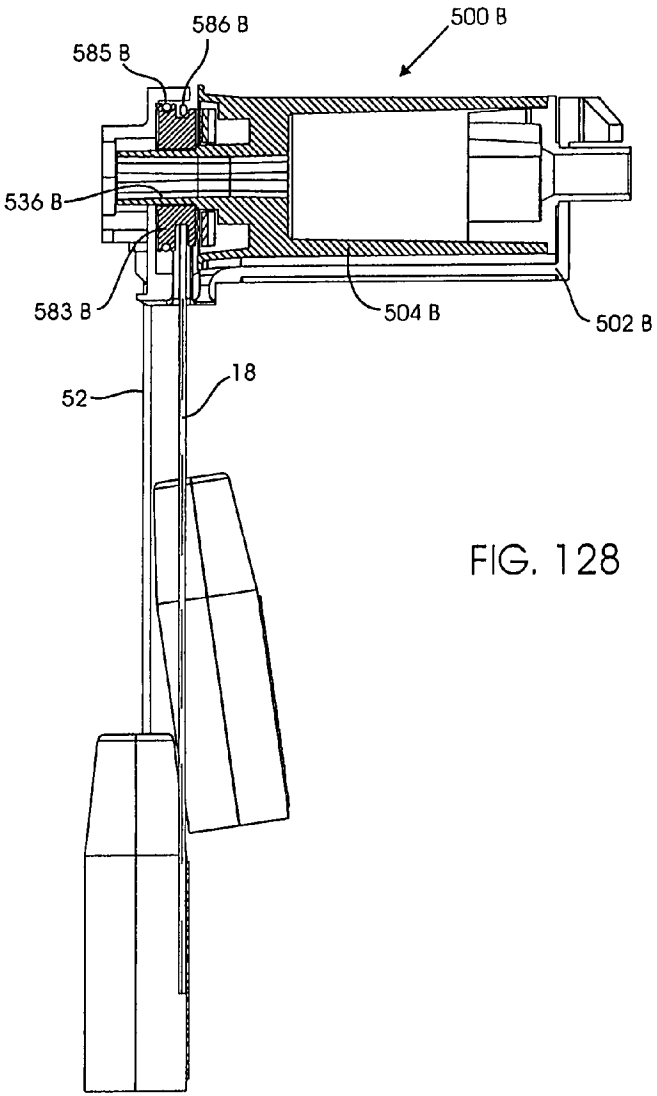
Figure 129:
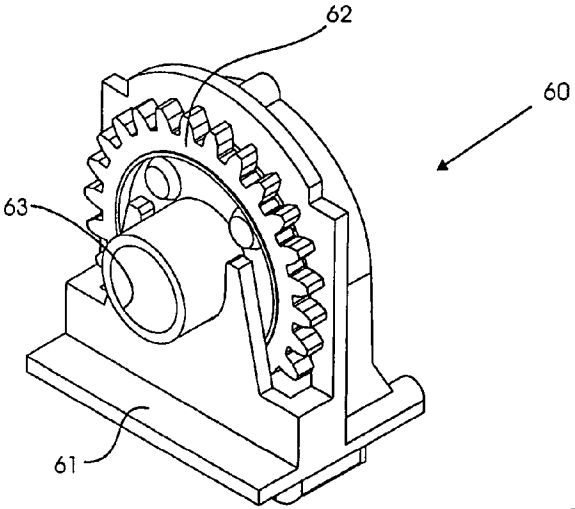
Figure 131:
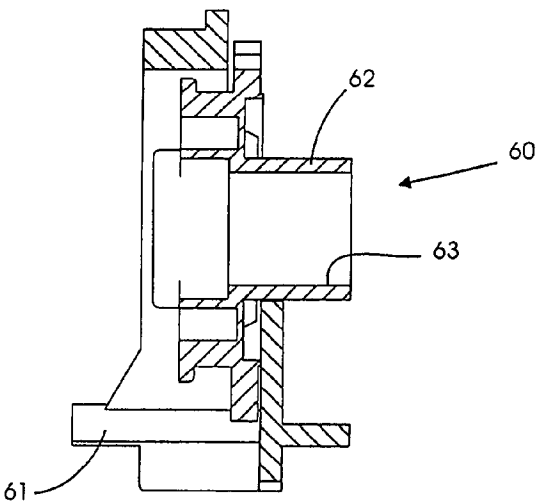
Figure 130:
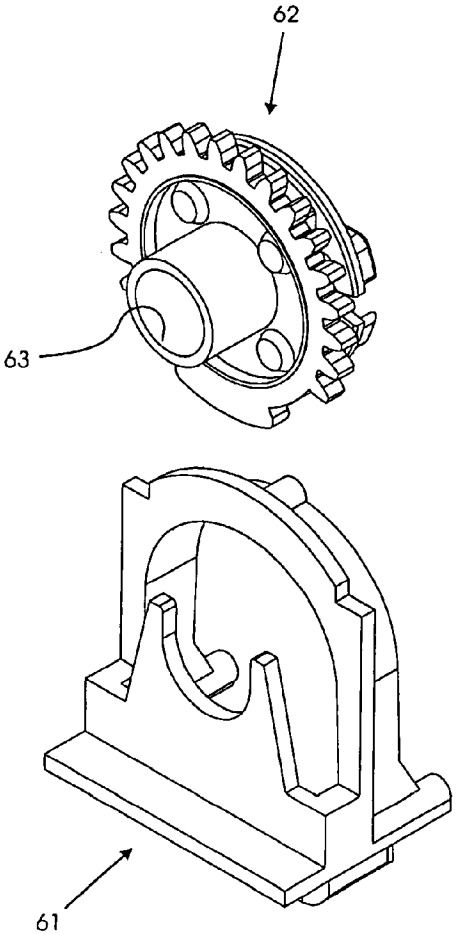
Figure 132:
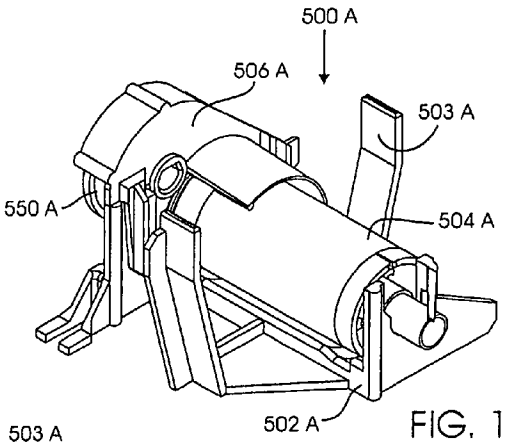
Figure 133:
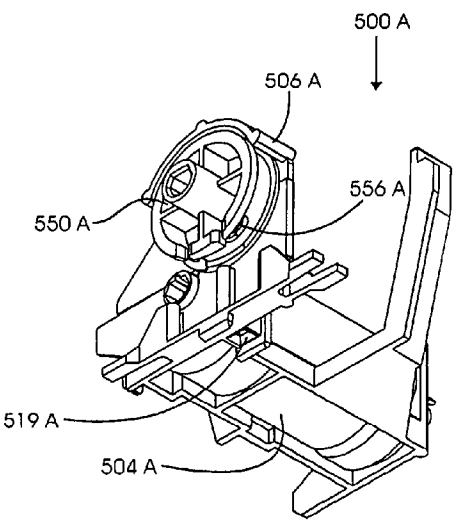
Figure 135:
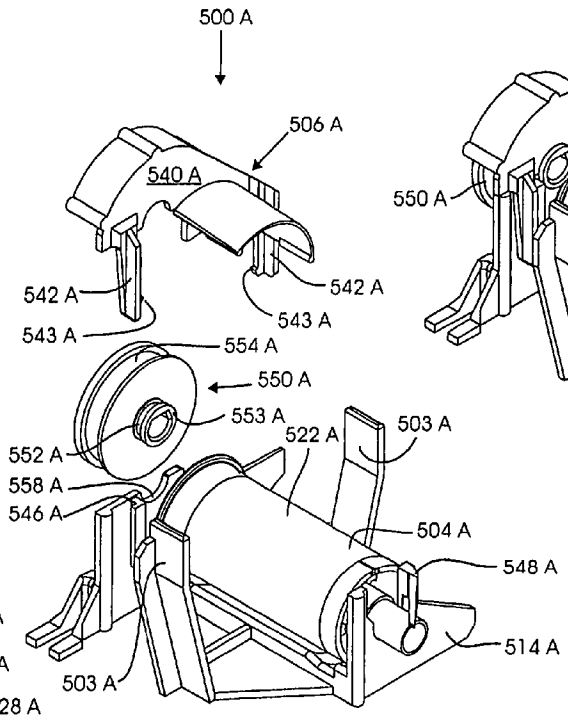
Figure 134:
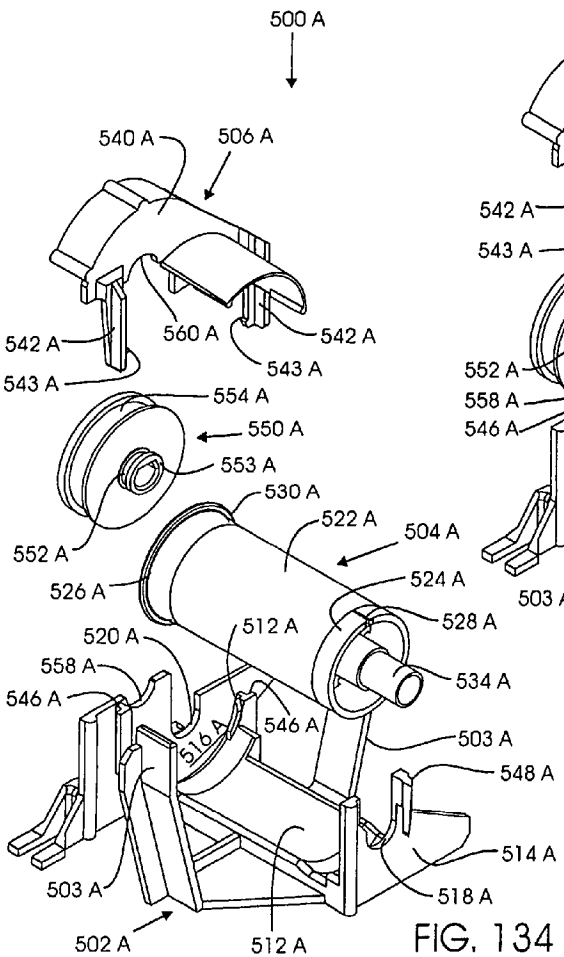
Figure 136:
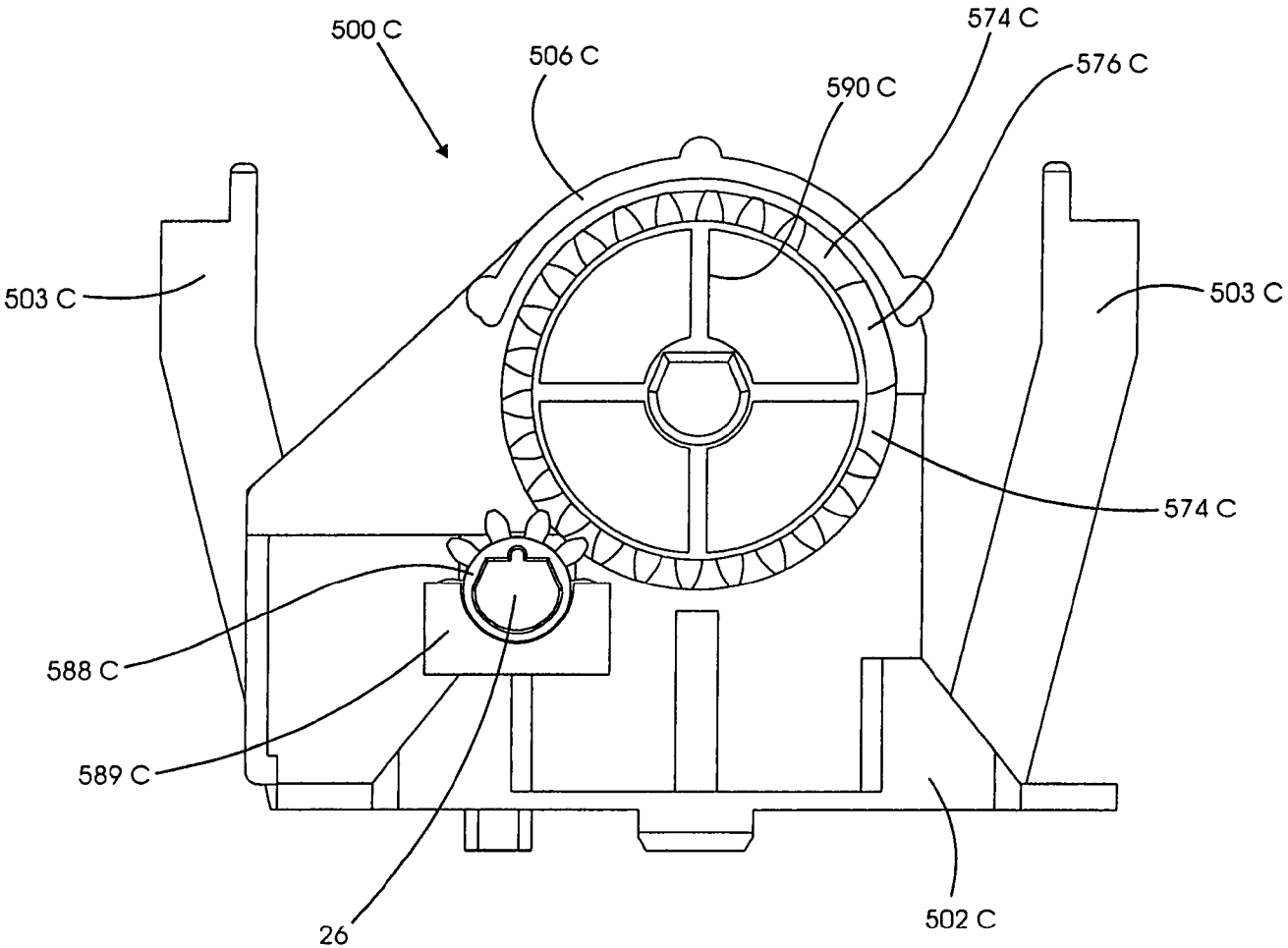
Figure 137:
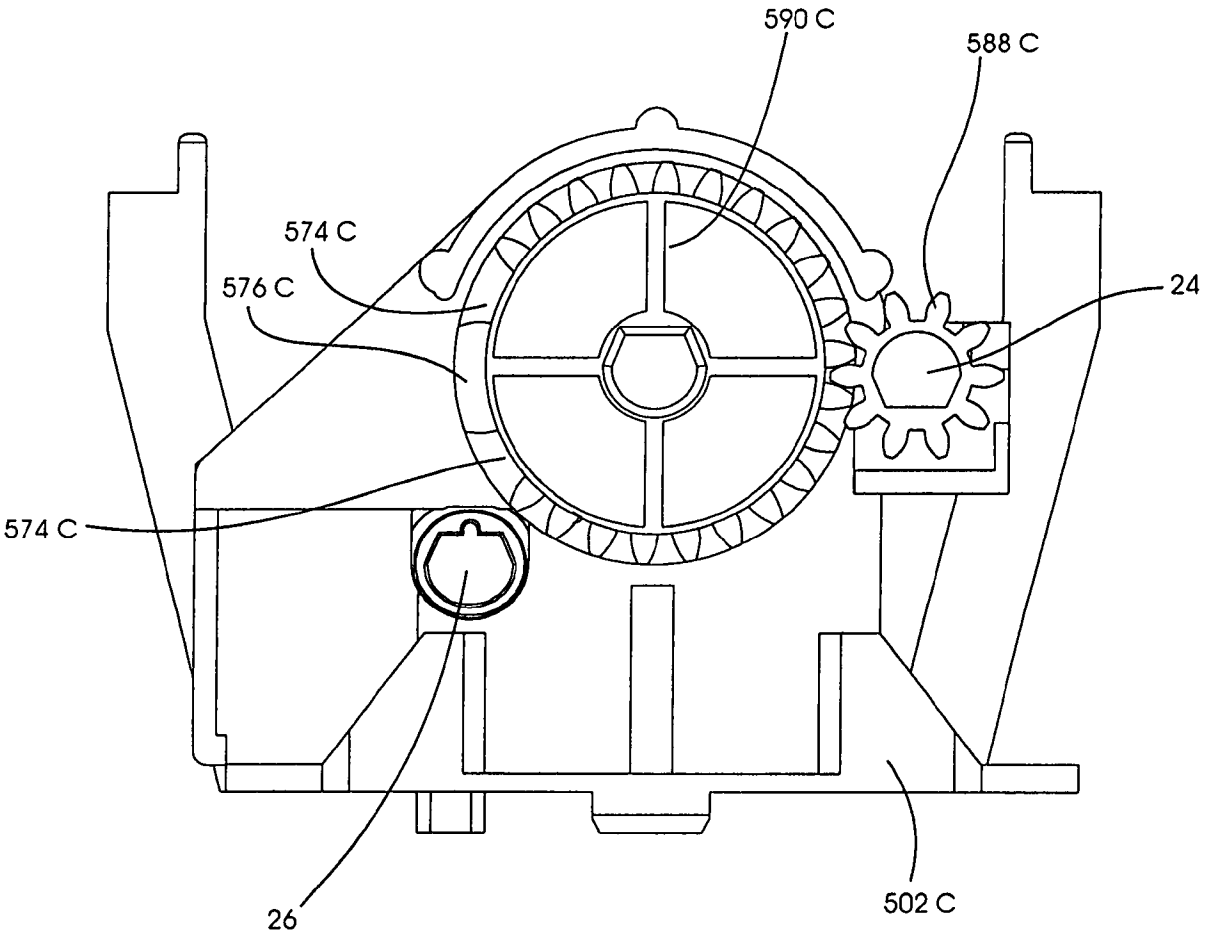
Figure 138:
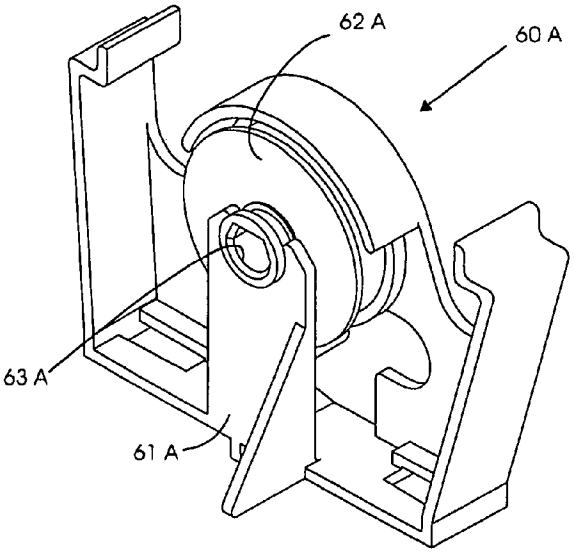
Figure 140:
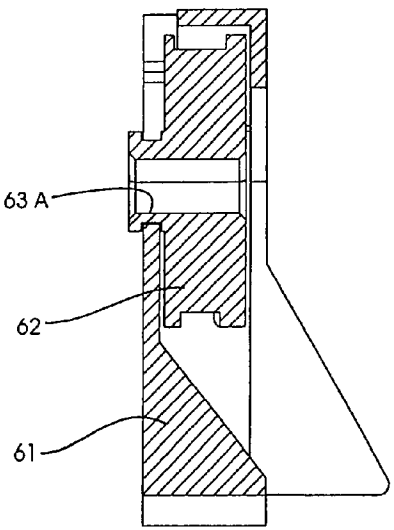
Figure 139:
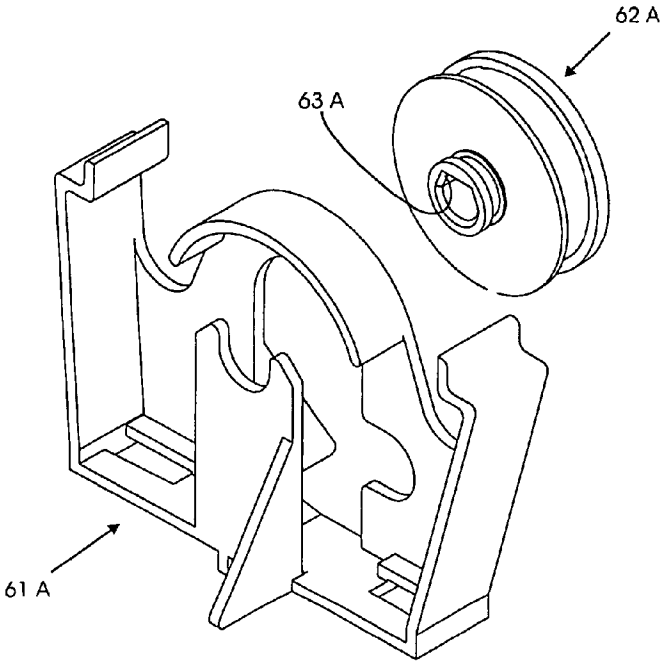
Figure 142:
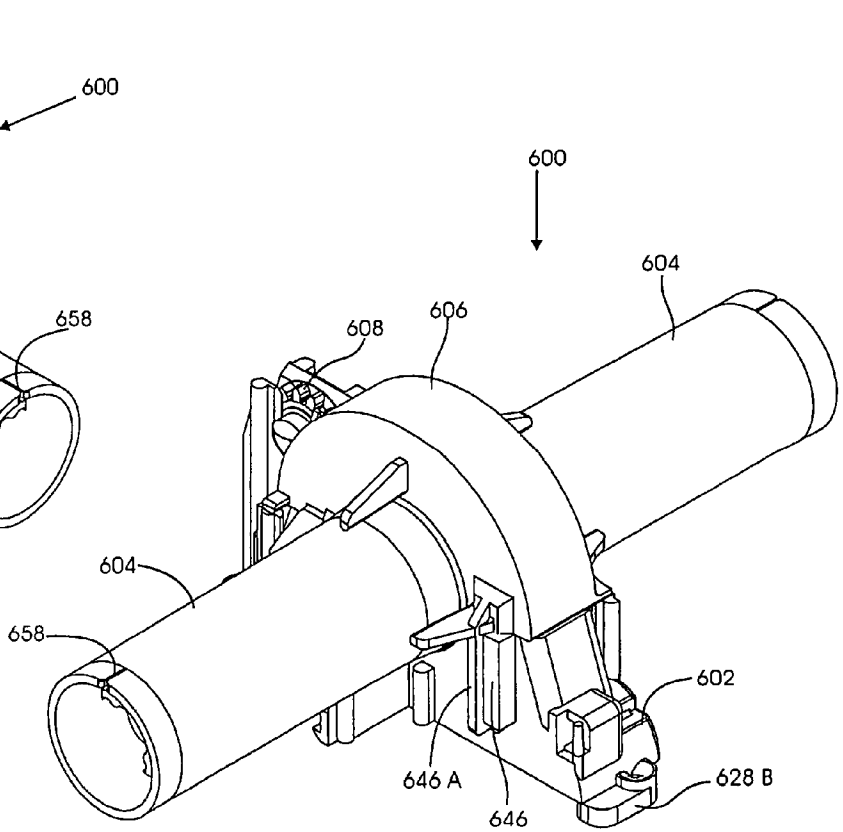
Figure 141:
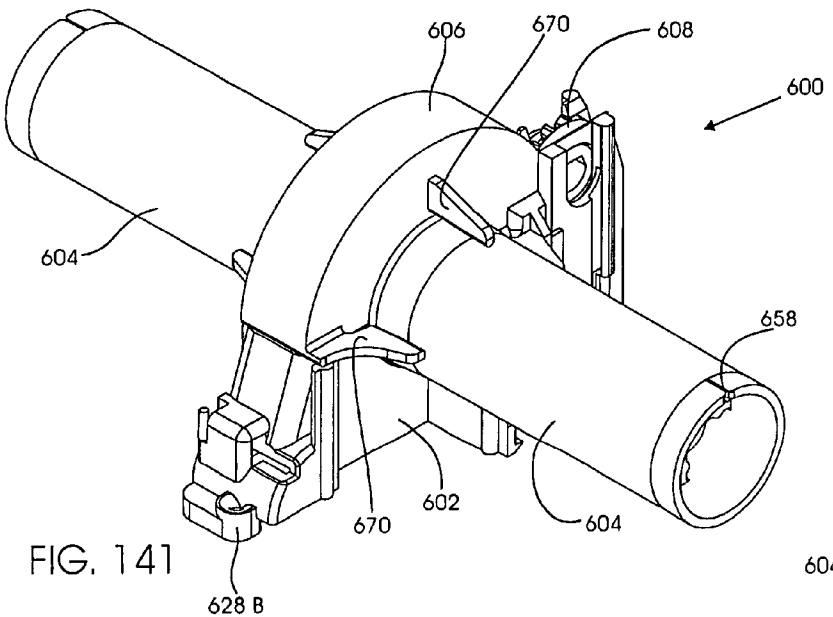
Figure 144:
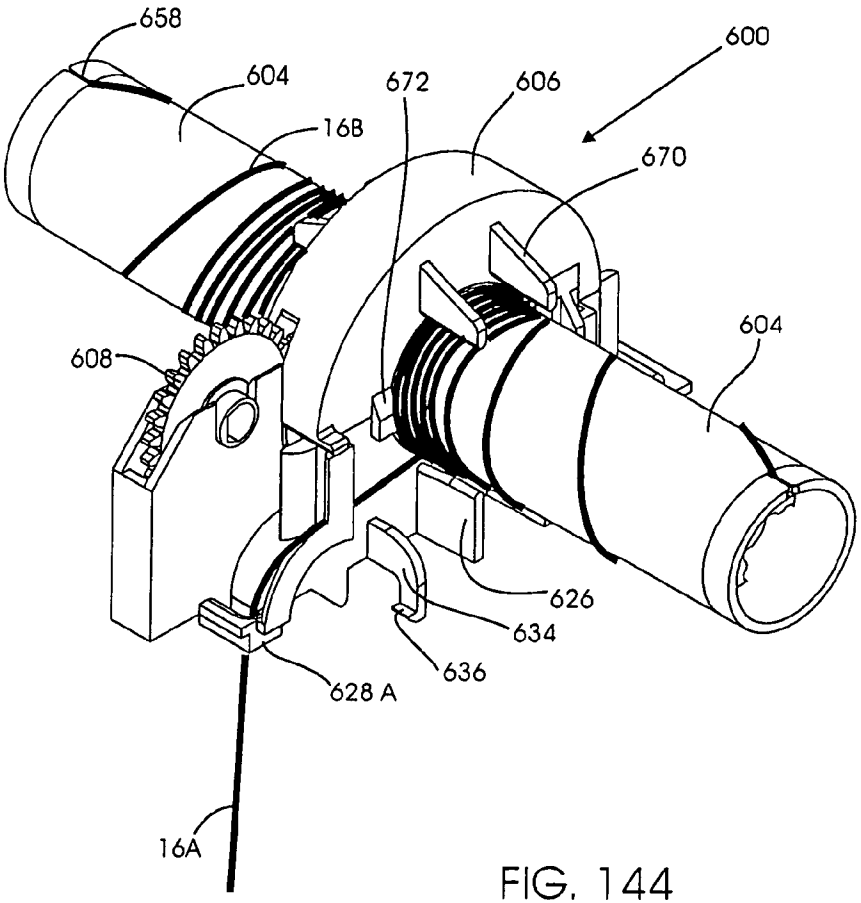
Figure 143:
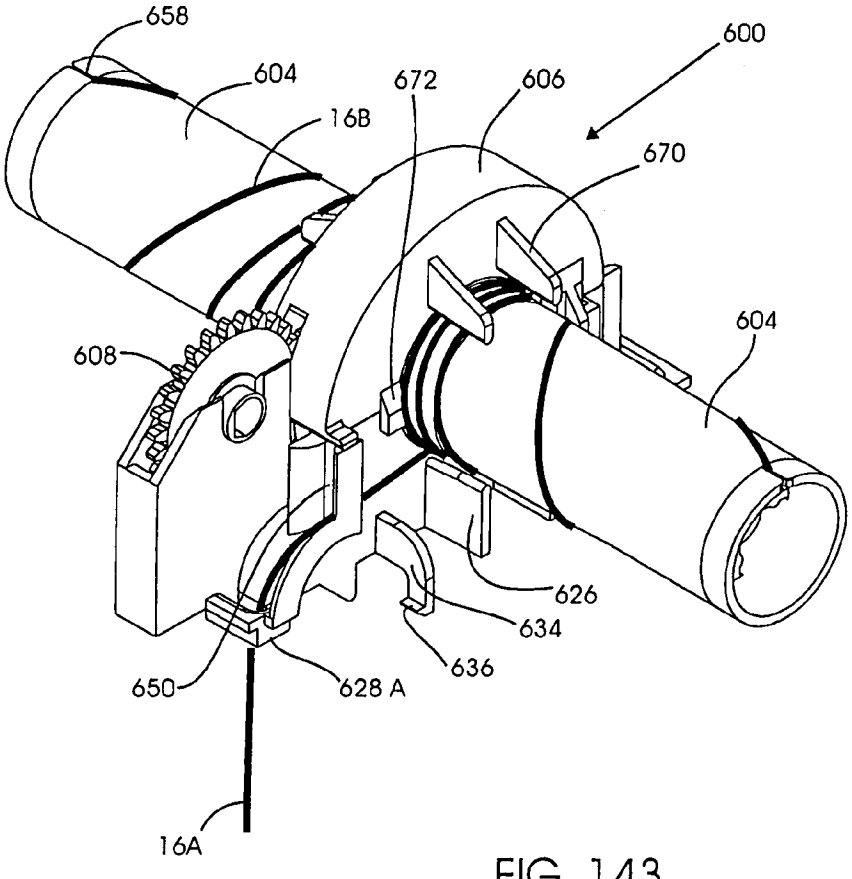
Figure 145:
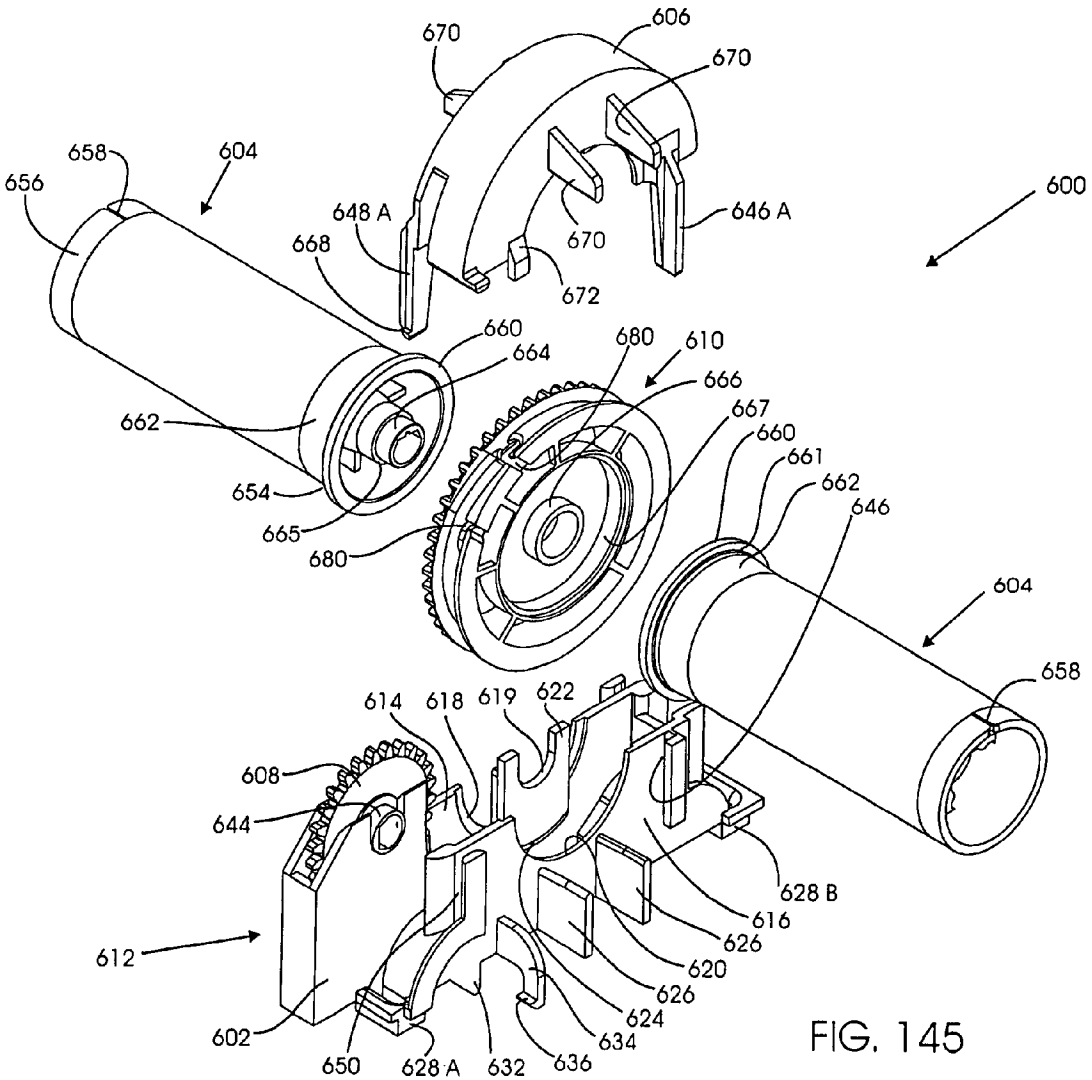
Figure 146D:
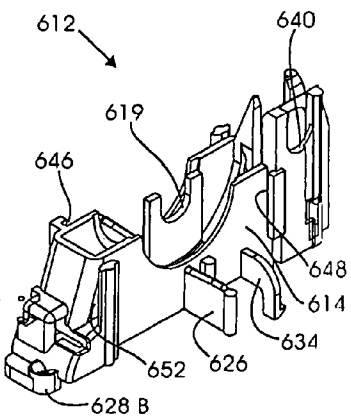
Figure 146C:
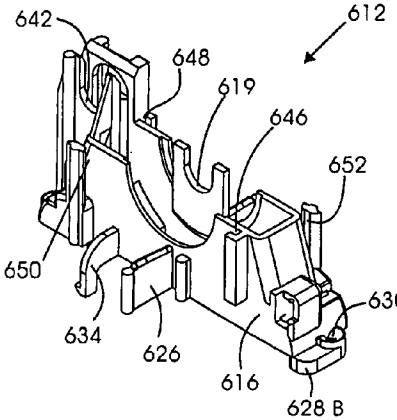
Figure 146B:
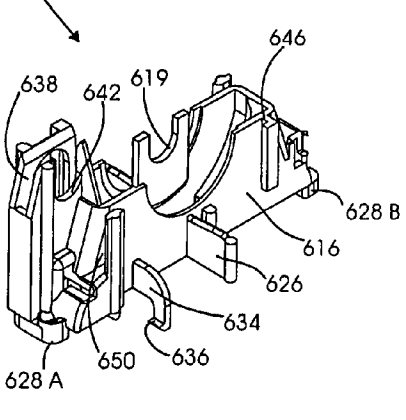
Figure 146A:
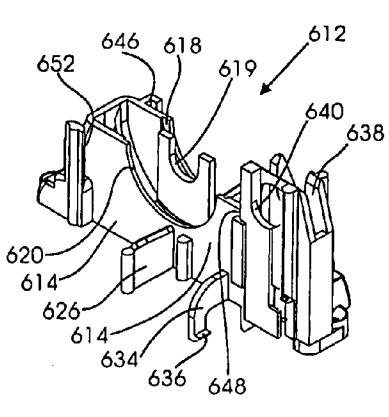
Figure 147D:
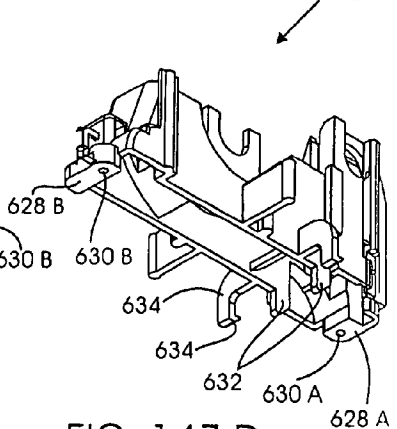
Figure 147C:
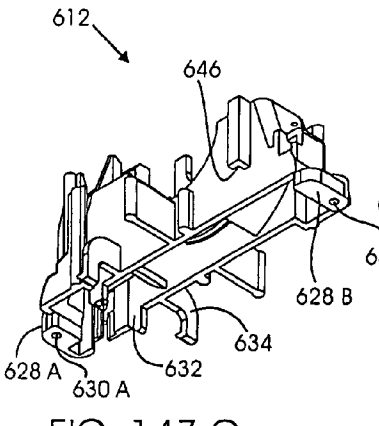
Figure 147B:
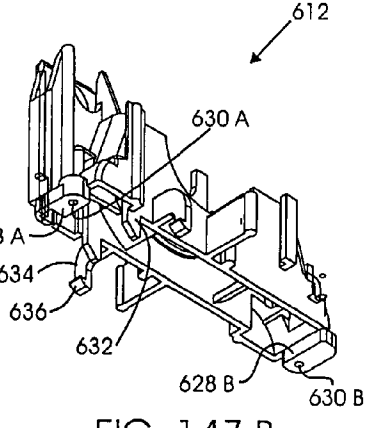
Figure 147A:
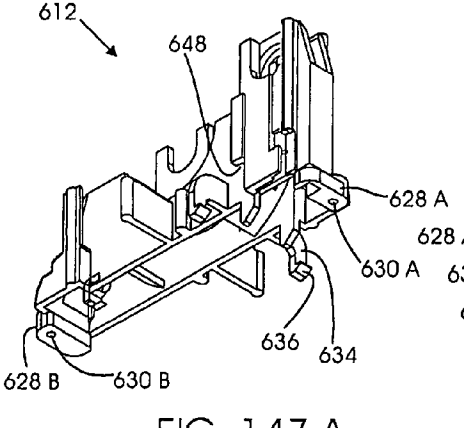
Figure 148:
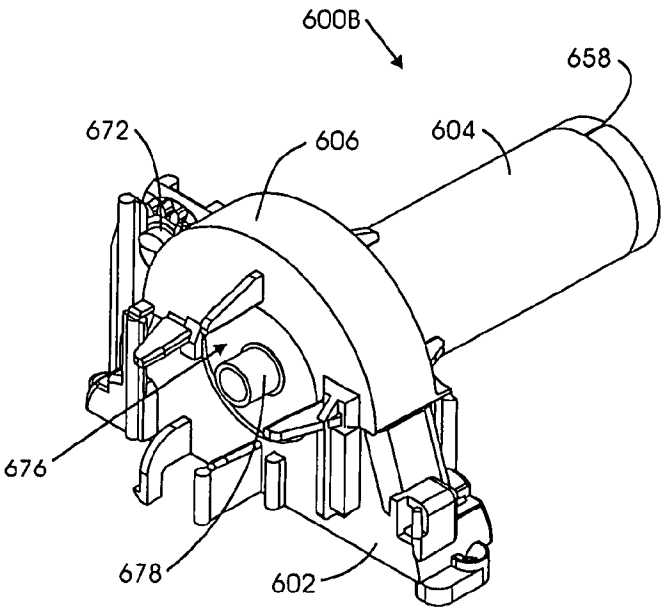
Figure 149:
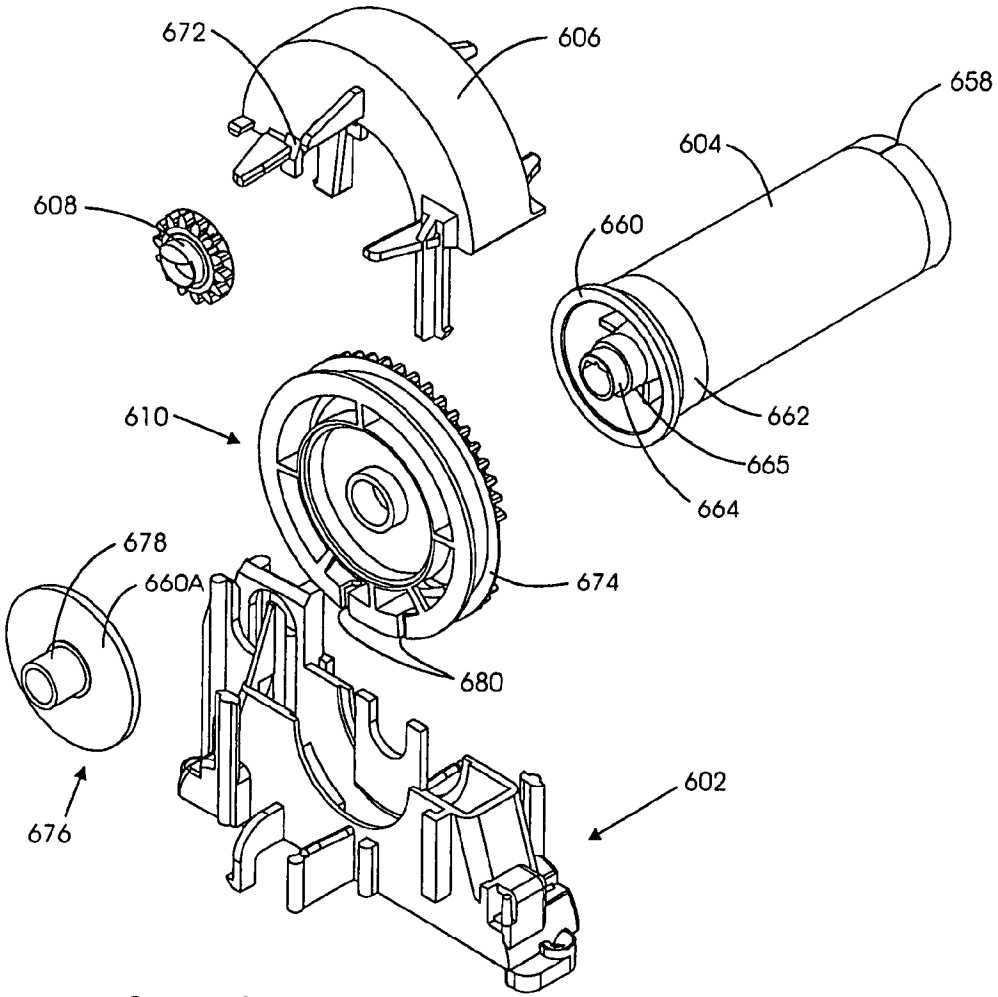
Figure 150:
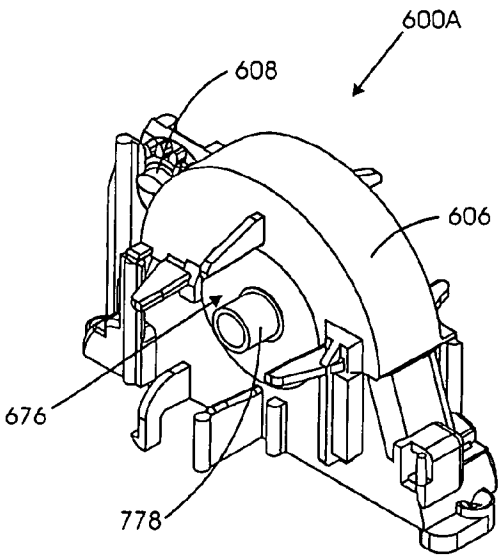
Figure 151:
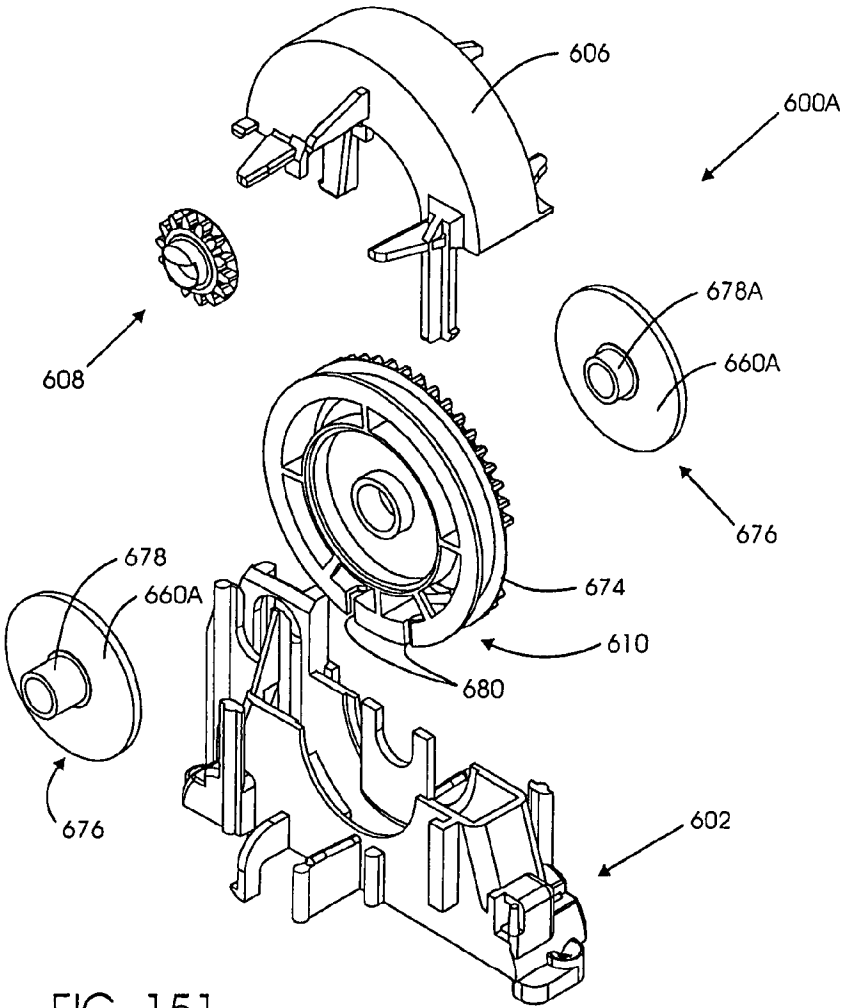
Figure 154:
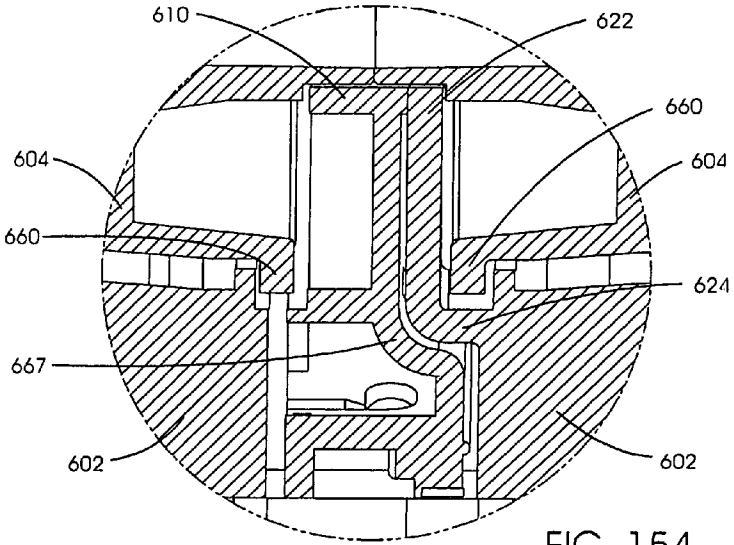
Figure 153:
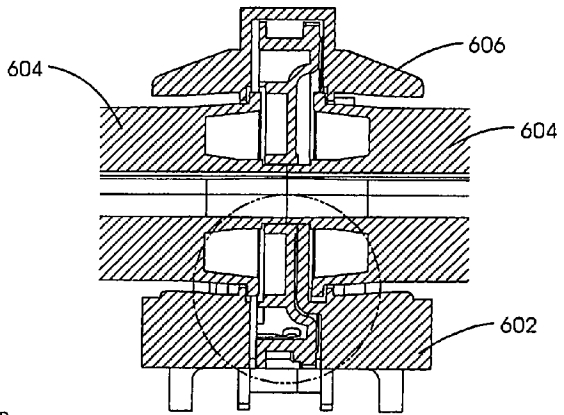
Figure 152:
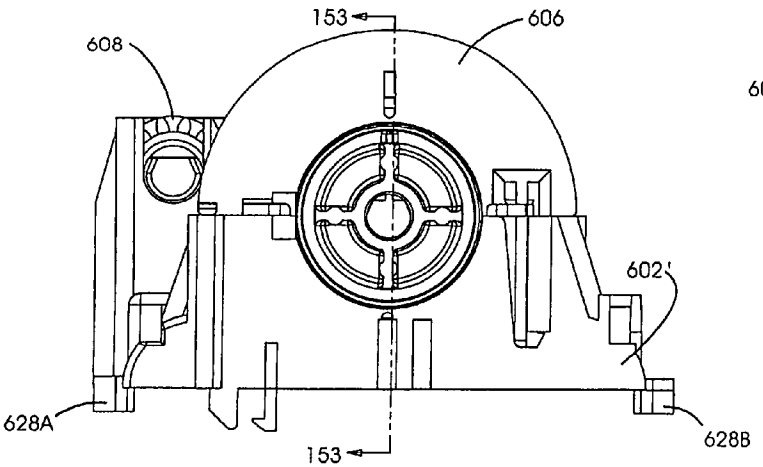
Figure 155B:
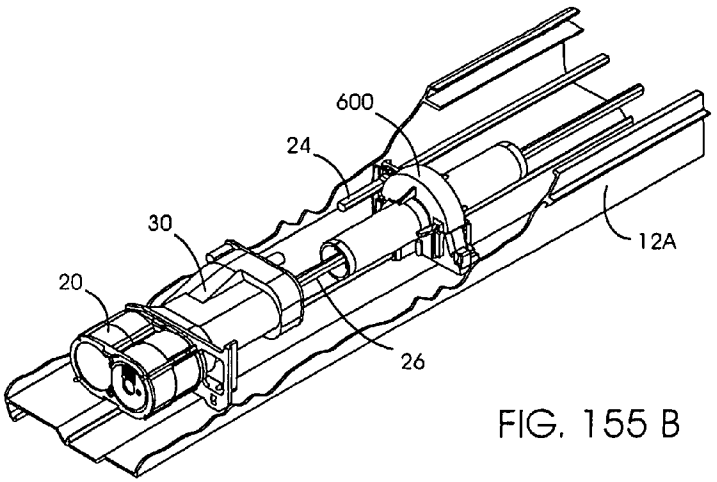
Figure 155D:
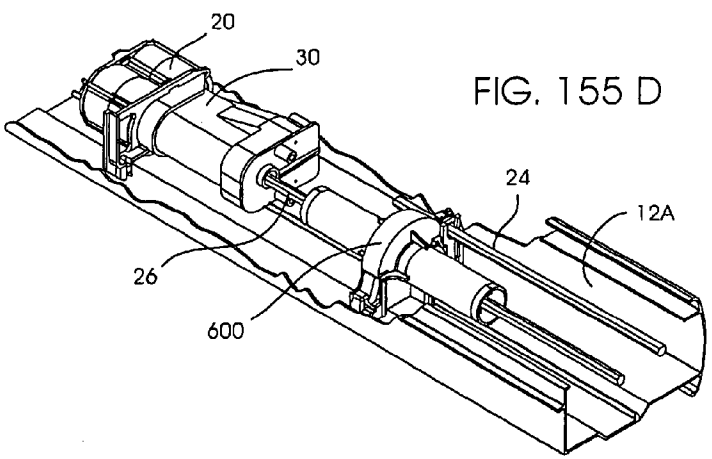
Figure 155A:
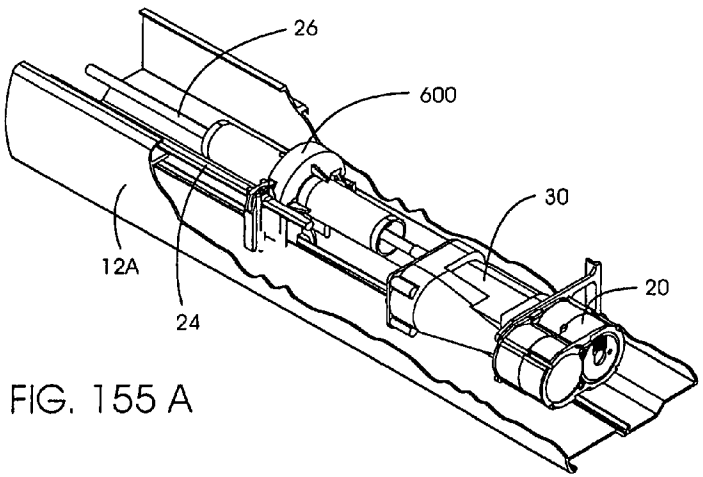
Figure 155C:
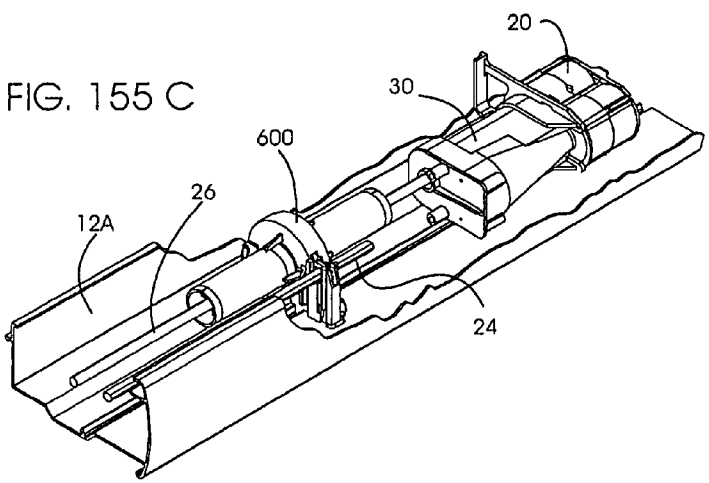
Figure 156B:
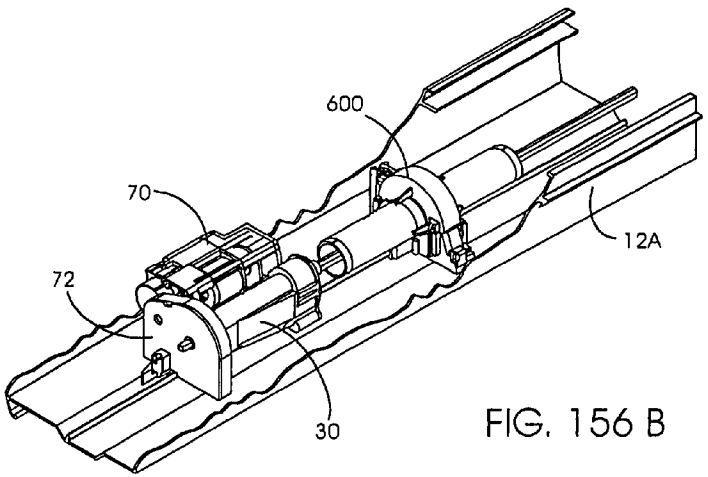
Figure 156D:
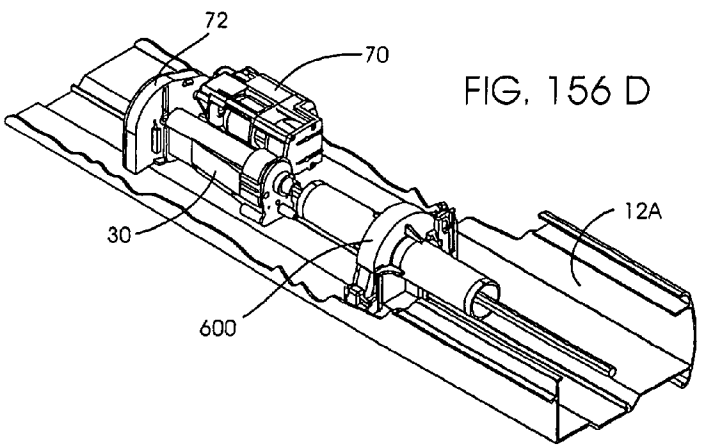
Figure 156A:
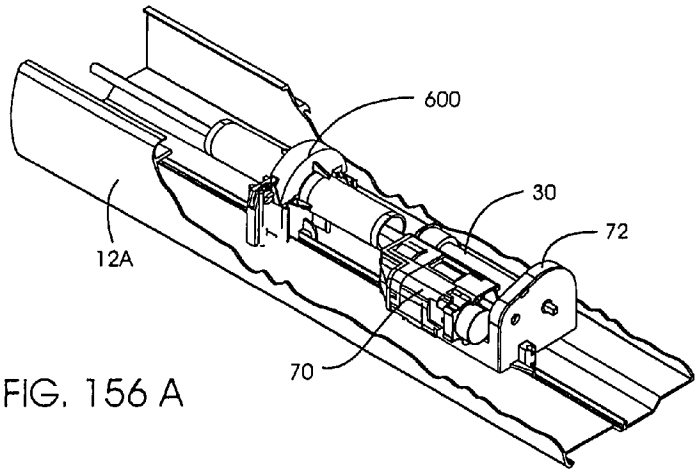
Figure 156C:
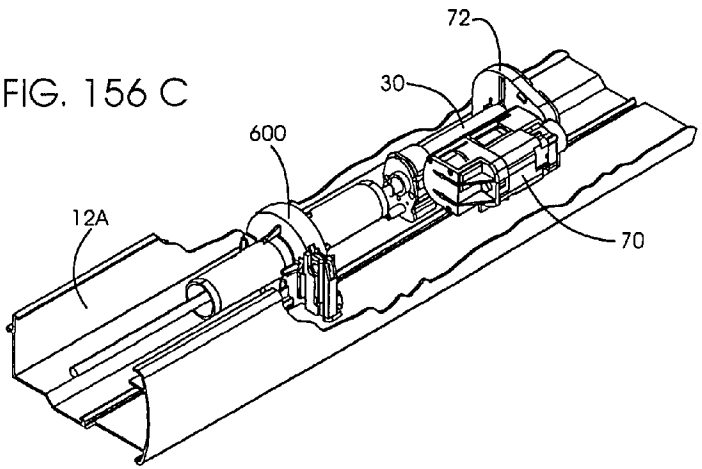
Figure 157B:
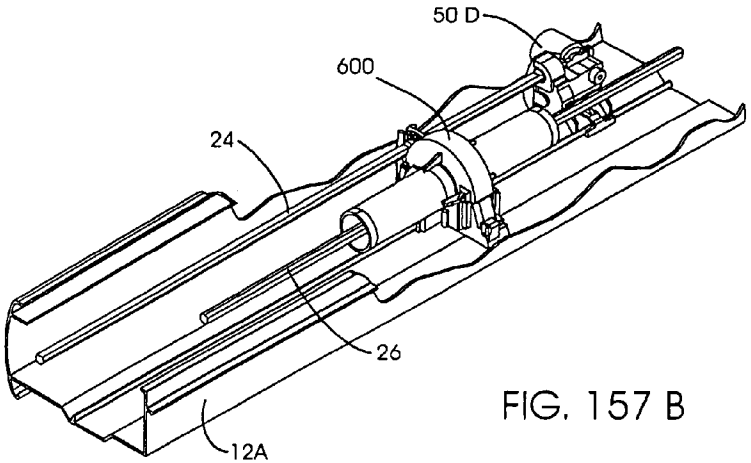
Figure 157D:
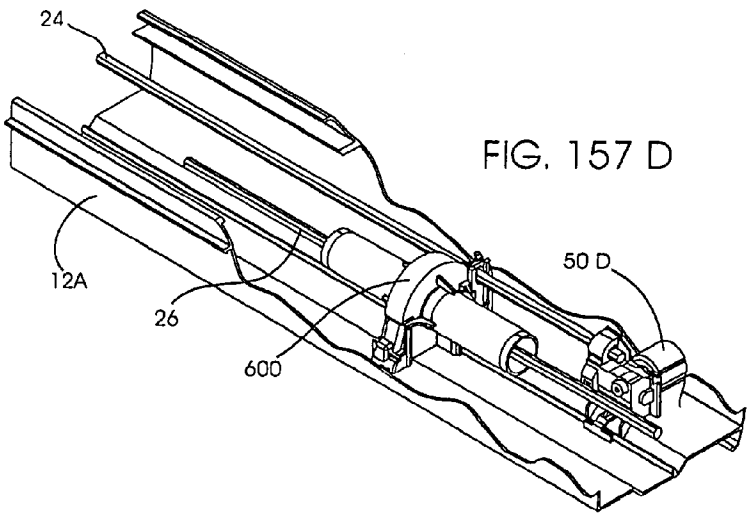
Figure 157A:
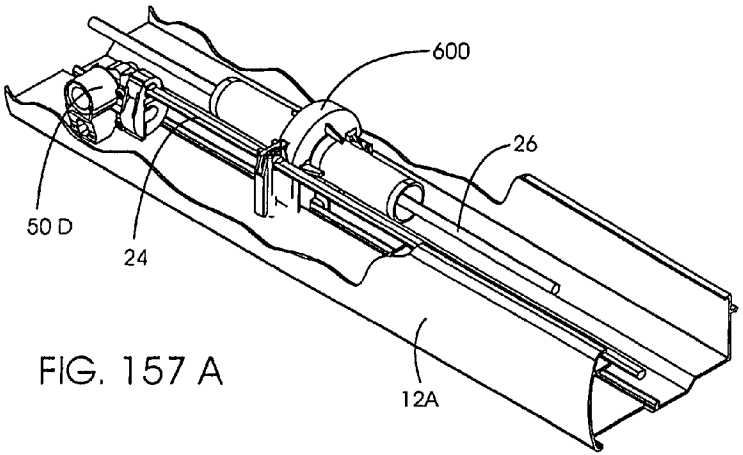
Figure 157C:
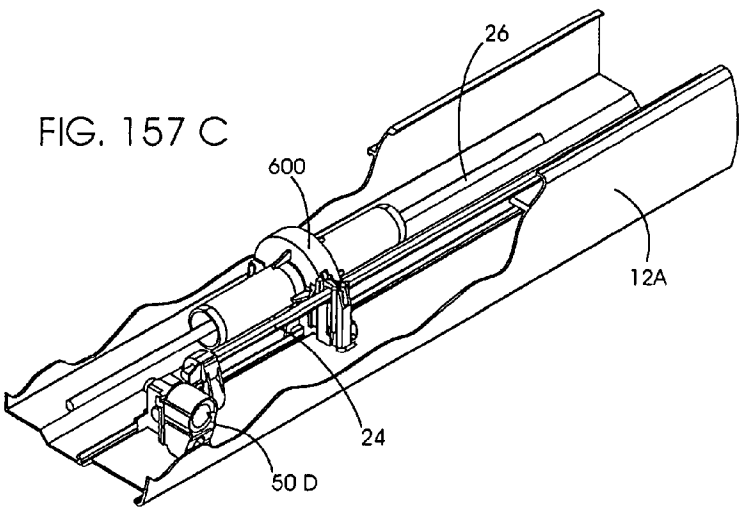
Figure 158B:
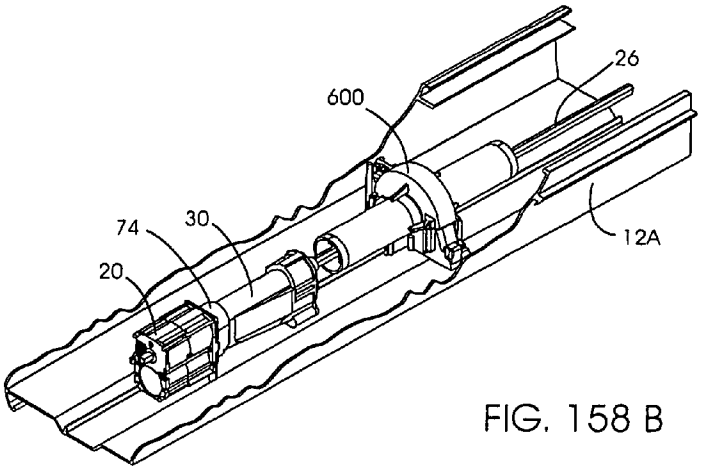
Figure 158D:
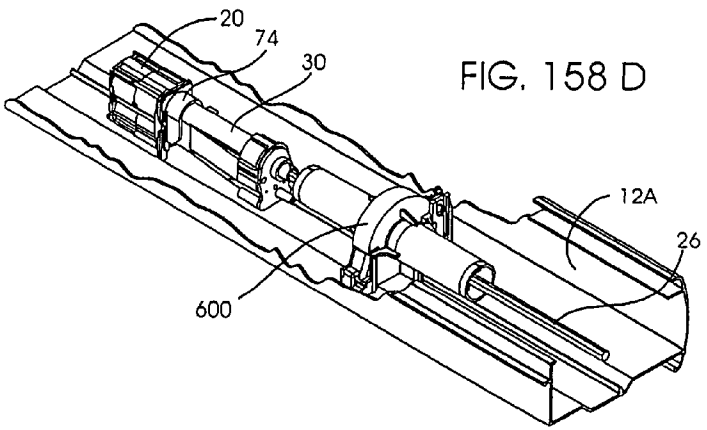
Figure 158A:
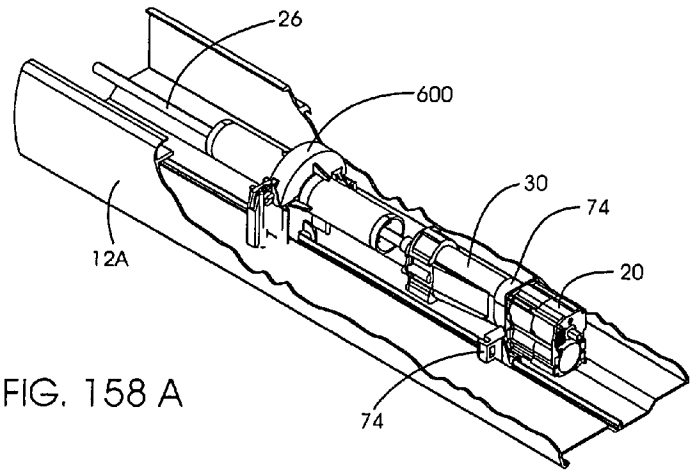
Figure 158C:
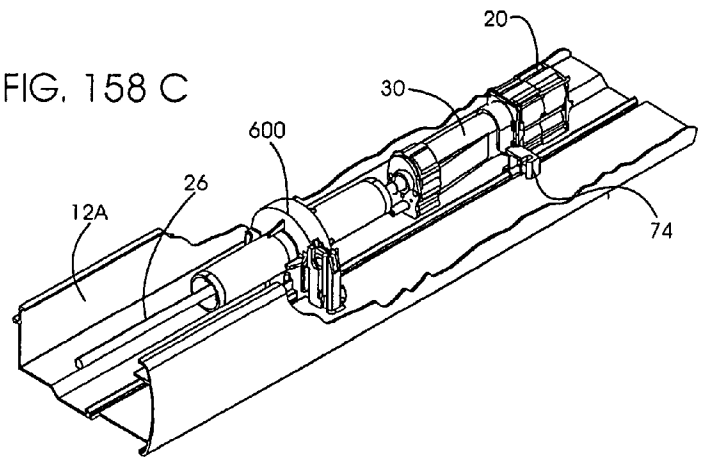
Figure 159:
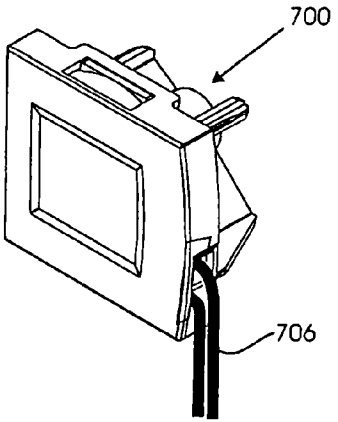
Figure 160:
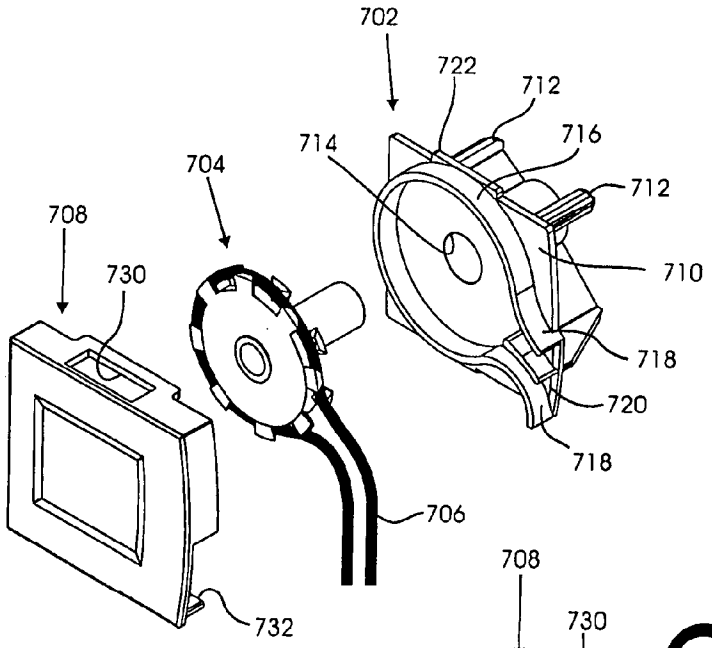
Figure 161:
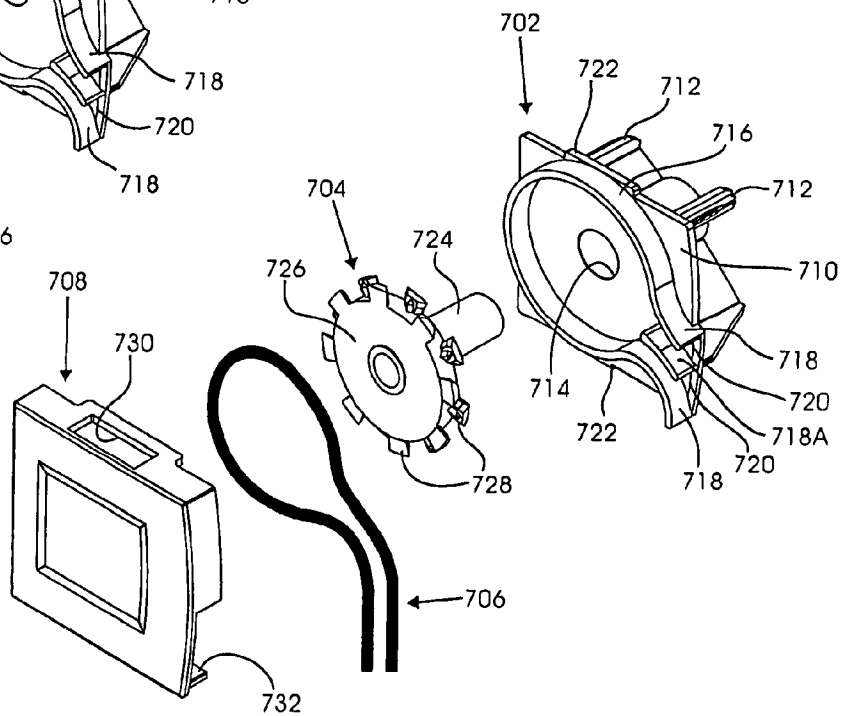
Figure 162:
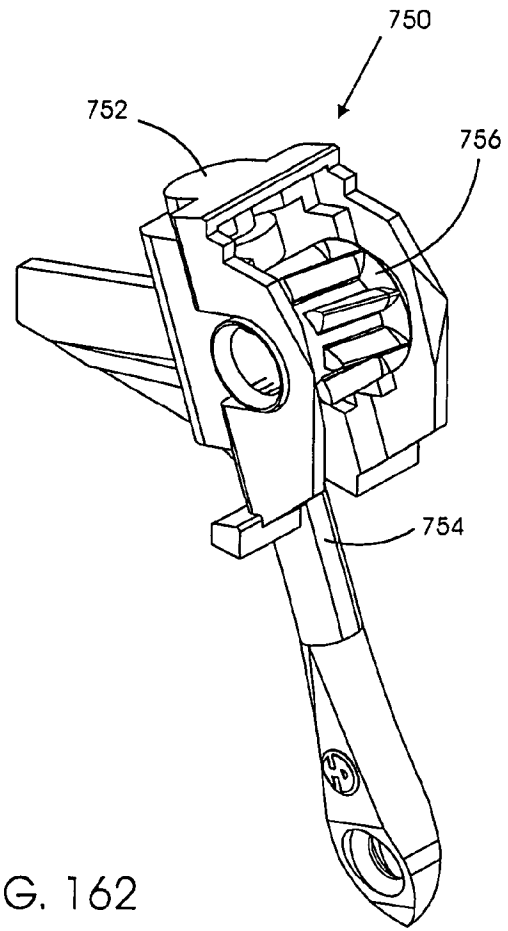
Figure 163:
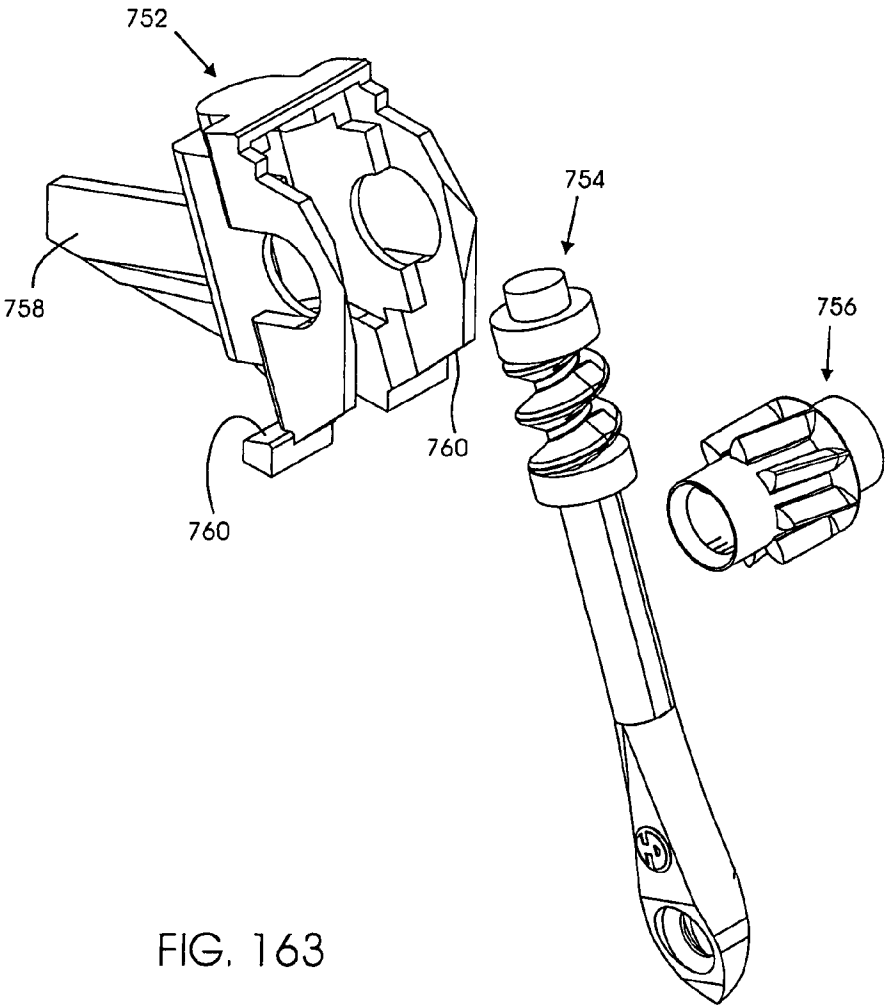
Figure 164:
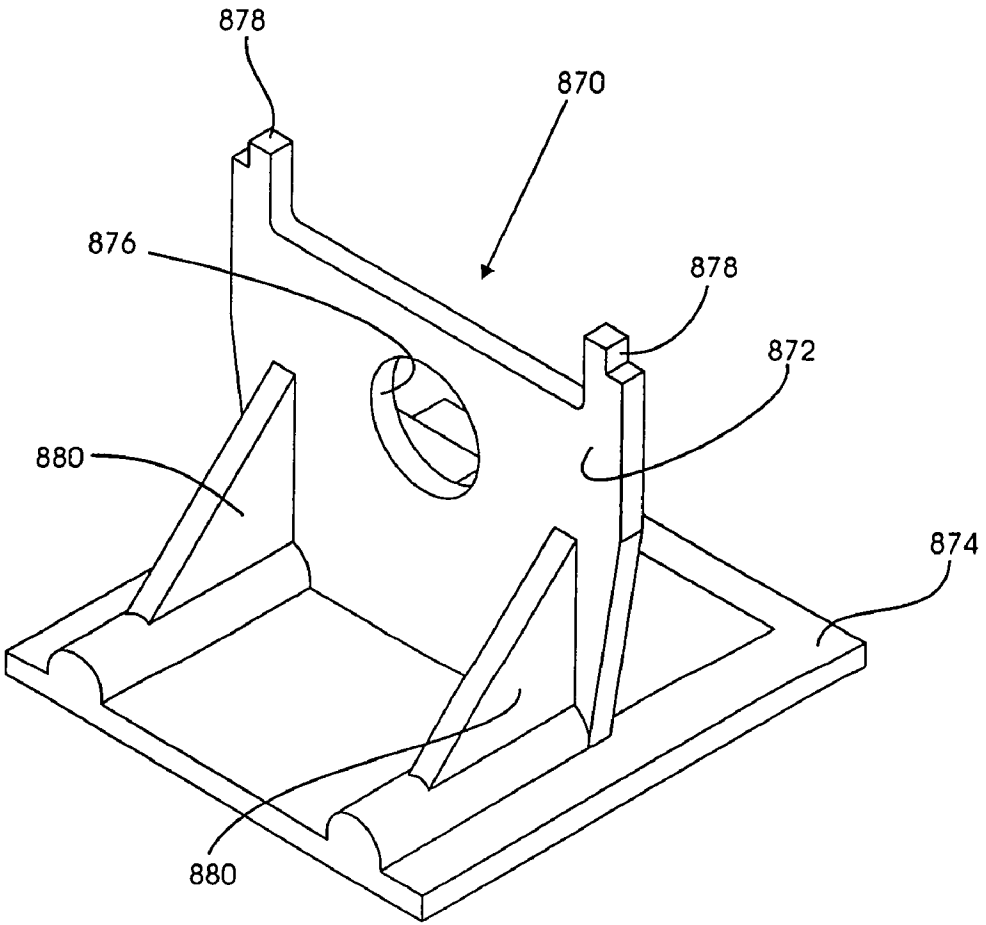
Figure 165B:
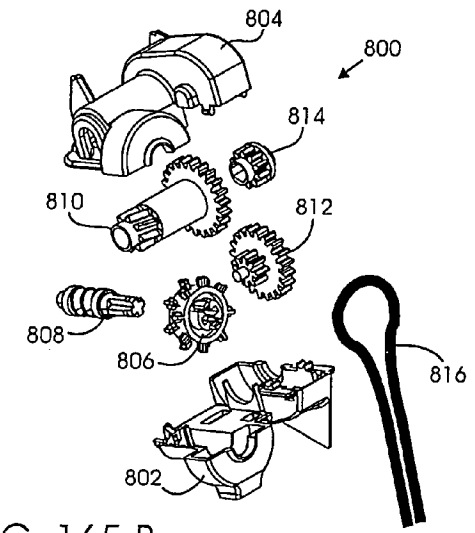
Figure 165C:
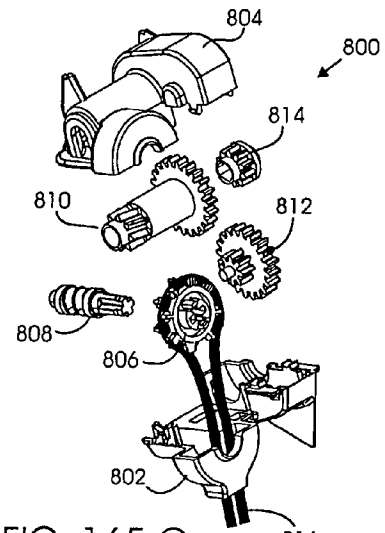
Figure 165D:
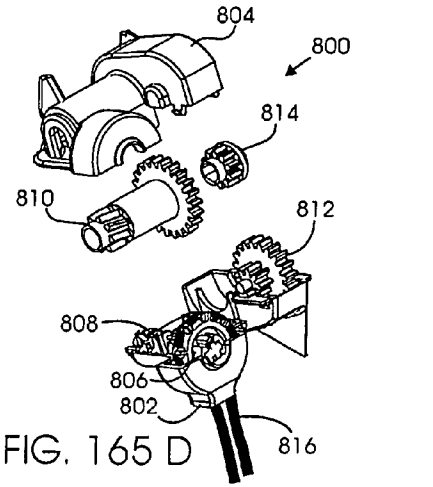
Figure 165E:
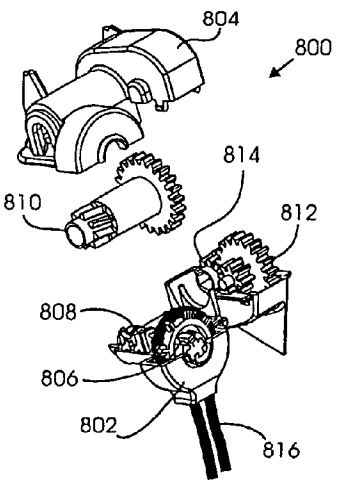
Figure 165F:
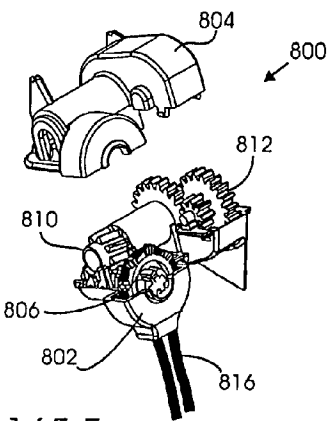
Figure 165A:
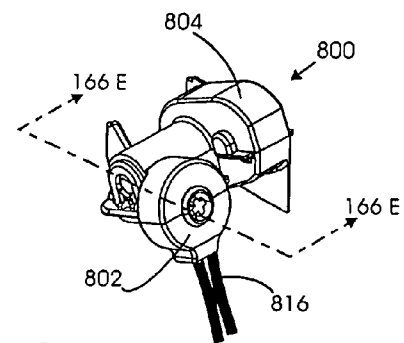
Figure 166:
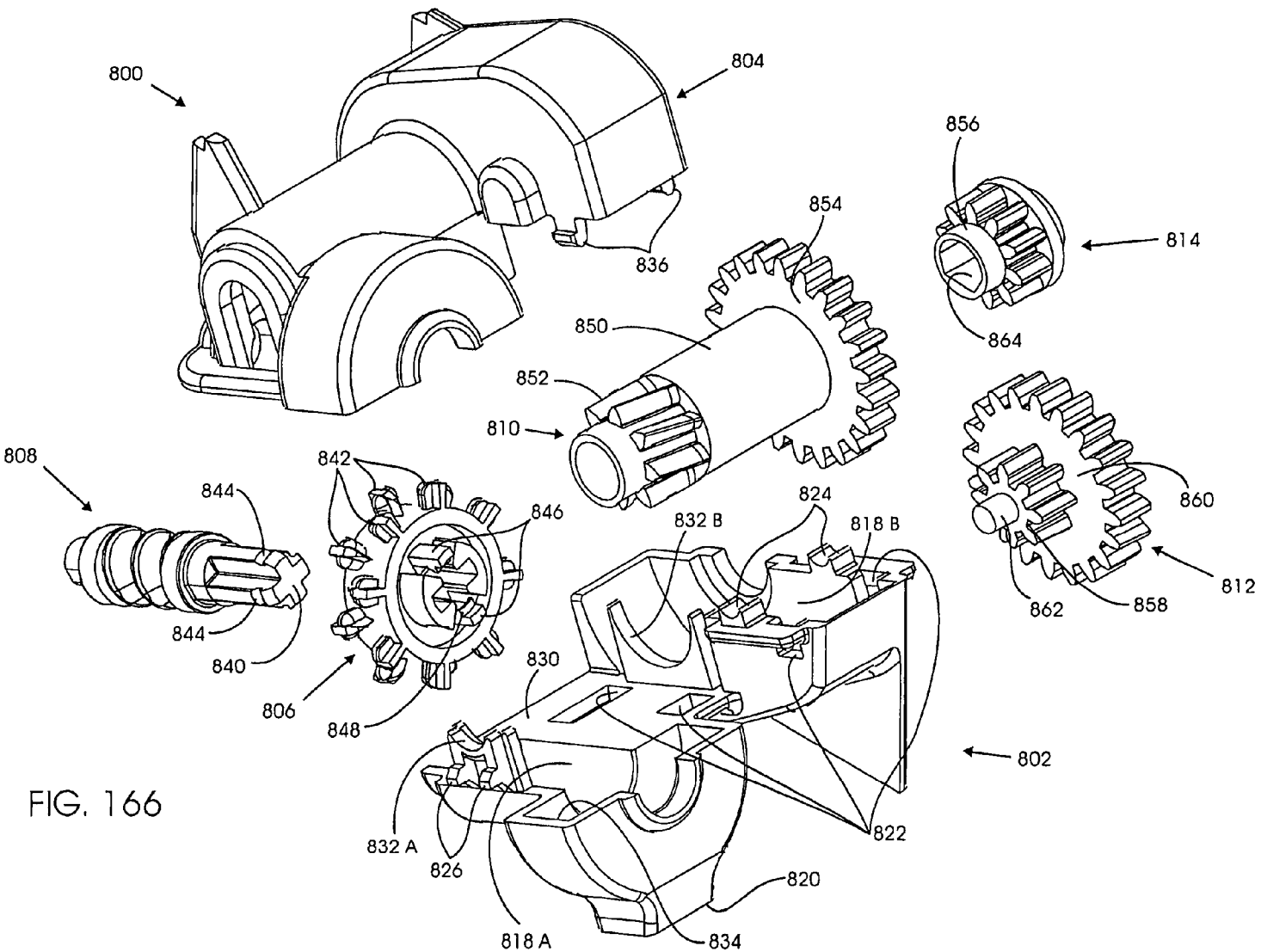
Figure 166C:
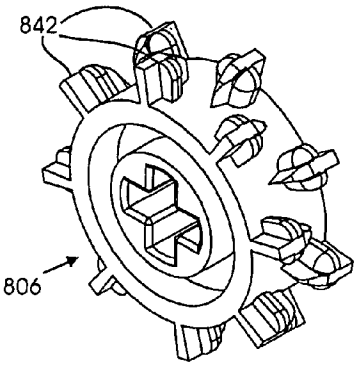
Figure 166B:
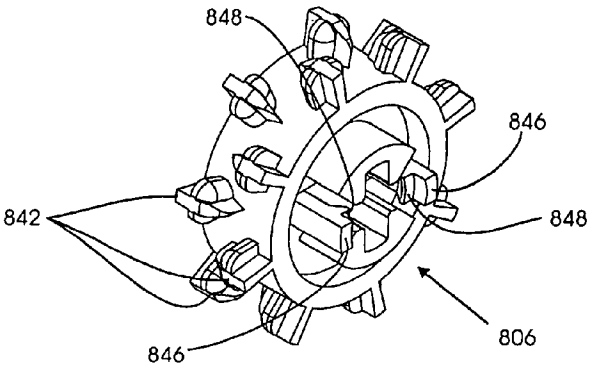
Figure 166D:
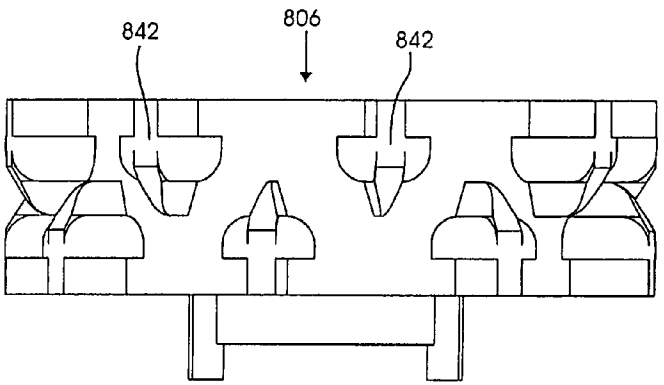
Figure 166A:
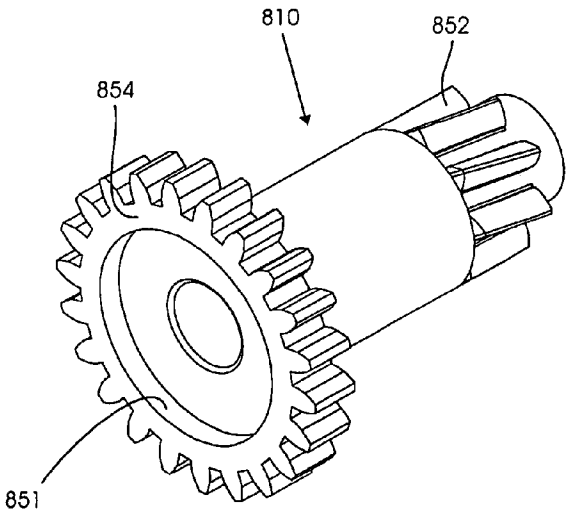
Figure 166E:
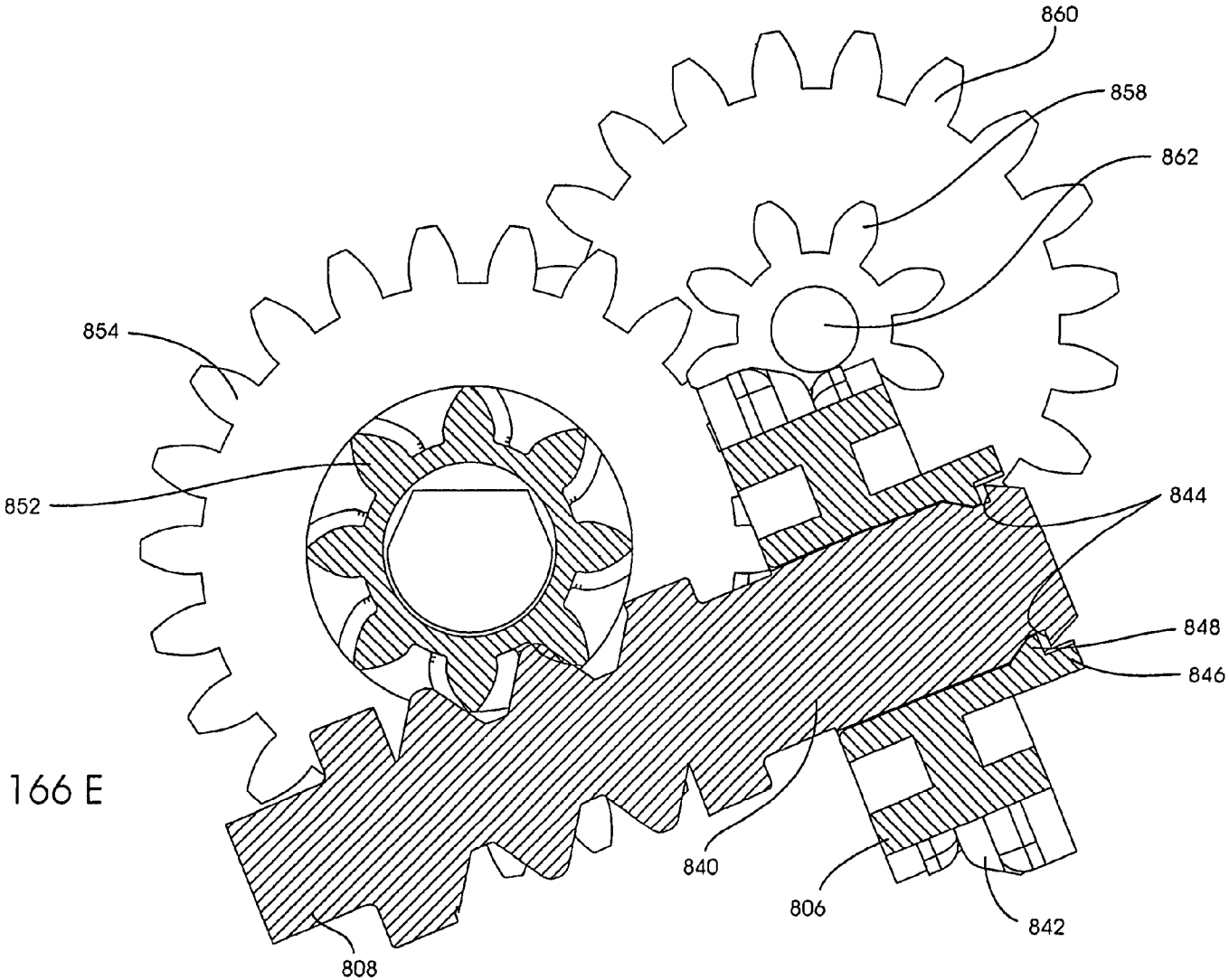
Figure 167:
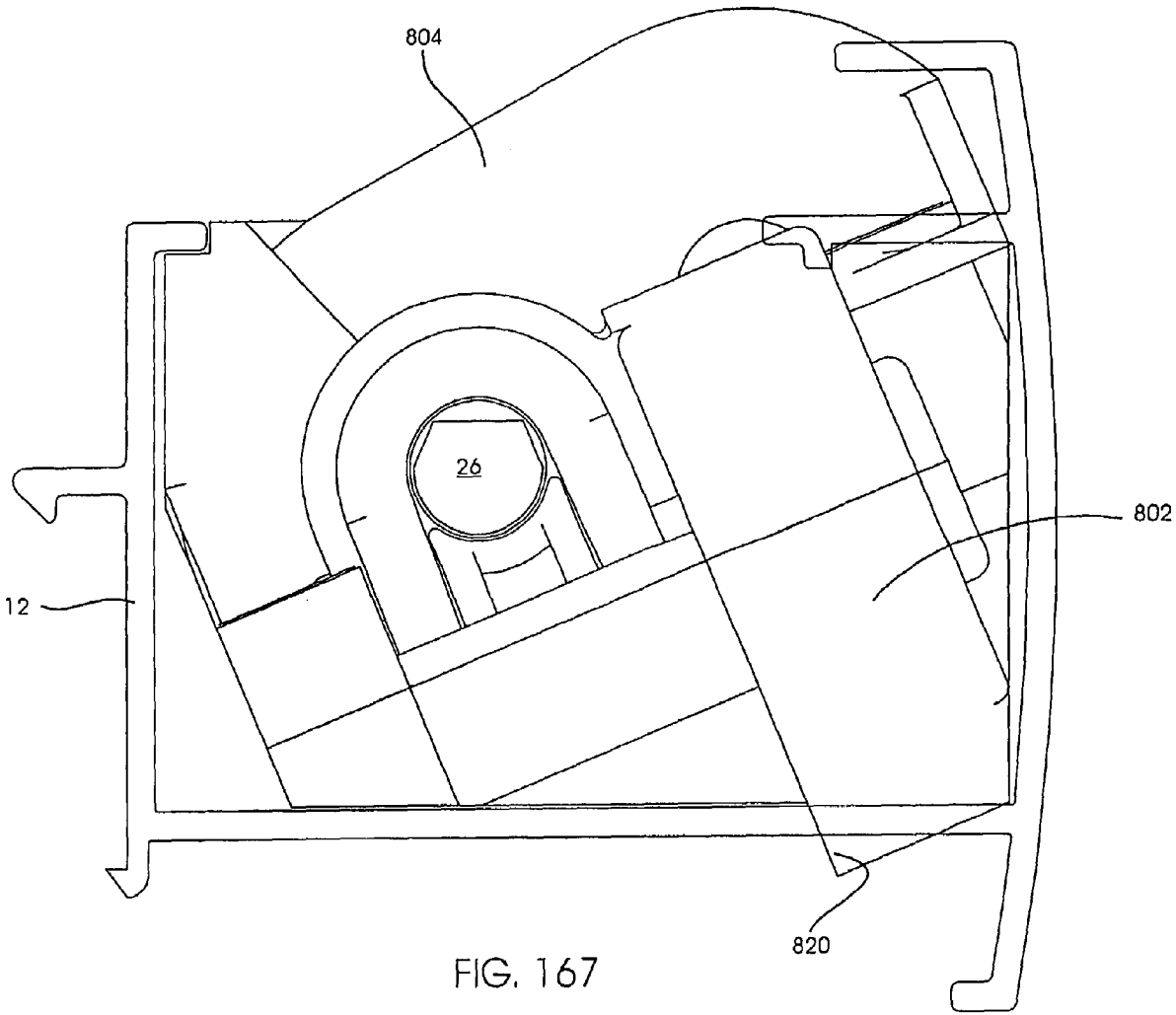
Figure 168:
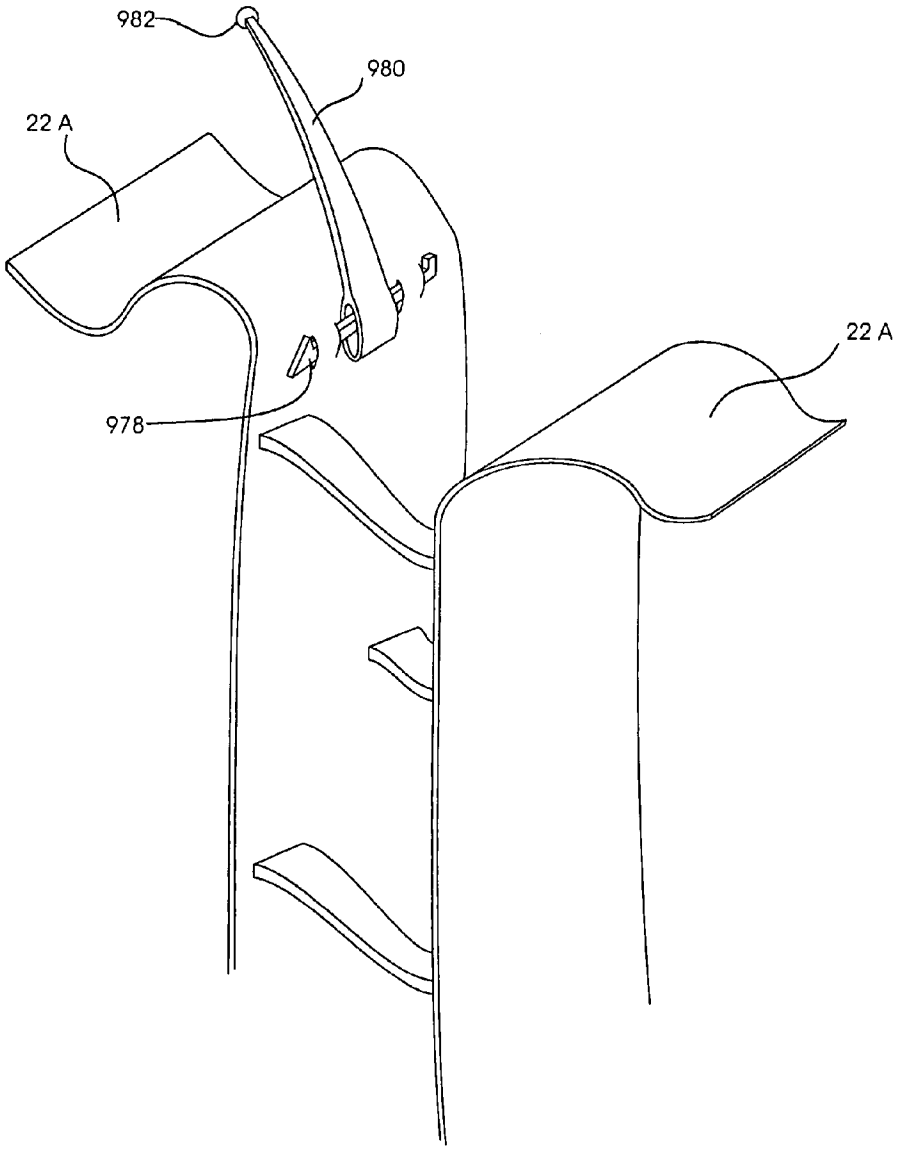
Figure 169:
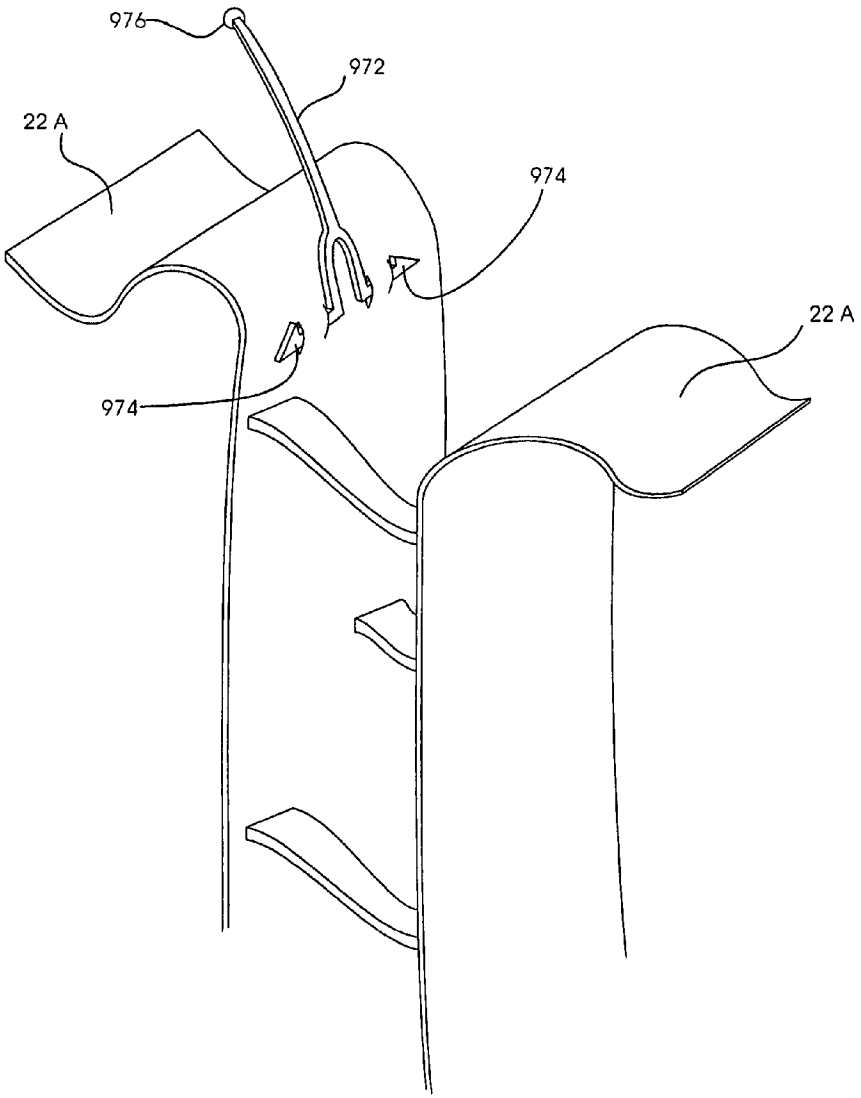
Figure 170:
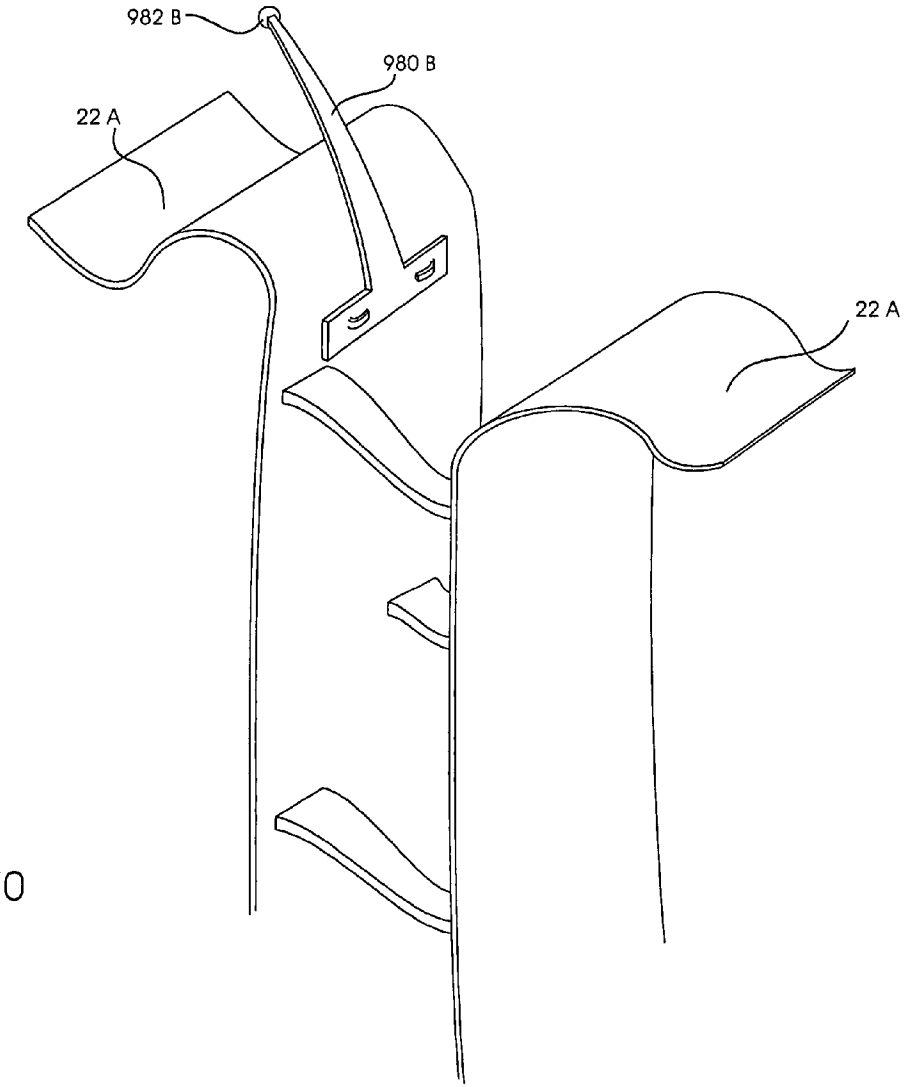
Figure 171:
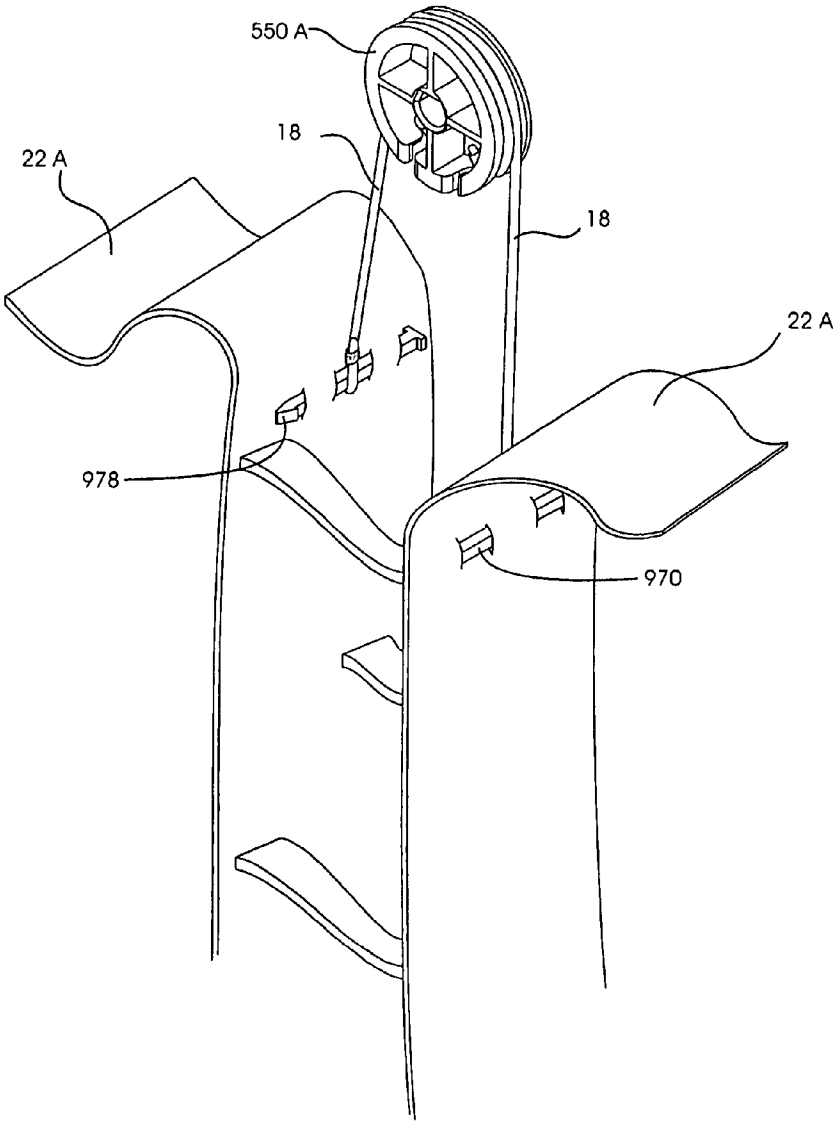
Figure 172:
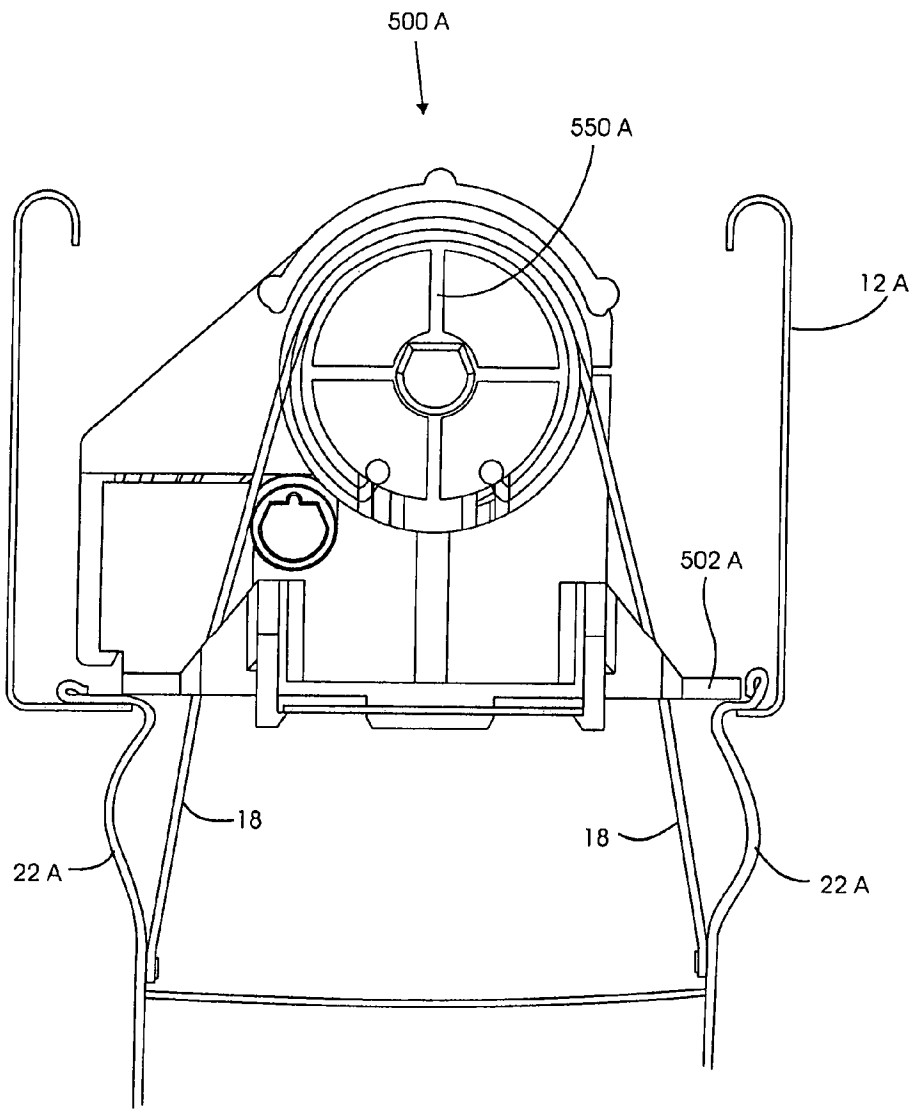
Figure 173:
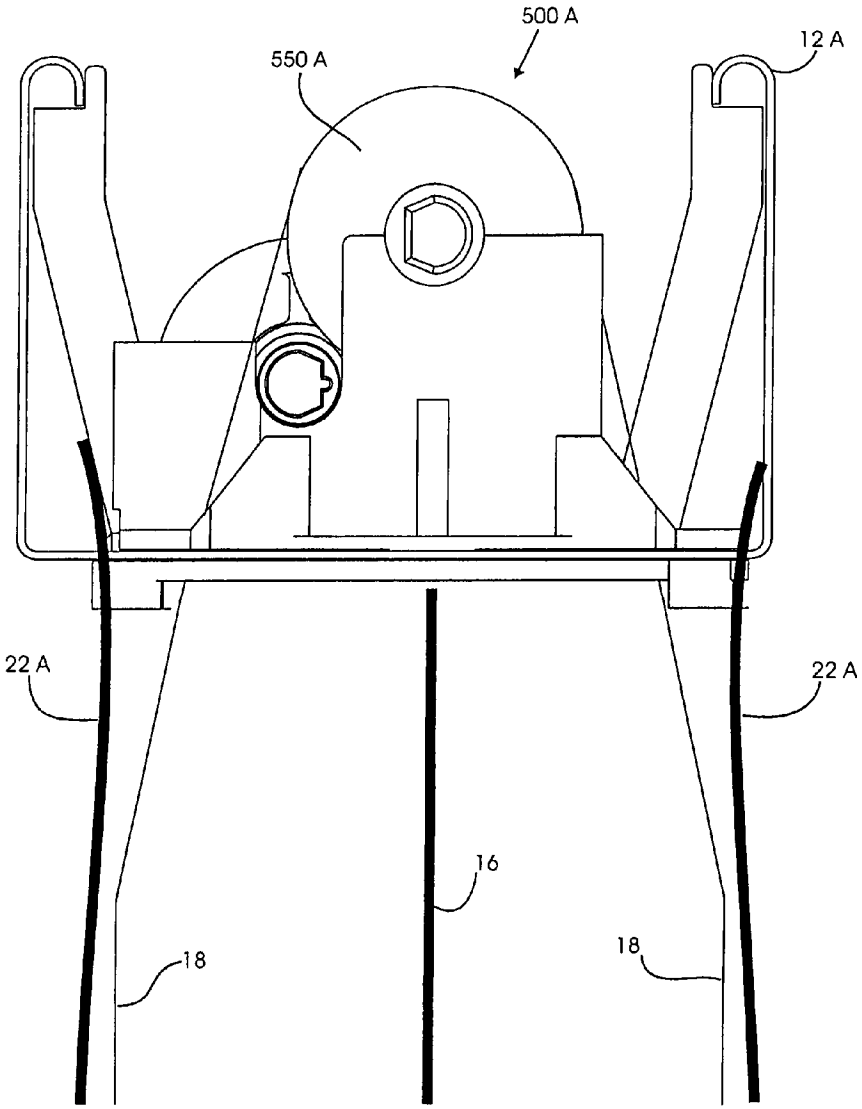
Figure 174:
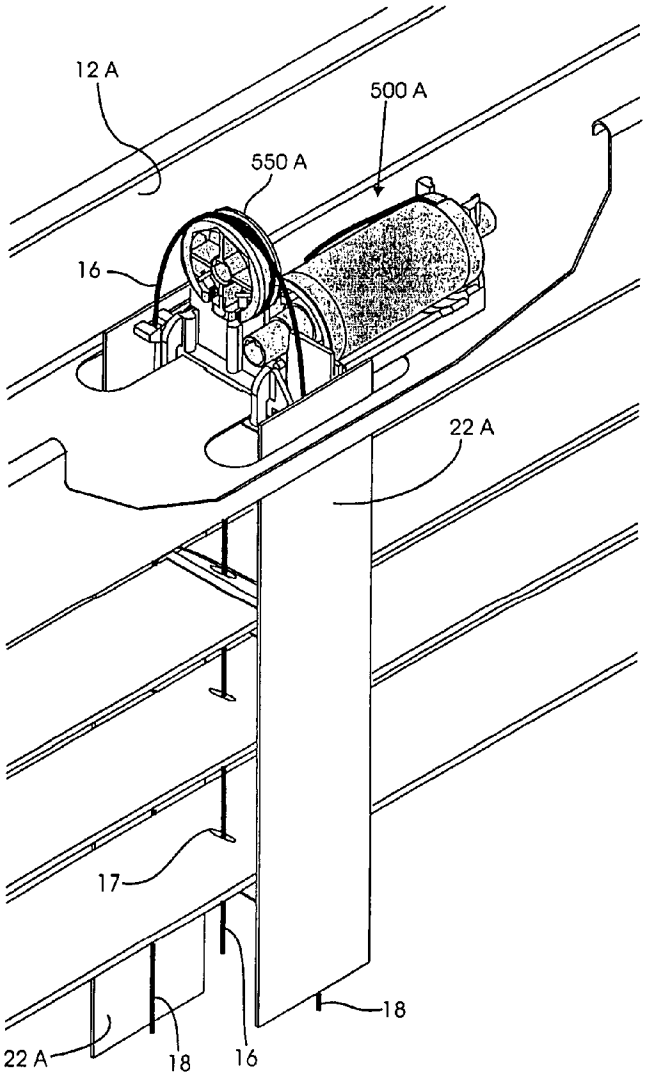
Figures 175, 176, 177, 178:
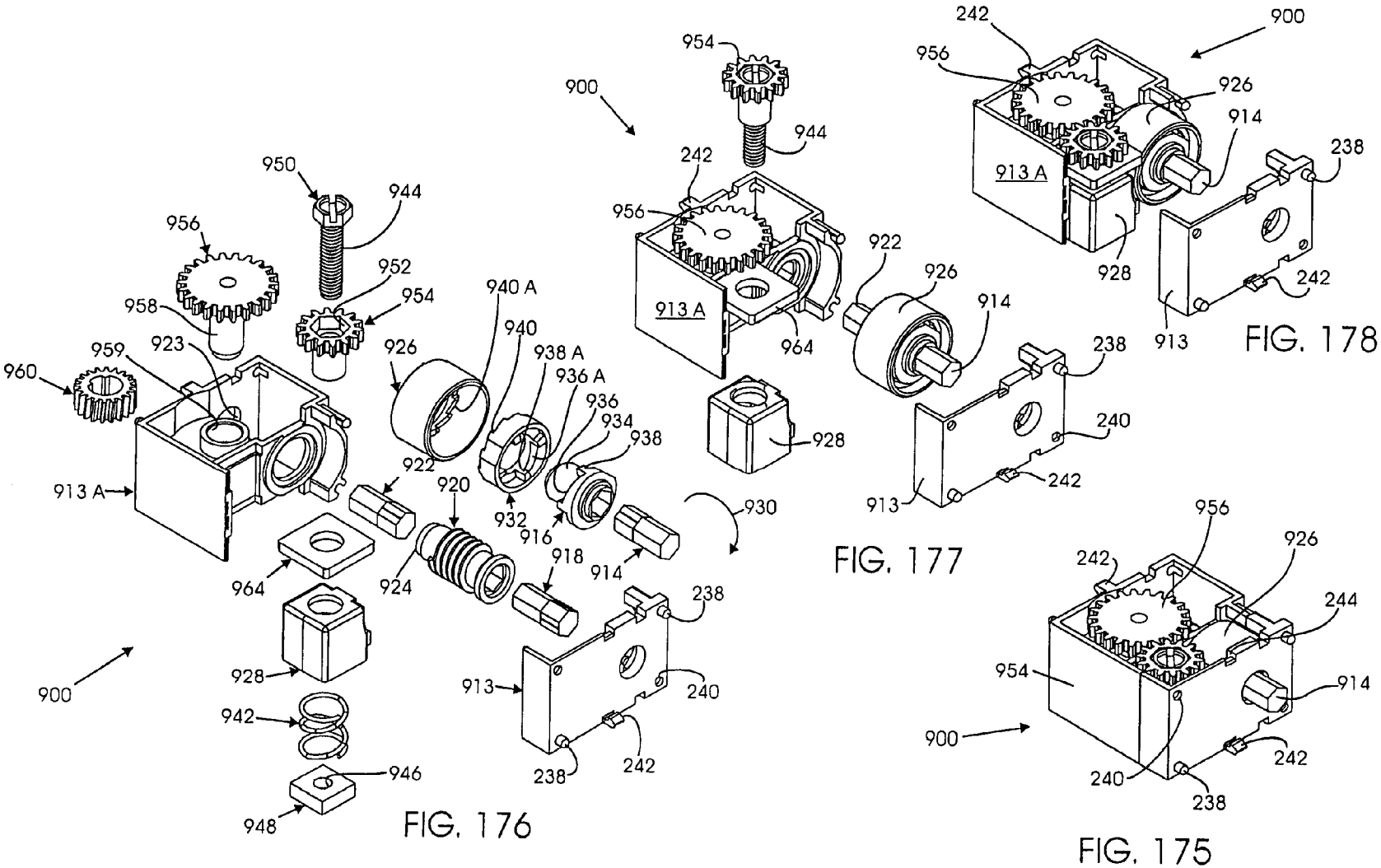
Figure 180:
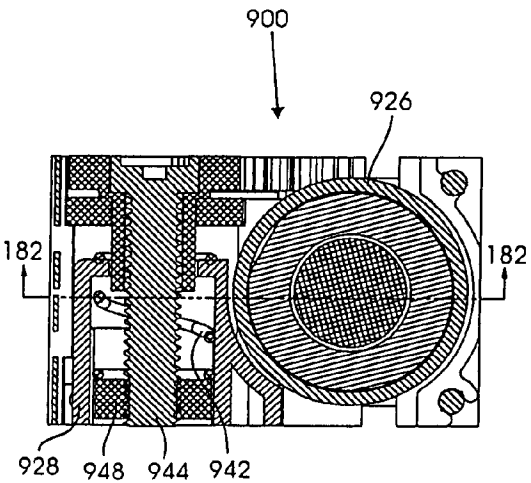
Figure 179:
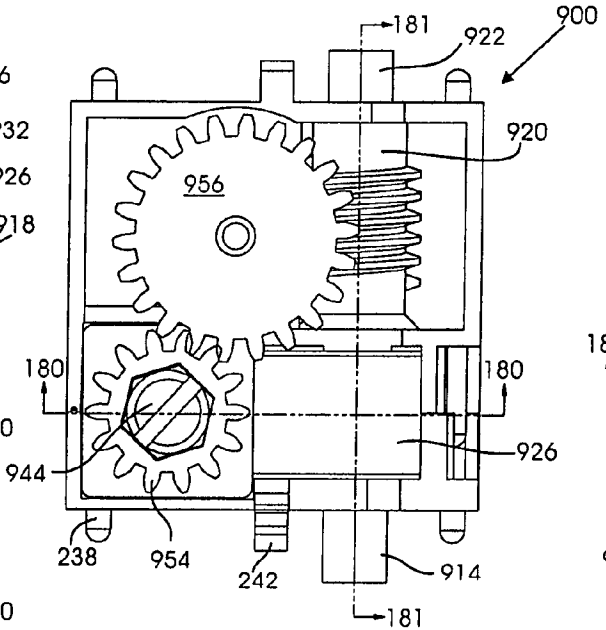
Figure 182:
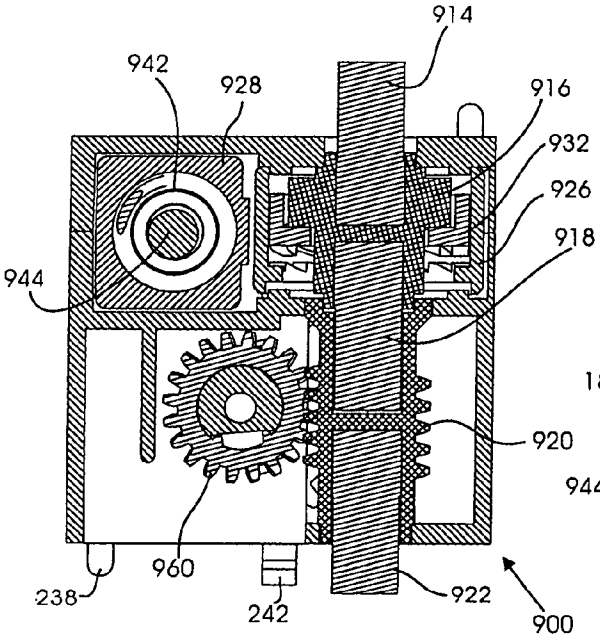
Figure 181:
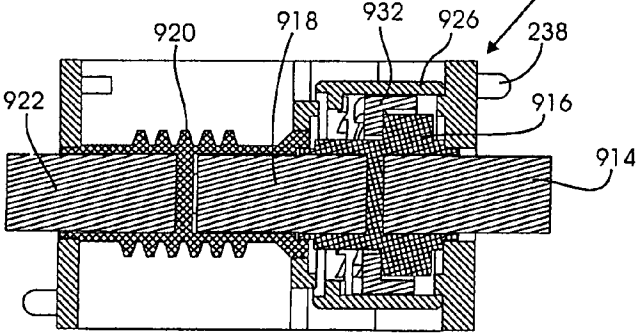
Figures 183A, 183B, 183C, 184:
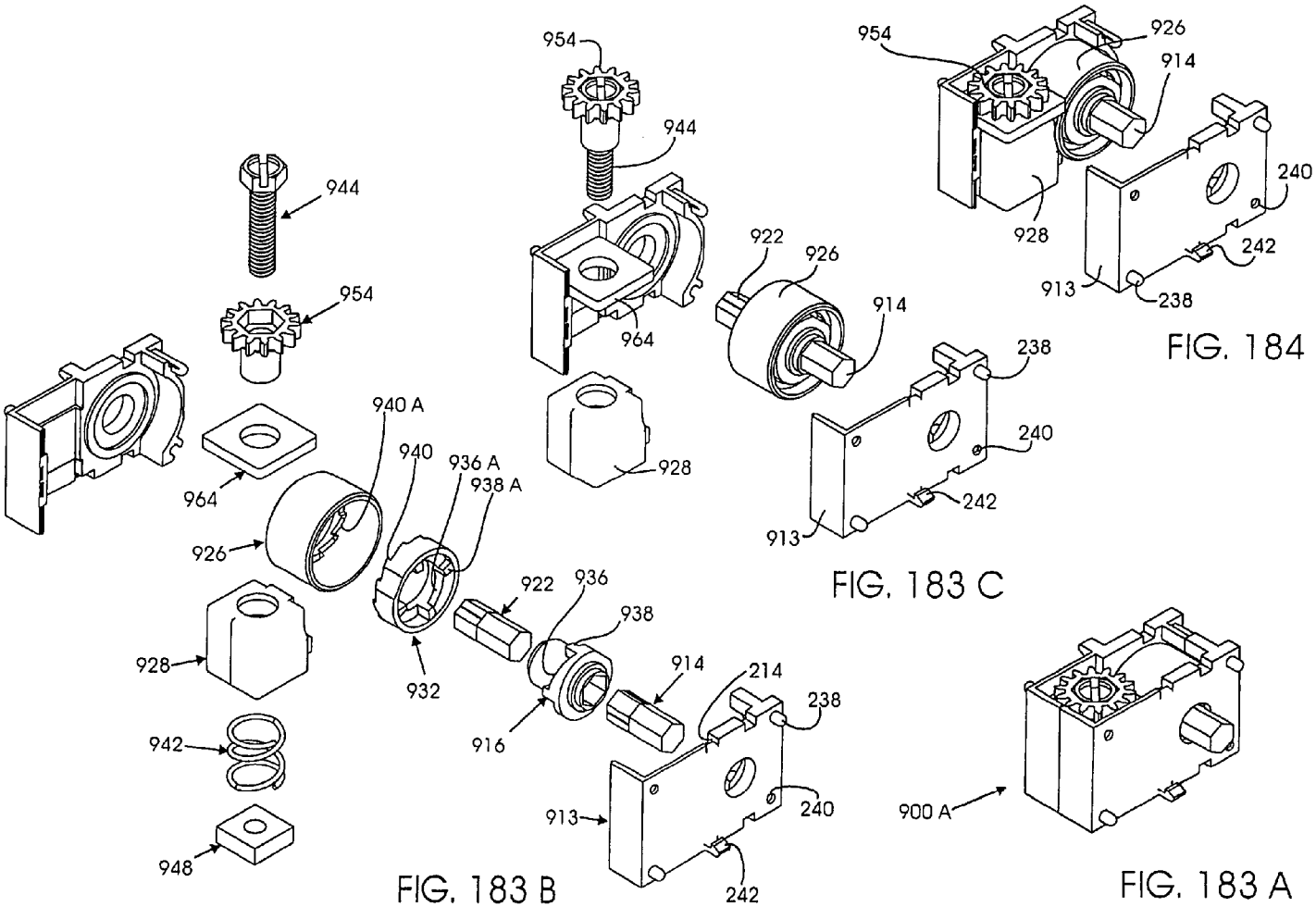
Figure 186:
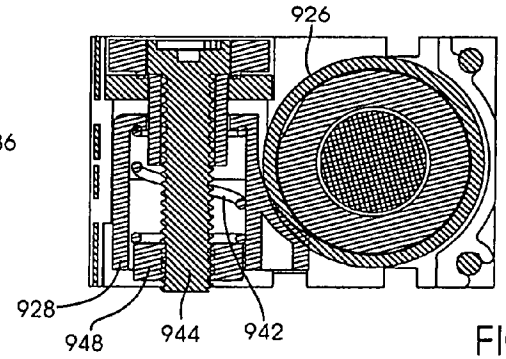
Figure 185:
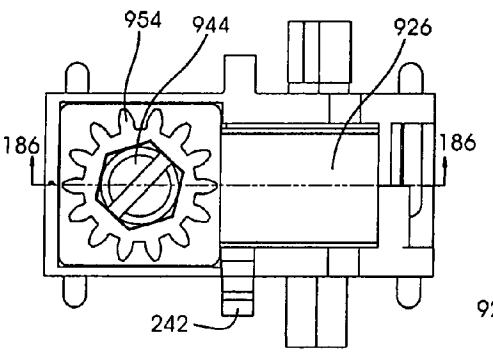
Figure 190:
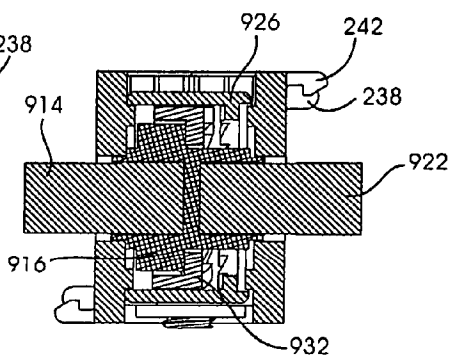
Figure 187:
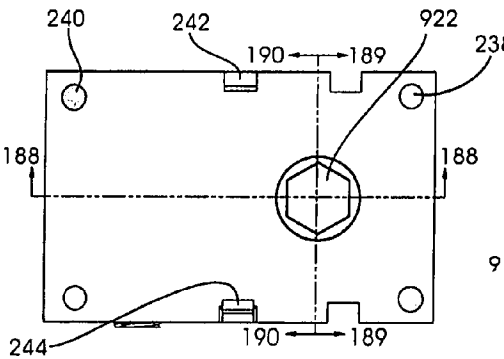
Figure 188:
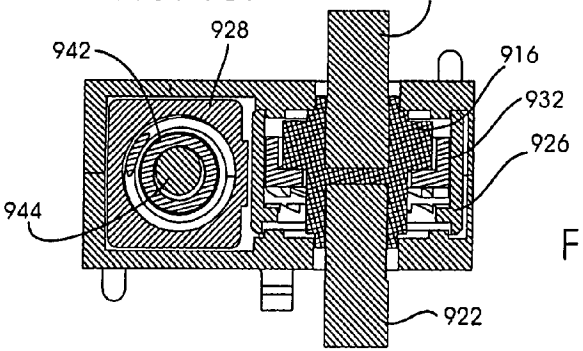
Figure 189:
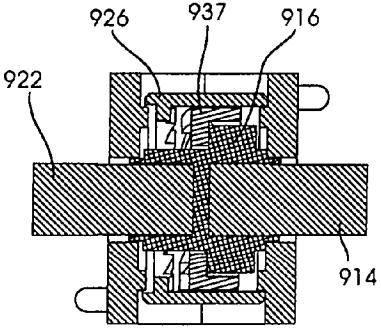
Figure 192:
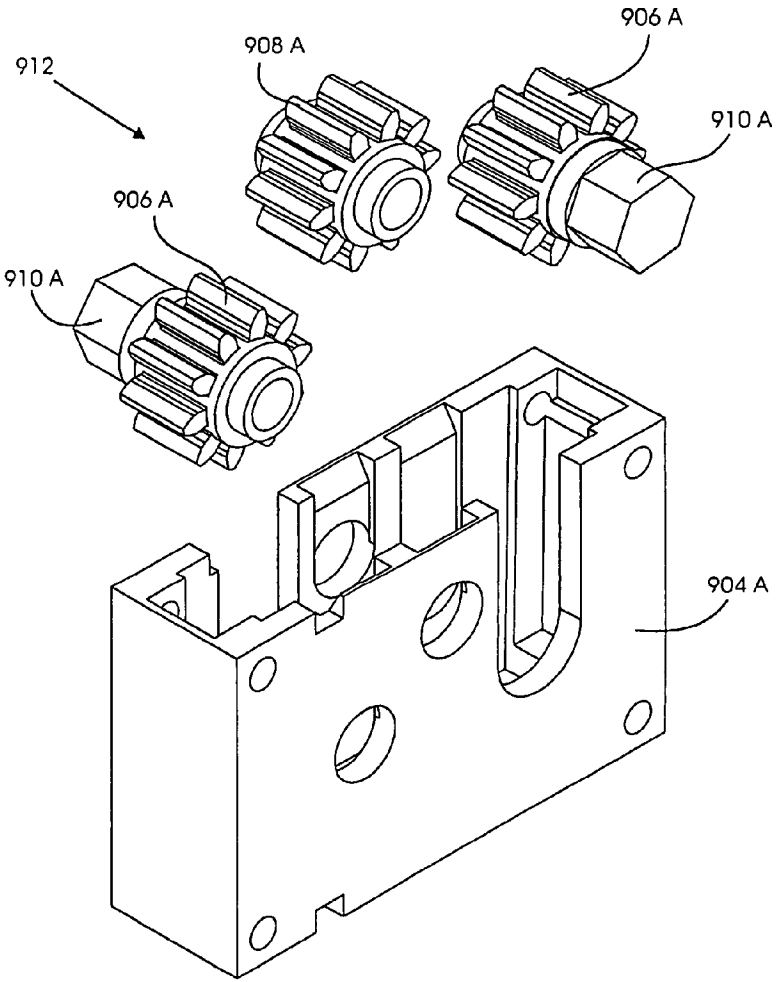
Figure 191:
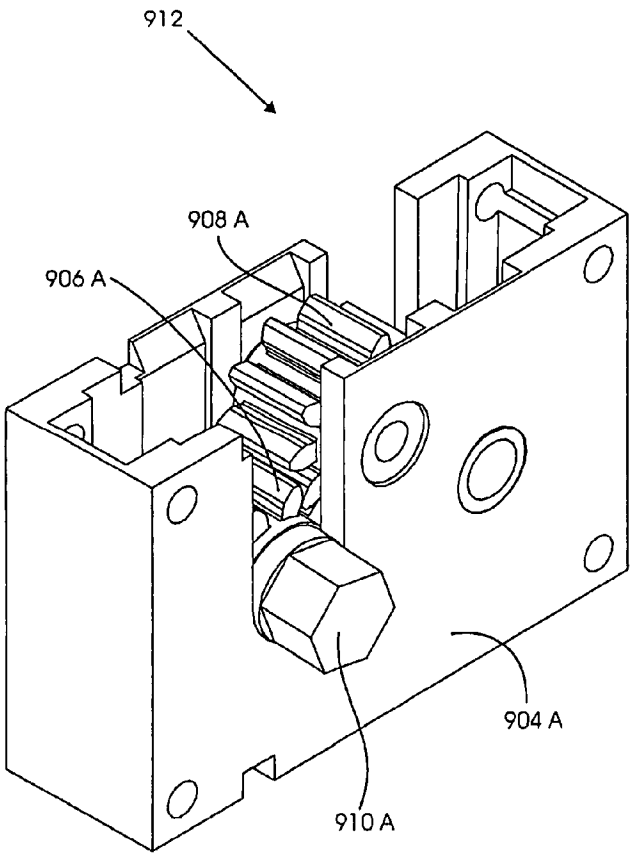
Figure 194:
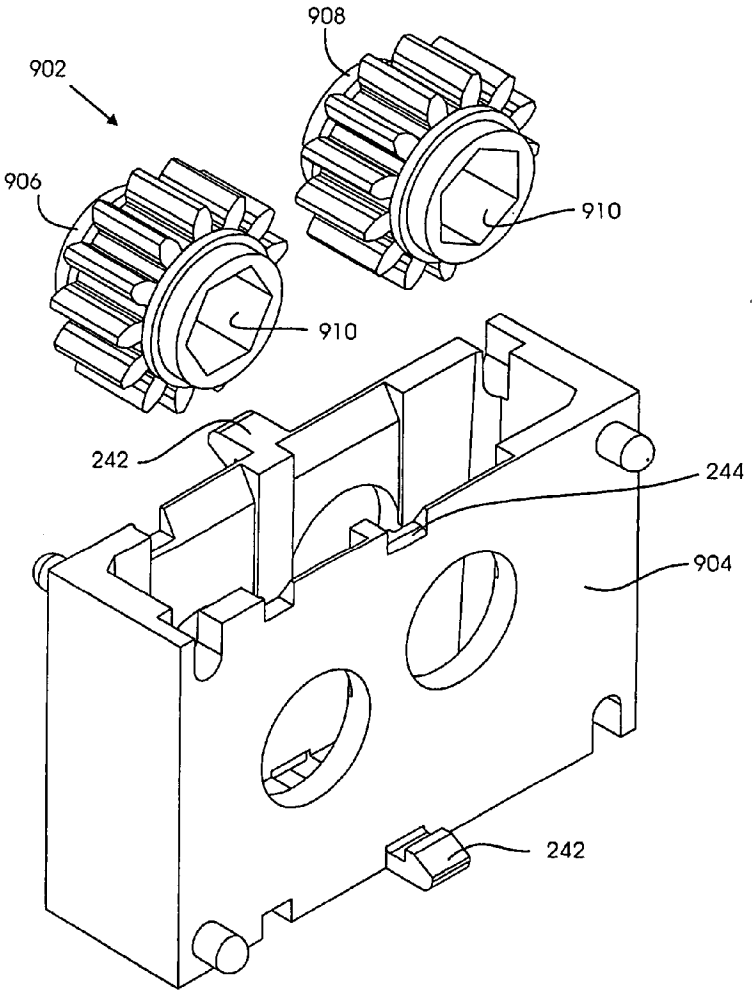
Figure 193:
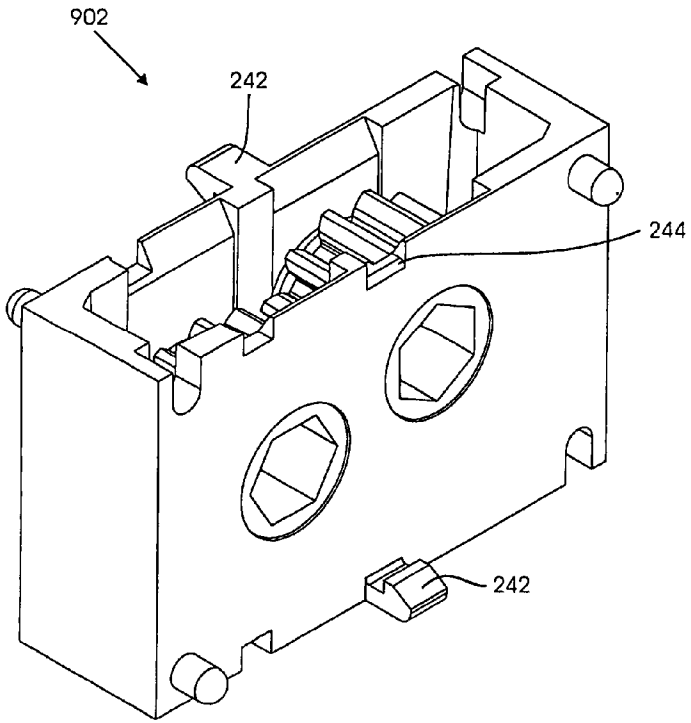
Figure 195:
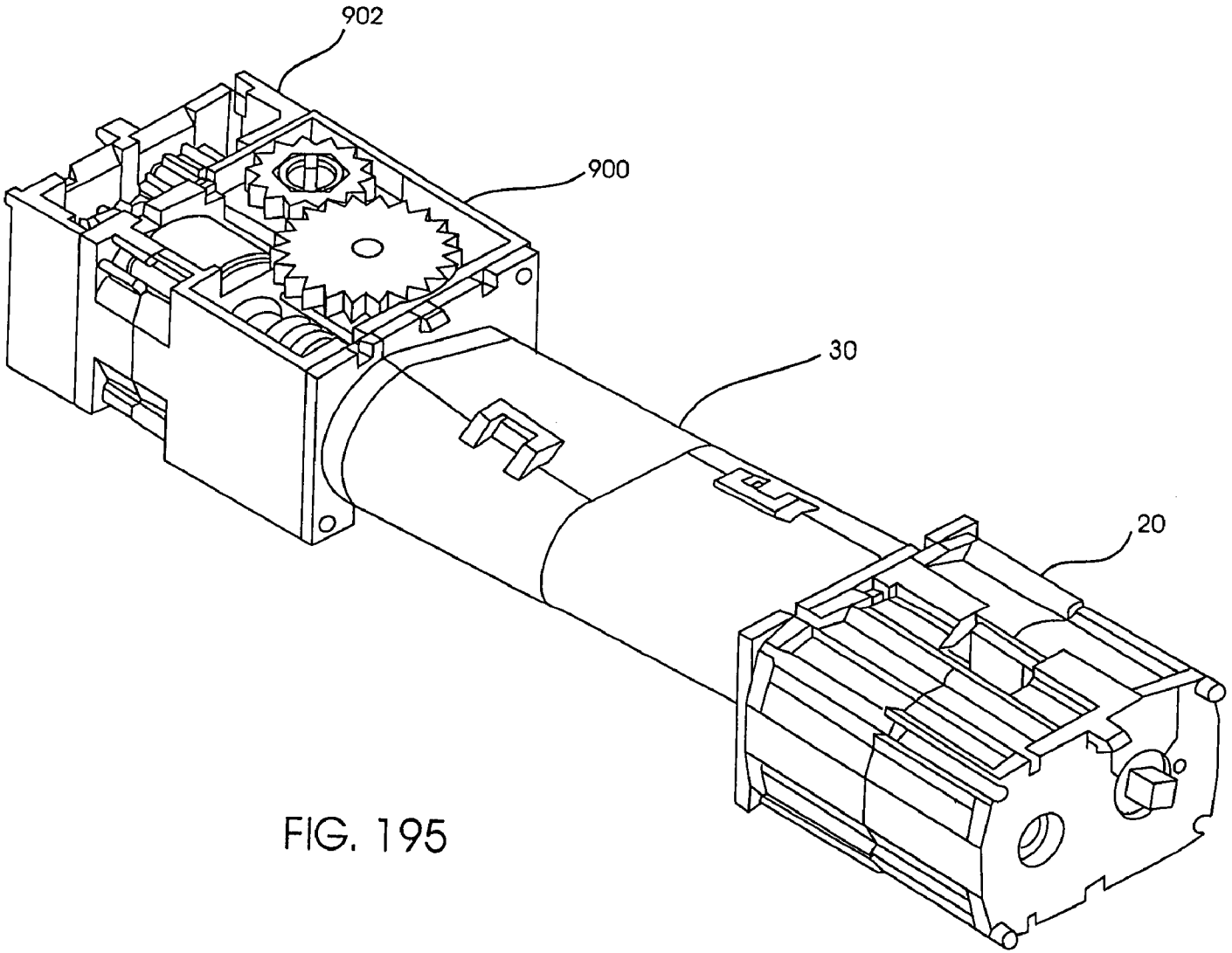
Figure 196:
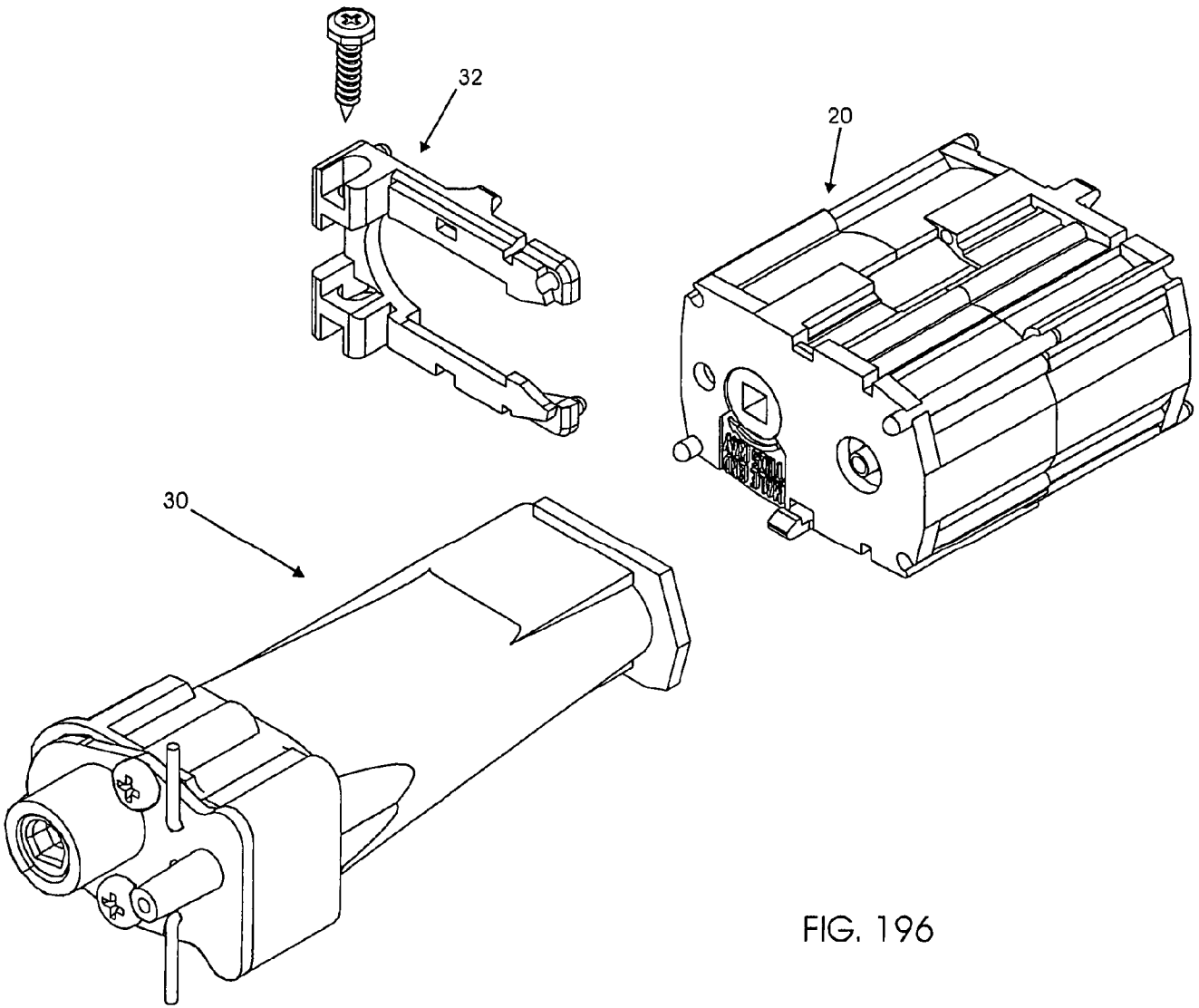
Figure 197:
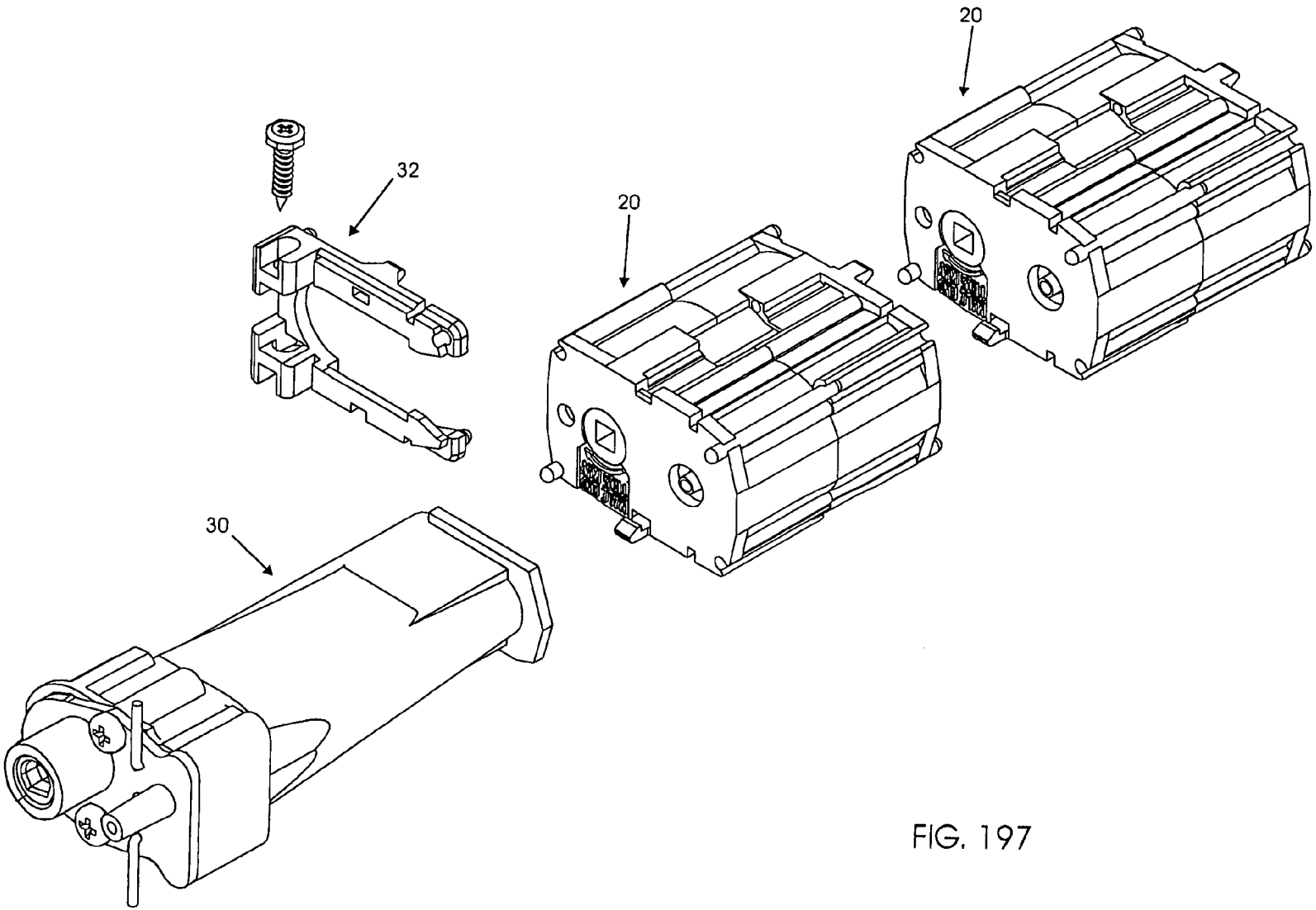
Figure 198:
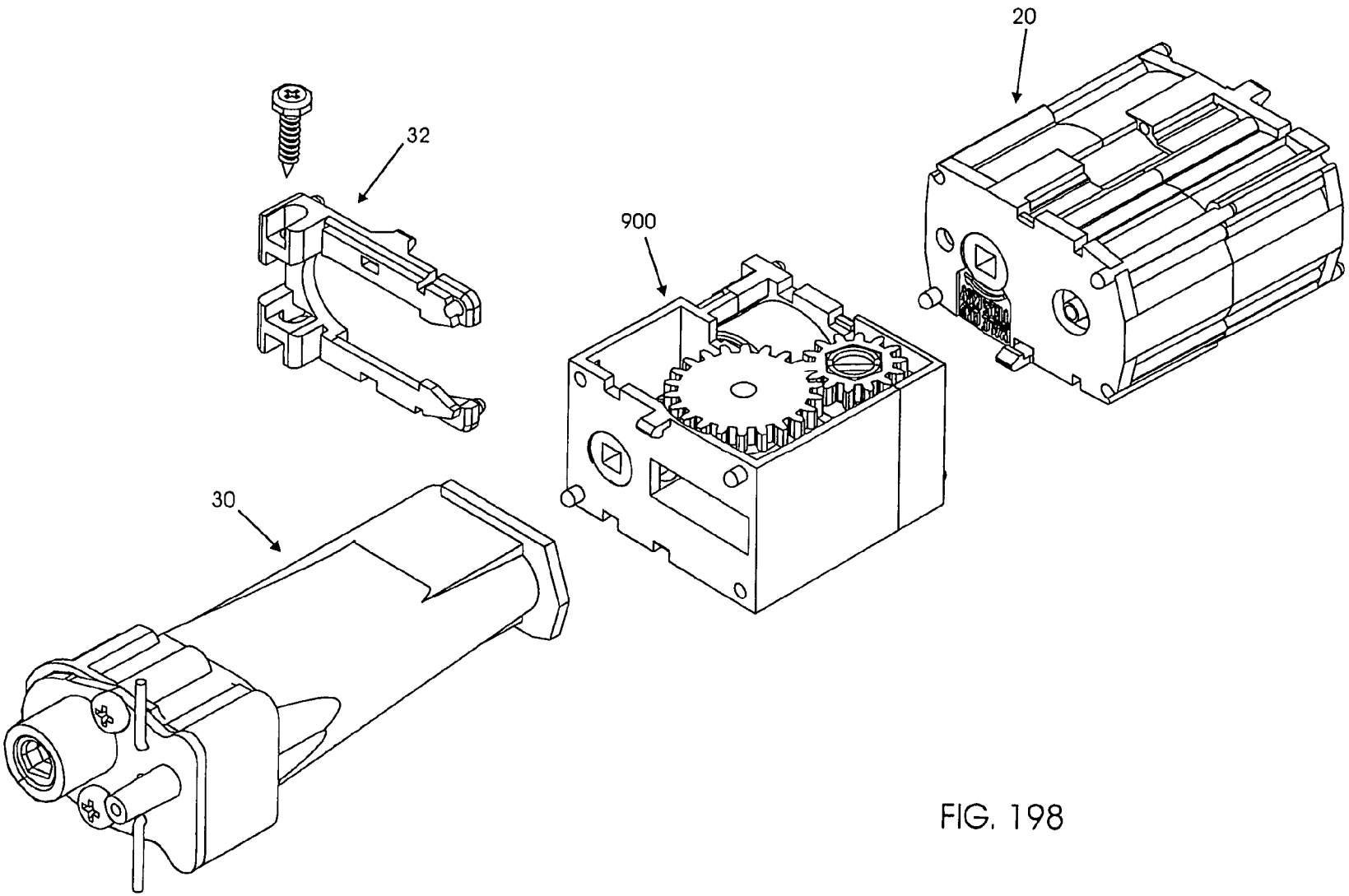
Figure 199:
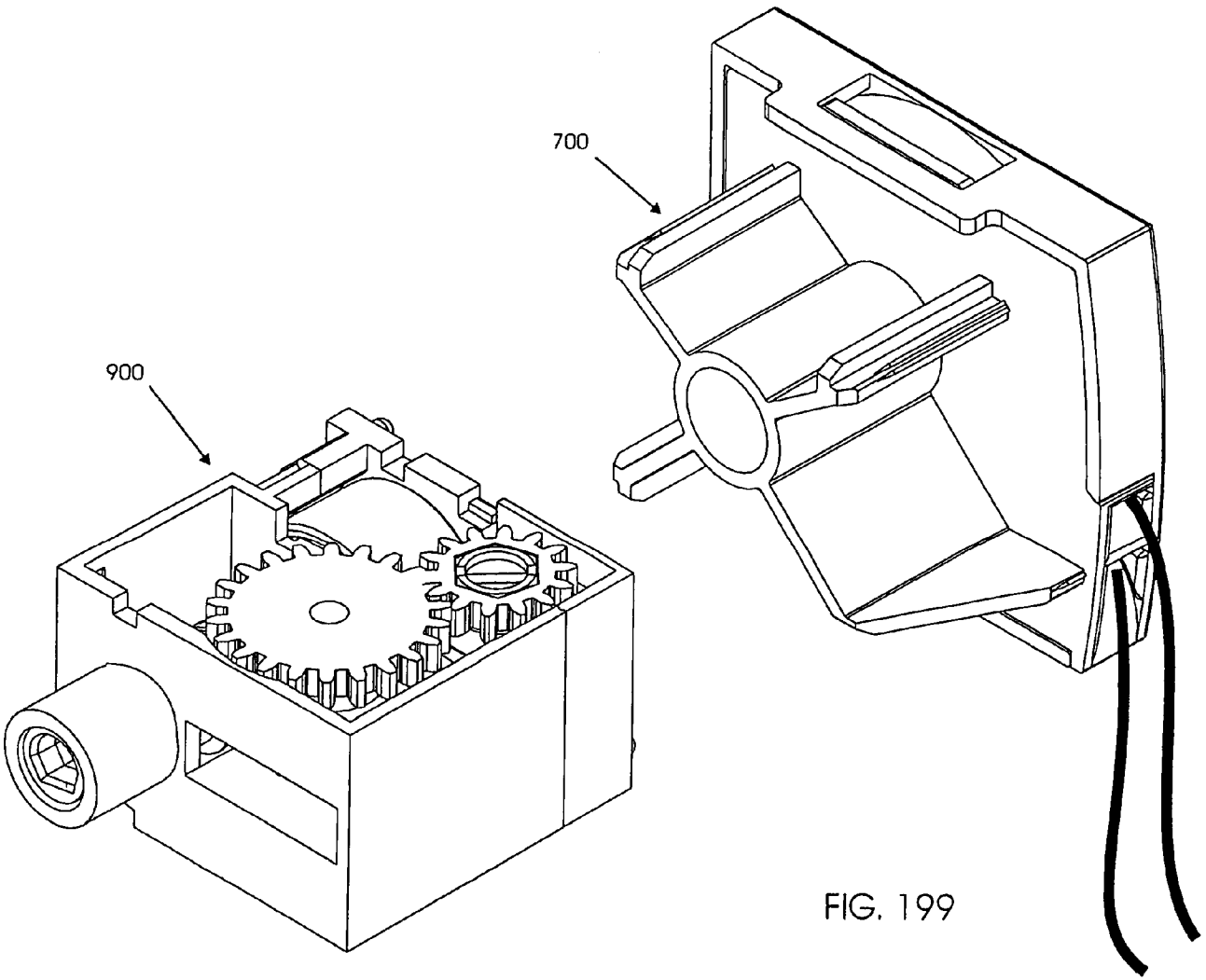
Figure 200:
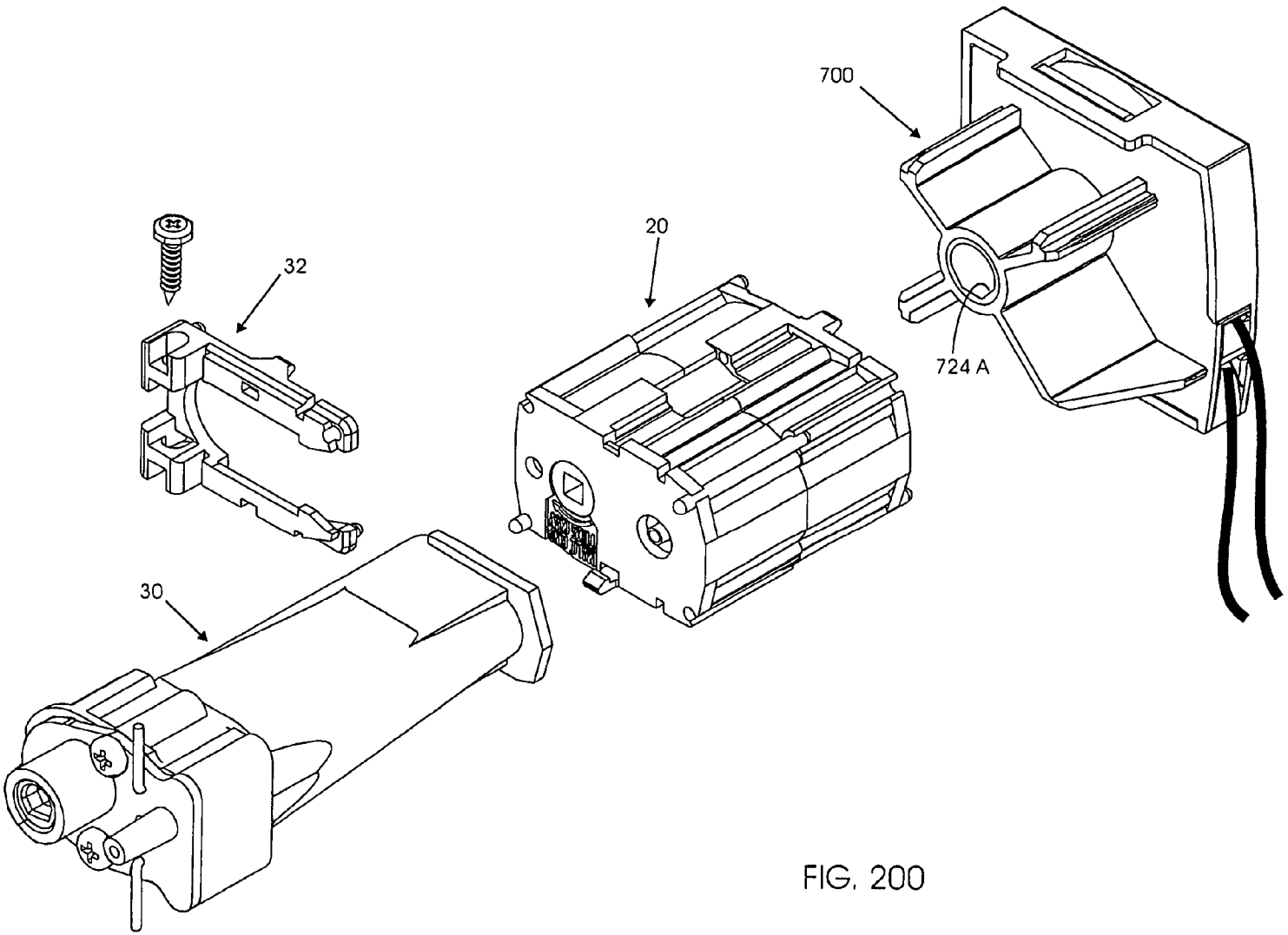
Figure 200A:
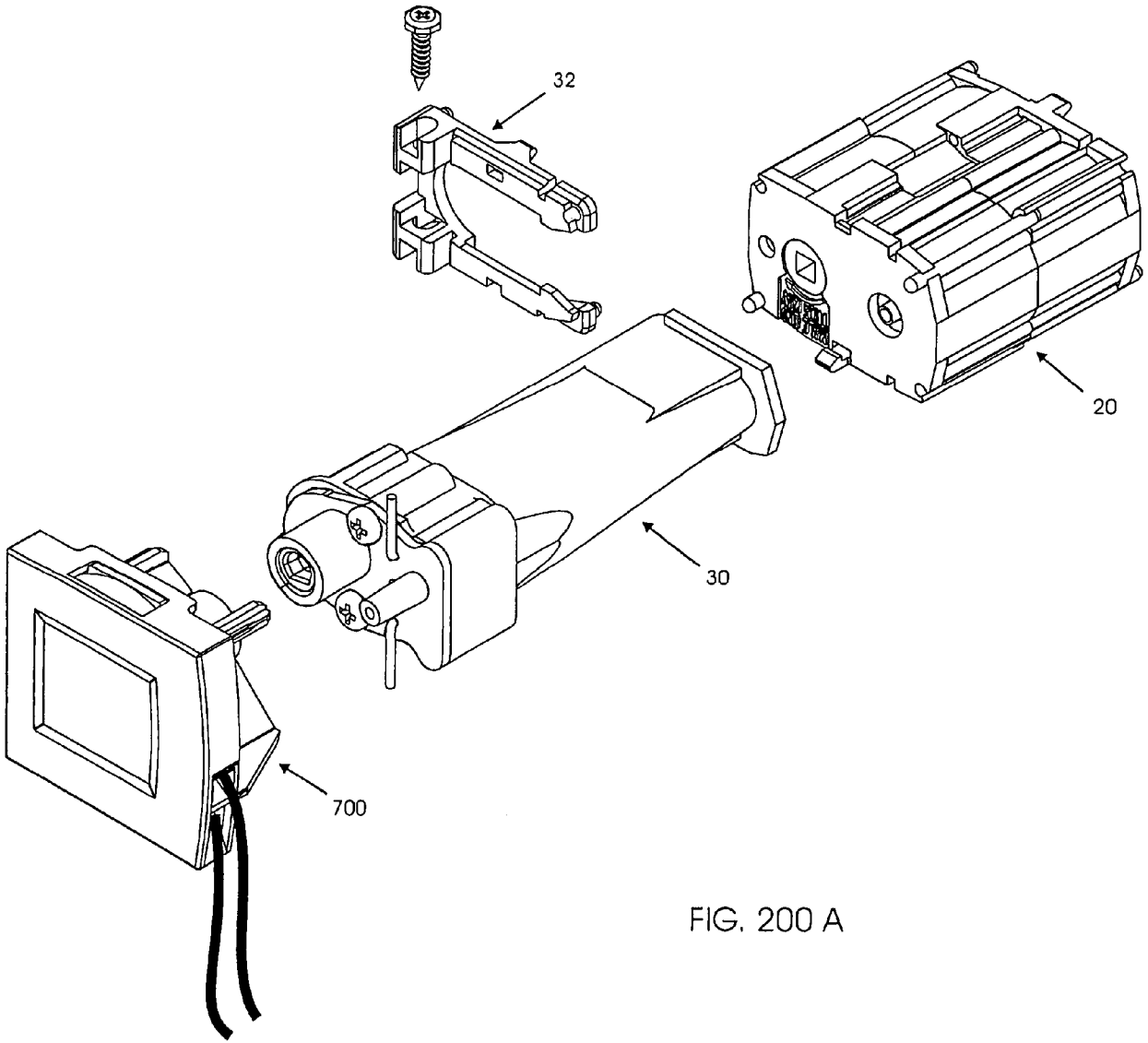
Figure 201:
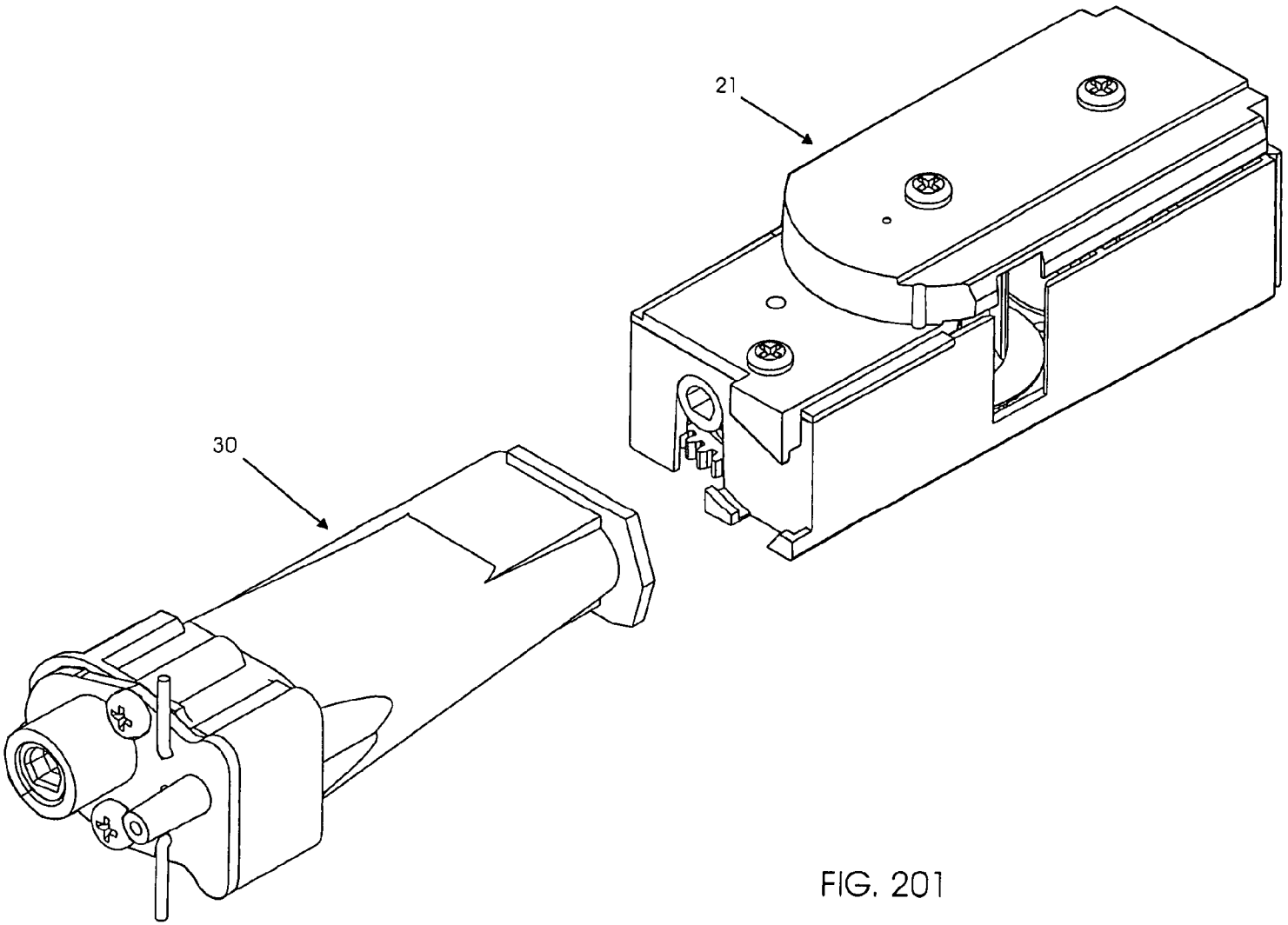
Figure 202:
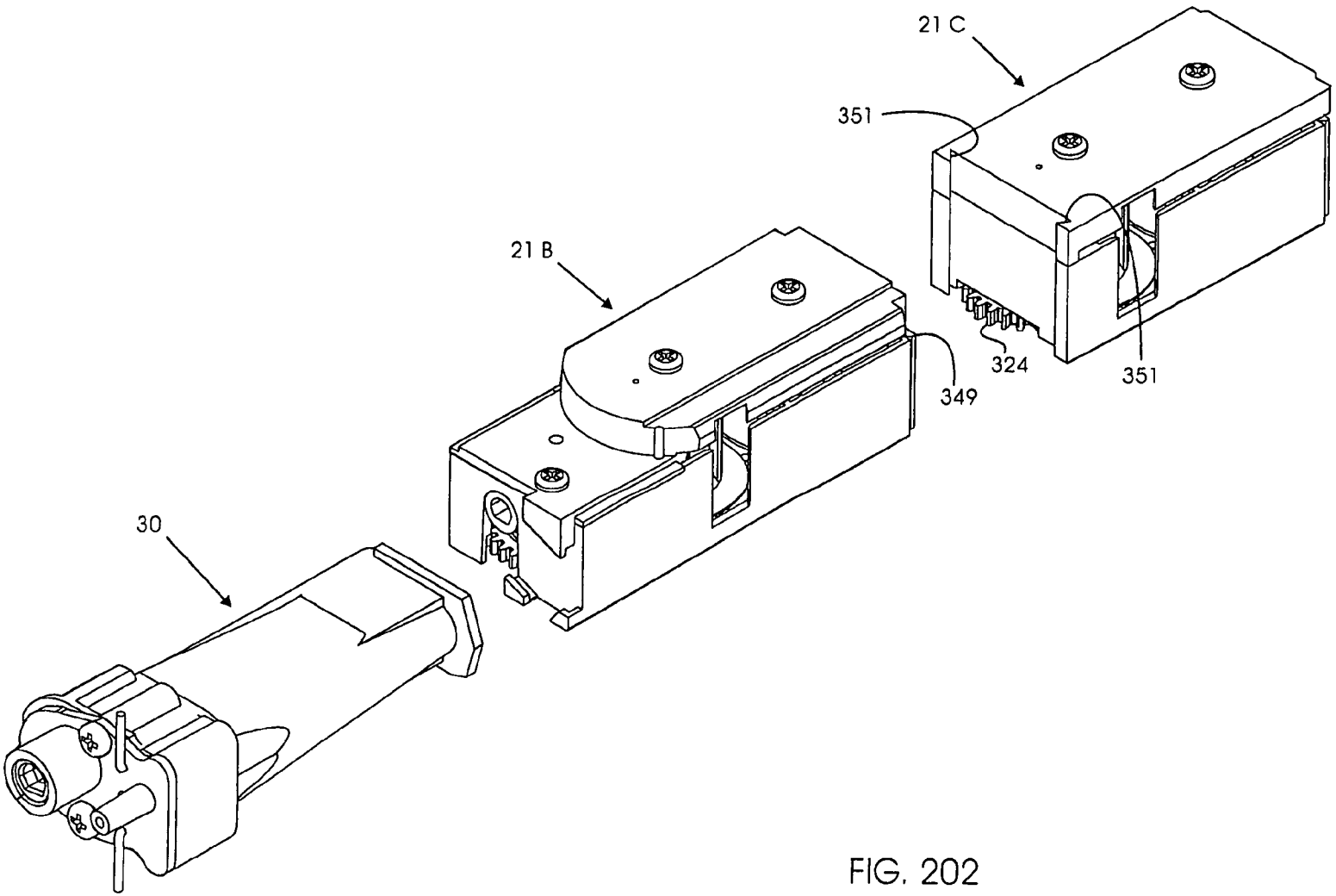
Figure 203:
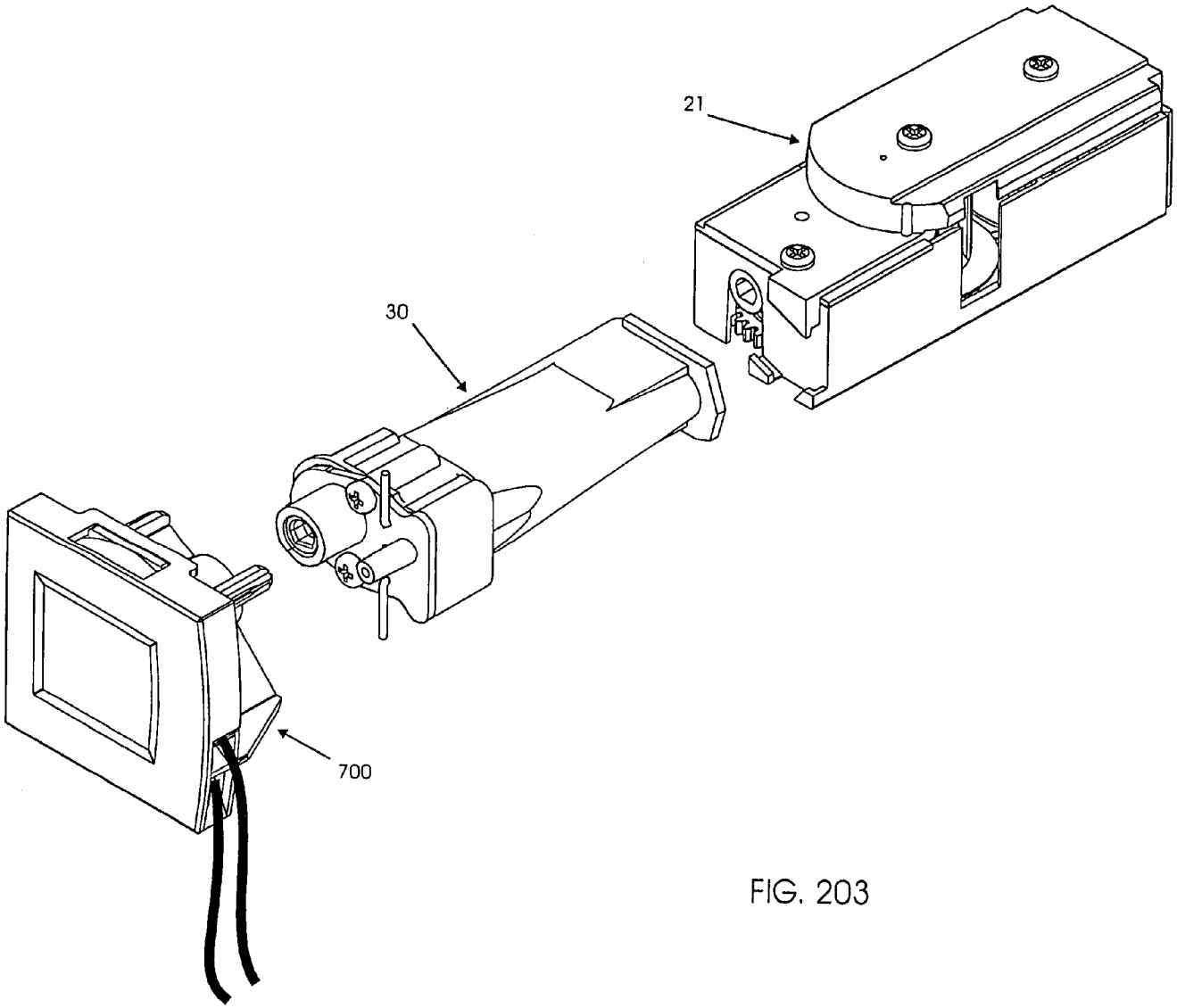
Figure 204:
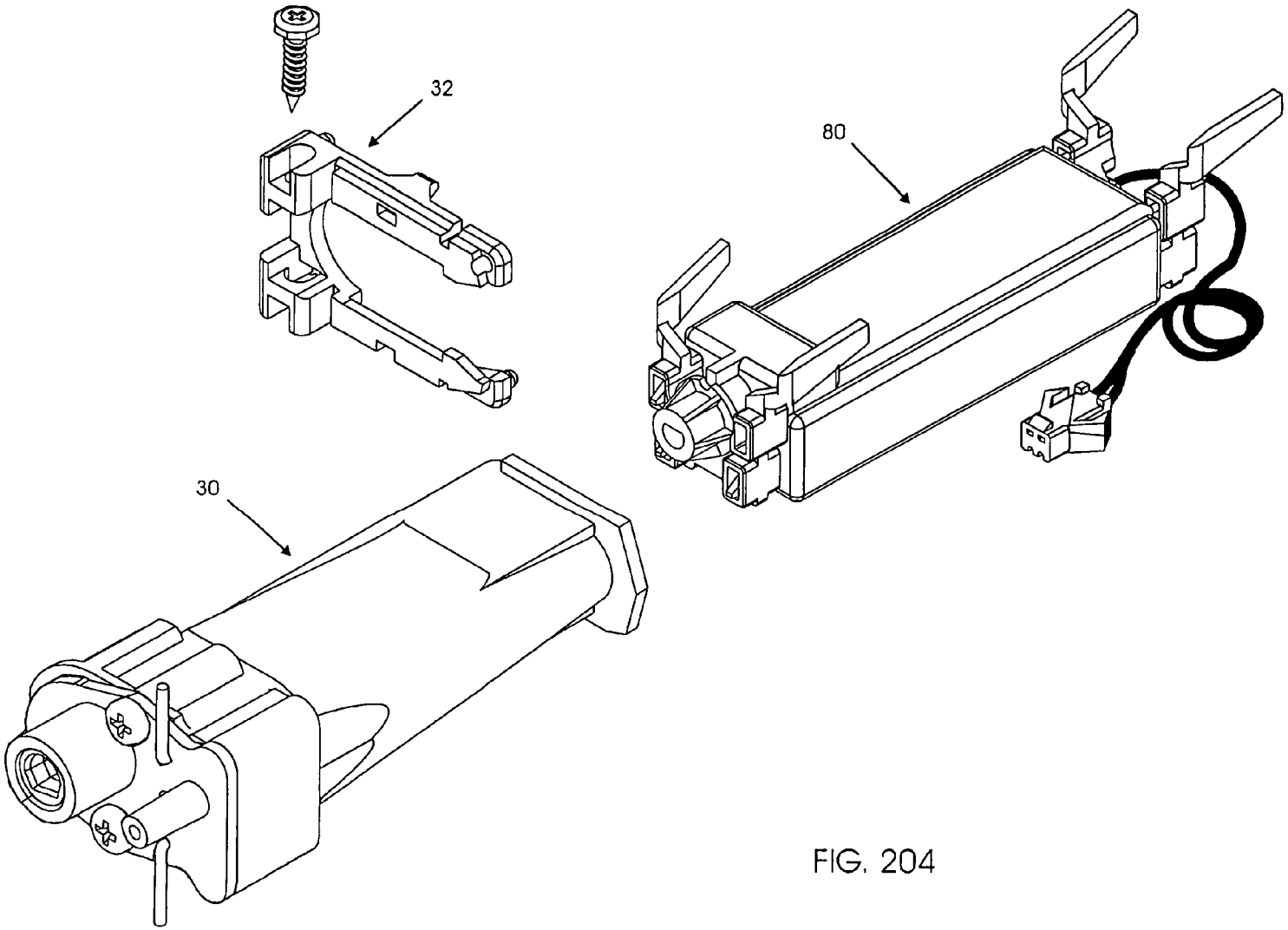
Figure 205:
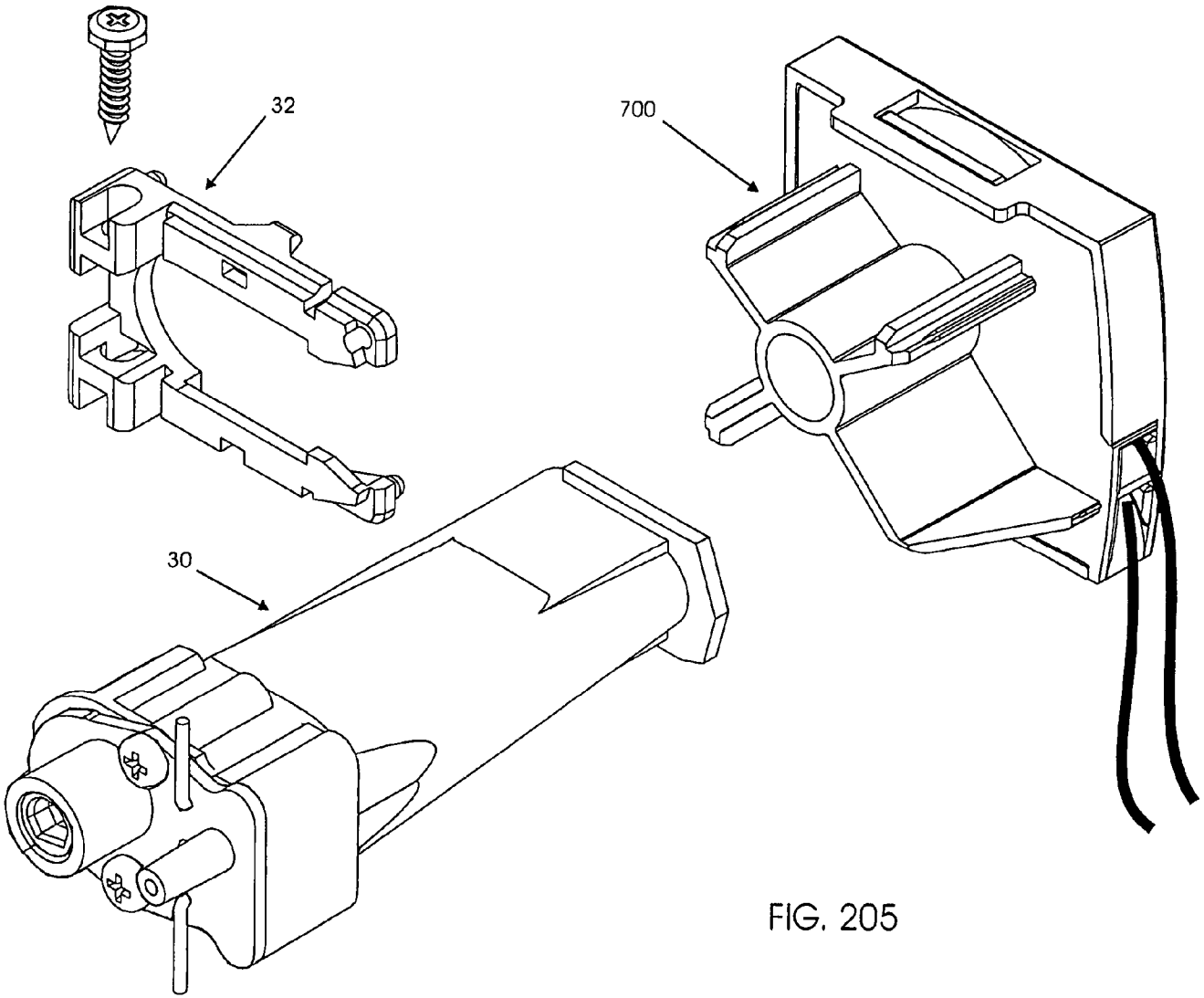
Figure 206:
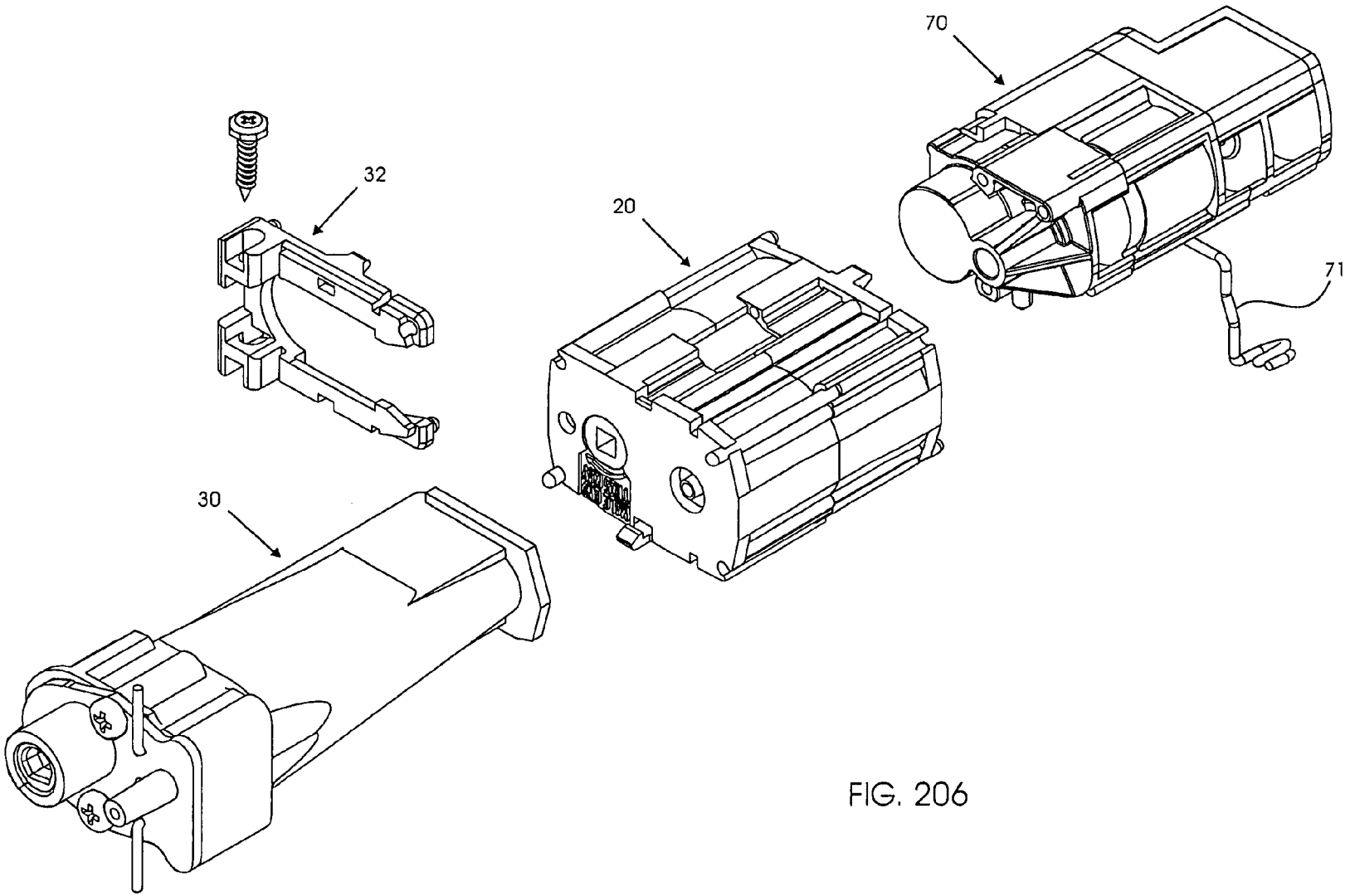
Figure 207:
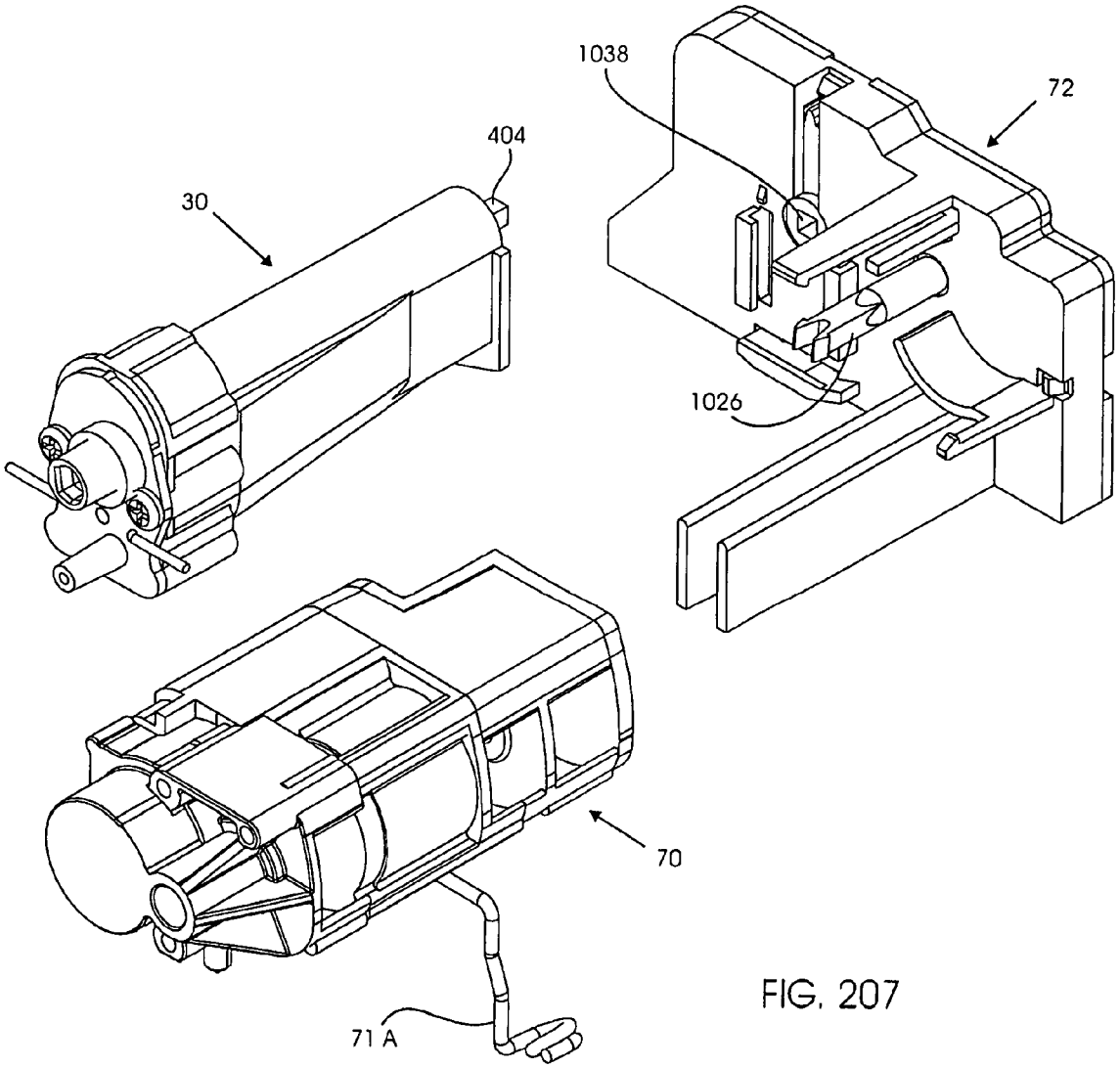
Figure 208:
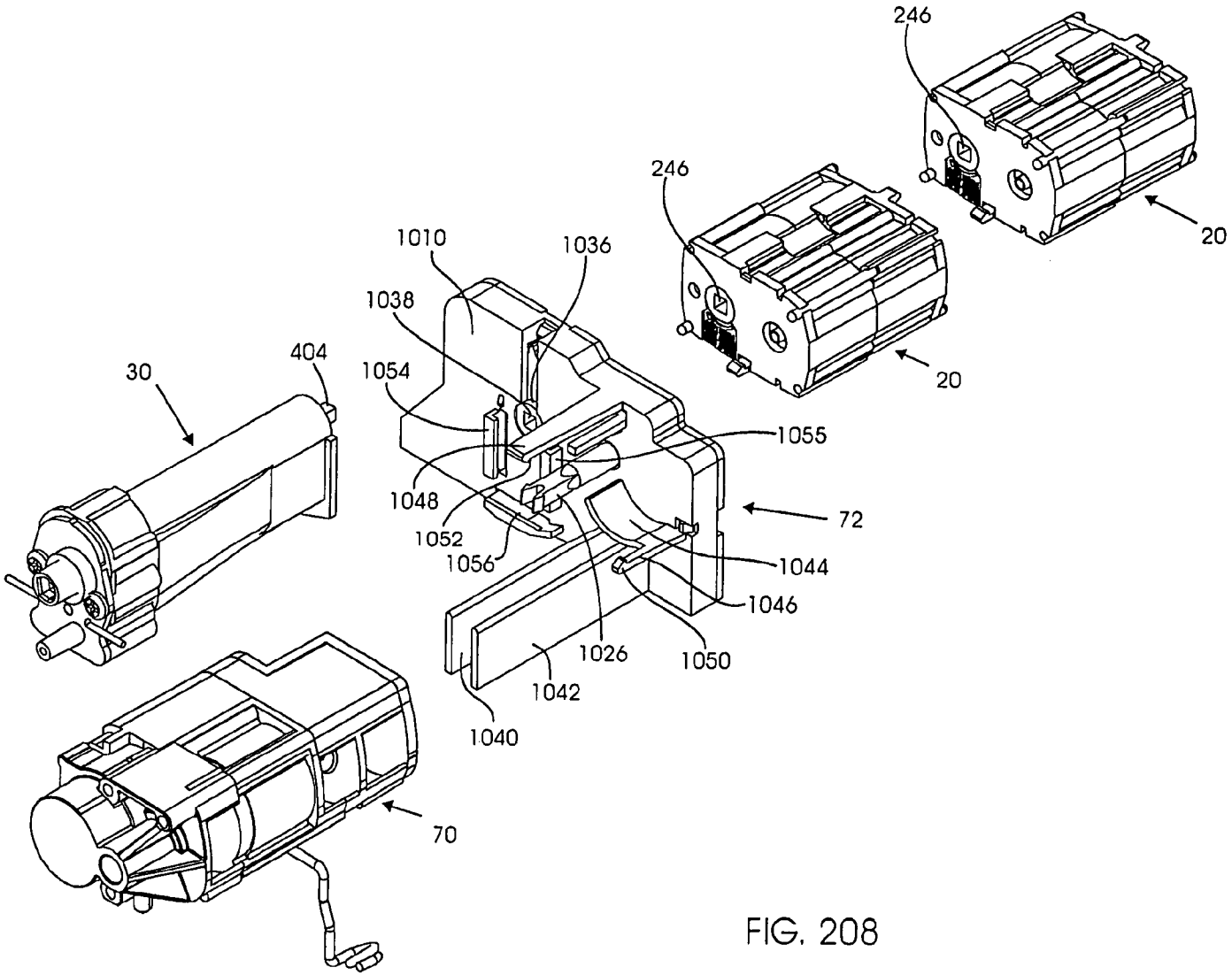
Figure 208A:
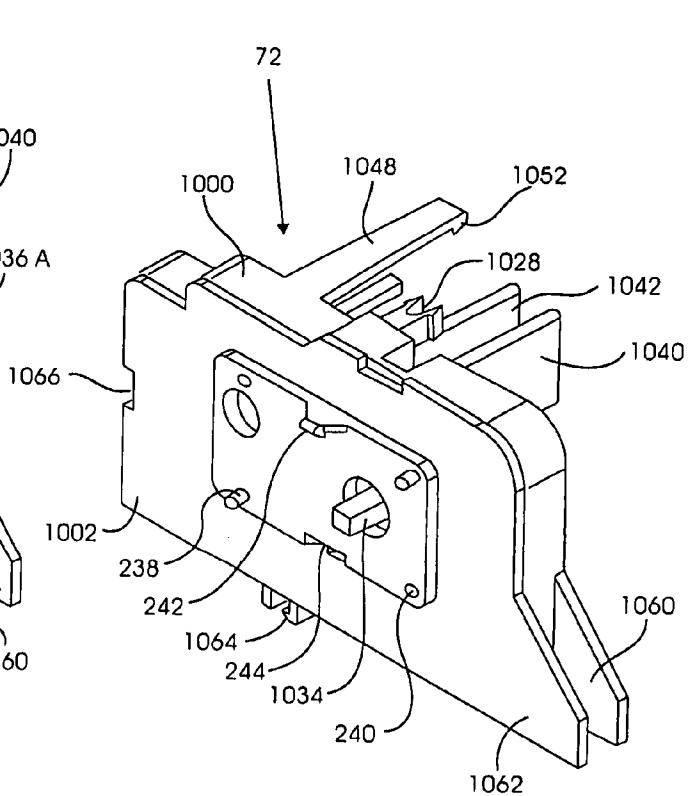
Figure 208B:
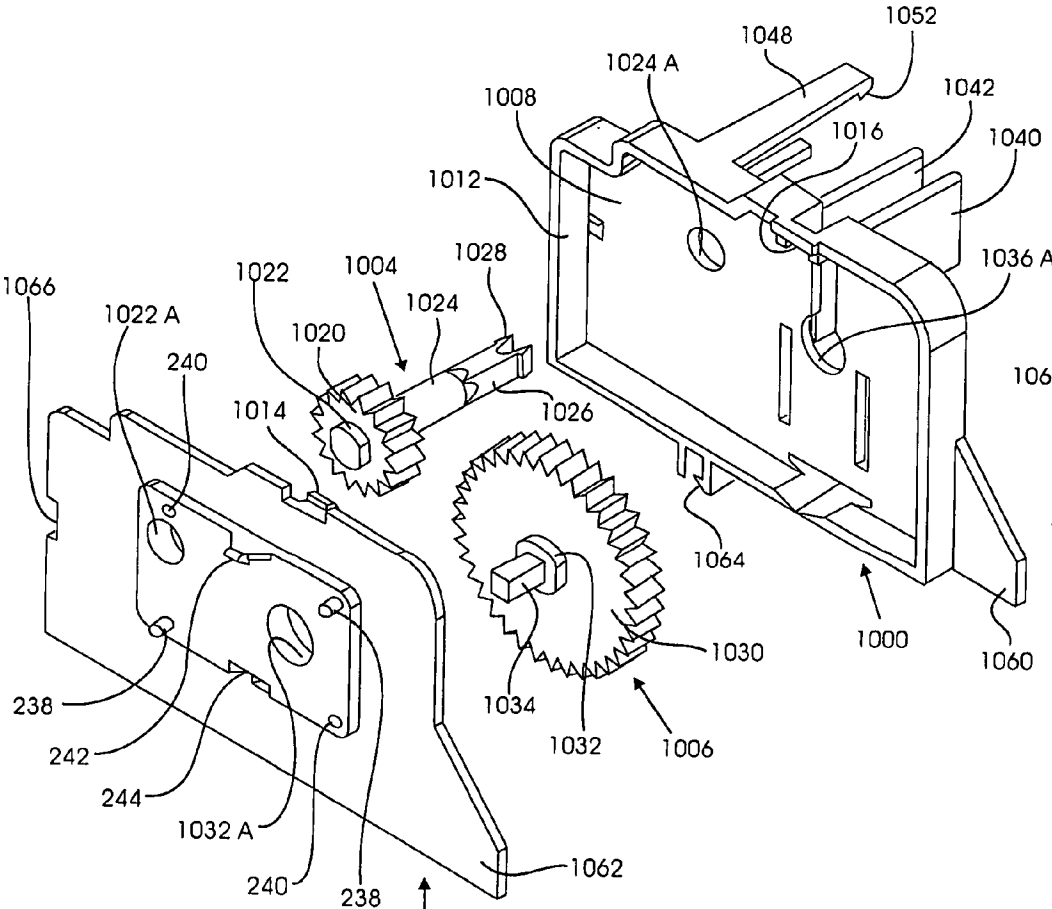
Figure 209:
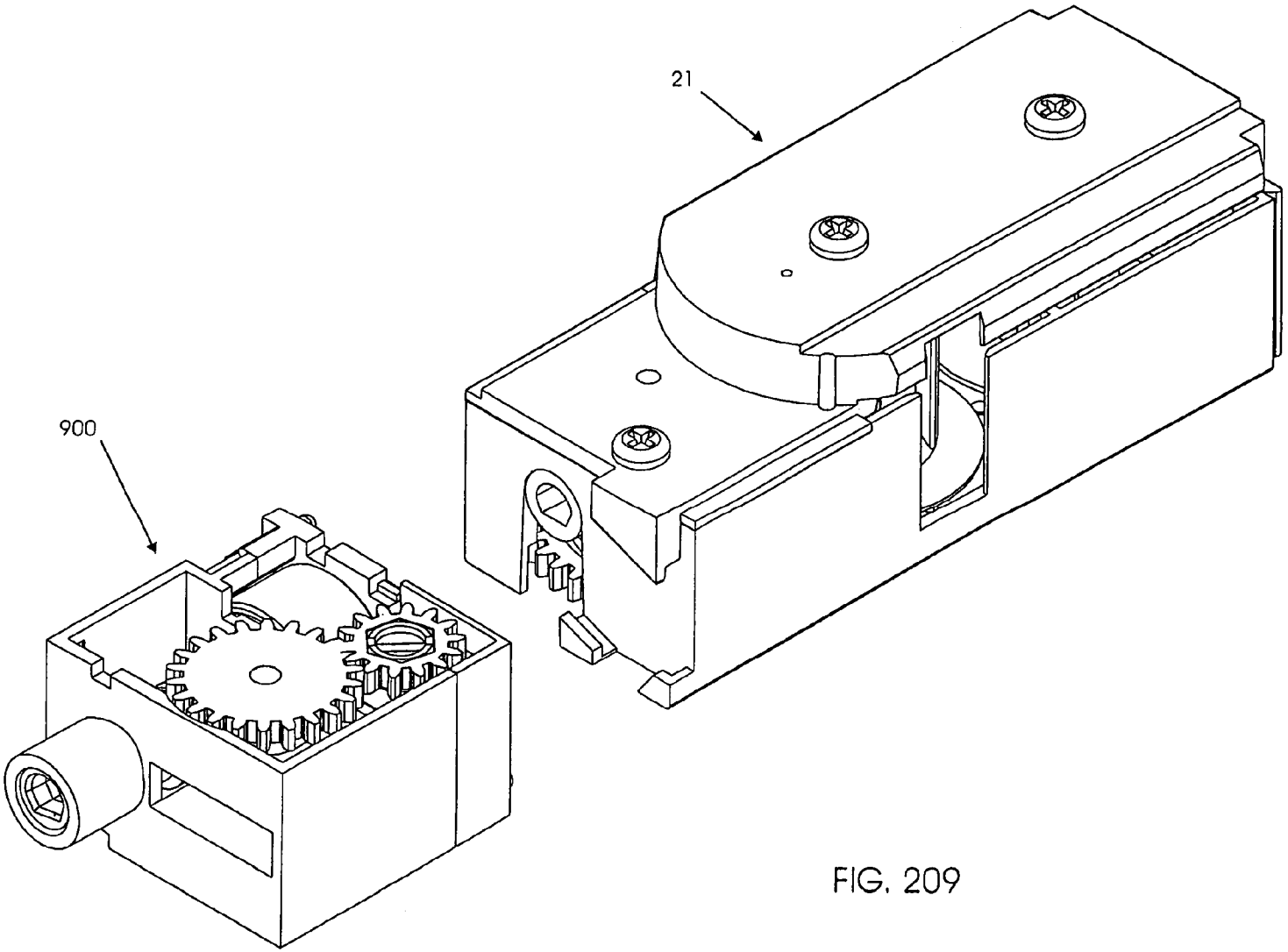
Figure 210:
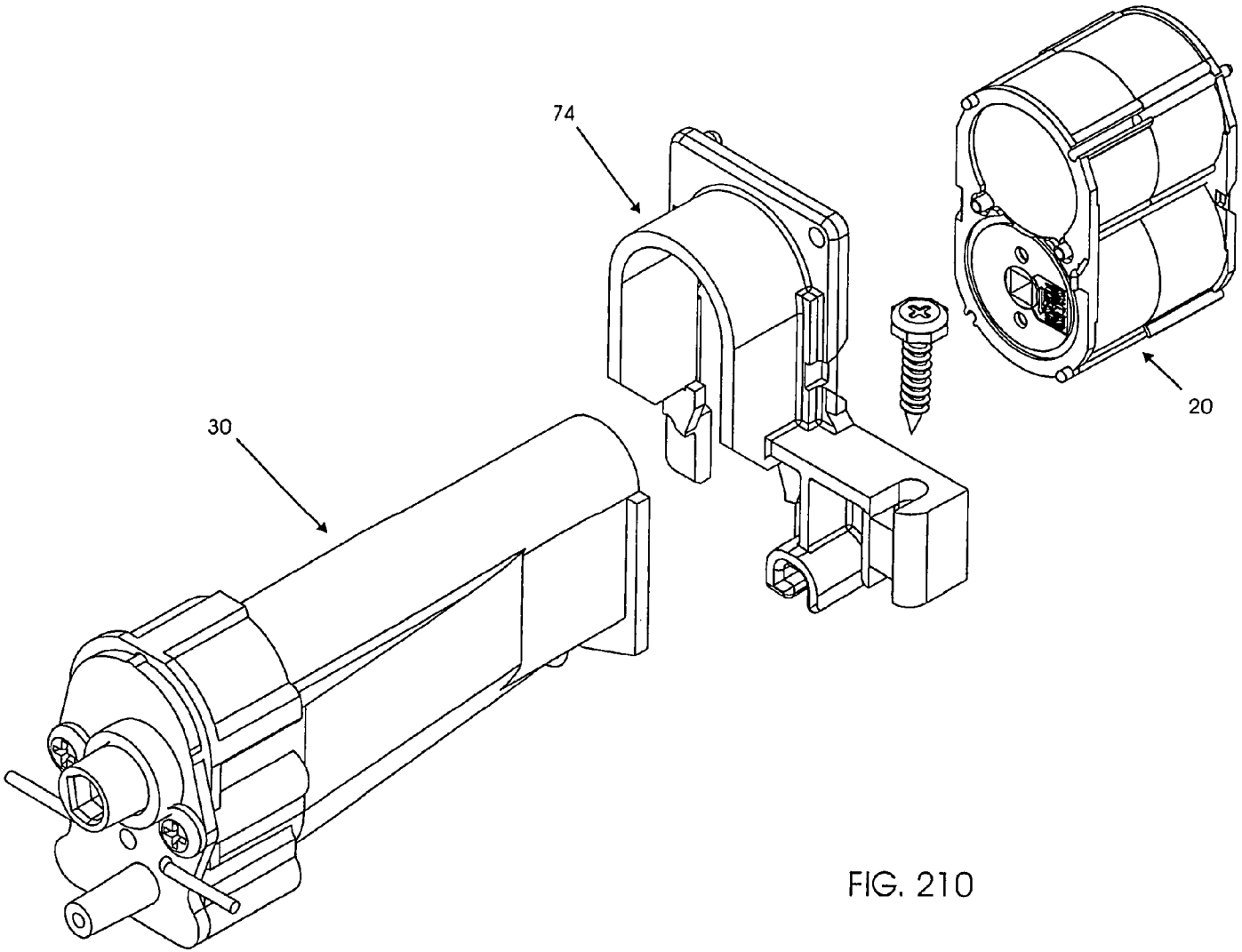
Figure 211:
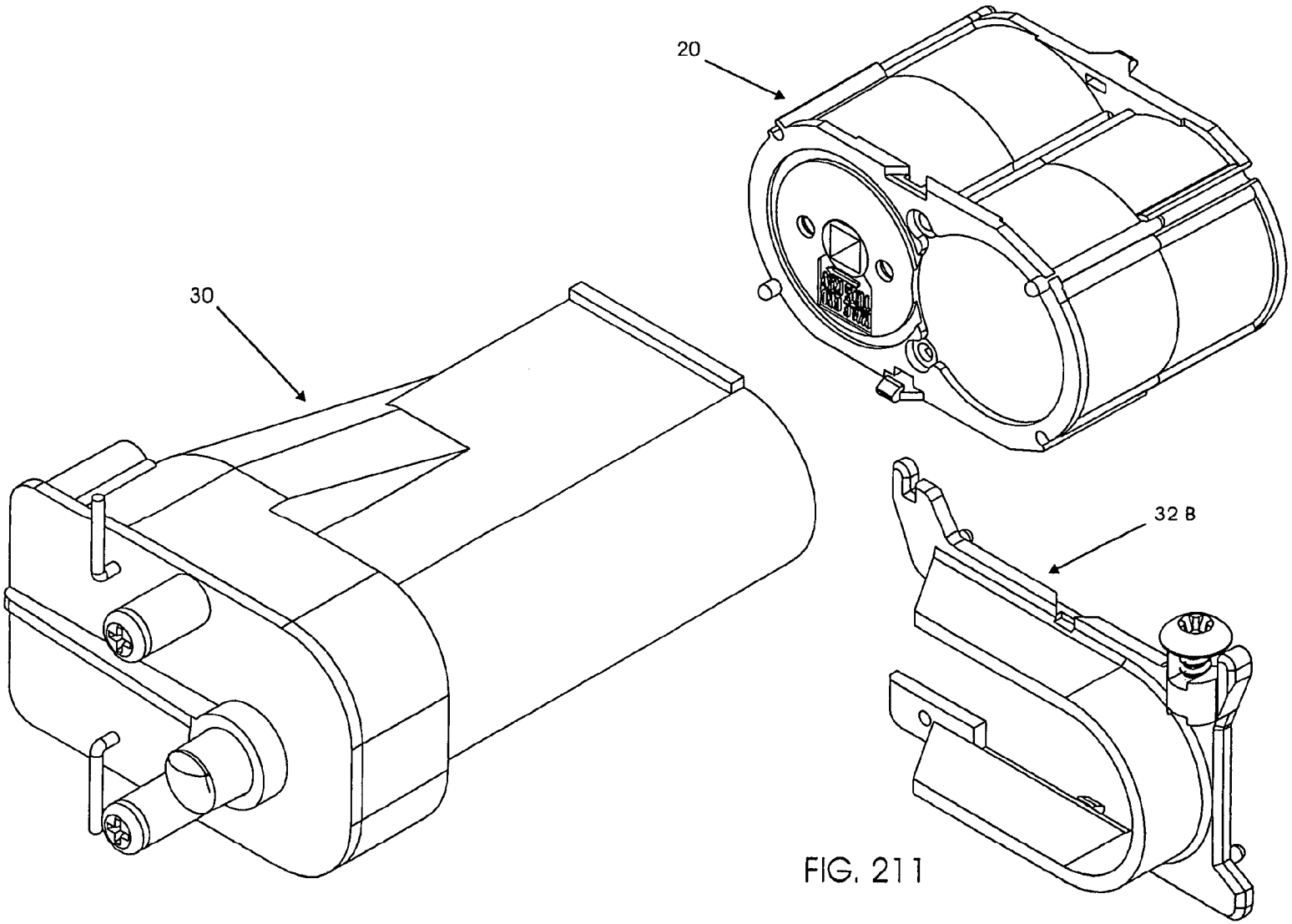
Figure 212:
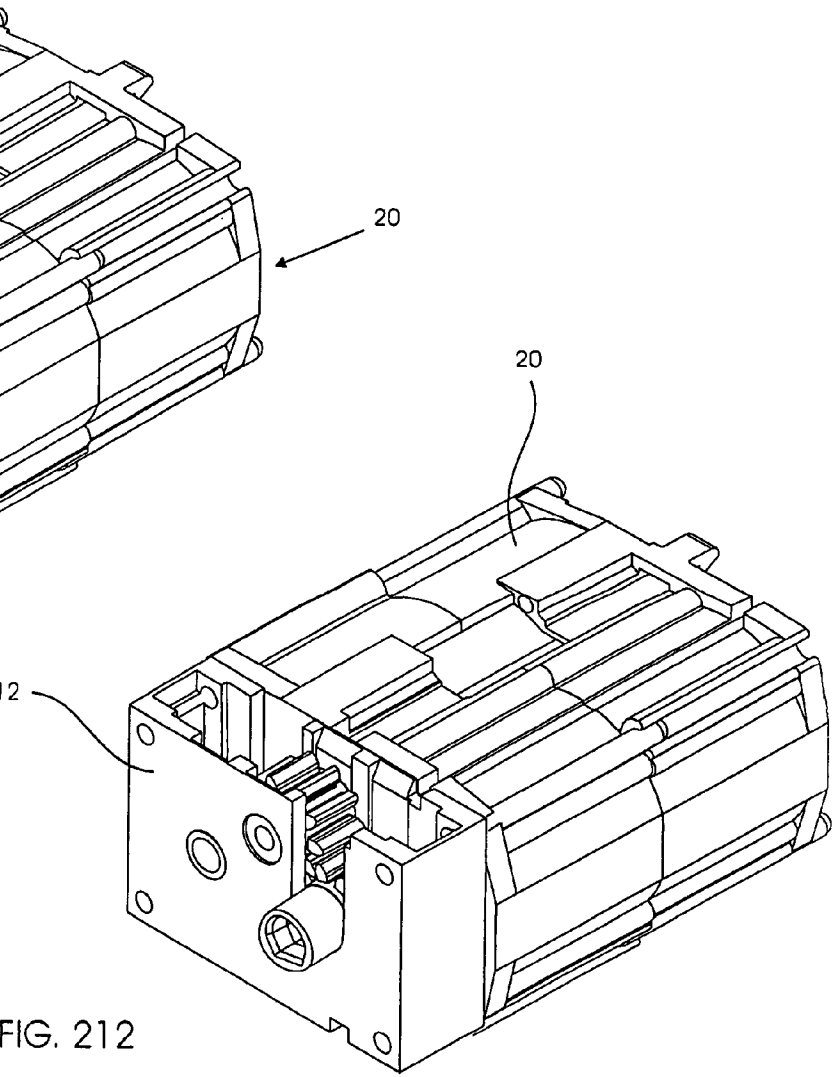
Figure 213:
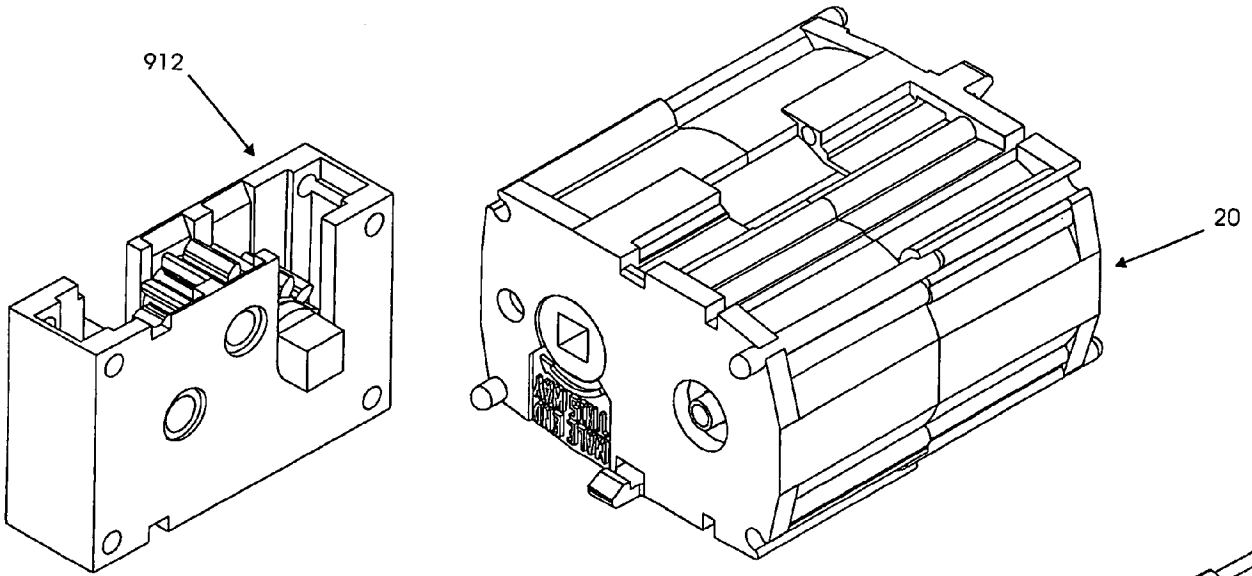
Figure 214:
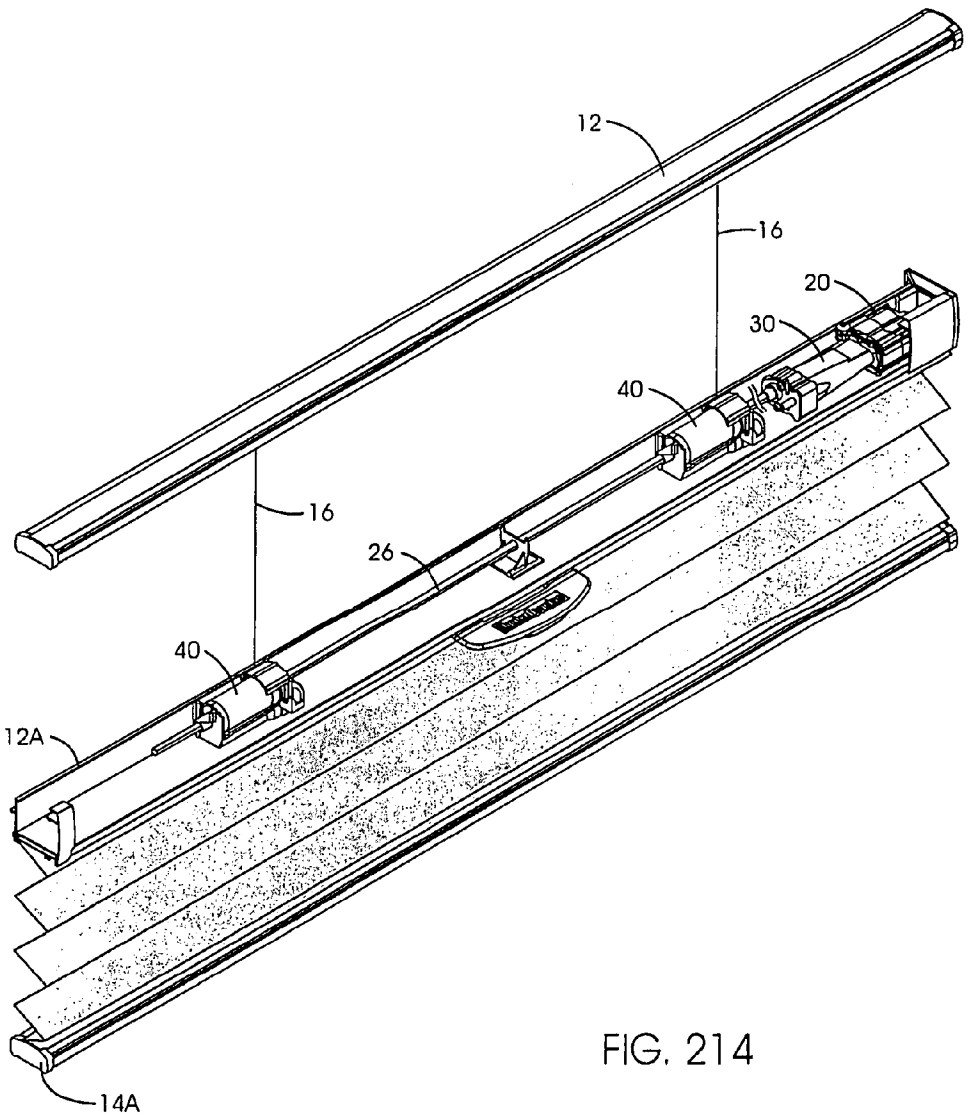
Figure 215:
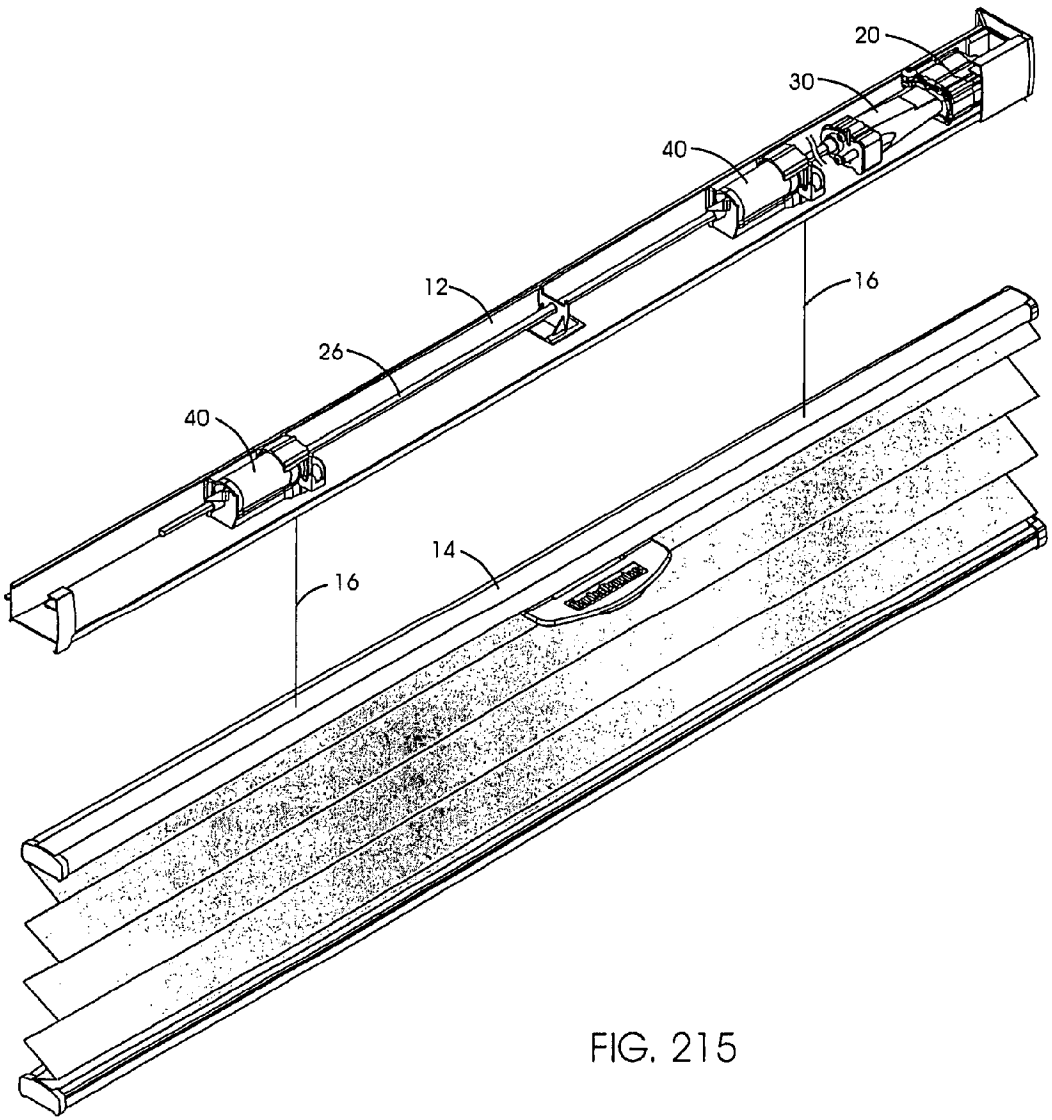
Figure 216:
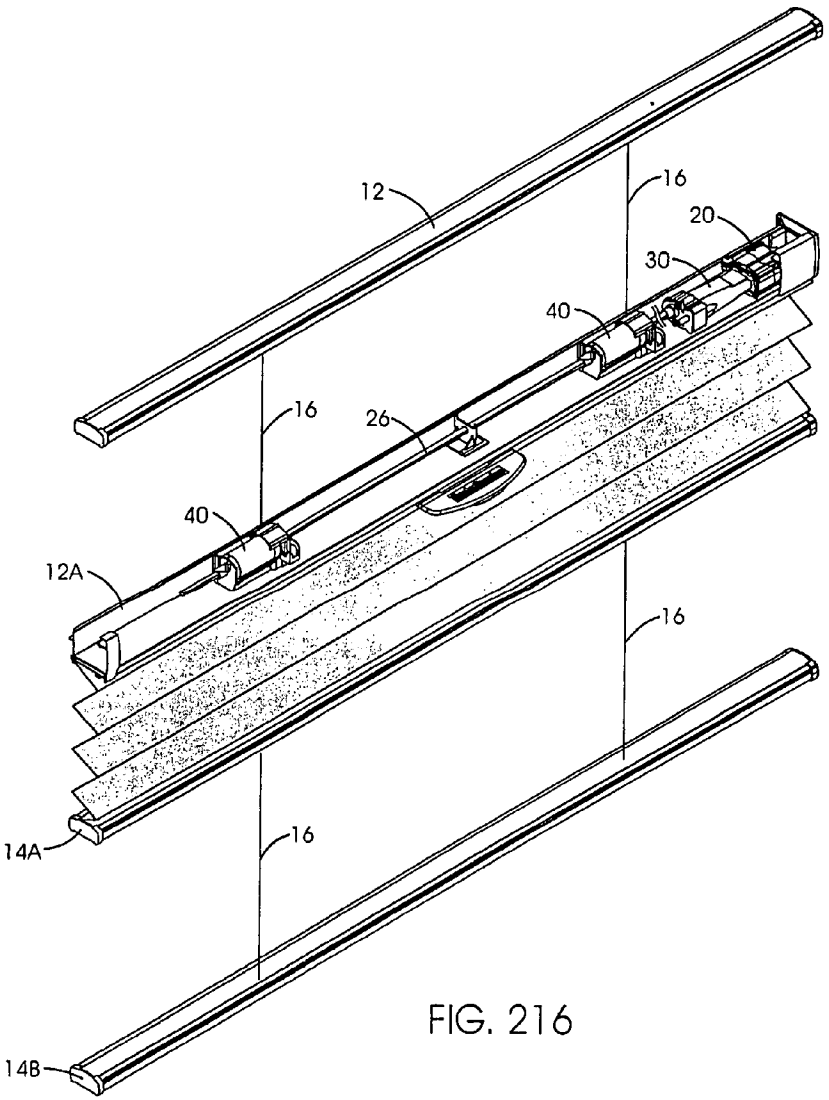
Figure 217:
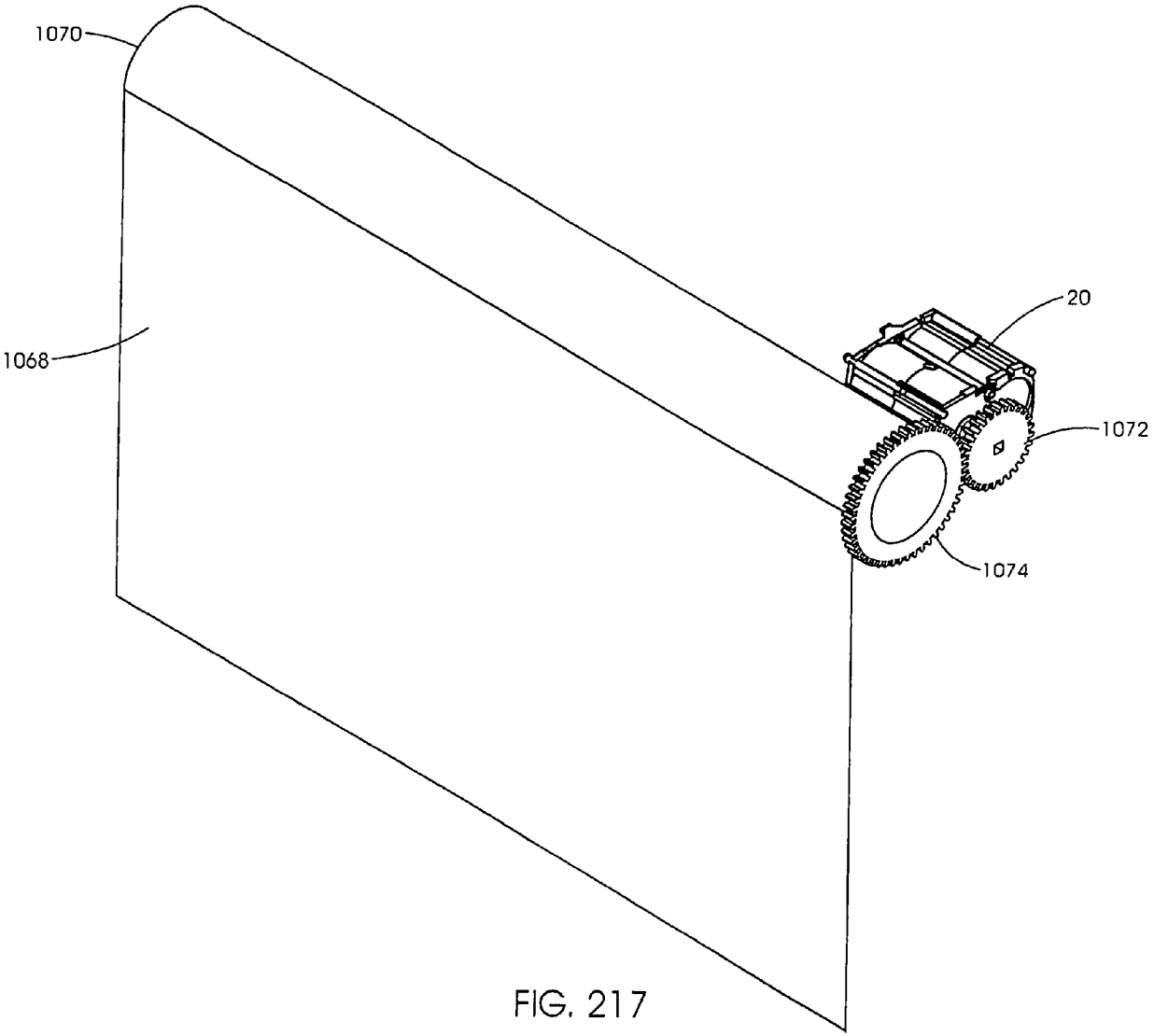
Figure 218:
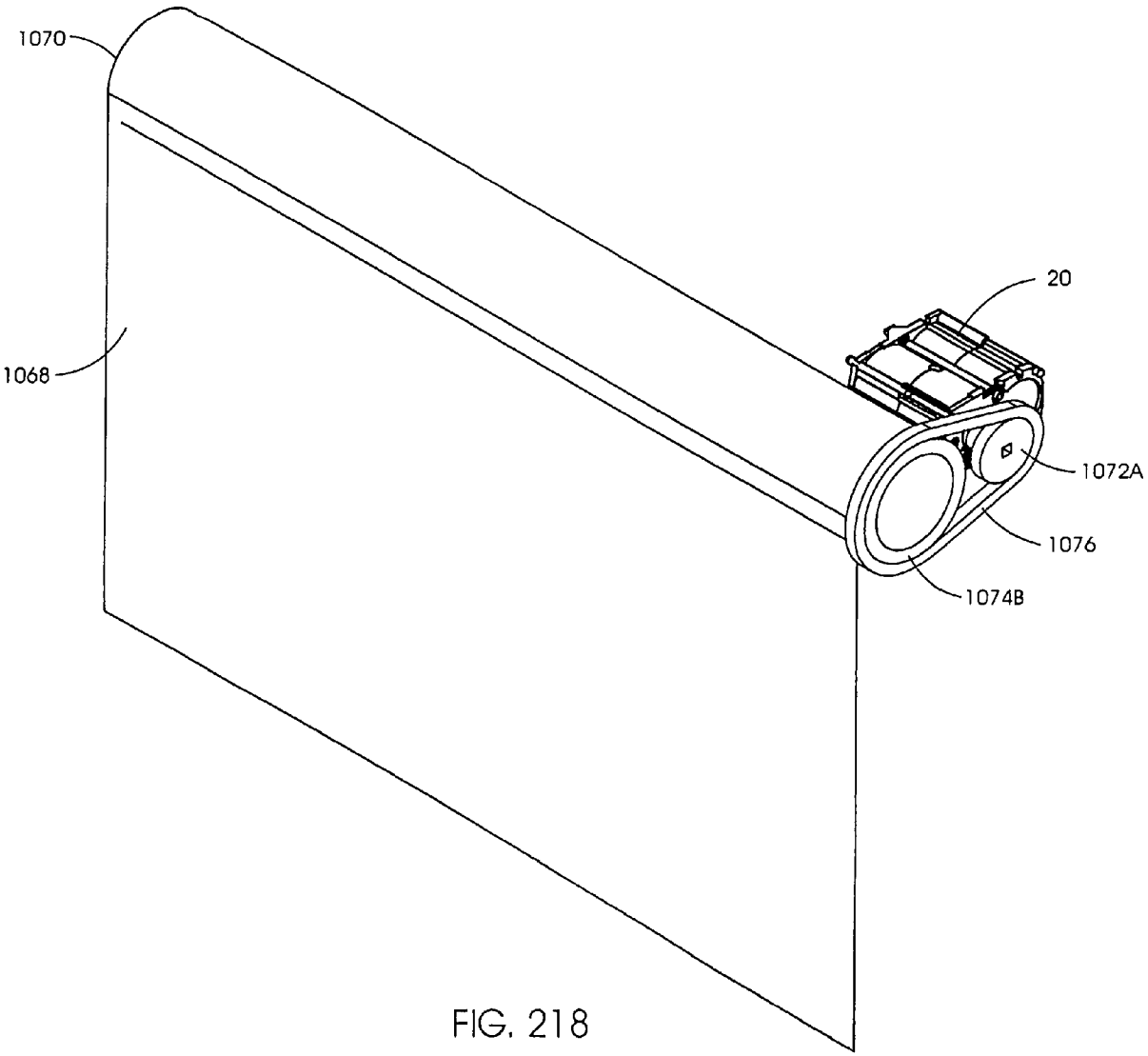
Figure 219:
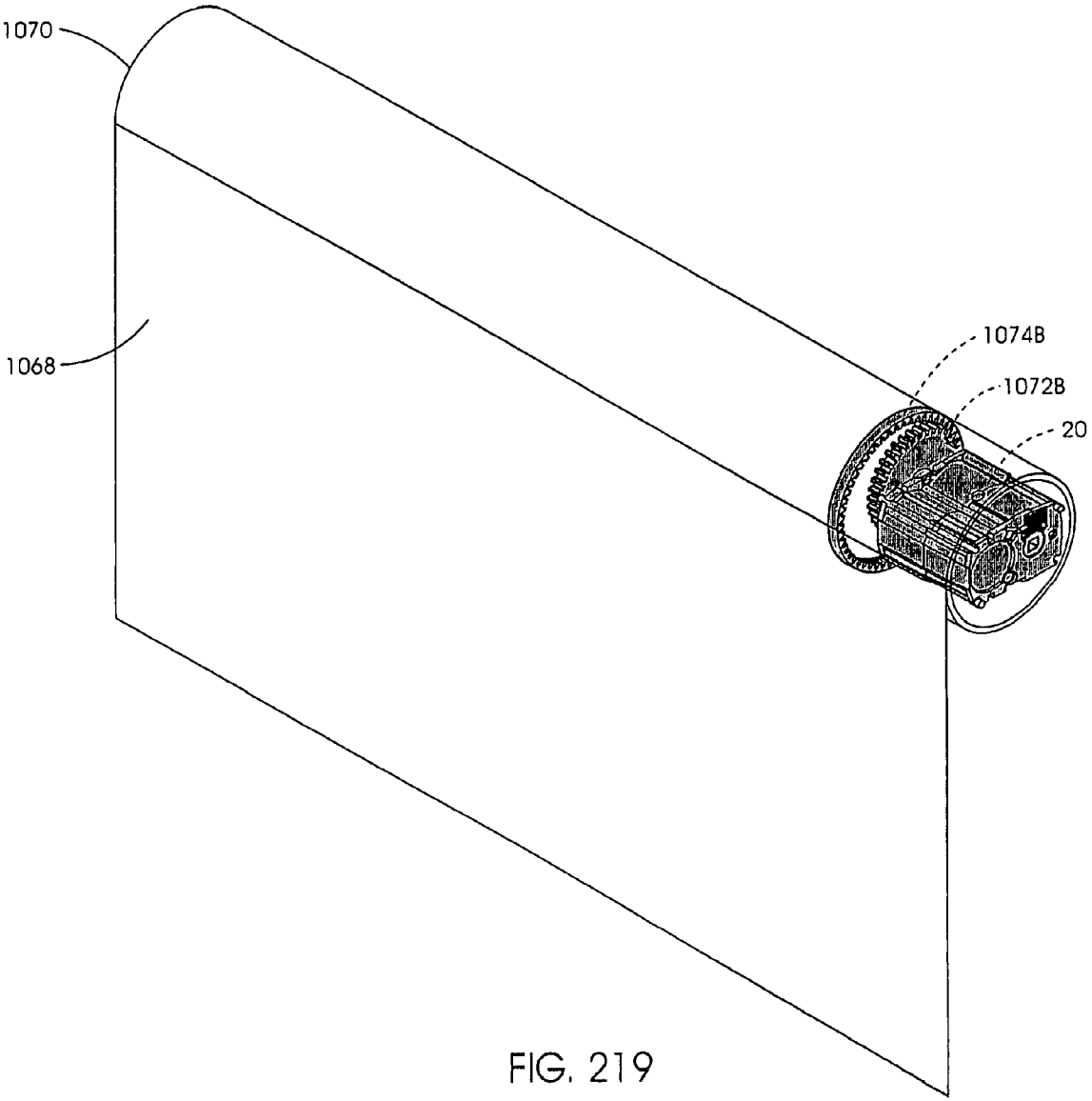
Figure 220:
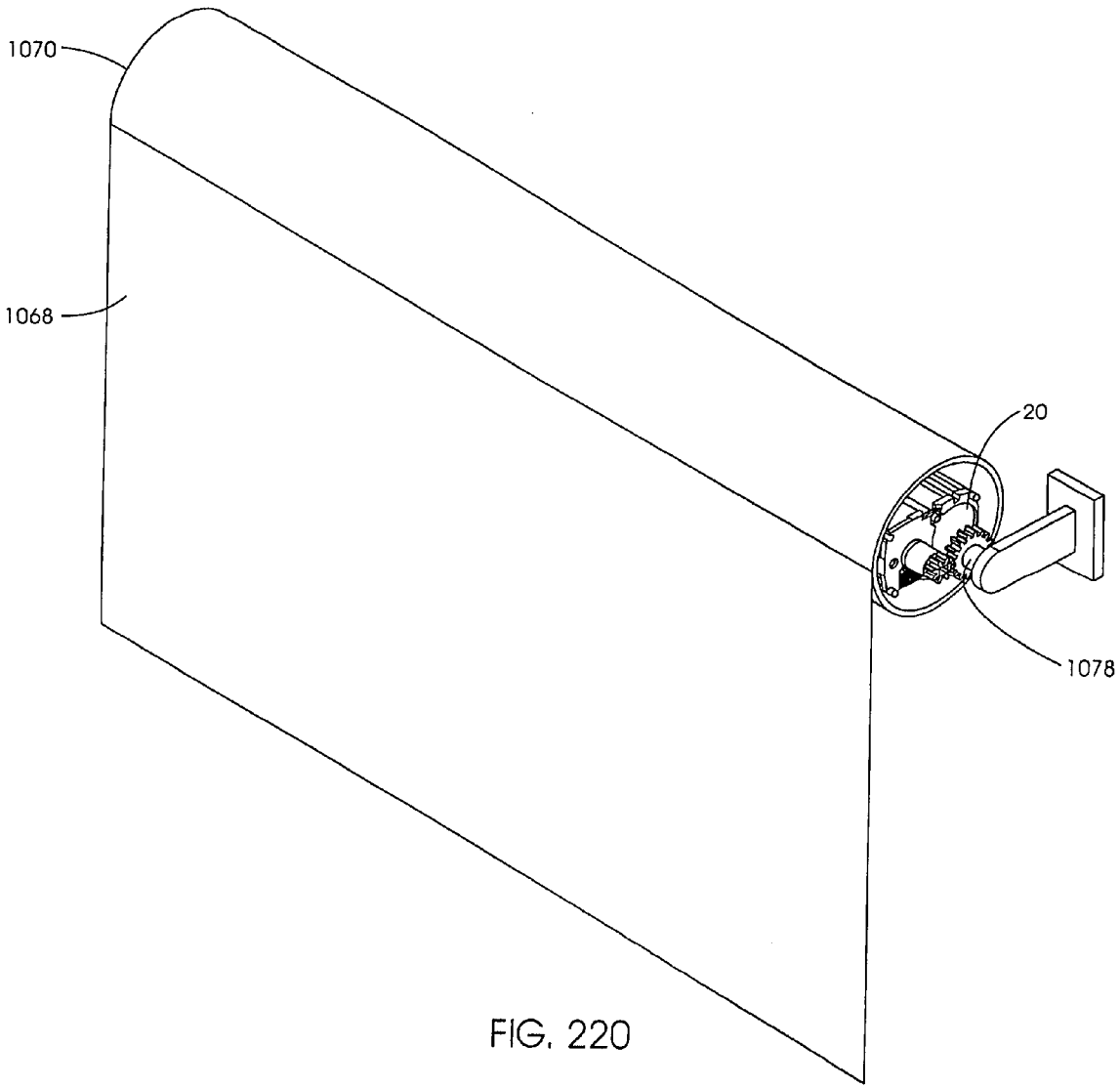

FIG. 100 is the same view as FIG. 99 but further assembled;

FIG. 101 is the same view as FIG. 100 but further assembled;

FIG. 102 is a perspective view of the assembly of FIG. 101 mounted in a two inch head rail, as shown also in FIG. 7;

FIG. 103 is a view along the section 103-103 of the assembly of FIG. 102;

FIG. 104 is a perspective front view of the lift roll assembly depicted in FIGS. 8, 9, and 10;

FIG. 105 is a perspective rear view of the lift roll assembly of FIG. 104;

FIG. 106 is an exploded view of the lift roll assembly of FIG. 104;

FIG. 107 is a perspective front view of the lift and tilt roll assembly depicted in FIG. 107;

FIG. 108 is a perspective rear view of the lift and tilt roll assembly depicted in FIG. 1;

FIG. 109 is an exploded view of the lift and tilt roll assembly of FIG. 107;

FIG. 110 is a perspective view of the lift spool of FIG. 106;

FIG. 111 is a sectional view of the lift spool of FIG. 110;

FIG. 112 is a perspective front view of the ladder pulley of FIG. 109;

FIG. 113 is a perspective rear view of the ladder pulley of FIG. 109;

FIG. 114 is a rear plan view of the ladder pulley of FIG. 109;

FIG. 114A is a perspective rear view of the ladder gear of FIG. 109, showing the tilt cables attached;

FIG. 115 is a perspective front view of the tilt rod gear of FIG. 109;

FIG. 116 is a perspective rear view of the tilt rod gear of FIG. 109;

FIG. 117 is an internal perspective view of the end cap of the two piece lift spool of FIG. 120;

FIG. 118 is an external perspective view of the end cap of the two piece lift spool of FIG. 120;

FIG. 119 is a sectional view of the end cap of FIG. 117;

FIG. 120 is an exploded view of second embodiment of a lift roll assembly, similar to FIG. 106 except the lift spool is a two piece component, and depicting the lift cord as it starts to wind up onto the lift spool;

FIG. 121 is the same view as FIG. 120 except the lift cord is almost fully wound onto the lift spool;

FIG. 122 is a perspective view of the cradle of the lift roll assembly of FIG. 106, highlighting the location of the kicker;

FIG. 123 is a sectional view along line 123-123 of FIG. 122, highlighting the optimum location range for the kicker;

FIG. 124 is a side sectional view of the lift roll assembly of FIG. 104, including the lift cord;

FIG. 125A is a sectional view along line 123-123 but offset slightly from FIG. 123, showing one possible routing of the lift cord through the cradle;

FIG. 125B is a the same view of FIG. 125A but showing a second possible routing of the lift cord through the cradle;

FIG. 125C is similar to FIG. 125A, showing a third possible routing of the lift cord through the cradle;

FIG. 125D is the same view as FIGS. 125A, B, and C but showing three holes so as to permit all three possible routings of the lift cord through the cradle;

FIG. 126 is a sectional view along line 126-126 of the lift and tilt assembly of FIG. 107, depicting the clutching mechanism of the ladder gear;

FIG. 127 is an exploded perspective view of the simultaneous lift/tilt assembly shown in FIG. 3;

FIG. 128 is a side view, partially in section, of another embodiment of a lift and tilt assembly wherein pull cords at one of the assemblies are used to directly tilt the blind;

FIG. 129 is a perspective view of a tilt only station shown in FIG. 1;

FIG. 130 is an exploded view of the tilt only station of FIG. 129;

FIG. 131 is a side view, partially in cross section, of the tilt only station of FIG. 129;

FIG. 132 is a top, rear perspective view of a lift and tilt assembly for a two inch head rail as shown in FIG. 7;

FIG. 133 is a bottom, front perspective view of a lift and tilt assembly for a two inch head rail as shown in FIG. 7;

FIG. 133A is a perspective view, with some of the elements omitted for clarity, of a lift and tilt assembly as it is installed in a two inch head rail, showing the lift cord and both tilt cables;

FIG. 133B is a perspective view of the ladder pulley and one tilt cable of FIG. 133A, as it is being installed;

FIG. 133C is a perspective view of the ladder pulley and both tilt cables of FIG. 133A, as they are being installed;

FIG. 133D is a perspective view of the ladder pulley and both tilt cables of FIG. 133A fully installed;

FIG. 134 is an exploded view of the lift and tilt assembly of FIG. 132;

FIG. 135 is the same view as FIG. 134 but with some parts assembled;

FIG. 136 is a front end view of a simultaneous tilt, lift assembly for a two inch head rail;

FIG. 137 is a front end view of another lift and tilt assembly for a two inch head rail wherein the tilt rod is in a third axis, independent of the lift rod axis and the ladder pulley axis;

FIG. 138 is a perspective view of a tilt only station for a two inch head rail;

FIG. 139 is an exploded view of the tilt only station of FIG. 138;

FIG. 140 is a side view, partially in cross section, of the tilt only station of FIG. 138;

FIG. 141 is a perspective rear view of the twin spool lift and tilt assembly shown in FIG. 5;

FIG. 142 is a perspective front view of the twin spool lift and tilt assembly shown in FIG. 5;

FIG. 143 is a perspective view of the twin spool lift and tilt assembly of FIG. 142, showing the lift cords starting to wind up onto the spools;

FIG. 144 is a the same view as FIG. 143, except the lift cords are now wound further onto the spools;

FIG. 145 is a partially exploded view of the twin spool lift and tilt assembly of FIG. 142, without the lift cords;

FIG. 146A is a top left rear perspective view of the cradle of the twin spool lift and tilt assembly of FIG. 142;

FIG. 146B is a top left front perspective view of the cradle of the twin spool lift and tilt assembly of FIG. 142;

FIG. 146C is a top right front perspective view of the cradle of the twin spool lift and tilt assembly of FIG. 142;

FIG. 146D is a top right rear perspective view of the cradle of the twin spool lift and tilt assembly of FIG. 142;

FIG. 147A is a bottom left rear perspective view of the cradle of the twin spool lift and tilt assembly of FIG. 142;

FIG. 147B is a bottom left front perspective view of the cradle of the twin spool lift and tilt assembly of FIG. 142;

FIG. 147C is a bottom right front perspective view of the cradle of the twin spool lift and tilt assembly of FIG. 142;

FIG. 147D is a bottom right rear perspective view of the cradle of the twin spool lift and tilt assembly of FIG. 142;

FIG. 148 is a front perspective view of the twin spool lift and tilt assembly of FIG. 142 wherein one of the spools has been removed;

FIG. 149 is an exploded view of the twin spool lift and tilt assembly of FIG. 148;

FIG. 150 is a front perspective view of the twin spool lift and tilt assembly of FIG. 142 wherein both of the spools have been removed;

FIG. 151 is an exploded view of the twin spool lift and tilt assembly of FIG. 150;

FIG. 152 is a front end view of the twin spool lift and tilt assembly of FIG. 142;

FIG. 153 is a view along line 153-153 of FIG. 152;

FIG. 154 is an enlarged detail on FIG. 153;

FIG. 155A is a left front perspective, partially broken away view of the twin spool lift and tilt assembly of FIG. 142, connected to a transmission and a coaxial motor, all in a two-inch head rail;

FIG. 155B is a right front perspective, partially broken away view of the assembly of FIG. 155A;

FIG. 155C is a left rear perspective, partially broken away view of the assembly of FIG. 155A;

FIG. 155D is a right rear perspective, partially broken away view of the assembly of FIG. 155A;

FIG. 156A is a left front perspective, partially broken away view of the twin spool lift and tilt assembly of FIG. 142, connected to a transmission and a ratchet-type manual drive, all in a two-inch head rail;

FIG. 156B is a right front perspective, partially broken away view of the assembly of FIG. 156A:

FIG. 156C is a left rear perspective, partially broken away view of the assembly of FIG. 156A;

FIG. 156D is a right rear perspective, partially broken away view of the assembly of FIG. 156A;

FIG. 157A is a left front perspective, partially broken away view of the twin spool lift and tilt assembly of FIG. 142, connected to a tilt cord mechanism, all in a two-inch head rail;

FIG. 157B is a right front perspective, partially broken away view of the assembly of FIG. 157A;

FIG. 157C is a left rear perspective, partially broken away view of the assembly of FIG. 157A;

FIG. 157D is a right rear perspective, partially broken away view of the assembly of FIG. 157A;

FIG. 158A is a left front perspective, partially broken away view of the twin spool lift and tilt assembly of FIG. 142, connected to a rotated transmission and coaxial motor, all in a two-inch head rail;

FIG. 158B is a right front perspective, partially broken away view of the assembly of FIG. 158A;

FIG. 158C is a left rear perspective, partially broken away view of the assembly of FIG. 158A;

FIG. 158D is a right rear perspective, partially broken away view of the assembly of FIG. 158A;

FIG. 159 is a perspective view of an endless cord loop drive for raising and lowering a blind, as shown in FIG. 13A;

FIG. 160 is a partially exploded perspective view of the endless cord loop drive of FIG. 159;

FIG. 161 is an exploded perspective view of the endless cord loop drive of FIG. 159;

FIG. 162 is a perspective view of a wand tilter assembly as shown in FIG. 13B;

FIG. 163 is an exploded perspective view of the wand tilter of FIG. 162;

FIG. 164 is a perspective view of a lift rod support as shown in FIG. 8;

FIG. 165A is a perspective view of a worm gear cord lift mechanism used to raise and lower a blind, as shown in FIG. 11;

FIG. 165B is an exploded view of the worm gear lift cord mechanism of FIG. 165A;

FIG. 165C is a view of the worm gear lift cord mechanism of FIG. 165B, partially assembled;

FIG. 165D is a view of the worm gear lift cord mechanism of FIG. 165C, further assembled;

FIG. 165E is a view of the worm gear lift cord mechanism of FIG. 165D, further assembled;

FIG. 165F is a partially exploded view of the worm gear lift cord mechanism of FIG. 165E, further assembled;

FIG. 166 is an enlarged, exploded view of the worm gear lift cord mechanism of FIG. 165A, less the cord;

FIG. 166A is a perspective view of the spur gear unit of the worm gear lift cord mechanism of FIG. 166;

FIG. 166B is a perspective view of the cord pulley of the worm gear lift cord mechanism of FIG. 166;

FIG. 166C is a perspective view of the other side of the cord pulley of FIG. 166B;

FIG. 166D is a plan view of the cord pulley of FIG. 166B;

FIG. 166E is a sectional view along line 166E-166E of the worm gear lift cord mechanism of FIG. 165A;

FIG. 167 is an end view of the worm gear lift cord mechanism of FIG. 165A, mounted in a one-inch head rail;

FIG. 168 is a broken away perspective view of a sleeve and pin mechanism to secure a wide ladder tape to a ladder pulley such as the one shown in FIG. 114A;

FIG. 169 is a broken away perspective view of a double pin mechanism to secure a wide ladder tape to a ladder pulley such as the one shown in FIG. 114A;

FIG. 170 is a broken away perspective view of a stapled attachment mechanism to secure a wide ladder tape to a ladder pulley such as the one shown in FIG. 114A;

FIG. 171 is a broken away perspective view of a loop and pin mechanism to secure a wide ladder tape to a ladder pulley such as the one shown in FIG. 114A;

FIG. 172 is an end view of a lift and tilt assembly mounted in a two-inch head rail, depicting one method of terminating the ends of wide ladder tapes to the head rail;

FIG. 173 is an end view of a lift and tilt assembly mounted in a two-inch head rail, depicting a second method of terminating the ends of wide ladder tapes to the head rail;

FIG. 174 is a broken away, perspective view of the lift and tilt assembly (with some elements removed for clarity of illustration) of FIG. 173;

FIG. 175 is a perspective view of a one-way variable brake;

FIG. 176 is an exploded view of the one-way variable brake of FIG. 175;

FIG. 177 is the same view as FIG. 176 but with the brake partially assembled;

FIG. 178 is the same view as FIG. 177 but further assembled;

FIG. 179 is a plan view of the one-way variable brake of FIG. 175;

FIG. 180 is a section taken along line 180-180 of FIG. 179;

FIG. 181 is a section taken along line 181-181 of FIG. 179;

FIG. 182 is a section taken along line 182-182 of FIG. 180;

FIG. 183A is a perspective view of a one-way adjustable brake;

FIG. 183B is an exploded view of the one-way adjustable brake of FIG. 183A;

FIG. 183C is the same view as FIG. 183B but with the brake partially assembled;

FIG. 184 is the same view as FIG. 183C but further assembled:

FIG. 185 is a plan view of the of the one-way adjustable brake of FIG. 183A;

FIG. 186 is a sectional view taken along line 186-186 of FIG. 185;

FIG. 187 is an end view of the one-way adjustable brake of FIG. 183A;

FIG. 188 is a sectional view taken along line 188-188 of FIG. 187;

FIG. 189 is a sectional view taken along line 189-189 of FIG. 187;

FIG. 190 is a sectional view taken along line 190-190 of FIG. 187;

FIG. 191 is a perspective view of an adapter module for use with other components such as the variable brake of FIG. 175;

FIG. 192 is an exploded view of the adapter module of FIG. 191;

FIG. 193 is a perspective view of an alignment module for use with other components such as the variable brake of FIG. 175;

FIG. 194 is an exploded view of the alignment module of FIG. 193;

FIG. 195 is a perspective view of an assembly including a coaxial coiled spring motor, a transmission, a variable brake, and an alignment module;

FIG. 196 is an exploded view of an assembly including a transmission, a transmission adapter, and a coaxial coiled spring motor;

FIG. 197 is an exploded view of an assembly including a transmission, a transmission adapter, and two coaxial coiled spring motors;

FIG. 198 is an exploded view of an assembly including a transmission, a transmission adapter, a variable brake and a coaxial coiled spring motor;

FIG. 199 is an exploded view of an assembly including a variable brake and a manual cord loop drive;

FIG. 200 is an exploded view of an assembly including a transmission, a transmission adapter, a coaxial coiled spring motor, and an endless cord loop drive;

FIG. 200A is an exploded view of an assembly including an endless cord loop drive, a transmission, a transmission adapter, and a coaxial coiled spring motor;

FIG. 201 is an exploded view of an assembly including a transmission and a transaxial coiled spring motor;

FIG. 202 is an exploded view of an assembly including a transmission and two transaxial coiled spring motors;

FIG. 203 is an exploded view of an assembly including a transmission and a transaxial coiled spring motor and an endless cord loop drive;

FIG. 204 is an exploded view of an assembly including a transmission, a transmission adapter, and a low power electric motor;

FIG. 205 is an exploded view of an assembly including a transmission, a transmission adapter, and an endless cord loop drive;

FIG. 206 is an exploded view of an assembly including a transmission, a transmission adapter, a coaxial coiled spring motor, and a ratchet-type drive mechanism;

FIG. 207 is an exploded view of an assembly including a rotated transmission, and a ratchet-type drive mechanism connected in parallel via an adapter;

FIG. 208 is an exploded view of an assembly including a rotated transmission, and a ratchet-type drive mechanism connected in parallel via an adapter, together with two coaxial coiled spring motors connected in series via the same adapter;

FIG. 208A is a perspective view of the adapter of FIG. 208;

FIG. 208B is an exploded view of the adapter of FIG. 208A;

FIG. 209 is an exploded view of an assembly including a variable brake and a transaxial coiled spring motor;

FIG. 210 is an exploded view of an assembly including a rotated transmission, a transmission adapter, and a rotated coaxial coiled spring motor;

FIG. 211 is an exploded view of an assembly including a transmission, a transmission adapter, a coaxial coiled spring motor, all for a two-inch head rail;

FIG. 212 is a perspective view of an assembly including an adapter module and a coaxial coiled spring motor;

FIG. 213 is an exploded view of an assembly including the adapter module and the coaxial coiled spring motor of FIG. 212;

FIG. 214 is a schematic of an assembly in which the transport system is mounted in an intermediate rail;

FIG. 215 is a schematic of an assembly in which the bottom rail lifted by the transport system is actually an intermediate rail of the covering;

FIG. 216 is another schematic of an assembly in which the transport system is mounted in an intermediate rail;

FIG. 217 is a schematic of an assembly in which the covering itself wraps onto an elongated roller of the transport system and the power unit is mounted outside the roller;

FIG. 218 is a schematic of an assembly similar to FIG. 217 except that the drive between the power unit and the elongated roller is a belt drive;

FIG. 219 is a schematic of an assembly similar to FIG. 217 except that the power unit is mounted inside the elongated roller; and FIG. 220 is a schematic of an assembly similar to FIG. 219 except that the output shaft of the motor is fixed and the motor rotates with the elongated roller.

DESCRIPTION OF THE PREFERRED EMBODIMENTS

Referring now to FIG. 1, the blind 10 includes a head rail 12, and a plurality of slats 14 suspended from the head rail 12 by means of tilt cables 18 and the associated cross cords which together comprise the ladder tapes 22. Two lift cords 16 extend through holes 17 in the slats 14 and are fastened at the bottom of the bottom slat (or bottom rail) 14A, which is heavier than the other slats 14, as is well known in the art. Inside the head rail 12 are a coaxial coil spring motor module 20, a transmission module 30, two lift and tilt modules 40, a tilt mechanism module 50, and a tilt only module 60. There are several ways the slats 14 may be tilted. This tilt mechanism module 50 pulls on one side or the other of the ladder tapes 22 to rotate the slats 14, as will be described later. Also housed in the head rail 12 are a tilt rod 24, and a lift rod 26, the functions of which will be described in more detail later. The tilt only station 60 provides additional support for the slats 14 so they will not sag. A lift and tilt module 40 could be used instead of the tilt only station 60 but this is more expensive and requires additional force from the coil spring motor module 20 to overcome the additional system inertia of the lift and tilt module 40 as compared to that of the tilt only station 60.

Figure 14:
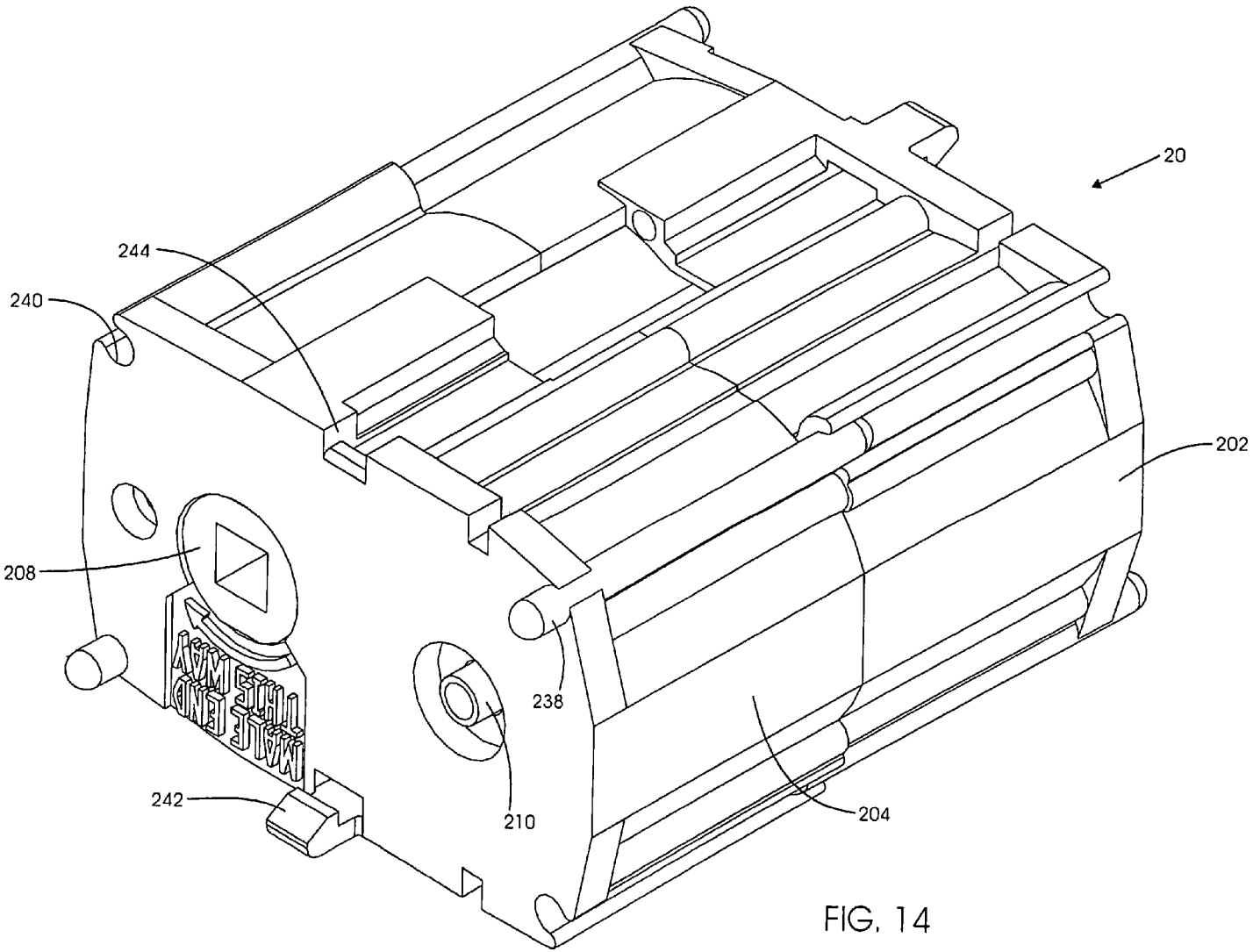
FIG. 14 is an output-end perspective view of a coaxial coiled spring motor made in accordance with the present invention and shown in the blind assembly of FIG. 1.
Figure 16:
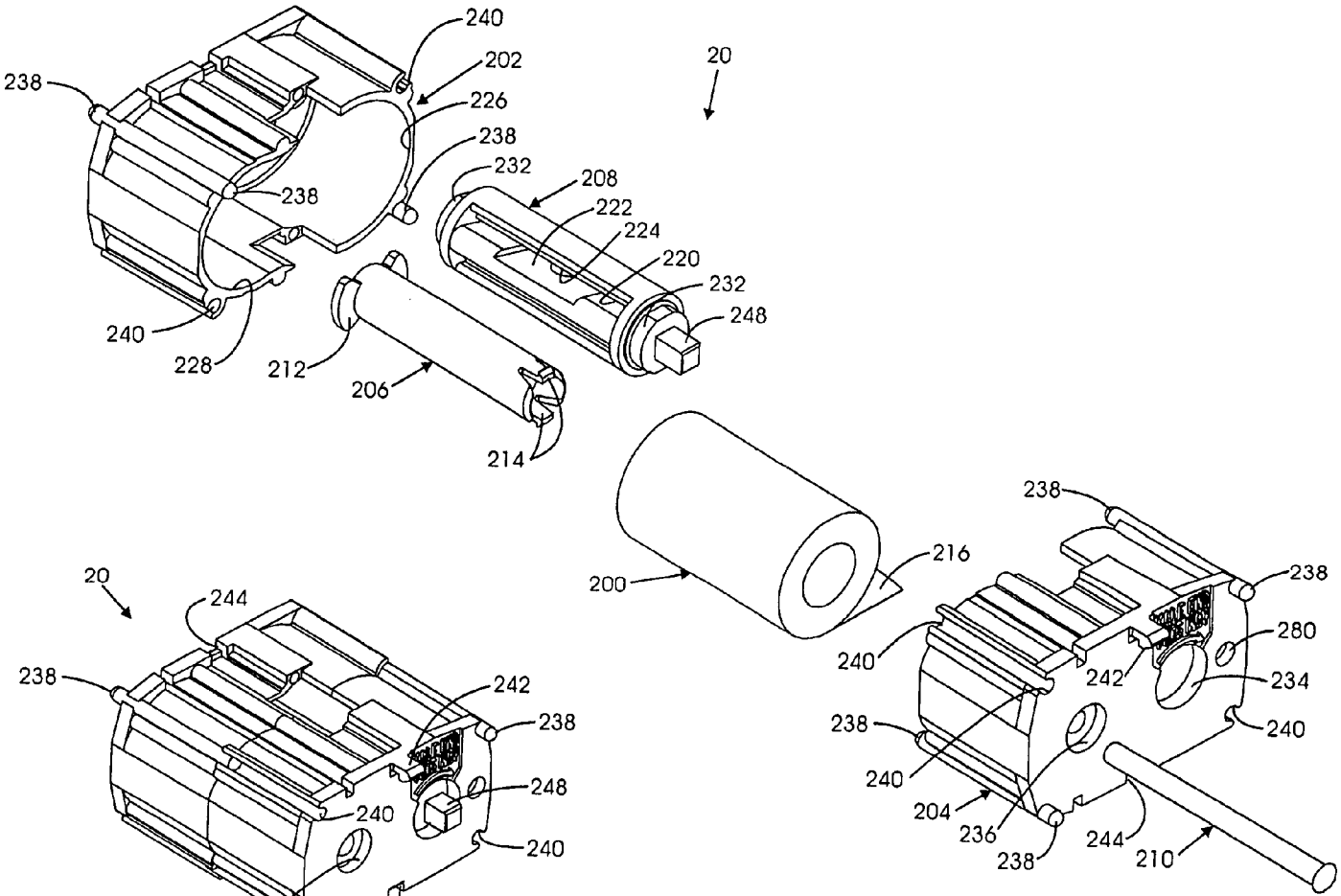
FIG. 16 is an exploded perspective view of the coiled spring motor of FIG. 15.
Figure 15:
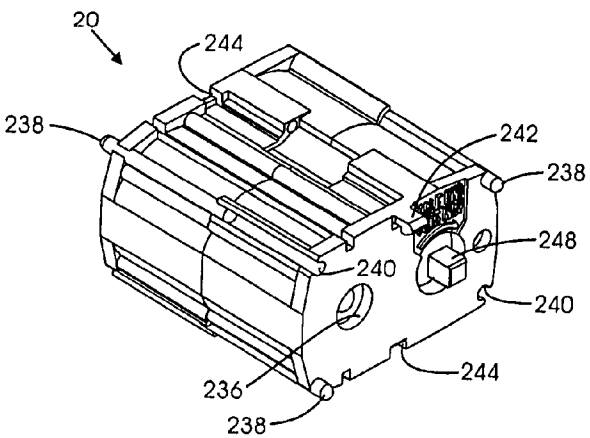
FIG. 15 is an input-end perspective view of the coaxial coiled spring motor of FIG. 14.
Figure 26B:
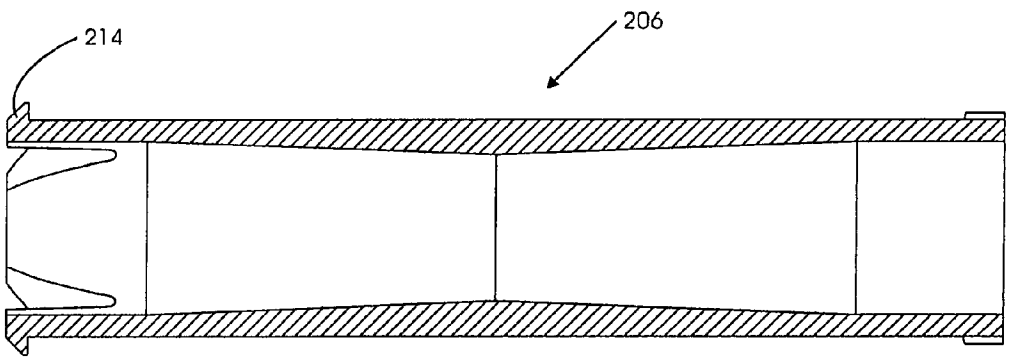
FIG. 26B is a side sectional view taken along line 26B-26B of FIG. 26A.
Figure 27:
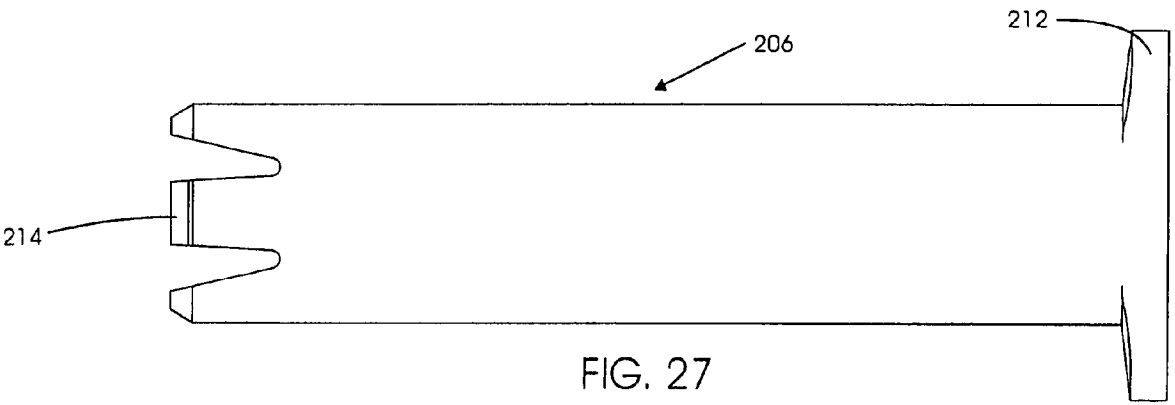
FIG. 27 is a side view, rotated 90 degrees, of the section of FIG. 26B.
Figure 26A:
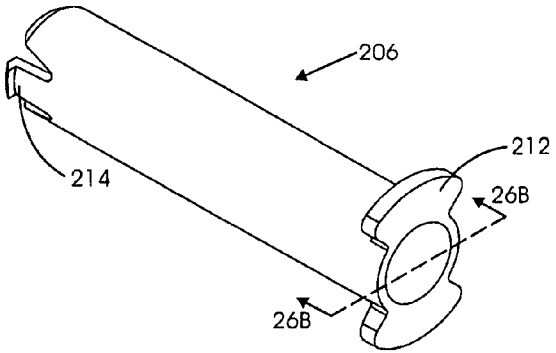
FIG. 26A is a perspective view of a storage spool for the coaxial coiled spring motor of FIG. 15.

The Power Module:

FIGS. 14-16 show the coaxial spring motor power module 20 of FIG. 1 and its parts. This power module 20 is referred to as a coaxial power module because the axis of the rotating spring 200 of this power module 20 extends lengthwise along the head rail 12, aligned with or parallel to the axis of the lift rod 26 (shown in FIG. 1). Referring first to FIG. 16, the spring motor power module 20 includes a two-piece housing 202, 204, a spring 200, a storage spool 206, a power spool 208, and a rivet 210 (or other suitable fastening device). The storage spool 206, which is shown in detail in FIGS. 26A, 26B, and 27, slides axially inside the rolled-up spring 200. The storage spool 206 includes a flange 212 at one end and flexible barbs 214 at the other end, so that, once the barbs 214 get through the spring roll 200, they flex outwardly, retaining the spring 200 on the storage spool 206. The flange 212 prevents the spring 200 from sliding off the other end of the storage spool 206. The resting position of the spring 200 is when it is coiled on the storage spool 206.

Figure 28:
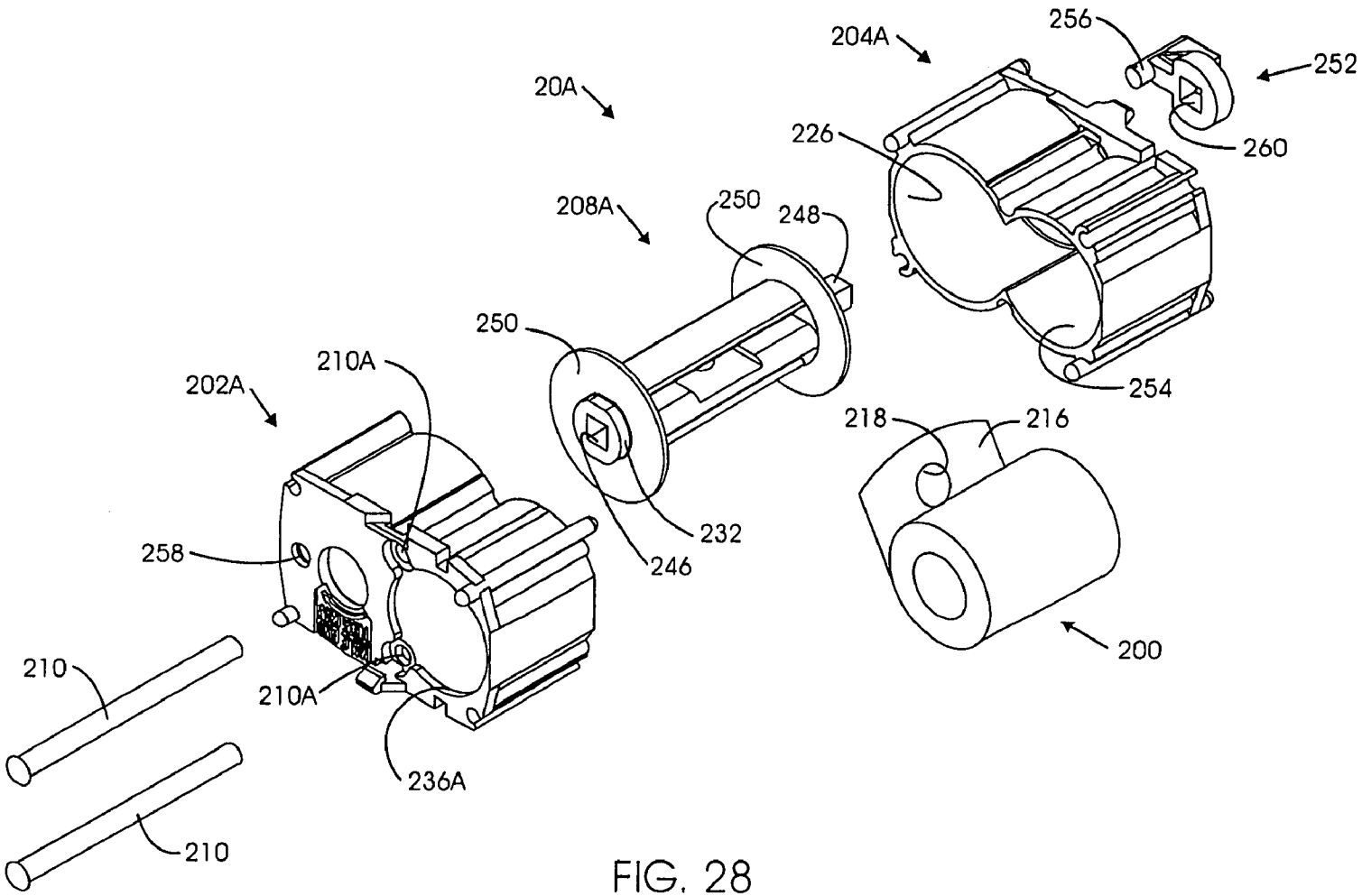
FIG. 28 is an exploded view of a second embodiment of a coaxial coiled spring motor similar to the motor of FIG. 14, except the storage spool has been eliminated.
Figure 29B:
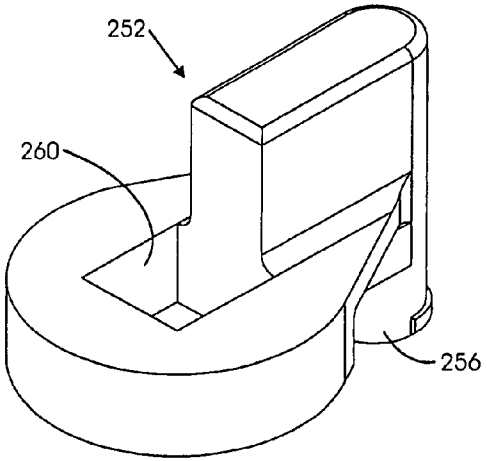
FIG. 29B is a top rear perspective view of the locking clip of FIG. 28.
Figure 29D:
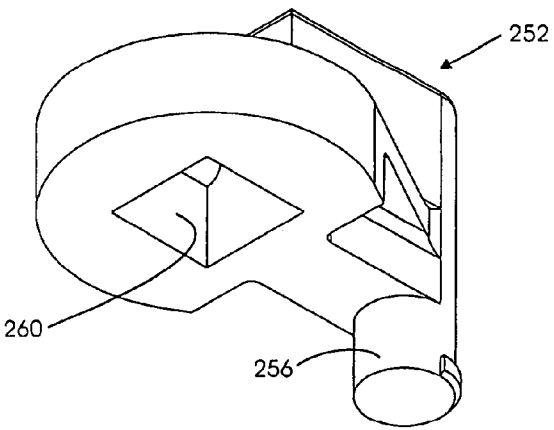
FIG. 29D is a bottom rear perspective view of the locking clip of FIG. 28.
Figure 29A:
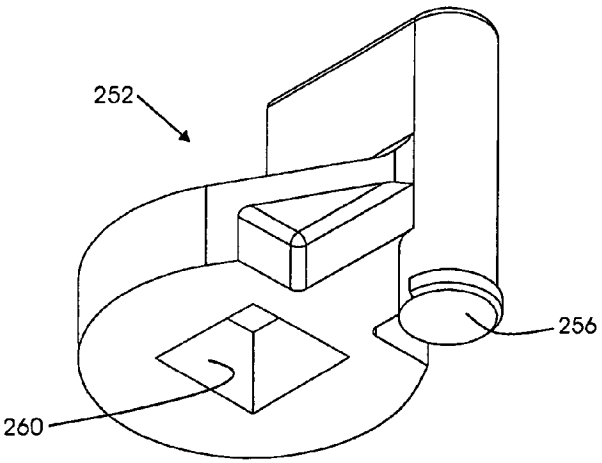
FIG. 29A is a bottom front perspective view of the locking clip of FIG. 28.
Figure 29C:
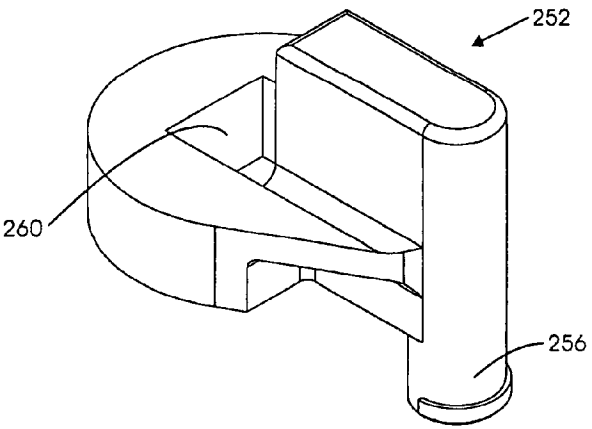
FIG. 29C is a top front perspective view of the locking clip of FIG. 28.

The spring 200 has a free end 216, which defines a central hole 218 (not shown in this figure but which may be seen in an alternate embodiment of the spring motor module in FIG. 28). The power spool 208 mates with that central hole 218 in order to retain the spring 200 on the power spool 208. The power spool 208 is almost identical to the power spool 208A except that it does not have flanges at its ends. Both spools 208, 208A have a central opening 220, which defines a rectangular recess 222, which is narrower than the width of the spring 200. Opposite the rectangular recess 222 is a cylindrical projection 224, which projects a short distance into the recess 222. To assemble the spring 200 and power spool 208, the free end 216 of the spring 200 is somewhat distorted and pushed down into the rectangular recess 222 until the hole 218 on the free end 216 of the spring 200 is aligned with the cylindrical projection 224. Then, the free end 216 of the spring 200 is released, and the spring 200 naturally straightens out and moves toward the cylindrical projection 224, so that the cylindrical projection extends through the hole 218, thereby retaining the spring 200 on the power spool 208. The spring 200 preferably is prewound onto the power spool 208 or 208A and is pinned in place in preparation for assembly of the blind 10. This pinning arrangement is explained in detail later, with respect to an alternate embodiment of the spring motor module.

Figure 23:
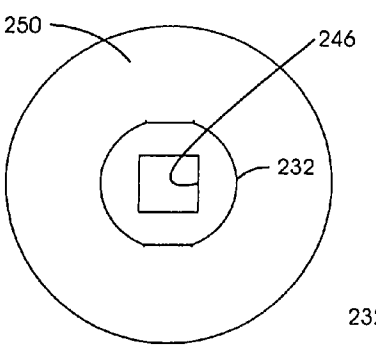
FIG. 23 is an output-end view of the power spool of FIG. 22.
Figure 21:
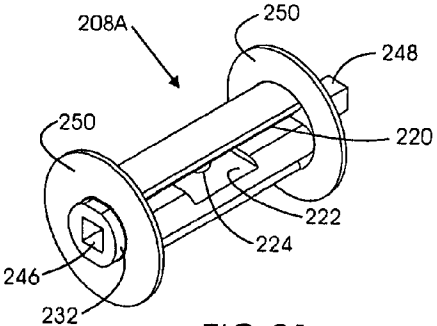
FIG. 21 is an output-end perspective view of a power spool for the coaxial coiled spring motor of FIG. 15.
Figure 22:
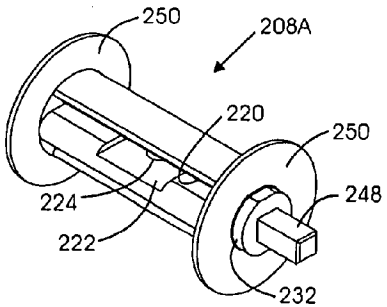
FIG. 22 is an input end perspective view of the power spool FIG. 21.

Looking in more detail at the housing halves 202, 204 in FIG. 16 and FIGS. 18 through 20, it can be seen that the housing halves are identical, with the left half 202 rotated 180° from the right half 204, so that the halves mate. The housing halves 202, 204 define forward and rear arcuate-cross-section chambers 226, 228 (shown if FIG. 16) for receiving the power spool 208 and the storage spool 206, respectively. The interior surface of the housing 202, 204 is indented between the chambers 226, 228. As shown best in FIG. 19, there are cylindrical projections 230 on the housing halves 202, 204 which project into the hollow ends of the storage spool 206, so the storage spool 206 is supported by and rotates on those projections 230. The power spool 208 has shoulders 232 on both ends, which are supported by and rotate in openings 234 in the housing halves 202, 204. The housing halves 202, 204 are assembled together by a rivet 210, the shaft of which extends through the storage sleeve 206 and through openings 236 in the housing halves 202, 204, and the ends of which, when assembled, are too large to pass through the openings 236. The exterior of the housing 202, 204 defines longitudinal, cylindrical projections 238 and recesses 240 at alternating corners, so that the projections 238 of one housing member project into the recesses 240 of the other housing member to assure proper alignment. It should be noted that the free ends of the projections 238 have a reduced diameter, which helps start them into the recesses 240. The exterior of each housing member 202, 204 also includes a hook 242 and a corresponding recess 244 for receiving the hook 242 of an adjacent module. A projection 246 at one end of the power spool 208 projects out of an opening 234 in the housing 202 and defines a female non-cylindrical recess 246 (See FIGS. 21 and 23). The female non-cylindrical recess 246 of the power spool 208 or 208A mates with and drives the drive shaft in the transmission module 30, which, in turn, drives the driven shaft of the transmission module 30 (shown in FIG. 1), which drives the lift rod 26, which drives the lift and tilt modules 40, as will be described later. The male non-cylindrical projection 248 on the shoulder 232 of the other end of the power spool 208 is used to prewind the motor module 20 and to transfer power from an adjacent motor module if two or more motors are connected together. The projection 248 is sized and shaped to be received in the recess 246 of an identical adjacent power spool 208 or 208A.

Alternate Embodiments of the Coaxial Spring Power Module

FIG. 28 shows an alternative embodiment of a coaxial motor 20A that is identical to the coaxial motor 20 of FIG. 16, except that: the coil spring 200 has no storage spool associated with it; the housing halves 202A and 204A are slightly different as there is no longer a projection 230 for supporting the spring 200 (as was shown in FIG. 19); there is a recess 236A instead of the opening 236; and the power spool 208A has flanges 250 just inside the shoulders 232. Also, a retaining clip 252 is shown, which will be described later. Finally, the recess 236A precludes the possibility of the use of a rivet 210, so additional openings 210A are provided and receive two rivets 210.

The elimination of the projection 230 (See FIG. 19) from the housing halves opens up an uninterrupted cavity 254 (in the place of the previous cavity 228 of FIG. 20) wherein the coil spring 200 is free to reside when in the rest or storage position. As the coil spring 200 uncoils and winds up onto the power spool 208A, the housing halves 202A and 204A prevent the coil spring 200 from revolving around the power spool 208A. The flanges 250 on the power spool 208A keep the spring coil 200 centered relative to the power spool 208A. However, when the first end 216 of the spring 200 is securely fastened to the center of the output spool 208A, and the cavity where the spring 200 is in the storage or rest position is just slightly wider than the width of the spring 200 itself, then the flanges 250 may not be required.

It should be noted that yet another possible embodiment of a coaxial motor could be assembled by combining the two previously described embodiments, namely the motor 20 (with a storage spool) and the motor 20A (without a storage spool). The new embodiment is a motor which does not have a storage spool, but does have a free-spinning shaft located so as to keep the coil spring 200 radially centered within the large uninterrupted cavity 254 of the housing of the motor 20A. Essentially, this new embodiment could look very much like the embodiment of motor 20A (See FIG. 16) with the storage spool 206 removed, letting the rivet 210 act as the free-spinning shaft in order to keep the spring 200 radially centered within the cavity 228 (or more accurately the cavity 254 of the housing 204A of the motor 20A, since the projection 230 to support the storage spool 206 would no longer be required). The advantage of this new "hybrid" motor embodiment is that frictional losses of the storage spool rotation (in the case of motor 20) and of the spring 200 rubbing against the housing cavity 254 (in the case of the motor 20A) are eliminated, resulting in a more efficient motor.

The retaining clip 252 has a projection 256, which is received in a hole 258 in the motor housing. It also has a non-cylindrical hole 260, which mates with the shaft 248 of the power spool 208A to retain the power spool 208A in the desired position. Thus, the coil spring motor module may be preloaded after assembly, with the coil spring 200 fully wound onto the power spool 208A, and the power spool 208A then locked in place by use of the retaining clip 252.

The coil spring 200 may vary depending on the desired spring force, as is well known in the industry. The coil spring 200 may be as wide as the axial distance between the flanges 250 of the power spool 208A, or it may be narrower than this distance. The coil spring 200 is typically made from a thin sheet of metal of constant thickness and width. It is possible to make a coil spring from a thin sheet of metal with a non-constant thickness and/or a non-constant width.

Figure 17:
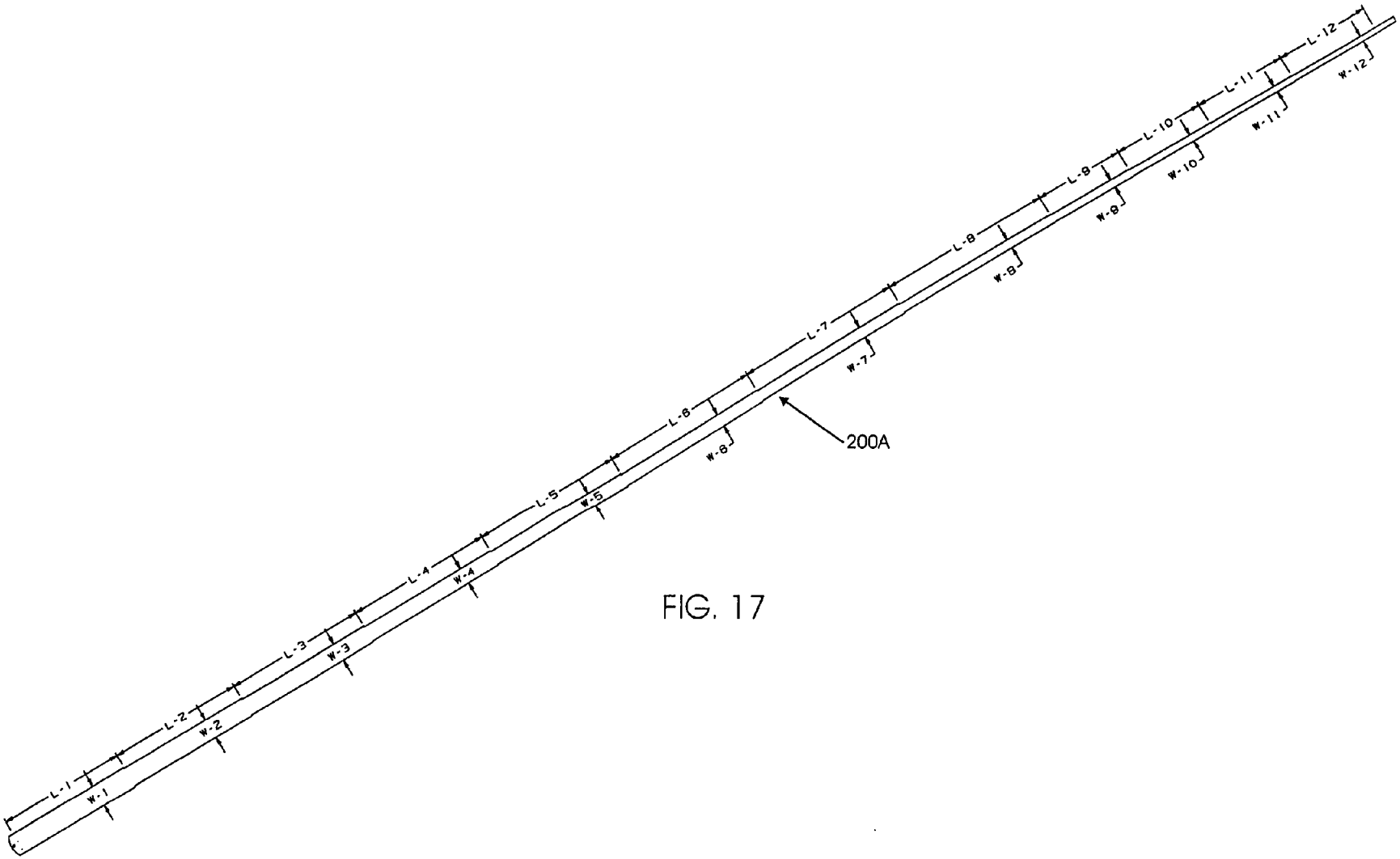
FIG. 17 is a plan view of a step-wise tapered coil spring, in un-coiled form, which may be used in the coaxial coiled spring motor of FIG. 15.
Figure 19:
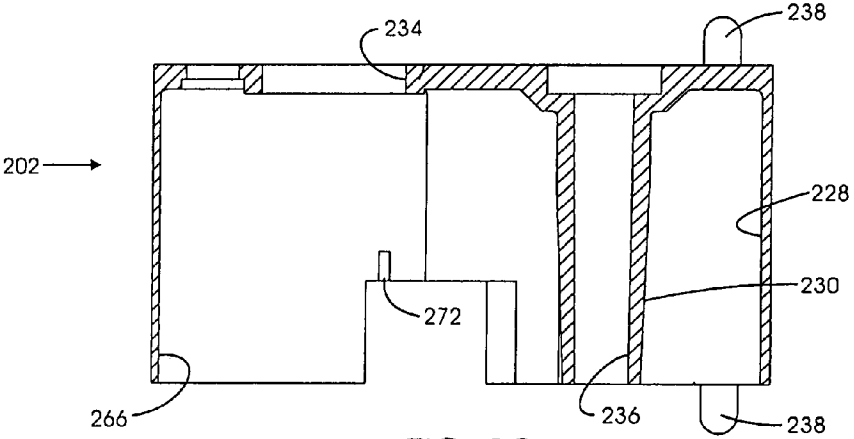
FIG. 19 is a top section view of the housing half of FIG. 18B.
Figure 20:
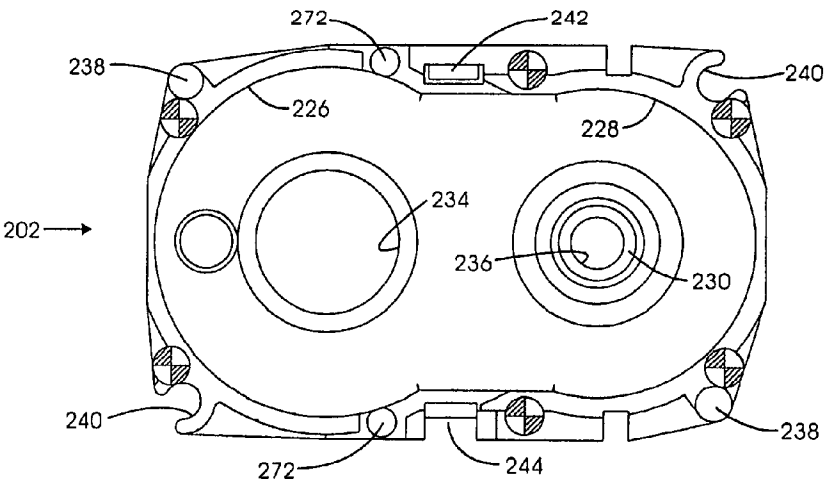
FIG. 20 is a front sectional view of the housing half of FIG. 18B.
Figure 18A:
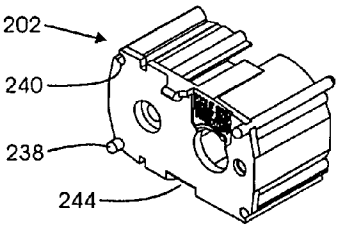
FIG. 18A is a perspective outer view of an embodiment of a housing half, two of which are needed for the coiled spring motor of FIG. 15.
Figure 18B:
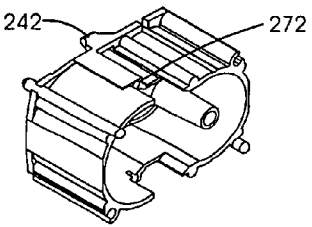
FIG. 18B is an inner view of the housing half of FIG. 18A.
Figure 18C:
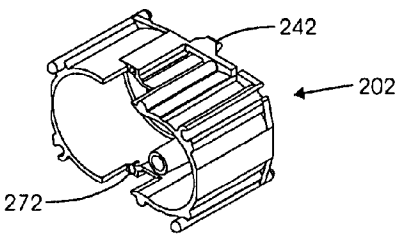
FIG. 18C is the same view as FIG. 18B, but rotated 180 degrees around an imaginary vertical axis through the middle of the housing.
Figure 25:
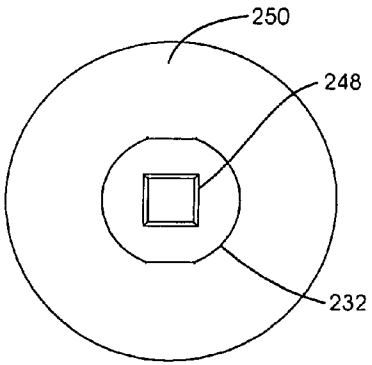
FIG. 25 is a input-end view of the power spool of FIG. 22.
Figure 25A:
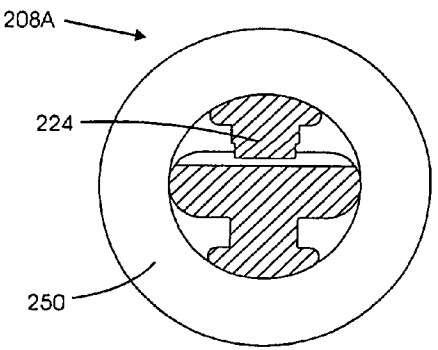
FIG. 25A is a view along line A-A of FIG. 24.
Figure 24:
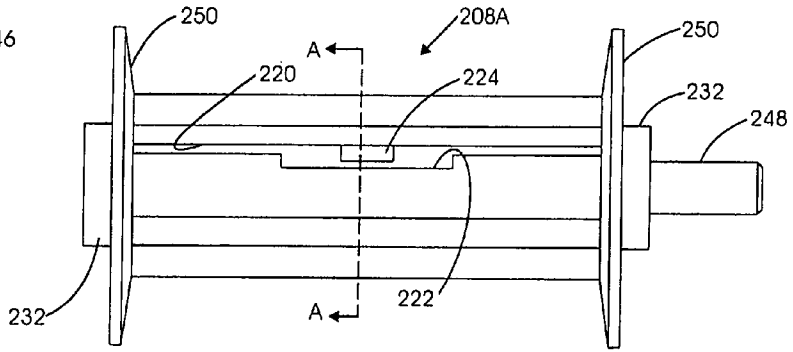
FIG. 24 is a side view of the power spool of FIG. 22.

FIG. 17 is a plan view of one such possible version of the coil spring 200A, in its uncoiled condition, showing how the width of the coil spring may be changed stepwise to obtain a particular power curve. In this particular case, the coil spring is widest at its first end, where it first starts to coil onto the power spool, and the width is reduced in a series of steps such that it is narrowest at its second end. This stepped coil spring will thus be strongest at its first end, which corresponds to when the blinds are in the fully raised position, when the most force is required to hold the blind in that position. The coil spring will be weakest when it is fully wound onto the power spool, corresponding to when the blind is in the fully lowered position, when the least force is required to hold the blind in that position. Thus, this is a very desirable feature for a coil spring as it may eliminate the need for a transmission module 30, or at least substantially reduce the range required of the transmission. The stepwise taper shown in FIG. 17 is only one possible way to obtain this desirable feature in a coil spring. Other ways to obtain similar results can be via a straight taper (vs the stepwise taper), varying the thickness of the spring instead of varying the width, or even by putting holes in the spring. In all cases, the intent is to progressively weaken the strength of the spring so that it is strongest at its first end, where it first starts to wind up onto the power spool, and weakens thereafter.

It is important to note that the coil spring has a tendency to wander or "telescope". The approaches we have disclosed in order to minimize this telescoping, including flanges on the power spool 208, flanges on the storage spool 206, and close control of the width of the pocket where the coil spring rests, are ineffective when dealing with a stepped spring. This wandering or telescoping tendency can be minimized for all coil springs by securing the second end of the coil spring to the center of the storage spool 206 in much the same manner as the first end of the coil spring is secured to the center of the power spool 208.

Figure 30:
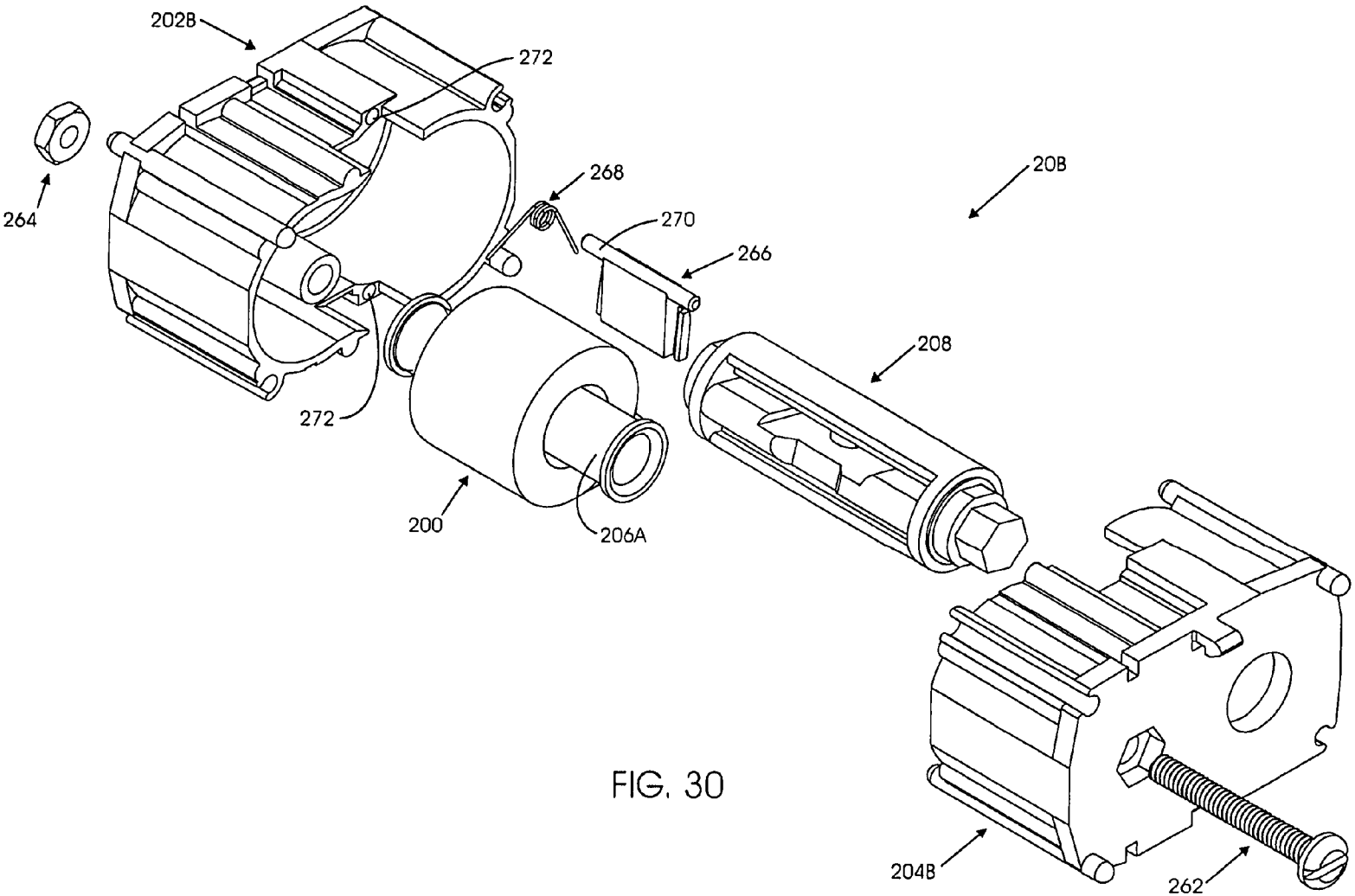
FIG. 30 is an exploded view of a third embodiment of a coaxial coiled spring motor similar to the motor of FIG. 14, but wherein there is an anti-backlash gate installed.

FIG. 30 shows another alternative embodiment of a coaxial motor 20B similar to the motor 20 shown in FIG. 14. It is essentially identical to the coaxial motor of FIG. 16, except that: the storage spool 206A is slightly different; the housing 202B and 204B is also slightly different to accommodate the use of a threaded fastener 262 and nut 264 instead of the rivet 210; and an optional anti-backlash gate 266 and associated gate spring 268 have been added.

Figure 32:
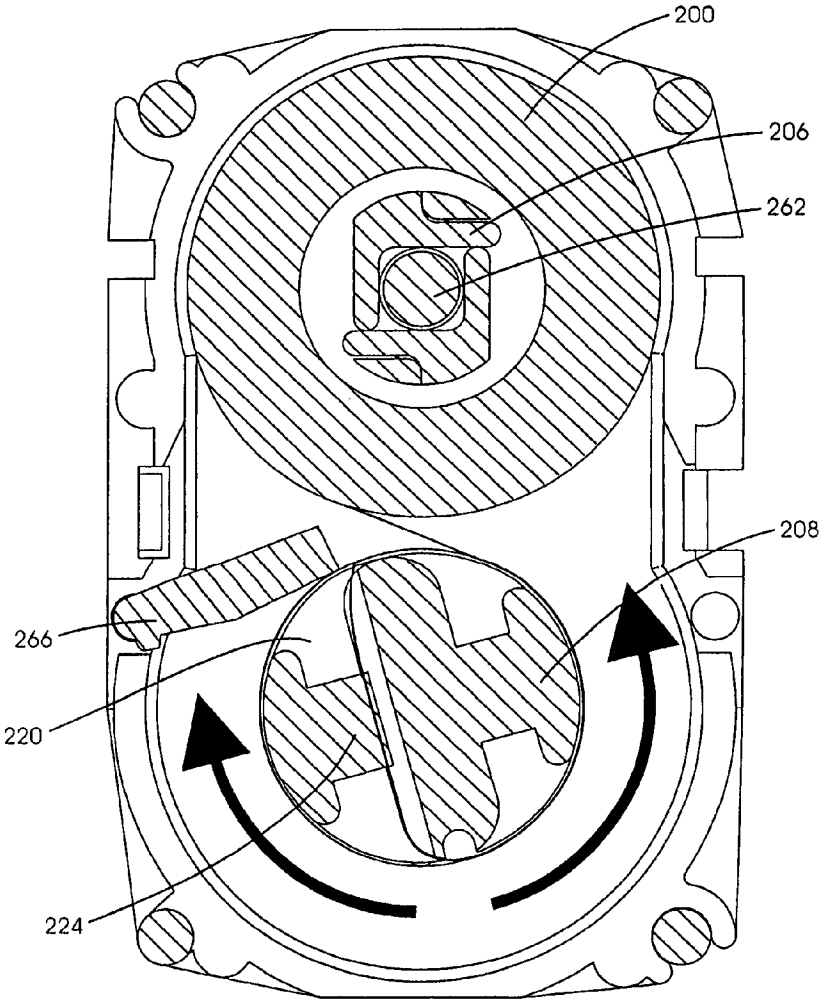
FIG. 32 is the same sectional view of FIG. 31 but with the spring being wound up onto the power spool.
Figure 31:
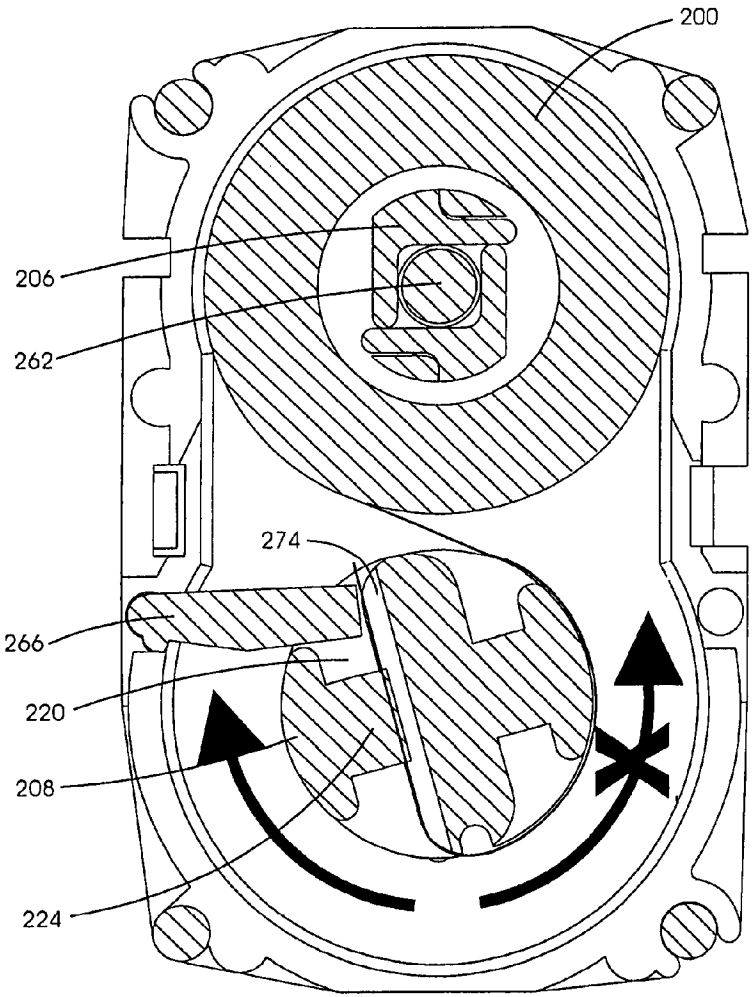
FIG. 31 is a sectional view of the coaxial coiled spring motor of FIG. 30 in the resting position.

The anti-backlash gate 266, is an optional part that may be omitted, if desired. The gate 266 has an axle 270, which extends through the gate spring 268 and into recesses 272 in the housing 202B, 204B. The anti-backlash gate 266 prevents the coil spring 200 from being wound up backwards onto the power spool 208, which would damage the coil spring 200. It is expected that the anti-backlash gate 266 would only come into play during prewinding of the coil spring 200, because, once the spring 200 is prewound, it never again unwinds enough from the power spool 208 for the anti-backlash gate 266 to function. As shown in FIG. 31, when the power spool 208 is unwound, the gate 266 prevents the power spool 208 from rotating counter-clockwise by interfering with the edge 274 of the opening 220. However, the gate 26 permits the power spool 208 to rotate clockwise. Once the coil spring 200 is wound up on the power spool 208, covering the opening 220, as shown in FIG. 32, the gate 266 does not interfere with rotation of the power spool 208 in either direction.

Figure 33:
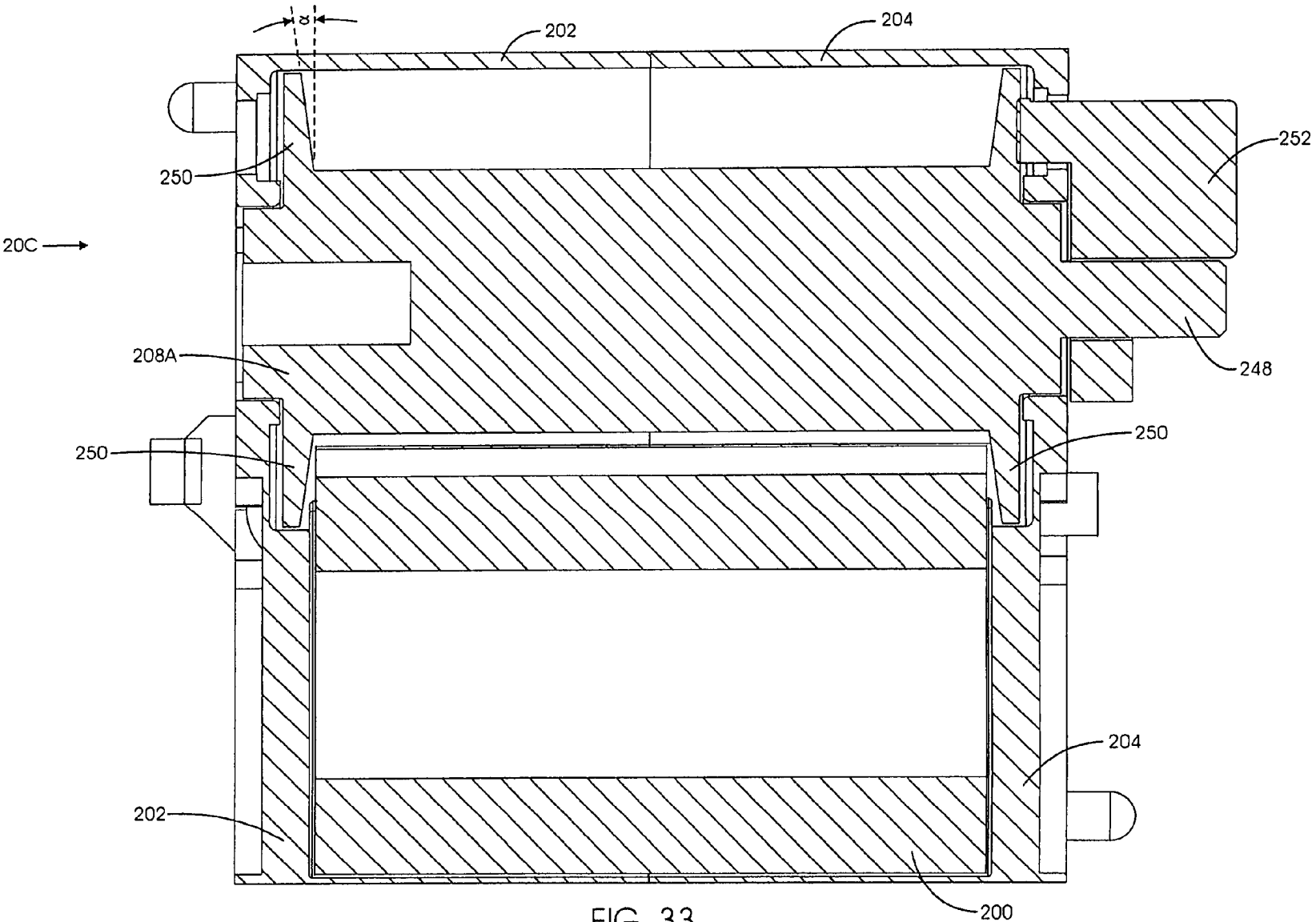
FIG. 33 is a sectional view of an embodiment of a coaxial coiled spring motor depicting the power spool with outwardly diverging flanges to help locate, guide, and center the coiled spring relative to the power spool.

There are other variations that may be made in the design of the coaxial power module, and some of these are listed below where special characteristics or features are highlighted:

FIG. 33 is a sectional view of an embodiment of a coaxial coiled spring motor 20C depicting the power spool 208A with outwardly diverging flanges 250 at both ends to help locate, guide, and center the coil spring 200 relative to the power spool 208A. The coil spring 200 is free to rotate within its cavity 254 (See FIG. 28) and is not supported on a storage spool. The flanges 250 have an interior dimension between the two flanges 250 at the base of the flanges 250, which is a close fit with the width of the coil spring 200 being used. The interior surface of each flange 250 tapers outwardly as shown, creating an angle $\alpha$ with a plane perpendicular to the axis of the power spool 208A. Ideally this angle $\alpha$ is not less than 2 degrees and not more than 20 degrees. The significance of the taper on the flanges 250 is that, as the coil spring 200 winds onto the power spool 208A, the coil spring 200 is centered onto the power spool 208A. However, as the flanges 250 resist the lateral movement of the coil spring 200, there is a friction created which results in higher system inertia and thus higher power consumption. By having a taper on the flanges 250, this interference and its associated friction are reduced, resulting in a more energy efficient mechanism.

Figure 34:
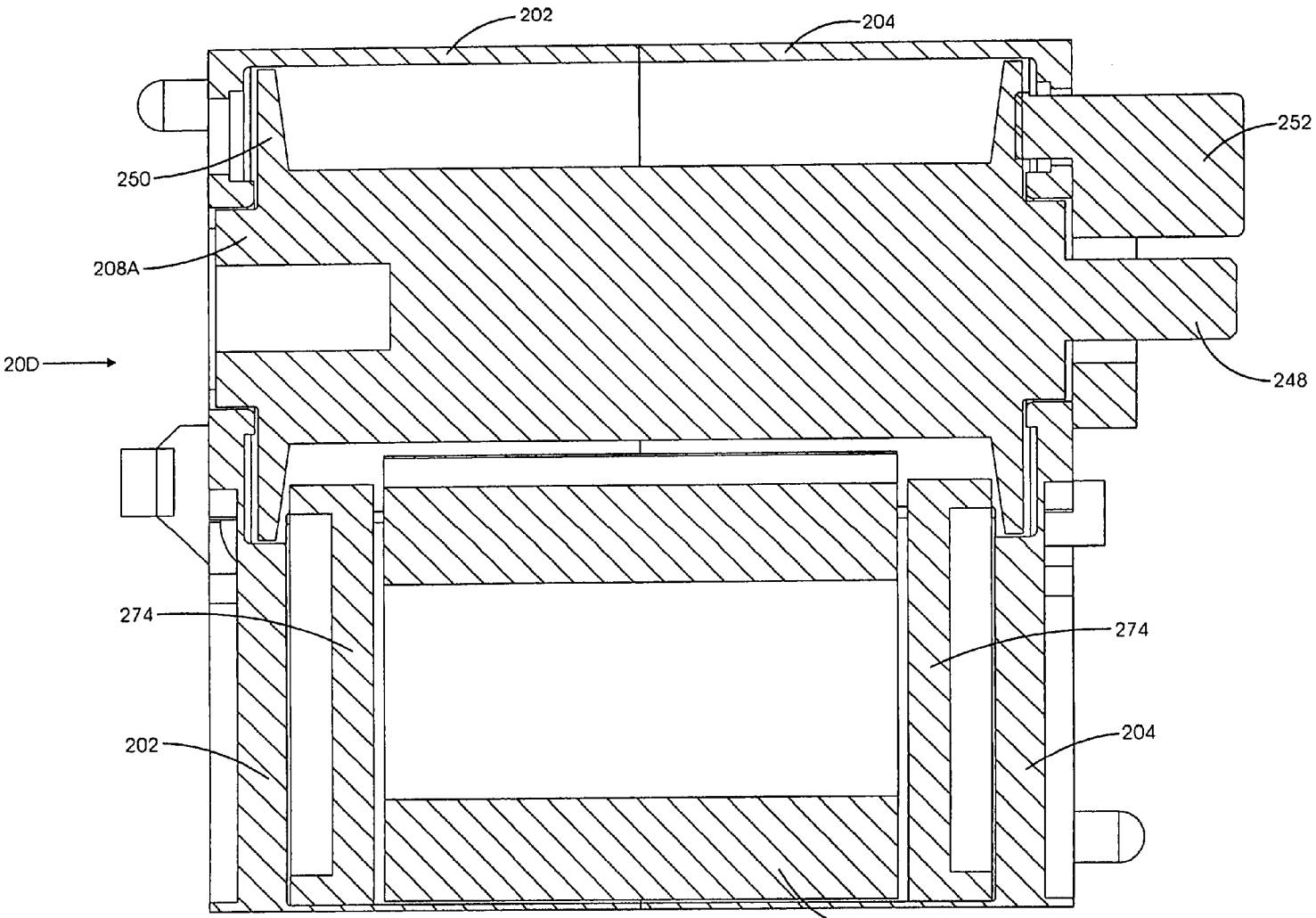
FIG. 34 is a sectional view of an embodiment of a coaxial coiled spring motor depicting spacers at each end of the spring when in the storage position, to help locate, guide, and center the coiled spring relative to the power spool.

FIG. 34 is a sectional view of an embodiment of a coaxial coiled spring motor 20D which is similar to the embodiment of FIG. 33, except that in this embodiment there are spacers 274 at each end of the coil spring 200 in the cavity 254, to help locate, guide, and center the coil spring 200 relative to the power spool 208A. This is very helpful when the coil spring 200 is substantially narrower than the interior dimension between the two flanges 250. This simple concept permits the use of several widths of coil springs in the same housing, with only very minor modifications to the thickness of the spacers 274.

Figure 35:
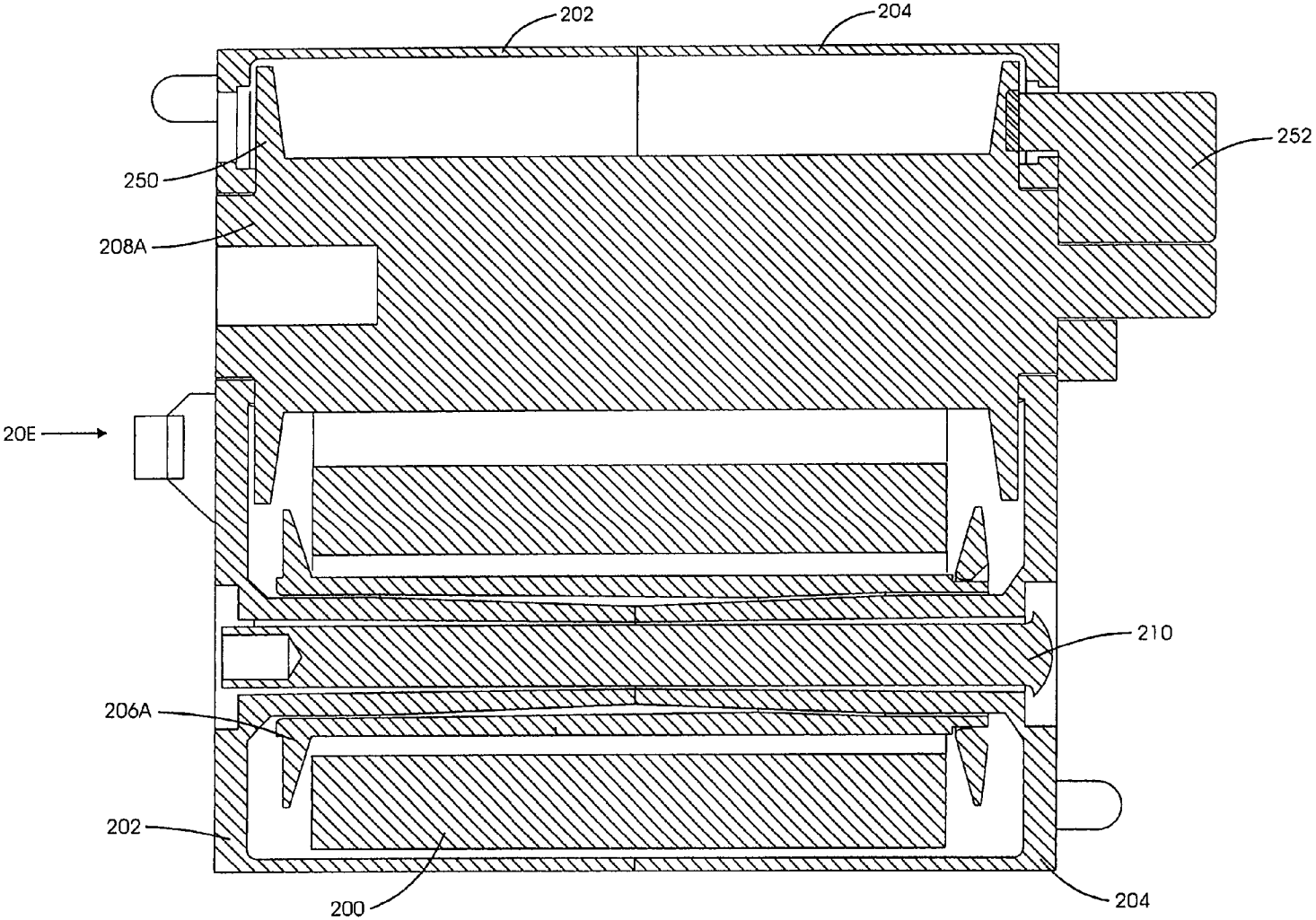
FIG. 35 is a sectional view of an embodiment of a coaxial coiled spring motor depicting the power spool and the storage spool located such that the total of the radius of the flange on the storage spool plus the radius of the flange on the power spool plus one half the thickness of the spring equals or exceeds the distance between the axis of the storage spool and the axis of the power spool.

FIG. 35 is a sectional view of another embodiment of a coaxial coiled spring motor 20E depicting the power spool 208A and the storage spool 206A located such that the total of the radius of the flange on the storage spool 206A plus the radius of the flange 250 on the power spool 208A plus one half the thickness of the coil spring 200 equals or exceeds the distance between the axis of the storage spool 206A and the axis of the power spool 208A. The significance of this dimensional relationship is that it is then physically impossible for the coil spring 200 to become wedged between the flanges of the storage spool 206A and the flanges of the power spool 208A because the radial gap between these flanges is less than the thickness of the coil spring 200.

Figure 36:
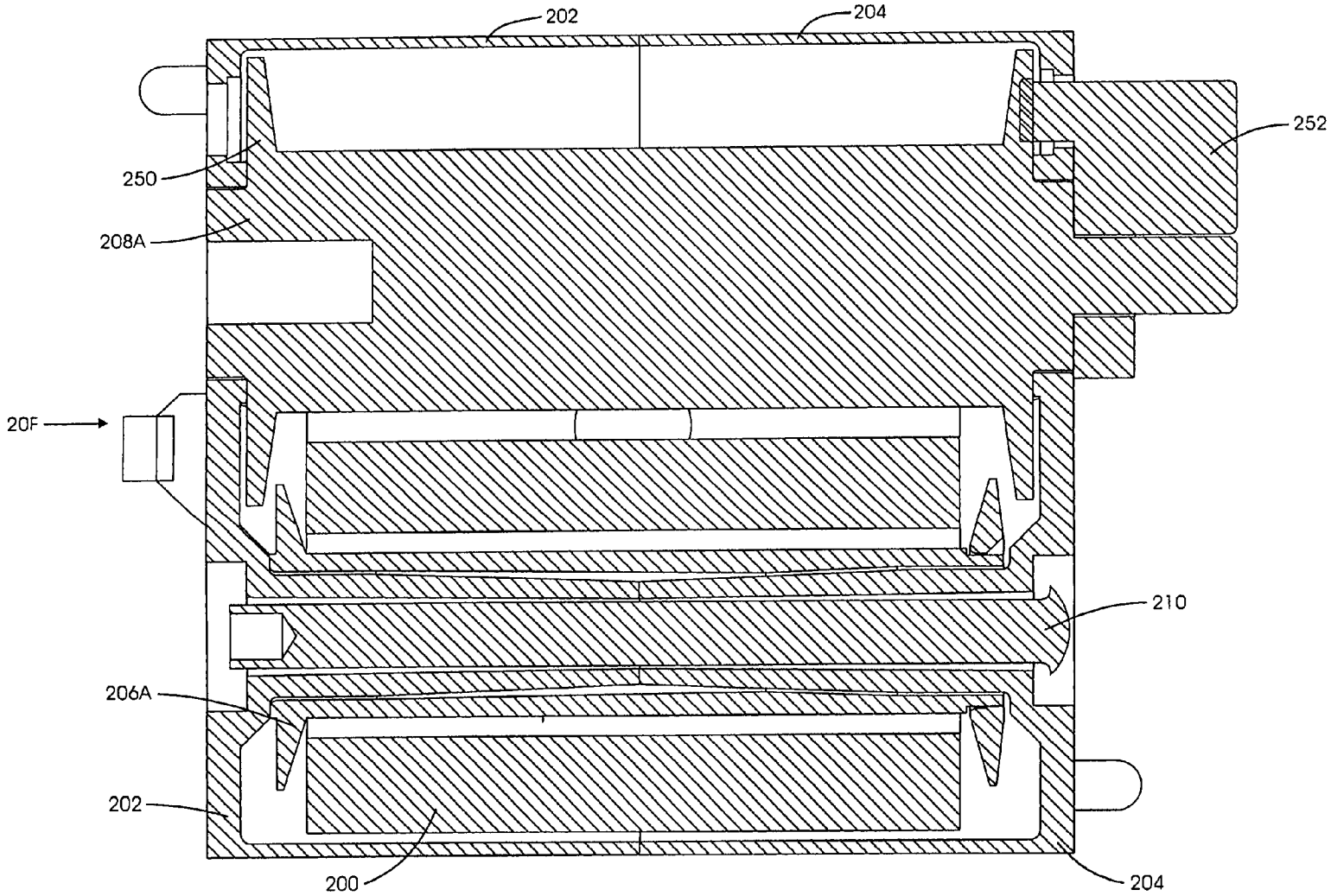
FIG. 36 is a sectional view of an embodiment of a coaxial coiled spring motor similar to the embodiment of FIG. 35 but wherein the outside of the flanges of the storage spool fit inside the inside of the flanges of the power spool.

FIG. 36 is a sectional view of an embodiment of a coaxial coiled spring motor 20F similar to the embodiment of FIG. 35 but wherein the outside edges of the flanges 250 of the storage spool 206A fit inside the inside of the flanges of the power spool 208A. The significance of this constraint is that now the storage spool 206A is always centered in the power spool 208A. Since the coil spring 200 is centered in the storage spool 206A by virtue of the tapered flanges on the storage spool 206A, and the storage coil 206A is always centered in the power spool 208A, then the coil spring 200 will also always be centered in the power spool 208A.

Figure 37:
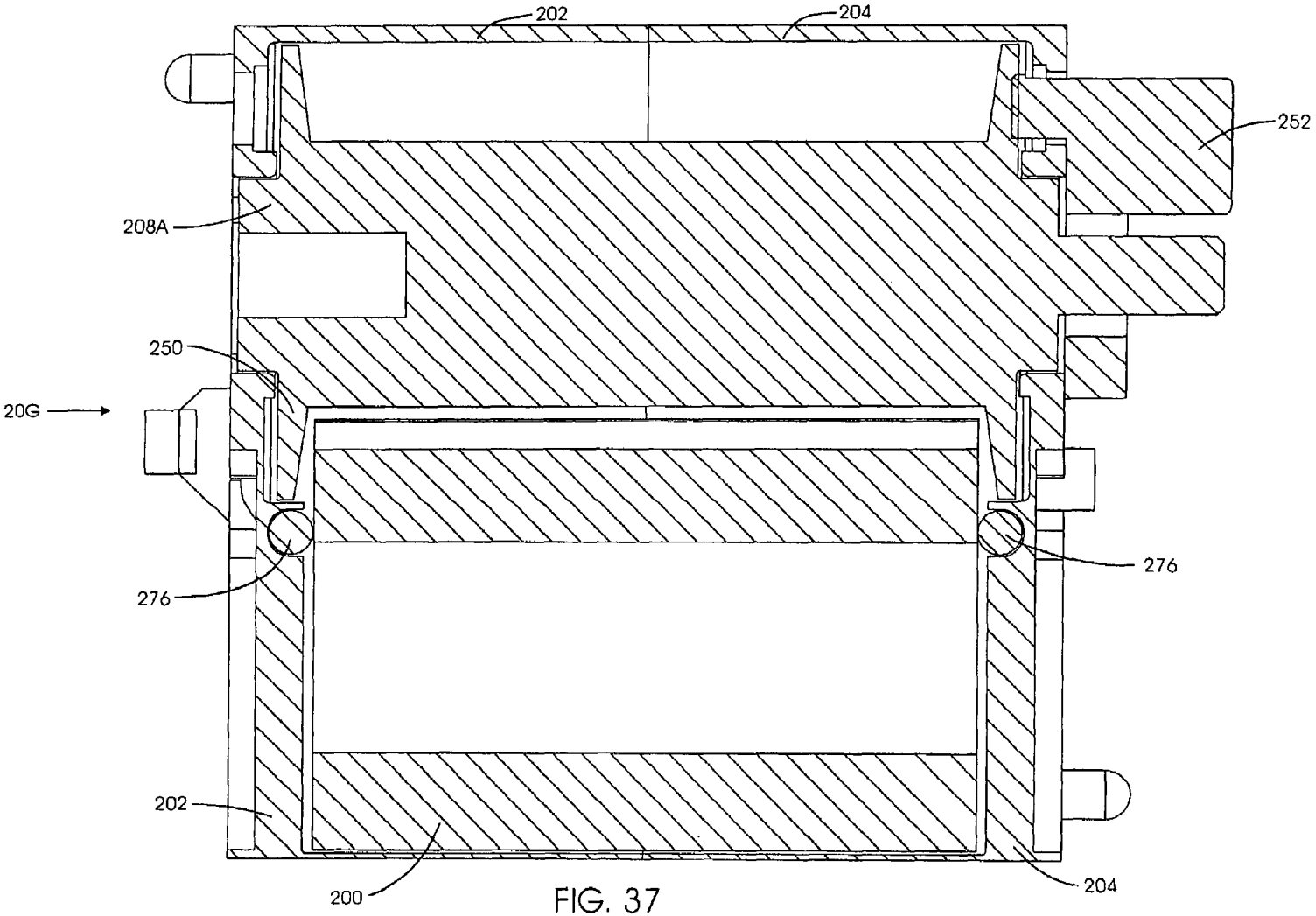
FIG. 37 is a sectional view of an embodiment of a coaxial coiled spring motor depicting the coiled spring without a storage spool, as in FIG. 34, except that rollers are now used to help locate, guide, and center the coiled spring relative to the power spool.

FIG. 37 is a sectional view of an embodiment of a coaxial coiled spring motor 20 depicting the coil spring 200 without a storage spool, as in FIG. 34, except that rollers 276 are now used to help locate, guide, and center the coiled spring 200 relative to the power spool 208A. This is similar to the concept of using spacers 274 discussed with respect to FIG. 34, except that now a simple bar or roller 276 at each end of the coil spring 200 accomplishes the task of keeping the coil spring 200 centered in the power spool 208A, while at the same time reducing the friction between the spring 200 and the end walls of the housing 202, 204. The rollers 276 can be inserted and press fitted through holes (not shown) drilled into the housings 202, 204. This eliminates the need for spacers 274, and for having to modify these spacers 274 depending on the width of the coil spring 200. There are no preset recesses or holes in the housing 202, 204 to receive the rollers 276. Instead, the correct drilling of the holes in the housing 202, 204, depending on the width of the spring 200, will properly locate the rollers 276 to accomplish their centering task. The holes for locating the rollers could be molded into the housing for several standard or anticipated widths of the coil spring 200, instead of post drilling the holes.

Figure 38:
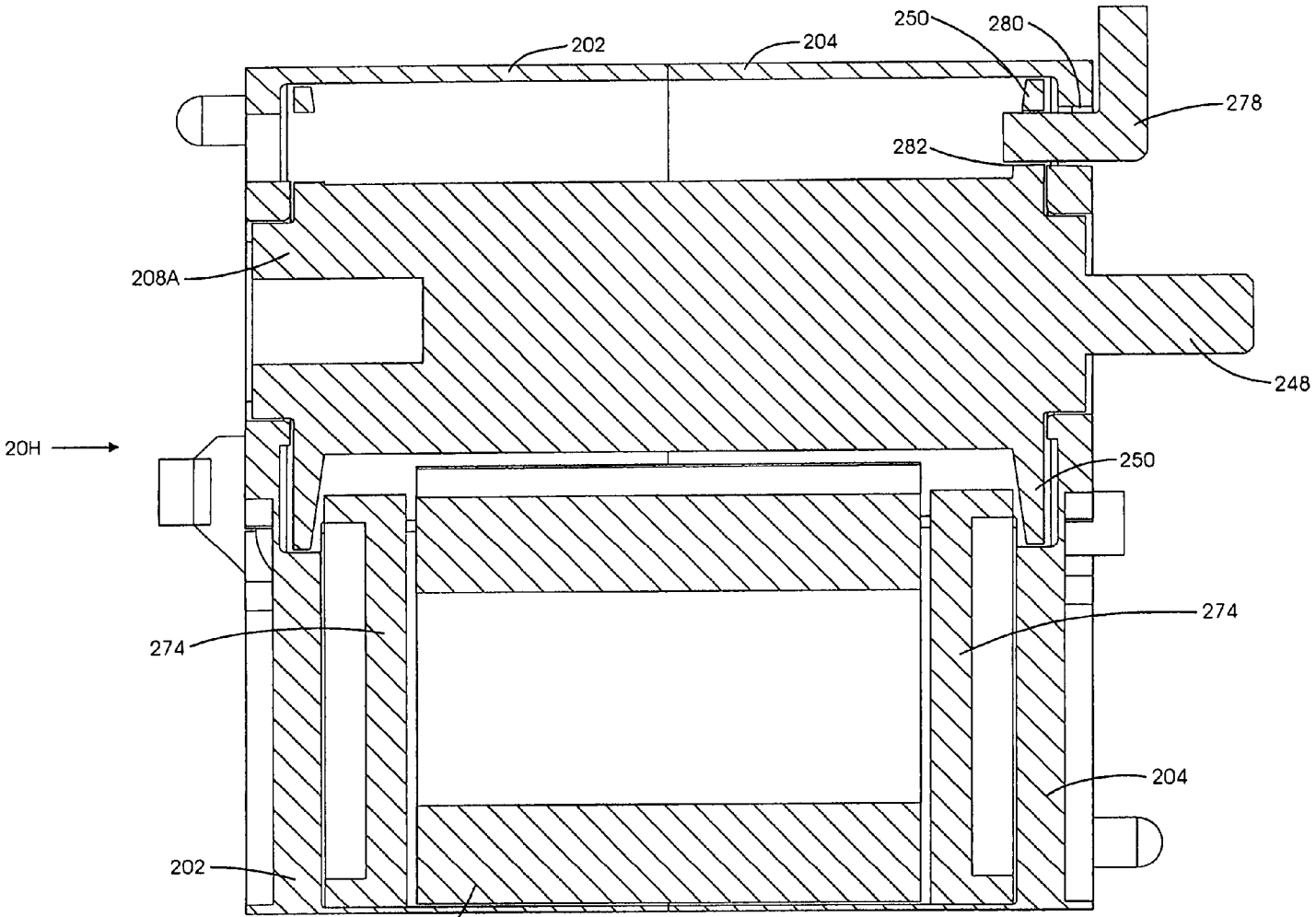
FIG. 38 is a sectional view of an embodiment of a coaxial coiled spring motor, similar to the motor of FIG. 34, except it depicts the use of a locking pin instead of a locking clip.

FIG. 38 is a sectional view of an embodiment of a coaxial coiled spring motor 20, identical to FIG. 34, except it depicts the use of a locking pin 278 instead of a retaining clip 252. A locking pin 278 extends through a hole 280 (See also FIG. 16) in the housing 204 and into a groove 282 in the flange 250 of the power spool 208A to hold the coil spring 200 in the prewound position. Once the blind is fully assembled, in its fully extended position, the locking pin 278 is pulled out, so that the coil spring 200 then winds up onto itself in the storage chamber 254 as the blind is raised. The force of the coil spring 200 winding up itself provides the counterbalance force to assist in raising the blind and in holding the blind in the desired position. When a user pulls the bottom slat (or bottom rail) 14A of the blind downwardly, the lift cords 16 cause the spring 200 to be rewound onto the power spool 208A, as will be explained in more detail later.

As was mentioned earlier, it is possible to connect two or more of the coaxial coil spring motors together as needed to provide sufficient force. When combining motors, it is preferable to connect the first motor to the transmission 30 and pin the transmission in place, then remove the locking pin 278 (or retaining clip 252) from the first motor, then snap a second motor onto the first motor with the power spool shafts of the two motors mating, and then remove the locking pin from the second motor.

Alternate Embodiment of the Power Module: The Transaxial Motor

The blind 10L of FIG. 13 is very similar to the blind of FIG. 7, except that this blind uses a transaxial power module 21 instead of the coaxial power module 20 of FIG. 7. Due to the space constraints in the head rail 12A, there is a limit to the size of the spring that can be used if the axis of the spring in the power module has to be aligned with or parallel to the axis of the lift rod 26. As was explained above, it is possible to connect coaxial power modules 20 together in order to increase the amount of force provided by the motors. Alternatively, it is possible to use a transaxial power module 21, in which the axis of the spring used in the power module 21 is perpendicular to the axis of the lift rod 26. It is because of this transaxial placement of the spring that a larger spring may be used to obtain a greater spring force. When a transaxial power module 21 is used, gears are used to make the right angle transition, which causes a loss of efficiency. The transaxial power modules 21 can also be connected together to provide an even greater spring force, or transaxial power modules 21 and coaxial power modules 20 can be combined.

FIGS. 40-63 show a couple of different embodiments for the transaxial power module. It should be noted that the dimensions of the transaxial power module 21 will vary depending upon the size of the head rail in which the module is to be installed. This transaxial power module 21 functions very similarly to the coaxial power module 20. It includes a storage spool 300, a power spool 302, a coil spring 304 (not shown in FIG. 41 but shown in FIG. 44) which wraps up on the storage spool 300 and power spool 302, a spacer 306 (which is used when the coil spring 304 is narrower than the length of the storage spool 300), an anti-backlash gate 308 with a spring 310, and a housing 312 with a cover 314. The housing 312 defines two upwardly-projecting, cylindrical spindles 316, 318. The storage spool 300 has a hollow cylindrical axis which drops down onto the first spindle 316, and the power spool 302 similarly has a hollow cylindrical axis which drops down onto the second spindle 318, so the storage spool 300 and power spool 302 rotate on their respective spindles 316, 318. There is a hole 320A in the housing cover 314, and there is a corresponding hole 320B in the power spool 302, which allows the transaxial power module 21 to be prewound and pinned in place, as was described earlier with respect to the coaxial power module 20.

The power spool 302, shown in detail in FIGS. 45-48, has a smooth flange 322 at one end and a geared flange 324 at the other end. It defines a central opening 326 (See FIG. 48), a rectangular recess 328, and a cylindrical projection 330 projecting toward the recess 328 for retaining the end of the coil spring 304, similar to the retaining arrangement in the coaxial power module 20.

Figure 41:
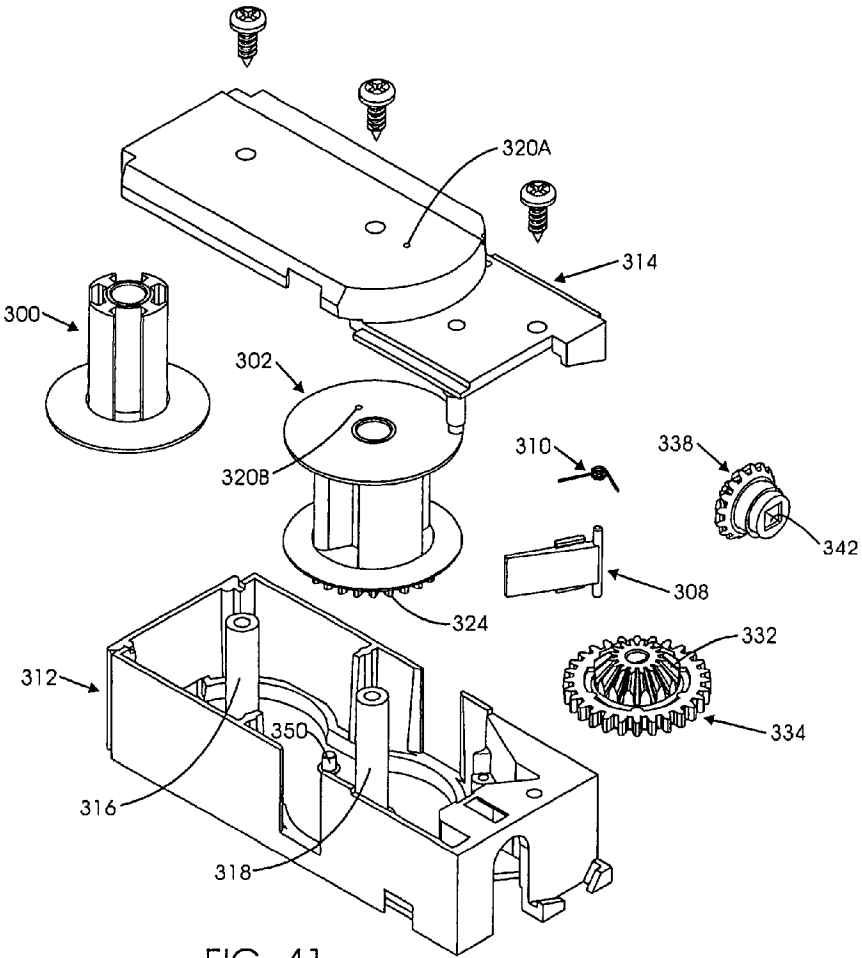
FIG. 41 is an exploded view of the transaxial coiled spring motor of FIG. 40.
Figure 44:
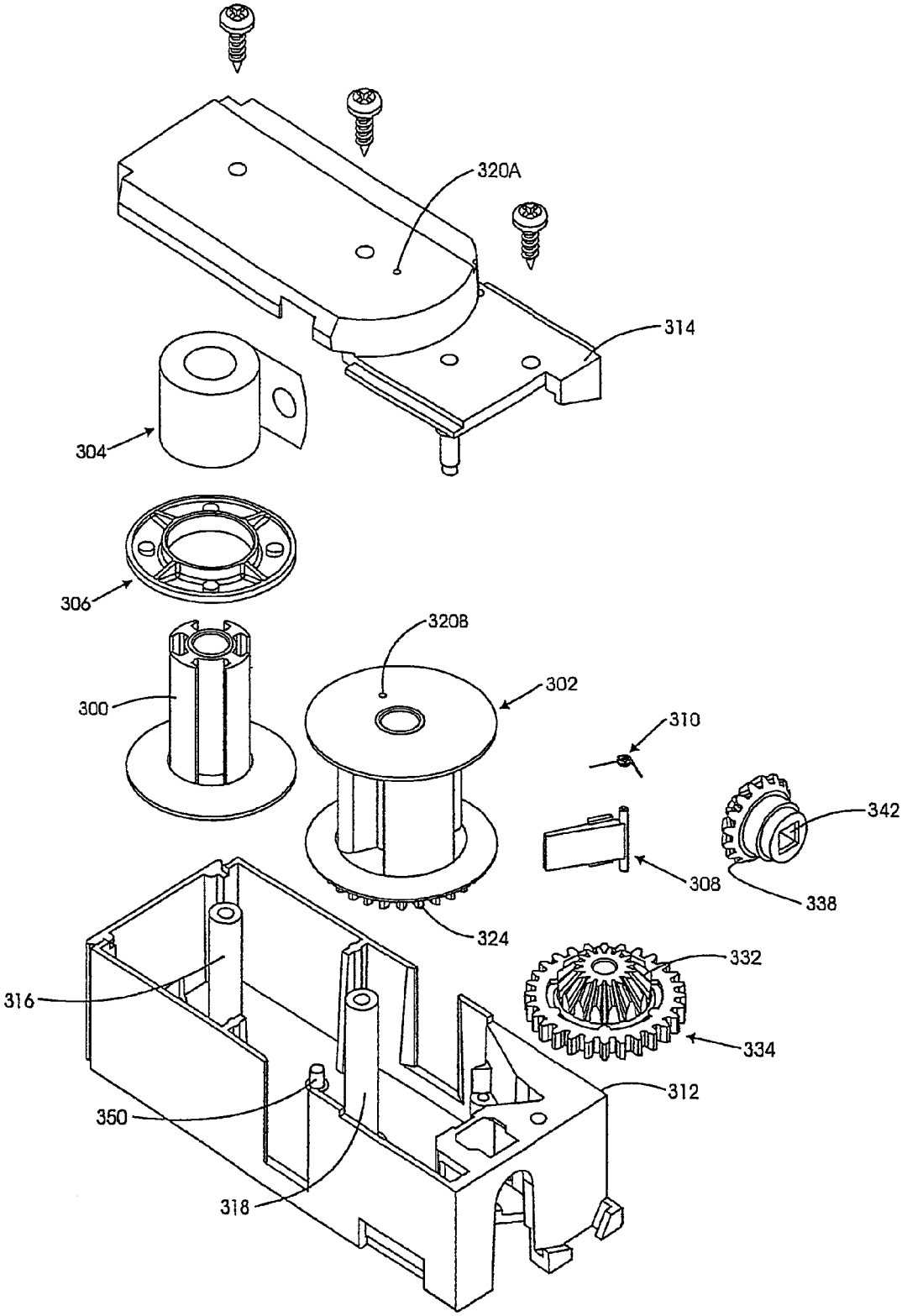
FIG. 44 is an exploded view of an alternate embodiment of a transaxial coiled spring motor similar to the motor of FIG. 40.
Figure 47:
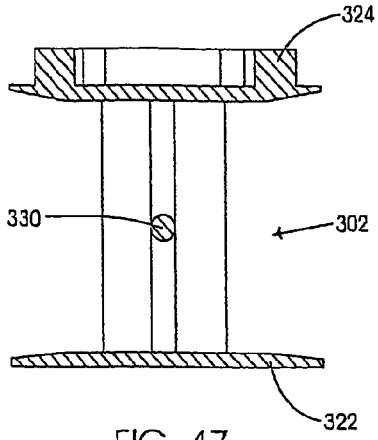
FIG. 47 is a side view, partially in section, of the power spool of FIG. 46, but rotated 90 degrees along its axis of rotation.
Figure 48:
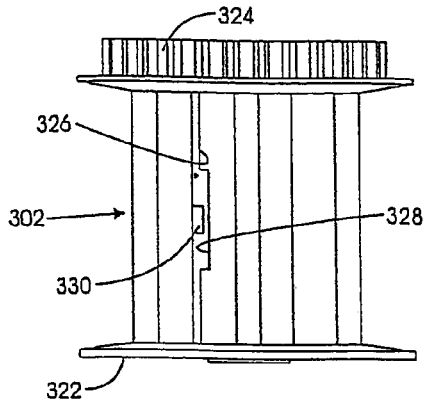
FIG. 48 is a front view of the power spool of FIG. 46.
Figure 46:
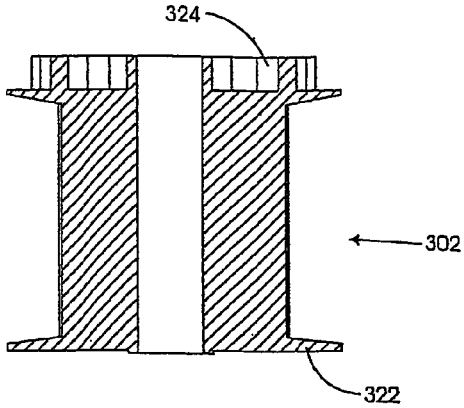
FIG. 46 is a sectional view of the power spool of FIG. 45A.
Figure 45A:
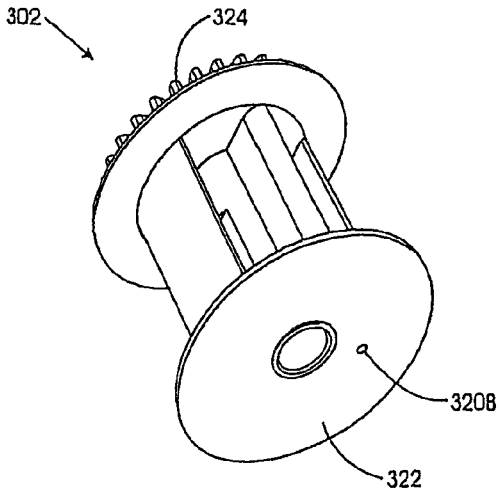
FIG. 45A is a top perspective view of the power spool of the transaxial coiled spring motor of FIG. 41.
Figure 45B:
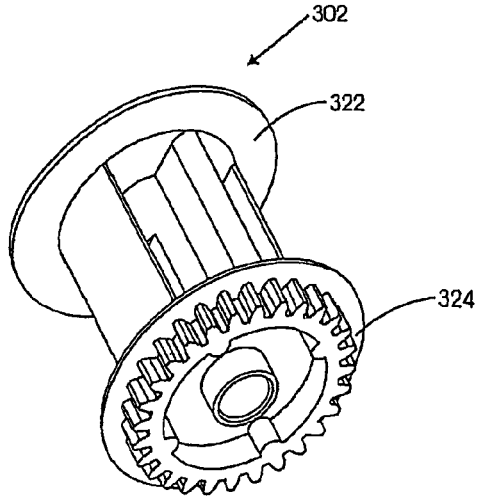
FIG. 45B is a bottom perspective view of the power spool of FIG. 45A.
Figure 49A:
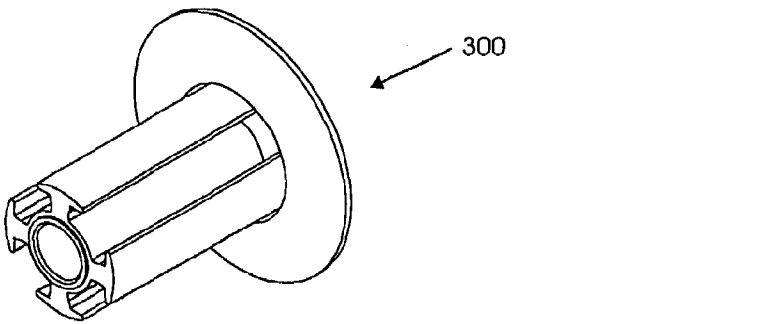
FIG. 49A is a top perspective view of the storage spool of FIG. 41.
Figure 49B:
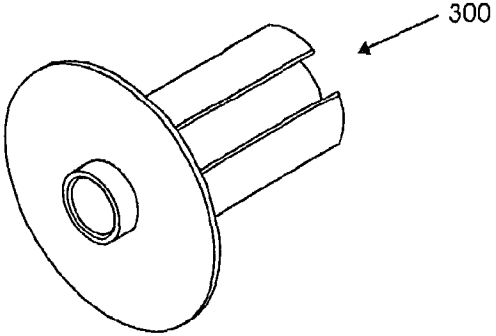
FIG. 49B is a bottom perspective view of the storage spool of FIG. 41.
Figure 50:
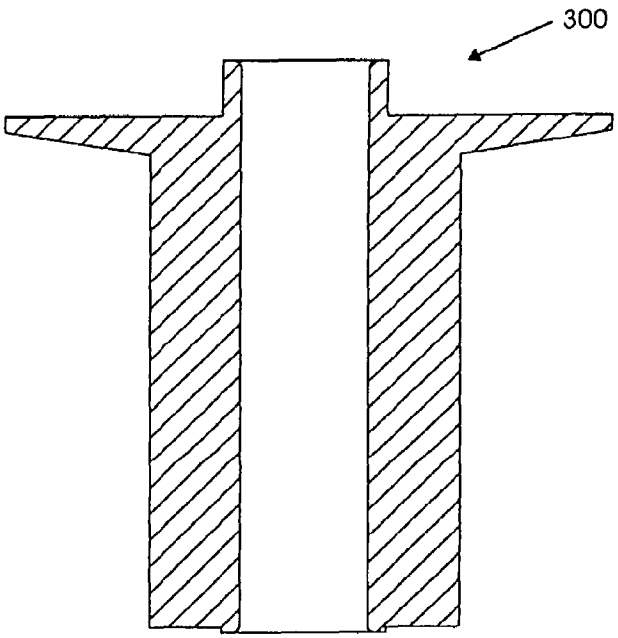
FIG. 50 is a sectional view of the storage spool of FIG. 41.
Figure 51:
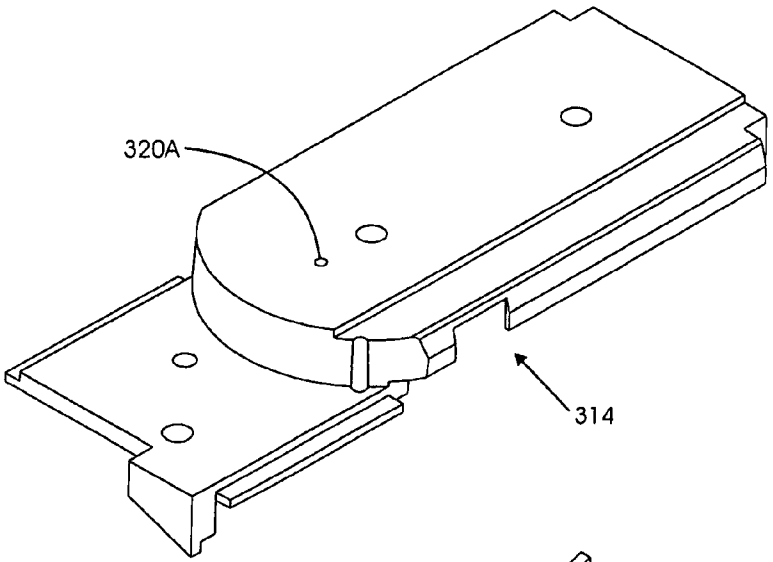
FIG. 51 is a top perspective view of the housing cover of FIG. 41.
Figure 52:
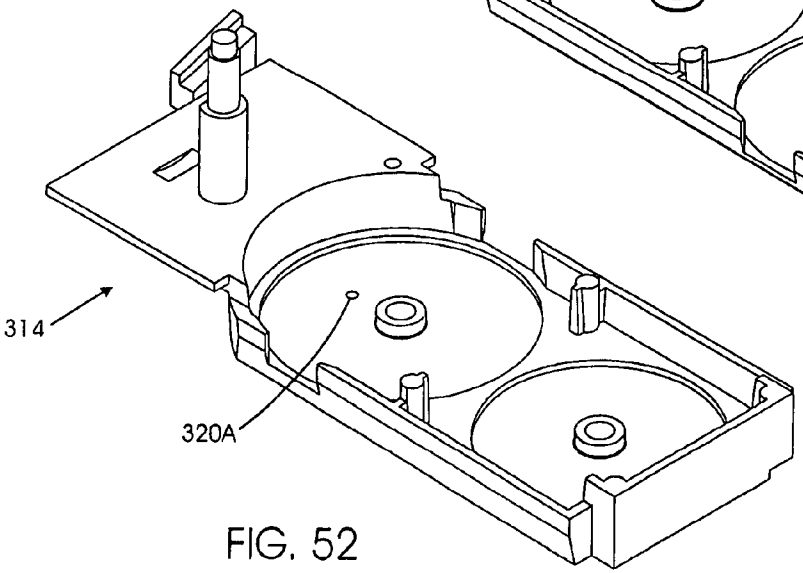
FIG. 52 is a bottom perspective view, input-end, of the housing cover of FIG. 51.
Figure 53:
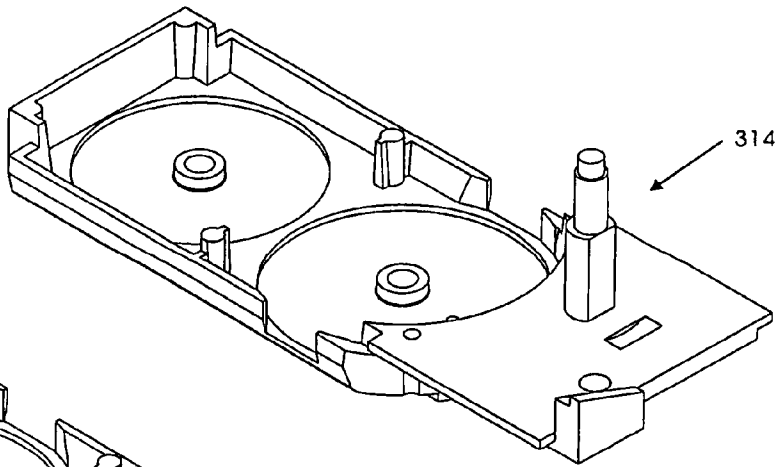
FIG. 53 is a bottom perspective view, output-end, of the housing cover of FIG. 51.
Figure 55:
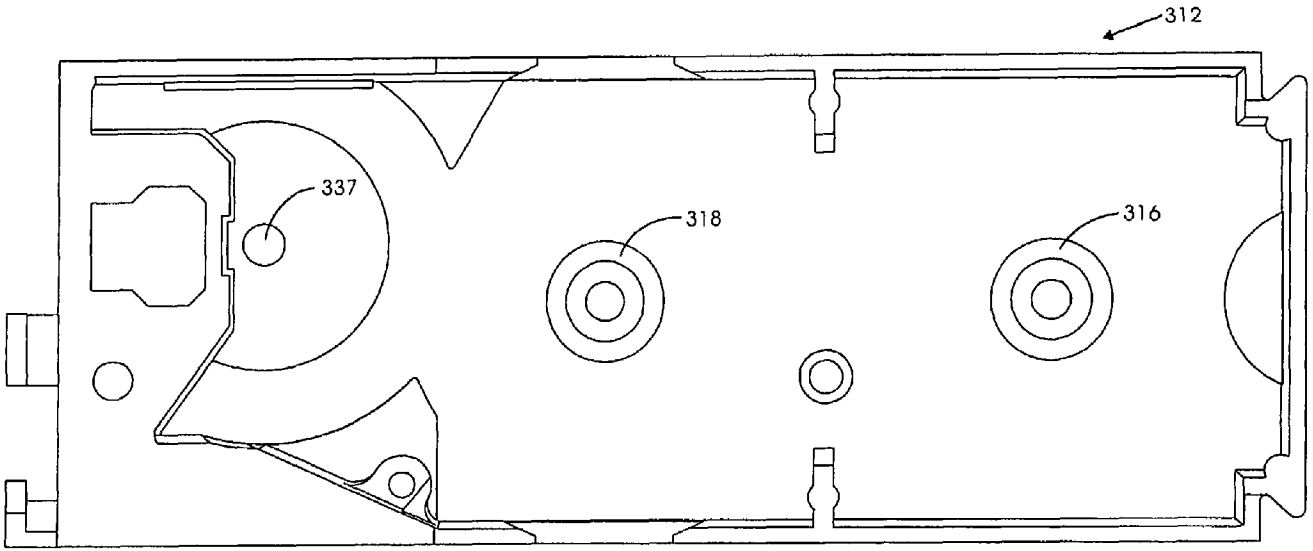
FIG. 55 is a plan view of the housing of FIG. 54.
Figure 54:
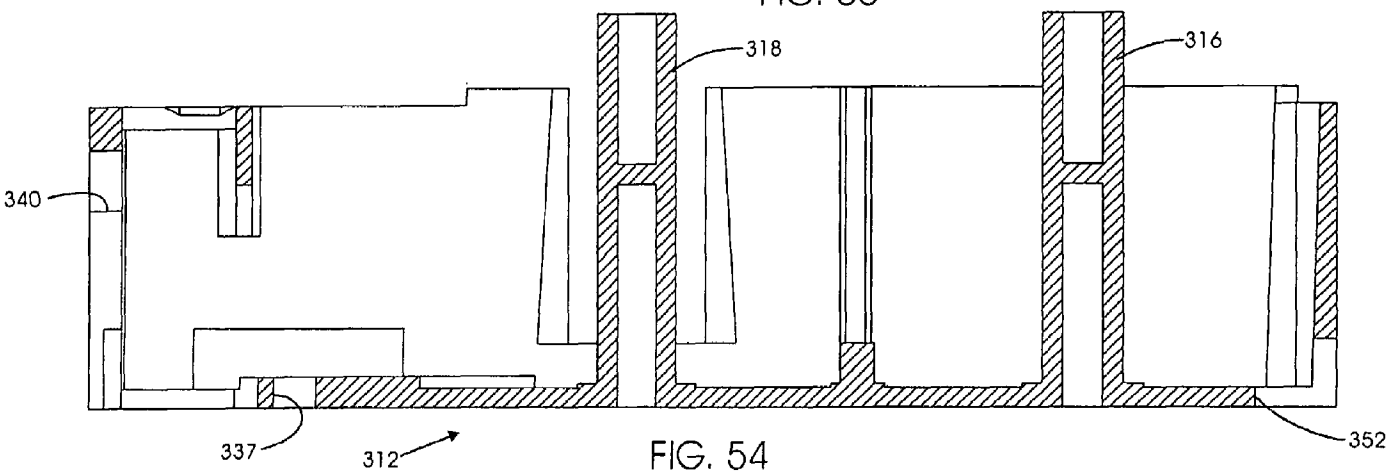
FIG. 54 is a sectional view of the housing of FIG. 41.
Figure 56B:
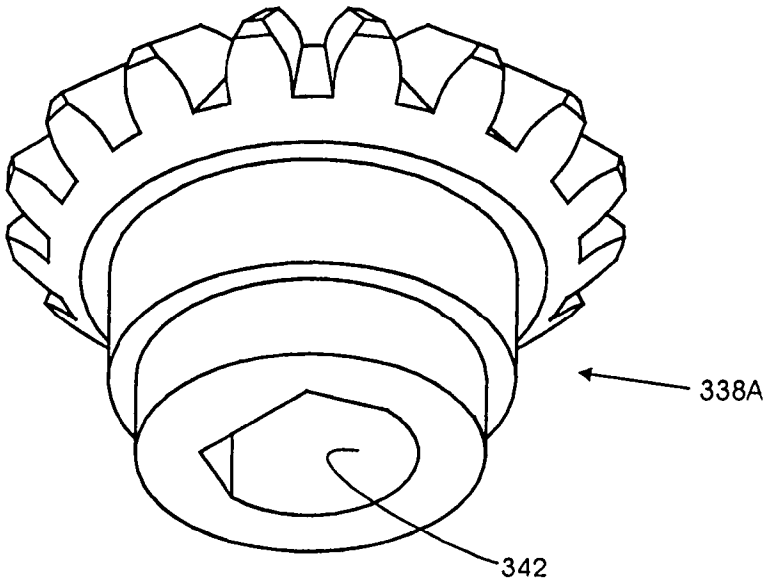
FIG. 56B is a right perspective view of the output gear of FIG. 56A.
Figure 56A:
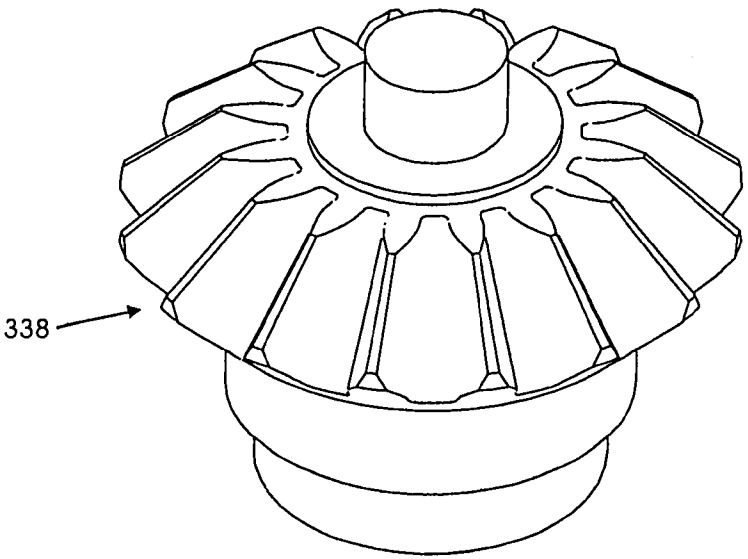
FIG. 56A is a left perspective view of the output gear of FIG. 41.
Figure 58:
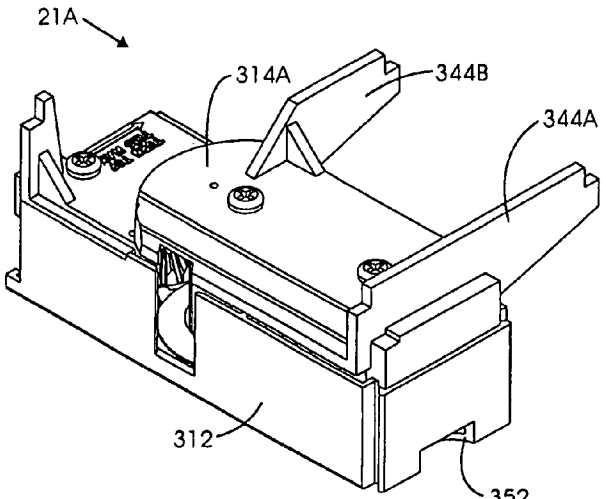
FIG. 58 is an input-end perspective view of the transaxial coiled spring motor of FIG. 57.
Figure 59:
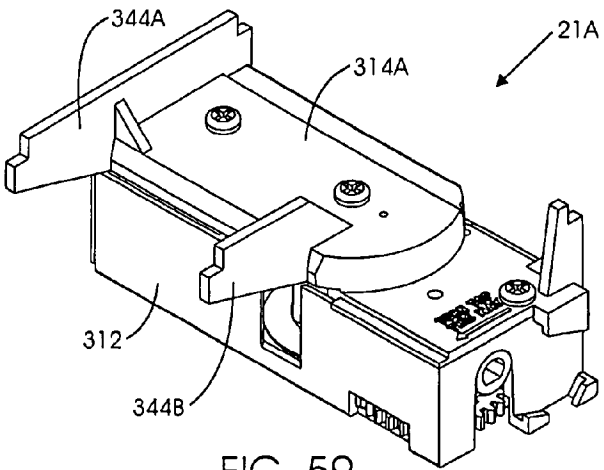
FIG. 59 is an output-end perspective view of the transaxial coiled spring motor of FIG. 57.

There is a beveled gear 332 mounted in the housing 312, as shown in FIGS. 41 and 44. At the base of the beveled gear 332 is a drive gear 334, which meshes with the toothed flange 324. The spindle 336 (See FIG. 63) of the combination beveled gear 332/drive gear 334 fits into a recess 337 in the housing 312 (See FIGS. 54 and 55), for rotation relative to the housing 312. An output gear 338 is mounted in a hole 340 (See FIG. 63) of the housing 312. The output gear 338 meshes with the beveled gear 332, and includes a female, non-cylindrical output shaft 342, which receives the non-cylindrical drive shaft of the transmission 30.

Figure 57:
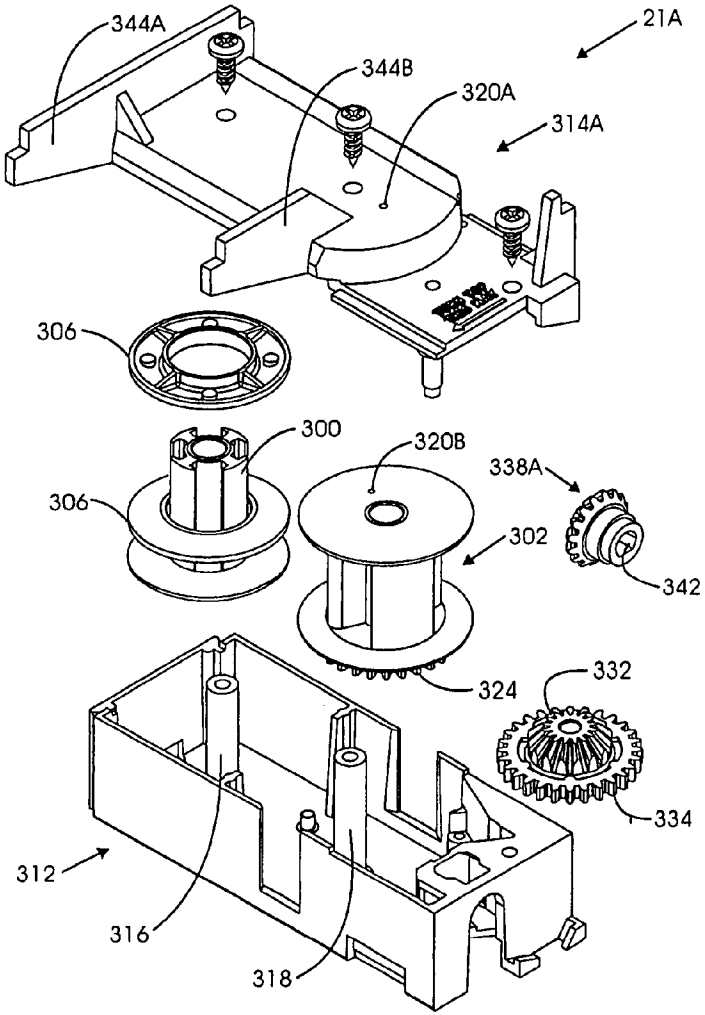
FIG. 57 is an exploded view of an alternate embodiment of a transaxial coiled spring motor similar to the motor of FIG. 40, depicting two spacers on the storage spool, a "D" shaped output gear instead of a square shaped output gear, and a wider housing cover for a two inch head rail.

FIG. 57 depicts an alternate embodiment of the transaxial power module 21A with four differences over the previous embodiment:

- The storage spool 300 now has two spacers 306 while previous embodiments had either one or no spacers.
- The housing cover 314A has extensions 344A, 344B so that this same transaxial power module may be installed in a one-inch head rail 12 (cover without extensions) or in a two inch head rail 12A (cover with extensions 344A, 344B).

Figure 61:
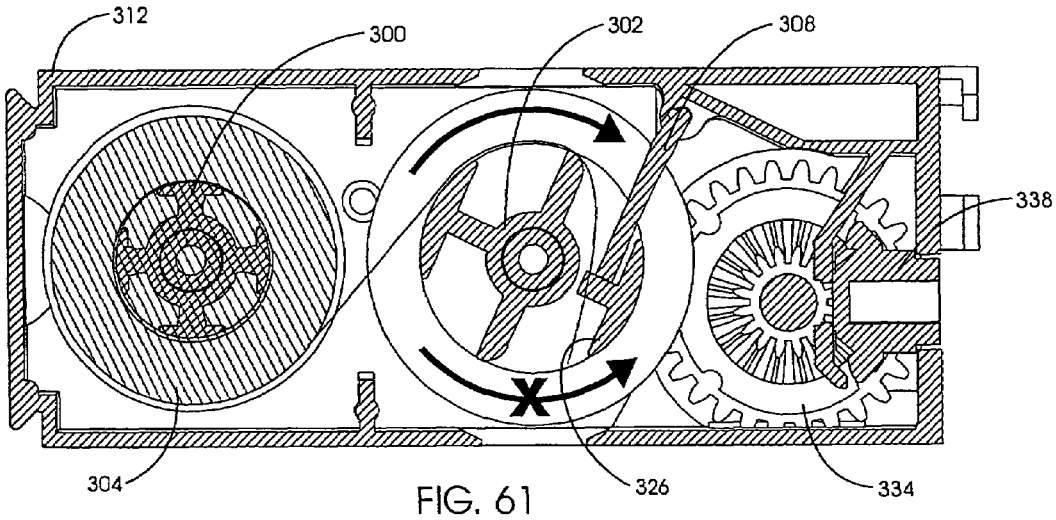
FIG. 61 is a sectional view of the transaxial coiled spring motor of FIG. 41 in the resting position.
Figure 62:
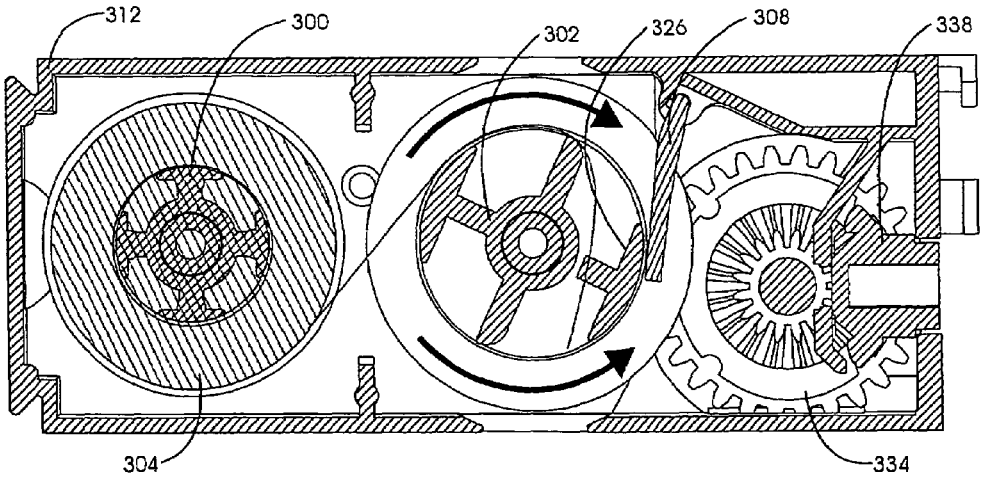
FIG. 62 is the same sectional view of FIG. 61 but with the spring being wound up onto the power spool.
Figure 63:
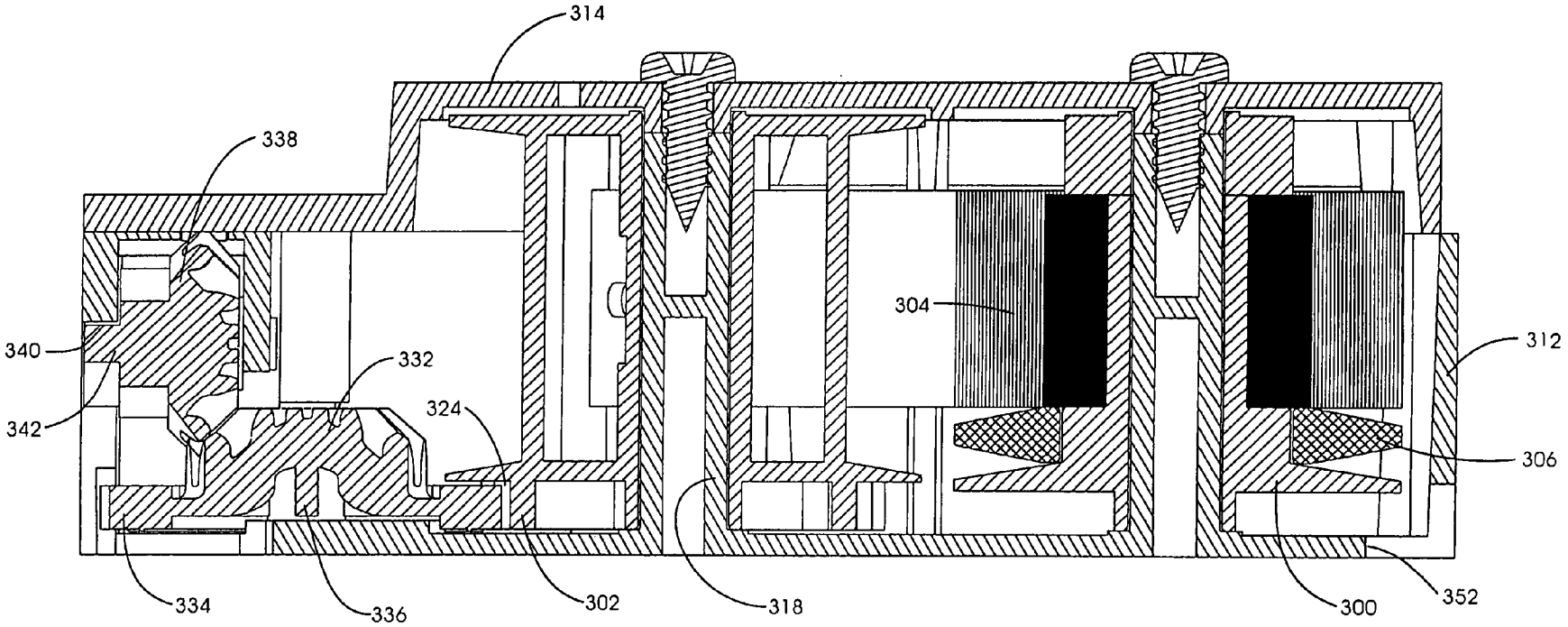
FIG. 63 is a sectional view of the transaxial coiled spring motor of FIG. 44.

The anti-backlash gate 308 and its associated spring 310 have been eliminated in this embodiment. As was the case for the coaxial power module 20, the anti-backlash gate 308 is optional and is only present to prevent the possible incorrect winding of the coil spring 304 onto the power spool 302 the first time the coil spring 304 is wound onto the power spool 302, as shown in FIG. 61. After the first full turn of the power spool 302 the coil spring 304 itself excludes the anti-backlash gate 308 from the opening 326 in the power spool 302 such that the anti-backlash gate 308 no longer impedes the rotation of the power spool 302 in either direction.

The output gear 338A has a non-cylindrical female output shaft 342 which has a "D" shape instead of the square shape of the output gear 338.

In fact, one will find that this feature (of a different shape of the output shaft) is a critical component of the ability to interconnect separate modules to obtain a working system. Many of the modules introduced in this specification may have output shafts which may be male or female, or may be "D" shaped or square shaped (or any other non-cylindrical shape), as required to mate up properly with an adjacent module. The change from male to female or from "D" shaped to square shaped is done quickly, easily, and inexpensively by the replacement of a single element of the module, leaving the balance of the module unchanged.

Figure 60:
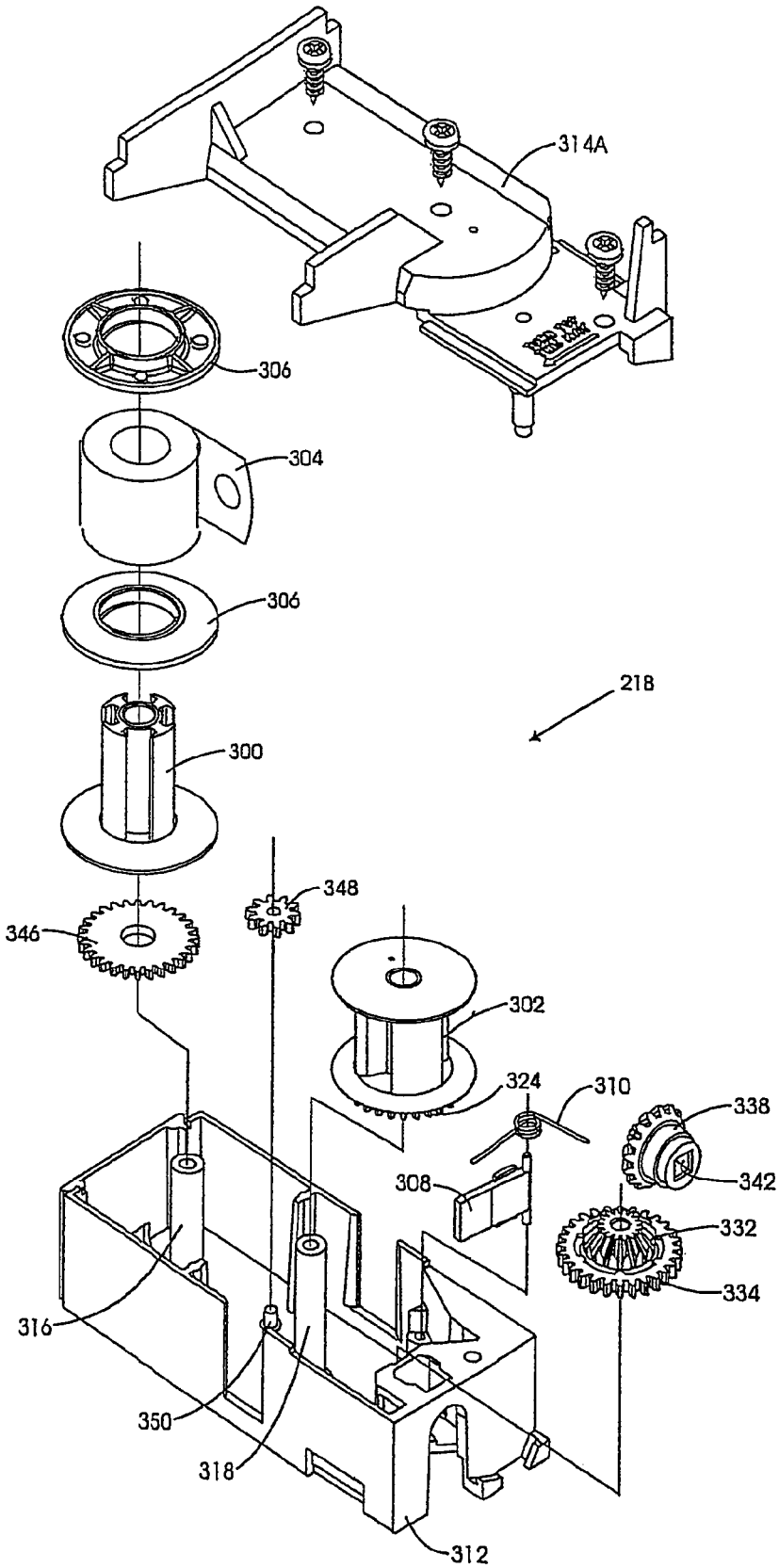
FIG. 60 is an exploded perspective view of an alternate embodiment of a transaxial coiled spring motor similar to the motor of FIG. 40, depicting two additional idler gears in order to transmit power from multiple transaxial motors connected in series.

FIG. 60 shows one more embodiment of the transaxial power module 21B which is used when connecting two or more transaxial power modules in series. The only difference from the previous embodiment is the addition of two idler gears 346, 348. Idler gear 346 is the same size as the gear on the gear flange 324 on the power spool 302, and the idler gear 346 spins freely on the same spindle 316 used by the storage spool 300. The second idler gear 348 fits onto an upwardly projecting cylindrical spindle 350 on the housing 312 and is sized such that it will transfer power from the first idler gear 346 to the geared flange 324 on the power spool 302, and thus to the drive gear 334, the bevel gear 332, and eventually to the output gear 338. The first idler gear 346 is so placed such that it projects slightly outside of the housing 312 via the opening 352 (See FIGS. 42, 58, and 63. These figures show the opening 352 but do not show the idler gear 346 projecting through the opening 352).

FIG. 202 depicts two transaxial power module 21B and 21C connected in series to a transmission 30. The transaxial power module 21B would have the set of idler gears 346, 348. The second transaxial power module 21C is slightly different from a typical transaxial power module 21 in that the drive gear 334, the bevel gear 332, and the output gear 338 have been eliminated and the housing has been truncated such that the geared flange 324 on the power spool 302 now projects slightly outside the truncated housing. This special truncated housing transaxial power module 21C is required when connecting one or more transaxial power modules in series. All the transaxial power modules being connected in series should be of the truncated housing design 21C except the last power module 21B which connects to the rest of the system.

As these two transaxial power modules are fitted together for a series connection with wedge shaped projection 349 fitting into wedge shaped groove 351 (as shown in FIG. 202), the geared flange 324 on the power spool 302 of the truncated housing module will mesh with the first idler gear 346 of the transaxial power module 21B (See FIG. 60). Thus, the force generated by the coil spring 304 of the truncated-housing power module 21C will be transferred to the idler gears 346, 348 of the module 21B, to the power spool gear 324, to the drive gear 334, to the bevel gear 332, to the output gear 338, and finally, through the output shaft 342, to the transmission 30. In this manner, two or more transaxial power modules may be connected in series to increase the force available to raise a blind 10L.

Figures 64, 65:
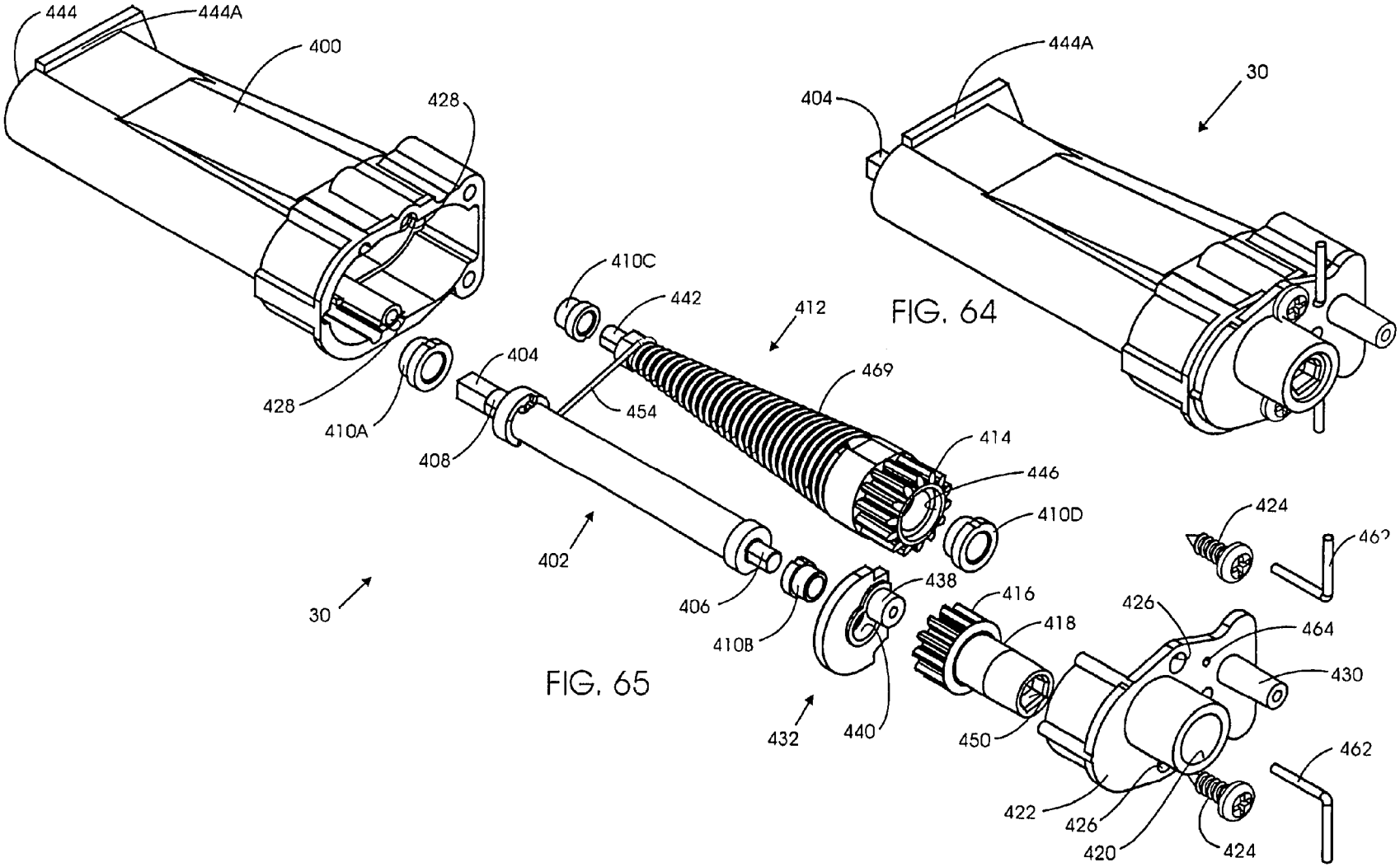
FIG. 64 is an output-end perspective view of a transmission made in accordance with the present invention and shown in the blind assembly of FIG. 1.
FIG. 65 is an exploded view of the transmission of FIG. 64.
Figures 66, 67:
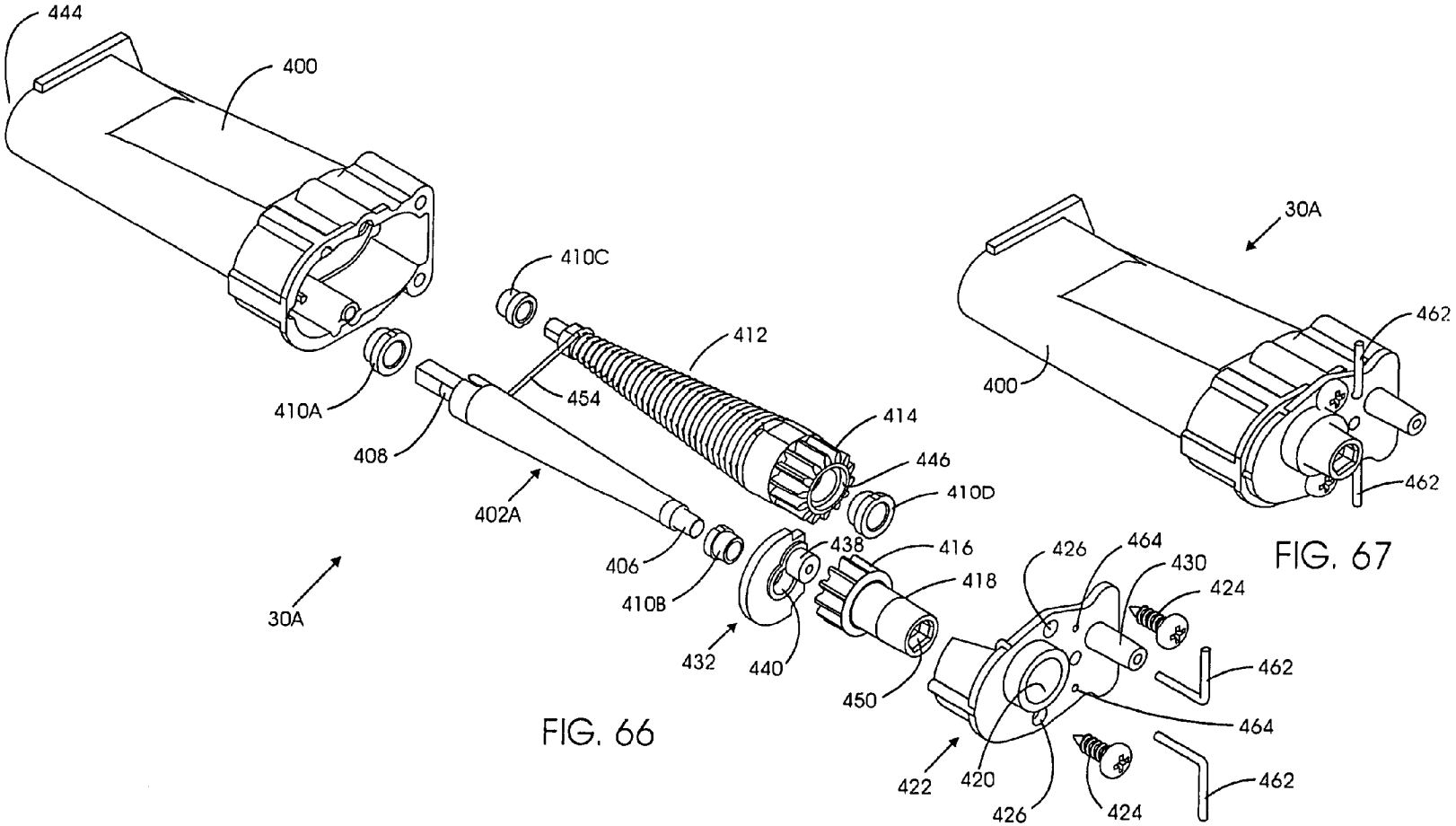
FIG. 66 is an exploded view of an alternate transmission, depicting a frusto-conical input shaft instead of a cylindrical input shaft.
FIG. 67 is an output-end perspective view of the transmission of FIG. 66.
Figure 68:
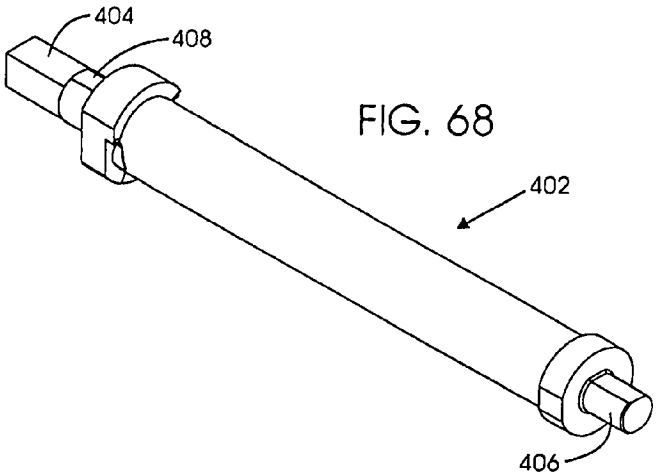
FIG. 68 is a perspective view of the input shaft of the transmission of FIG. 65.
Figure 69:
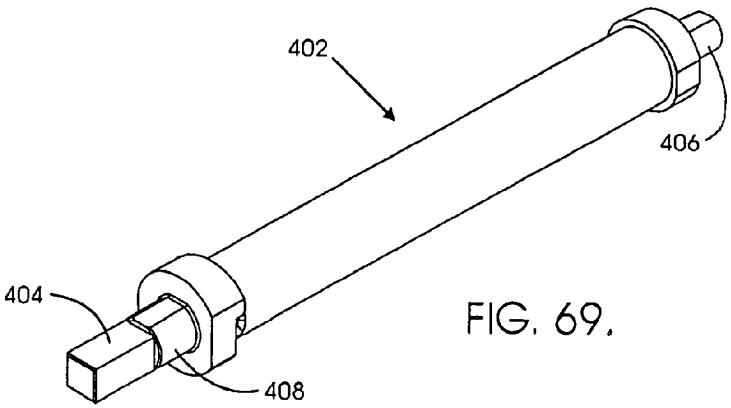
FIG. 69 is the same as FIG. 68 but taken from the input end.

The Transmission:

The transmission 30 and its parts for the blind 10 of FIG. 1 are shown in FIGS. 64-90. Referring first to FIG. 65, the transmission 30 includes a drive shaft 402, which may be cylindrical or tapered, and a driven shaft 412. The drive shaft 402, shown in more detail in FIGS. 68-72, has a non-circular end 404 that is received in the female non-circular recess 246 of a projection 232 on one end of the power spool 208 or 208A (See FIG. 21) of the power module 20, so that the power spool 208 of the power module 20 drives the drive shaft 402 of the transmission module 30. The other end of the drive shaft 402 defines a substantially cylindrical projection 406. There is a shoulder 408 on one end of the drive shaft 402, as shown in FIG. 65. There are bushings 410A, B, C, and D at the ends of the drive shaft 402 and at the ends of the driven, threaded shaft 412. The drive shaft may be a straight cylinder drive shaft 402 (FIGS. 68-72) or a tapered cylinder drive shaft 402A (FIGS. 73-78) as shown in FIG. 66, depending upon the desired transmission ratio. A tapered, threaded shaft 412 (shown in more detail in FIGS. 81-86) lies parallel to the drive shaft 402, and inside the transmission housing 400. At the large end of the tapered, threaded driven shaft 412 is a first gear 414. The number of teeth on the gear may vary. In this embodiment, the first gear 414 is an integral part of the driven shaft 412, but it could be made as a separate piece that is connected to the threaded driven shaft 412. A second gear 416 is meshed with the first gear 414 and is fixed to the transmission output shaft 418, which projects out an opening 420 in the end cover 422 of the transmission housing 400. While this embodiment uses output gears to align the transmission 30 with the lift rod 26, it is possible, in certain sizes of blinds, to have the lift rod 26 aligned directly with the threaded driven shaft 412, so that output gearing is not required. The end cover 422 of the transmission housing 400 is held onto the main portion of the transmission housing 400 by means of self-tapping screws 424 (or other suitable fastening devices), which extend through holes 426 in the housing end cover 422 and into cylindrical receptacles 428 in the transmission housing 400. There is an outward projection 430 at the end cover 422 of the transmission 30, which, in some assemblies, is used as a spacer to abut the end of the tilt rod 24 and prevent the tilt rod 24 from sliding axially within the head rail 12.

An intermediate cap 432, as shown in more detail in FIGS. 79A through 79F, supports and aligns the ends of several of the components, as will be described below. The intermediate cap 432 has two faces 434, 436. The output-directed face 434 defines a cylindrical projection 438, which is received in a cylindrical recess 438A (See FIG. 80) of the second gear 416. The input-directed face 436 defines a cylindrical recess 440, which is offset from the cylindrical projection 438. The cylindrical recess 440 receives and supports for rotation the end 406 of the cylindrical input shaft 402 of the transmission 30.

So, the transmission 30 has three rotating parts. The first rotating part is the drive shaft 402, which has its input non-cylindrical end 404 mated with the output female non-cylindrical recess end 246 of the power spool 208 of the spring motor 20. The shoulder 408 at that input end of the drive shaft 402 is supported in a hole (not shown) at the input end 444 of the housing 400 such that the non-cylindrical input end 404 projects out beyond the housing 400 (shown in FIG. 64). The projection 406 at other end of the drive shaft 402 is received in the recess 440 of the intermediate cap 432, and the intermediate cap 432 is held in position in the housing 400 by the second gear 416 pushing it against the housing 400.

The second rotating part is the tapered, threaded driven shaft 412 which has a substantially cylindrical projection 442 at its first end and which is received in a bushing 410C which in turn is received in a hole (not shown) at the first end 444 of the transmission housing 400. The gear 414 is fixed to the other end of the tapered, threaded driven shaft 412 and defines a cylindrical recess 446 which receives a bushing 410D which in turn is received in the cylindrical projection 448 on the inner face of the end cover 422 of the transmission 30. (The end cover 422 is shown in detail in FIG. 79.) The third rotating part in the transmission 30 is the output gear 416/output shaft 418 which preferably is molded as a single piece. As was explained above, the recess 438A of the output gear 416 (See FIG. 80) receives and is supported by a projection 438 on the output face 434 of the intermediate cap 432. The output gear 416 is meshed with the gear 414 at the end of the threaded driven shaft 412. The output shaft 418 extends through and is supported by a hole 420 in the end cover 422. The output end of the output shaft 418 defines a non-cylindrical recess 450, which receives the similarly-configured non-cylindrical lift rod 26, as shown in FIG. 1.

Figure 70:
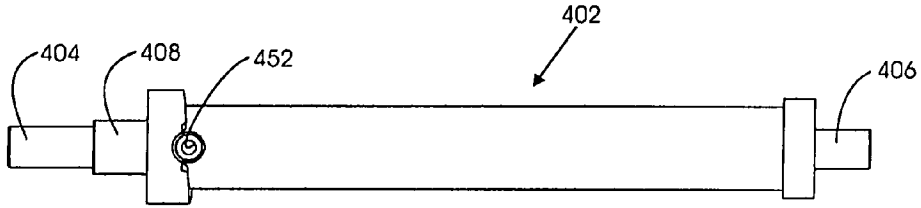
FIG. 70 is a side view of the input shaft of FIG. 68.
Figure 71:
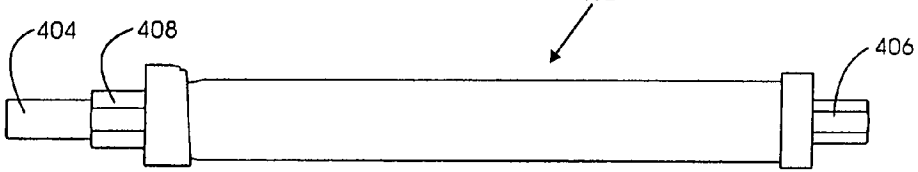
FIG. 71 is a side view of the input shaft of FIG. 70, but rotated 90 degrees.
Figure 72:
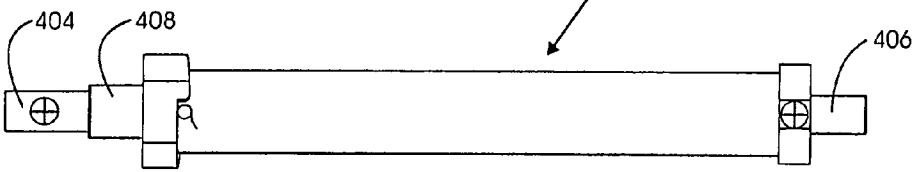
FIG. 72 is a side view of the input shaft of FIG. 71, but further rotated 90 degrees so that it is now the back view of FIG. 70.
Figure 73:
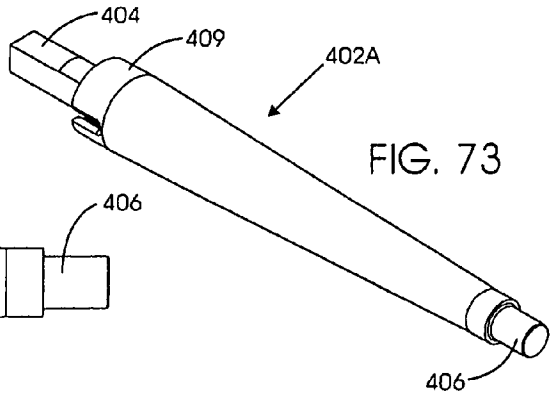
FIG. 73 is a perspective view of the input shaft of the transmission of FIG. 66.
Figure 74:
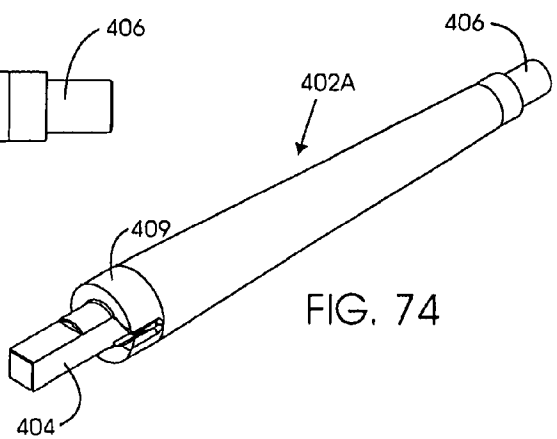
FIG. 74 is the same as FIG. 73 but taken from the input end.
Figure 75:
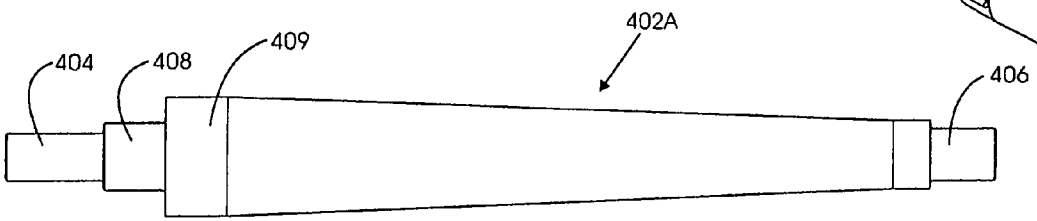
FIG. 75 is a side view of the input shaft of FIG. 73.
Figure 76:
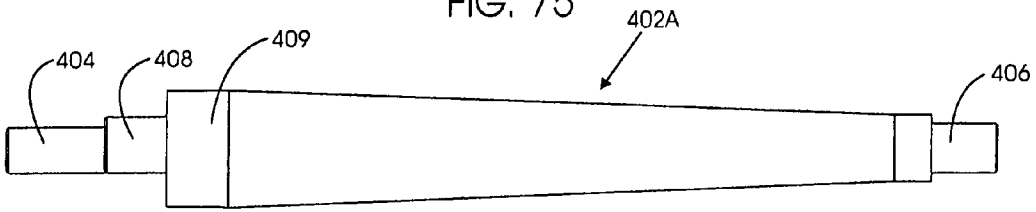
FIG. 76 is a side view of the input shaft of FIG. 75, but rotated 90 degrees.
Figure 77:
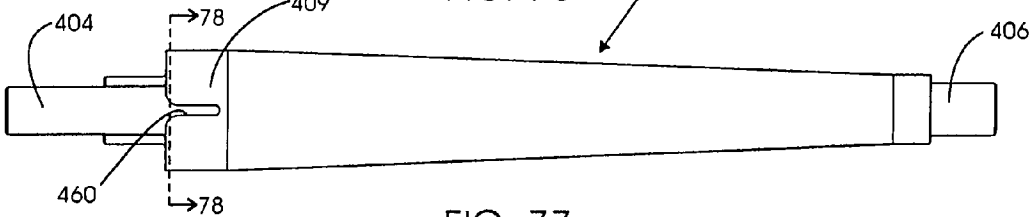
FIG. 77 is a side view of the input shaft of FIG. 76, but further rotated 90 degrees so that it is now the back view of FIG. 75.
Figure 78:
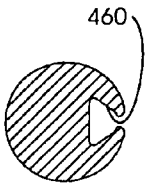
FIG. 78 is a view along line 78-78 of FIG. 77.
Figure 80:
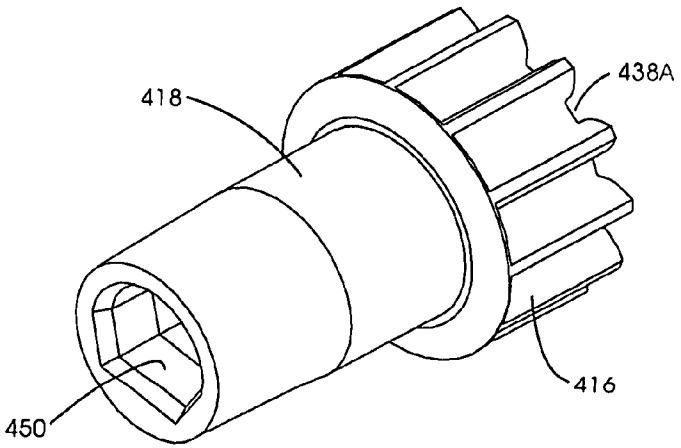
FIG. 80 is a perspective view of the output gear of the transmission of FIG. 65.
Figure 79:
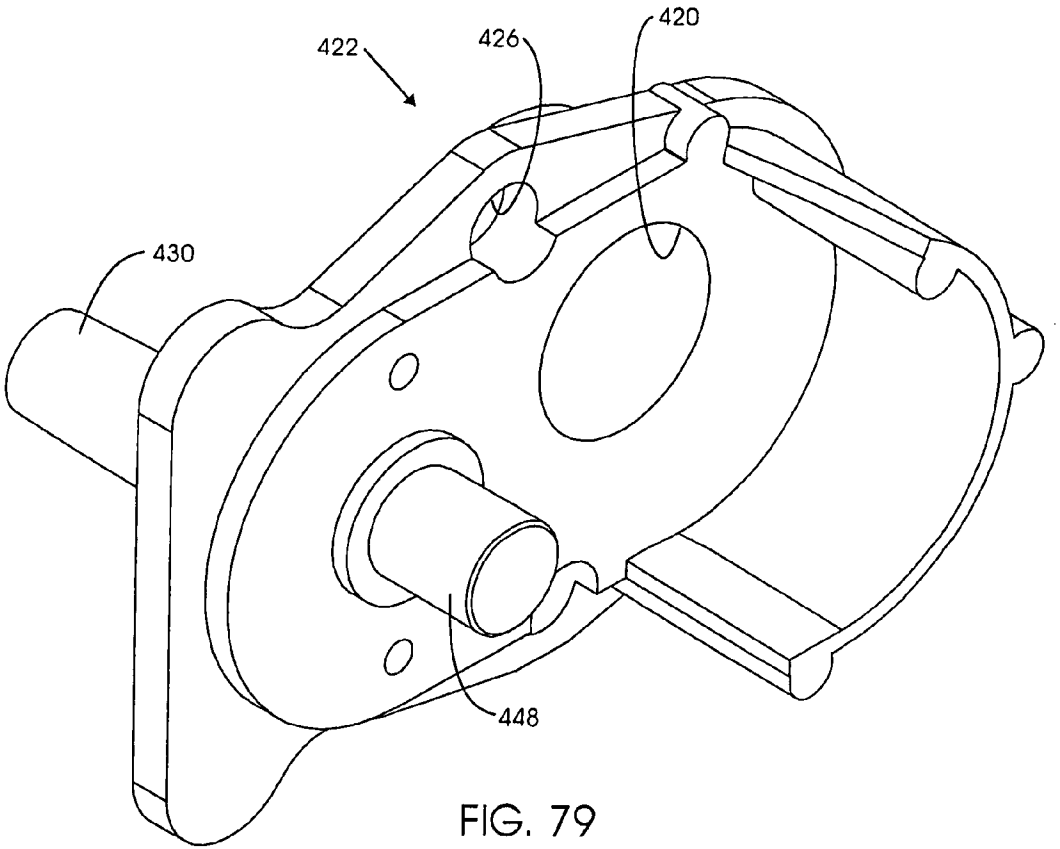
FIG. 79 is a perspective view of the end cap of the transmission of FIG. 65.
Figure 81:
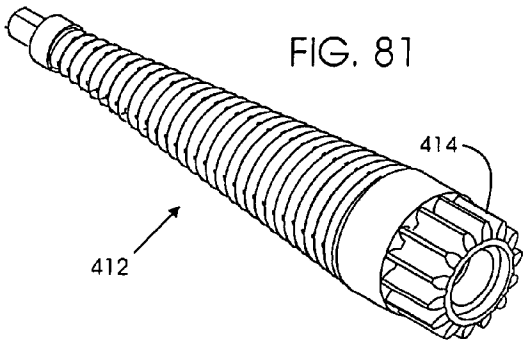
FIG. 81 is an output-end perspective view of the output shaft of the transmission of FIG. 65.
Figure 82:
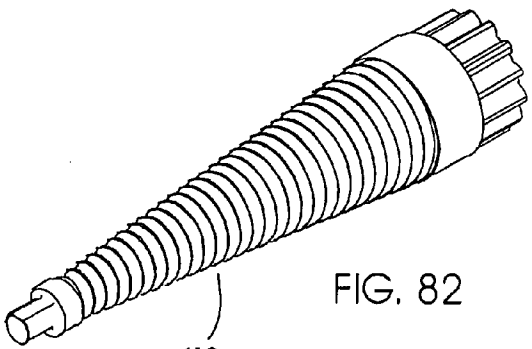
FIG. 82 is the same as FIG. 81 but taken from the other end.
Figure 83:
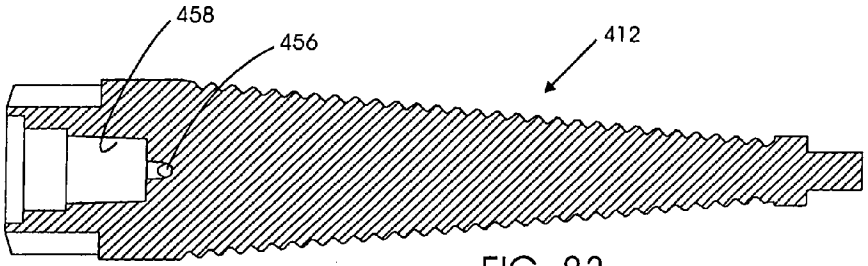
FIG. 83 is a sectional view of the output shaft of FIG. 81.
Figure 84:
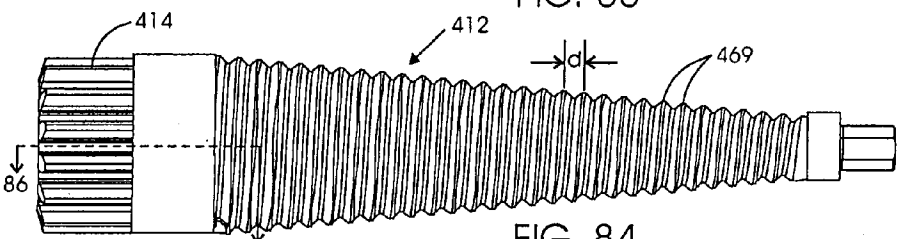
FIG. 84 is a side view of the output shaft of FIG. 83, but rotated 90 degrees.
Figure 85:
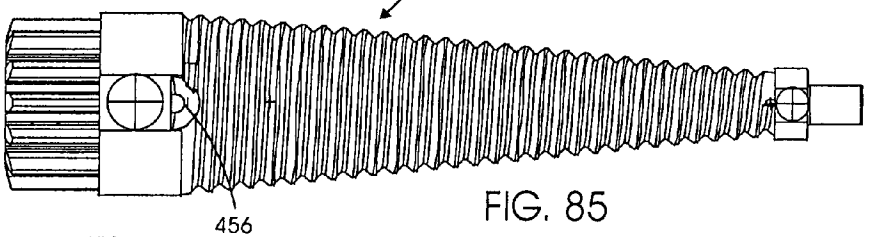
FIG. 85 is the same view as FIG. 83 but a side view instead of a sectional view.
Figure 86:
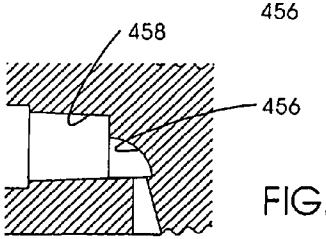
FIG. 86 is an enlarged, sectional, broken away view along line 86-86 of FIG. 84.

As shown in FIG. 70, there is a small hole 452 near the input end of the drive shaft 402 extending completely through the drive shaft 402. This hole 452 receives a transmission cord 454, which is knotted at the end or otherwise secured, so it cannot come free from the shaft 402. Mechanisms for securing a cord are described later with respect to the lift cord and could also be used to secure this transmission cord 454. As shown in FIGS. 85 and 86, there is also a hole 456 in the large diameter end of the tapered, threaded driven shaft 412, which extends into the cylindrical recess 458. This hole 456 receives the other end of the transmission cord 454, which again is knotted or otherwise secured so that it cannot come free.

As shown in FIG. 65, the transmission cord 454 is wound onto the threaded, tapered driven shaft 412 when the blind is in the fully lowered position, with the coil spring 200 of the power module 20 wound on the power shaft 208. As the blind 10 is urged up, the coil spring 200 rolls onto the storage spool 206, causing the drive shaft 402 to rotate, which winds the transmission cord 454 onto the drive shaft 402, causing the tapered, threaded driven shaft 412 to rotate. This causes the gear 414 to rotate, which, in turn, rotates the output gear 416, which rotates the output shaft 418, which rotates the lift rod 26, which causes the lift cords 16 to be rolled onto the lifting modules 40, as will be described later. When the blind 10 is pulled down, the lift cords 16 are unwound from the lifting modules 40, causing the lift rod 26 to rotate in the opposite direction, also causing the output shaft 418 and output gear 416 to rotate in the opposite direction, which causes the tapered driven shaft 412 to rotate so as to wind up the transmission cord 454 onto itself, which rotates the drive shaft 402, which drives the power spool 208 to wind the spring 200 back up on the power spool 208.

The shafts 402, 412 of the transmission 30 are tapered relative to each other so that the output force is greater when the blind is in the raised position and is less when the blind is in the lowered position. The output force must be small enough that the blind is not pulled upwardly and great enough that the blind does not fall down when the user releases it at any point along the range of motion of the blind.

Transmission Adapted to Carry Heavier Loads:

As was discussed in the summary of the invention, heavier loads such as those imposed by handling larger blinds, especially metal and wooden blinds, pose a problem, especially for the transmission. First, the heavier weight necessitates a stronger transmission cord 454 to transmit sufficient force to handle this weight. The obvious solution would be to increase the cord diameter, but a larger diameter cord would require longer transmission shafts 402, 412 to accommodate the cord 454. These longer shafts 402, 412 would then have to be more slender in order for the shafts 402, 412 and cord 454 to fit in the same space constraints of the head rail 12. These longer shafts with a higher slenderness ratio (ratio of length to girth) would not be strong enough to handle the load and, due to the continuous flexing of the shafts caused by the load, the shafts might fail in an unacceptably short number of cycles.

However, a solution to the problem has been developed. It has been discovered that an Ultra High Molecular Weight (UHMW-PE) polyethylene twisted or braided cable (or cord) 454 has a tensile strength exceeding that of steel and has flexibility and fatigue resistance superior to Aramid fibers such as Kevlar, Twaron, Nomex or indeed all other known plastics. With these characteristics, it was possible to reduce the diameter of the transmission cord 454, shorten the length and increase the cross-section of the transmission shafts 402, 412, and end up with a much stronger product.

Typically a 3:1 transmission ratio is enough to handle the load of the lighter weight blinds (smaller blinds or blinds made out of plastic or fabric). However, for higher loads, such as those encountered when handling larger blinds or blinds made out of wood, a higher transmission ratio in the 5:1 range or higher may be required. The 3:1 transmission ratio can be achieved by having a smooth, unthreaded cylinder 402 (with no taper) (As shown in FIG. 65) in connection with a uniformly tapered threaded cone 412 which has a uniform pitch to the threads for its entire length, as was described with respect to the first embodiment of the transmission 30. The result is a desirable, very linear power curve. In the 5:1 transmission, however, in order to keep the shafts 402, 412 short and stubby instead of long and slender, both the drive shaft and the driven shaft are tapered (as shown in FIG. 66). This brings in another complication—proper tracking of the cord 454 as described below.

Figures 87A, 87B, 88, 89:
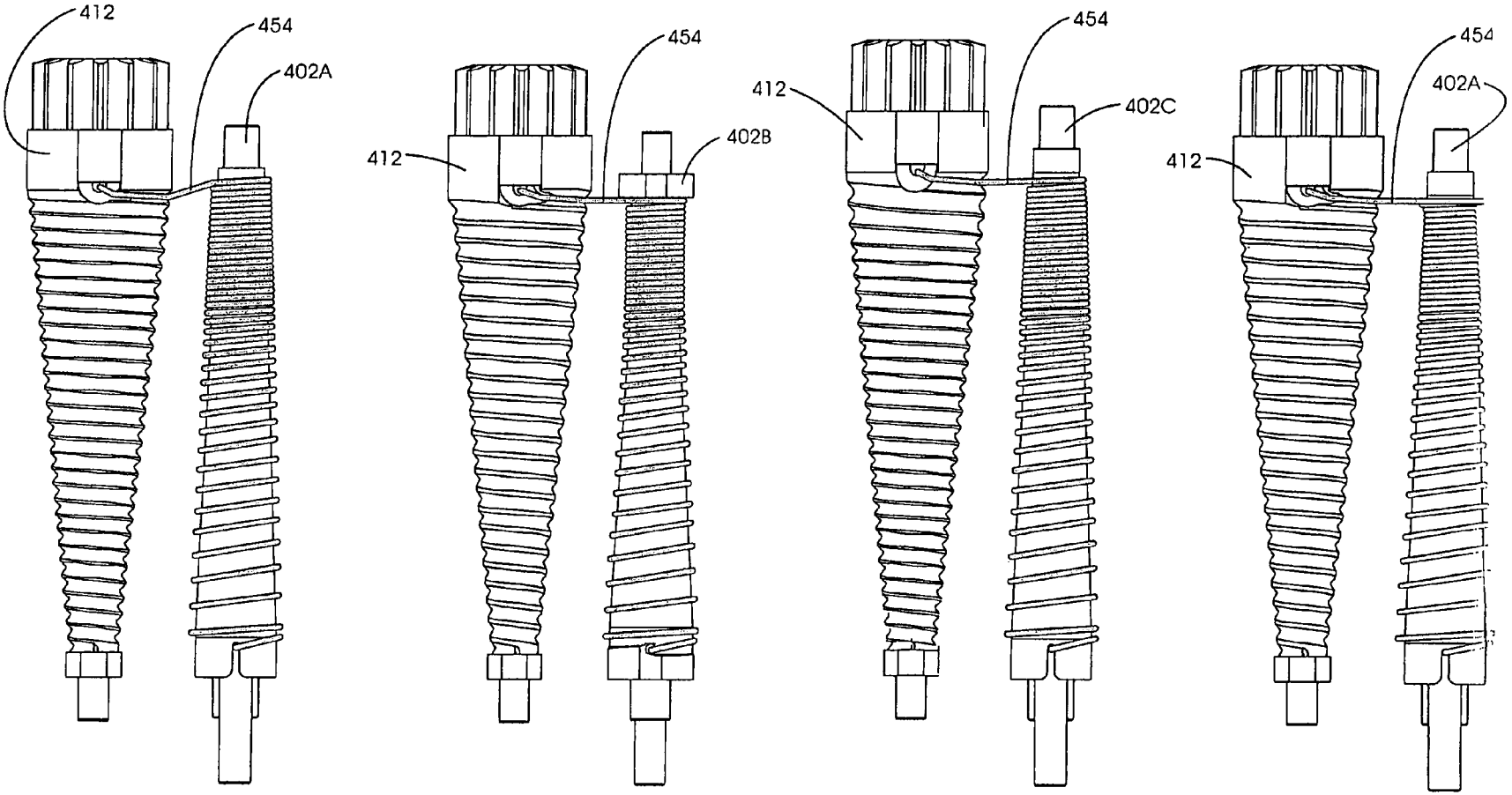
FIG. 87A is a broken away plan view of a threaded output shaft, a frusto-conical input shaft, and the connecting cable or cord of a transmission, where the cord is leading ahead as it winds onto the input shaft, resulting in over-wrap tendencies.
FIG. 87B is the same view as FIG. 87A, except the shape of the input shaft is changed from frusto-conical to cylindrical at the point where the over-wrap tendencies appear in order to eliminate such tendencies.
FIG. 88 is the same view as FIG. 87A except both shafts have been made slightly longer so that the pitch of the threads in the output shaft is increased on the last few threads in order to eliminate the over-wrap tendencies.

In order for the transmission cord 454 to track correctly, the cord 454 must always lead perpendicularly from the axis of rotation of the driven shaft 412 to the drive shaft 402A. If, when winding on the drive shaft 402A, the cord 454 leads ahead of the driven shaft 412 (as is shown in FIG. 87A), and this lead action approaches one cord 454 diameter, this may result in an over-wrap or overlap (as has occurred in FIG. 89), which normally takes place on the drive shaft 402A but could also take place on the driven shaft 412. This over-wrap condition is very undesirable.

In order for the cord 454 to track correctly such that the cord 454 always leads perpendicularly from the axis of rotation of the driven shaft 412 to the drive shaft 402A, the ratio of the pitch of the grooves of the driven shaft 412 to the cord diameter must be equal to or greater than the ratio of the diameter of the driven shaft 412 at that point to the diameter of the drive shaft 402A at that same point. The pitch of the grooves of the driven shaft 412 is defined as the center-to-center distance "d" (See FIG. 84) from one groove to the next.

For instance, if the diameter of the driven shaft 412 at a given point is 3 inches and the drive shaft 402A diameter at that same point is 1 inch, then the ratio is 3:1 or 3. If the cord 454 diameter is 0.05 inches, then the pitch of the grooves at that point should be 0.15 inches or more since the ratio of the pitch to the cord 454 diameter (0.15 to 0.05) needs to be equal to or greater then the ratio of the driven shaft 412 diameter to the drive shaft 402A diameter which is 3 to 1.

If the pitch of the grooves (distance from one groove to the next) is 0.2 inches, for example, then the ratio of this pitch to the cord 454 diameter is 0.2 to 0.05 which is equal to 4. Since 4 is greater than 3 (which is the ratio of the diameter of the driven shaft 412 to the diameter of the drive shaft 402A, 3 to 1) then, in this case, the cord 454 will track properly with no problems of over-wrap (provided this condition is met throughout the length of the transmission shafts 412, 402A).

If the pitch of the grooves (distance from one groove to the next) is 0.1 inch, for example, then the ratio of this pitch to the cord 454 diameter is 0.1 to 0.05 which is equal to 2. Since 2 is smaller than 3 (which is the ratio of the diameter of the driven shaft 412 to the diameter of the drive shaft 402A, 3 to 1) then, in this case, the cord 454 will not track properly and may well develop problems of over-wrap.

Since, in the 5:1 transmission, the diameters of both the drive shaft 402A and the driven shaft 412 are constantly changing (they are both tapered), then their ratios are also constantly changing, and thus, the pitch on the grooves of the driven shaft 412 is also changing. At the low end of the power curve (where the driven shaft 412 diameter is smallest and the drive shaft 402A diameter is largest) the pitch of the grooves will be short. At the high end of the power curve (where the driven shaft 412 diameter is largest and the drive shaft 402A diameter is smallest) the pitch of the grooves will be long. This combination of short pitch at the low end of the power curve and long pitch at the high end of the power curve results in the added benefit of a much more linear power curve than if the groove pitch is maintained constant throughout the entire length of the driven shaft 412.

Experimentation has determined that the minimum groove pitch on a driven shaft 412 which results in good cord 454 tracking characteristics is two times the cord 454 diameter. Further experimentation has determined that, despite the precautions of maintaining a ratio of groove pitch to cord diameter which is greater than the ratio of driven shaft 412 to drive shaft 402A diameters at any point along the shaft length, there is a physical limitation to the degree of slope on the smooth tapered drive shaft 402A. If the degree of slope is too great (the taper is too high) then the transmission cord 454, instead of tracking perpendicularly to the driven shaft 412 thread, has a tendency to slide down the slope and thus get ahead of the thread when transferring to the drive shaft 402A, or to trail behind the thread when transferring to the driven shaft 412. Either of these cases can result in an over-wrap condition and malfunction.

This condition works against the design in two ways. The heavier the load, the greater the tendency of the cord 454 to slide down a given slope on the tapered drive shaft 402A. Also, the heavier the load, the greater the desired slope to achieve a greater transmission range. The end result is that this is another limiting factor on the minimum length of a given transmission 30. This sliding down tendency, or slippage, may be reduced by adding a texture to the surface of the tapered drive shaft 402A. If the drive shaft 402A is die cast, this texture may be added in the cavity from which the part is cast. If the part is machined (or is perhaps a two-piece composite where one piece is die cast and the other piece is a machined piece), the cutting tool may take a coarser cut to provide this added texture.

Loading (i.e. total weight of the blind) will determine the tapered drive shaft 402A surface treatment. Low load will allow for a smooth surface. A moderate load may require a textured surface to prevent slippage. A high loading may mandate a grooved surface, similar to the threads on the driven shaft 412, in order to maintain proper cord 454 location.

Figure 87:
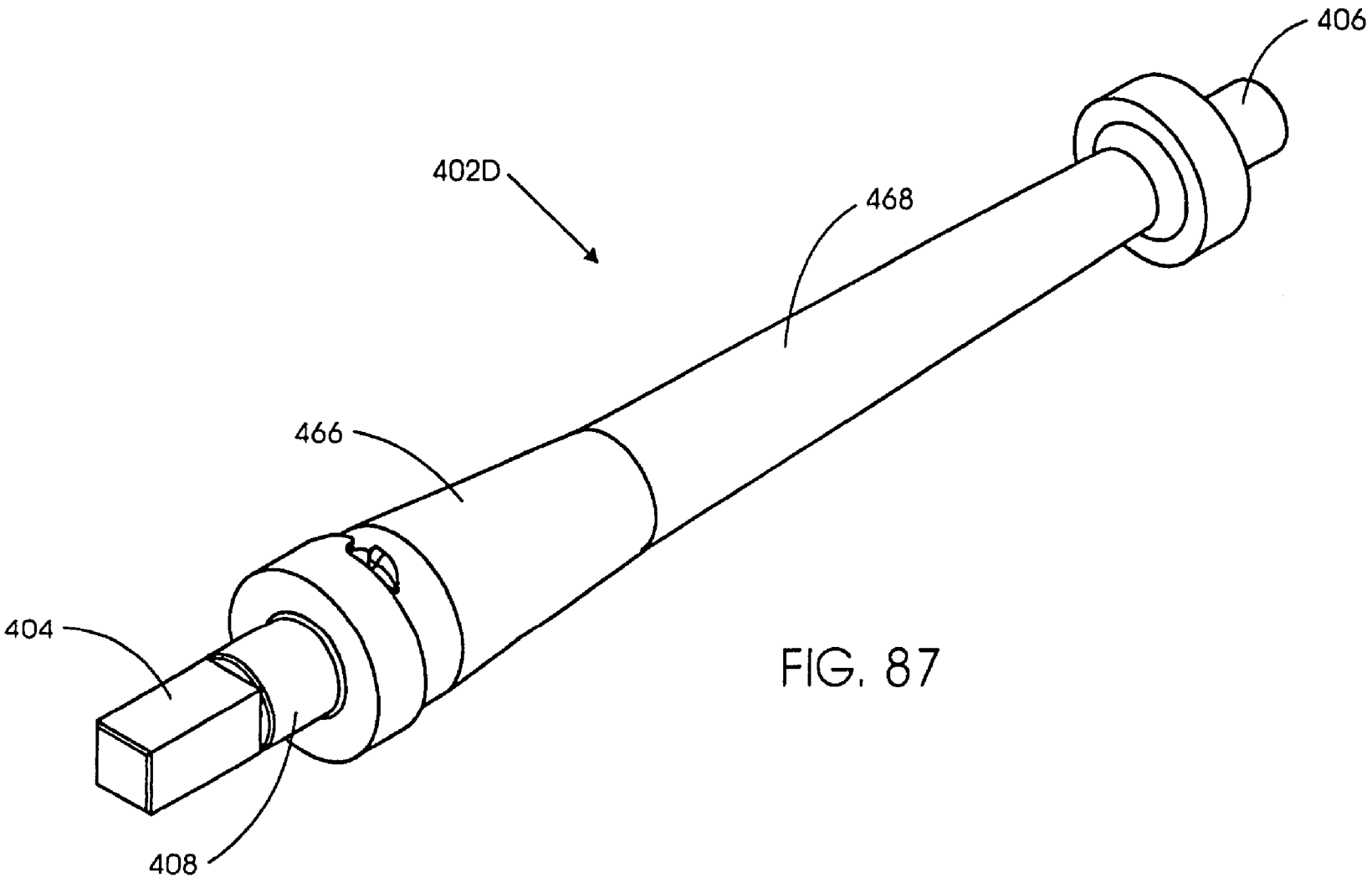
FIG. 87 is an input-end perspective view of an alternative input shaft which may be used in a transmission instead of a straight cylindrical shaft as shown in FIG. 65, or instead of a frusto-conical shaft shown in FIG. 66.

Other approaches to eliminating or alleviating the over-wrap condition include:

1) Lengthening both the drive shaft 402C and the driven shaft 412 (as shown in FIG. 88), so as to have enough length for the cord 454 to wrap properly on the drive shaft 402C without over-wrap. The drawback of this approach is that the transmission 30 is now longer, taking up more of the scarce room available in the head rail 12, and the aspect ratio (width to length ratio) of the shafts 402C, 412 is now smaller, making them more susceptible to flexing and premature failure (unless, of course, the diameters of the shafts 402C, 412 are also increased, taking up even more of that scarce room available in the head rail 12). Or 2) Changing the degree of taper of the drive shaft 402B as is shown in FIG. 87B. In this instance, all the taper is eliminated at the point where the cord 454 begins to crowd itself as it wraps onto the drive shaft 402B, so that no over-wrap condition occurs. It may also be possible to simply reduce the degree of taper on the drive shaft 402D as is shown in FIG. 87 where a first section 466 close to the largest diameter has a steeper taper, and then this taper is reduced in a second section 468 towards the smallest diameter of the drive shaft 402D.

Figure 90B:
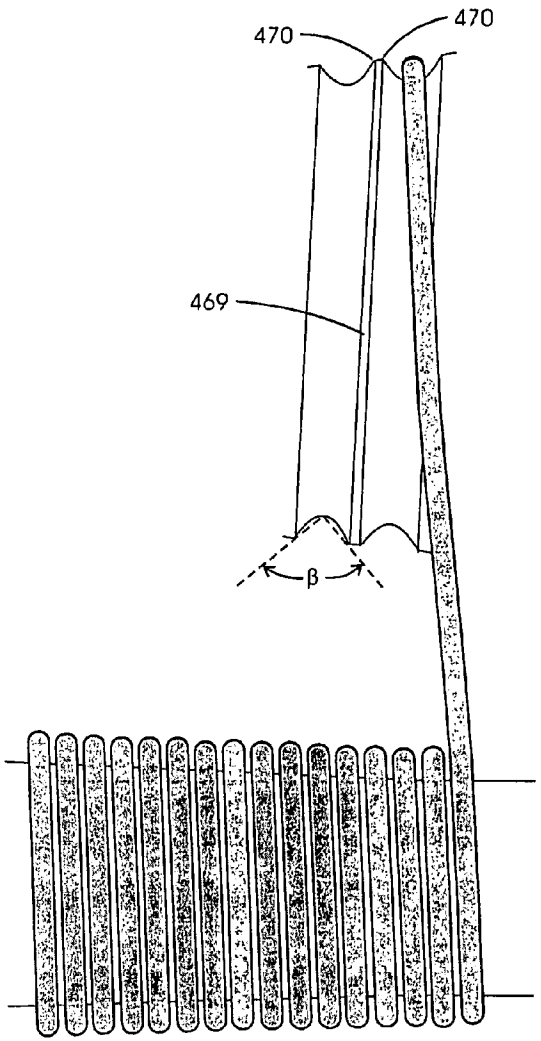
Figure 90A:
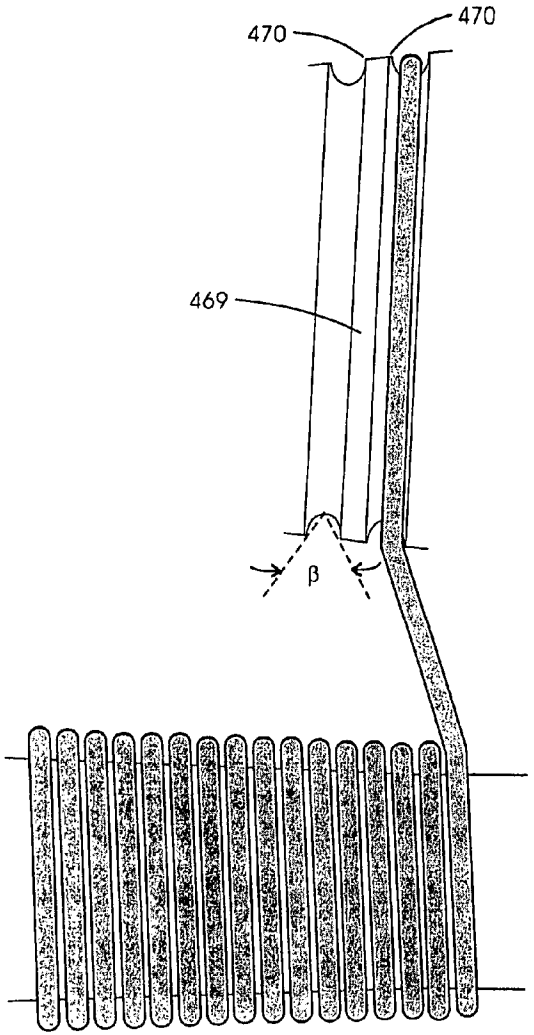

Despite all best efforts, it is not always possible or practical to totally eliminate some "leading" of the cord 454 as it winds onto the drive shaft 402. The cord 454 will then tend to abrade against the side walls 470 of the threads 469 of the driven shaft 412 (See FIGS. 90A, 90B), resulting in both additional frictional losses and fraying (and eventual premature failure) of the cord 454. Thus, it is particularly important that the threads 469 on the driven shaft 412 be opened as much as possible so as to substantially reduce or eliminate this potential interference between the cord 454 and the side walls 470 of the threads 469. This opening of the threads may be measured by the angle β (See FIG. 90A). This angle β should not be less than 30 degrees and preferably should be in the 90 degree to 120 degree range (as shown in FIG. 90B).

In summary, the transmission 30 is designed for minimum length based on the heaviest load, the worst case scenario. This implies a higher transmission ratio in the 5:1 range or higher, and tapered drive shafts 402A and driven shafts 412, with a variable pitch on the grooves of the driven shaft 412. Lower loads may then be accommodated within the same housing with minor changes in taper and/or pitch to one or both of the shafts 402A, 412 (for instance, make the cylinder non-tapered as in item 402 in FIG. 65, or of varying tapers as in item 402D in FIG. 87 or item 402B in FIG. 87B).

The transmission 30A shown in FIGS. 66-67, has been developed to solve the problem of handling heavier loads. Most of the components and their description and function remain unchanged from that of the standard transmission 30 described earlier. Therefore, this description will focus primarily on the differences from the transmission 30.

FIG. 66 shows an exploded view of the transmission 30A adapted to carry heavier loads. The threaded driven shaft 412, which is shown in greater detail in FIGS. 81 through 86 is in fact the very same driven shaft 412 shown in FIG. 65. However, In an embodiment adapted for heavier loads, the pitch "d" (See FIG. 84) of the threads of the driven shaft 412 may be variable and, in fact, the pitch "d" at any given point along the length of the driven shaft 412 is such that the ratio of the pitch "d" to the diameter of the transmission cord 454 is equal to or greater than the ratio of the diameter of the driven shaft 412 to the diameter of the drive shaft 402 at that same given point. This relationship ensures that the cord 454 will always lead perpendicularly from the driven shaft 412 to the drive shaft 402 and will thus not result in an over-wrap condition where the cord 454 wraps around itself and causes a malfunction. The groove pitch "d" of the driven shaft 412 is never less than two times the diameter of the transmission cord 454. In the heavier duty embodiment, the transmission cord 454 preferably is an Ultra High Molecular Weight (UHMW) polyethylene cord manufactured by Berry Braiding, Inc. of 1500 Interstate Dr., Erlanger, Ky. 41018 under the name Blue Knight Kite String or Spectra 1000. This cord 454 is supplied in three sizes: a 130 Lb. line designated SPBR 130, a 155 Lb. line designated SPBR 155, and a 200 Lb. line designated SPBR-200. Other heavy duty cords may replace the preferred cord material in less demanding applications. In a preferred embodiment, the cord diameter is less than 0.03 inches.

Specifically in the case of a transmission 30A for handling heavier loads, it is advantageous to use a tapered drive shaft 402A instead of the straight cylindrical drive shaft 402 of the standard transmission 30. This tapered drive shaft 402A is very similar to the straight cylindrical drive shaft 402 except that the shaft 402A now tapers from a large diameter at the input end 444 of the transmission housing 400, to a small diameter at the opposite end. The larger diameter of this drive shaft 402A may allow for the shoulder 409 at that end to accommodate a slotted opening 460 (See FIGS. 77 and 78) to be used to secure the transmission cord 454 as is discussed below.

The transmission cord 454 is secured to the driven shaft 412A as was already described in the previous embodiment of a transmission 30, and involves threading the cord 454 through a hole 456 on the driven shaft 412A and 128 and then tying a knot or attaching something to the cord 454 which is larger in size than the hole 456 through which the cord 454 was threaded so that the cord 454 can not be pulled back out. Similarly, the cord 454 is secured to the tapered drive shaft 402A by tying a knot or attaching something to the cord 454 which is larger than the slotted opening 460 on the shoulder 409 of the tapered drive shaft 402A. This enlargement on the cord 454 is then slipped behind the slotted opening 460 where it will "catch" and thus prevent the cord 454 from being pulled back out.

Figure 84A:
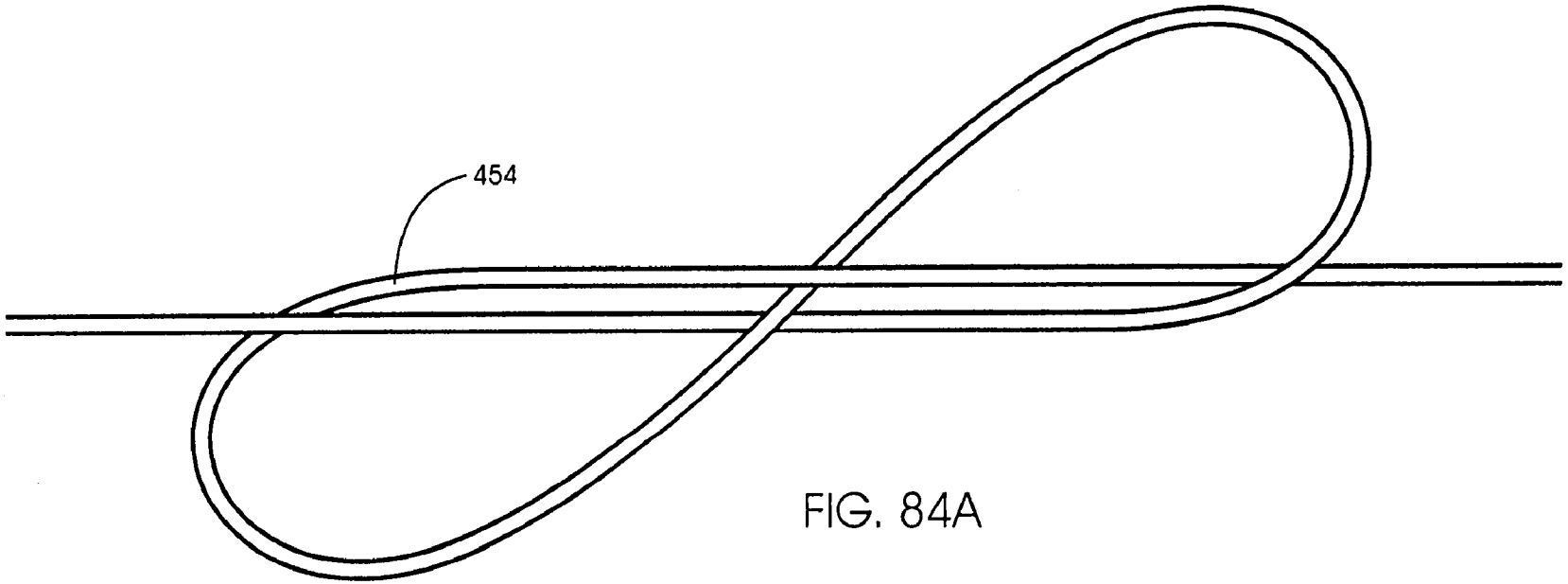
FIG. 84A is a plan view of a FIG. 8 knot used to enlarge cable ends in this present invention, such as in the transmission of FIG. 65.
Figure 84B:
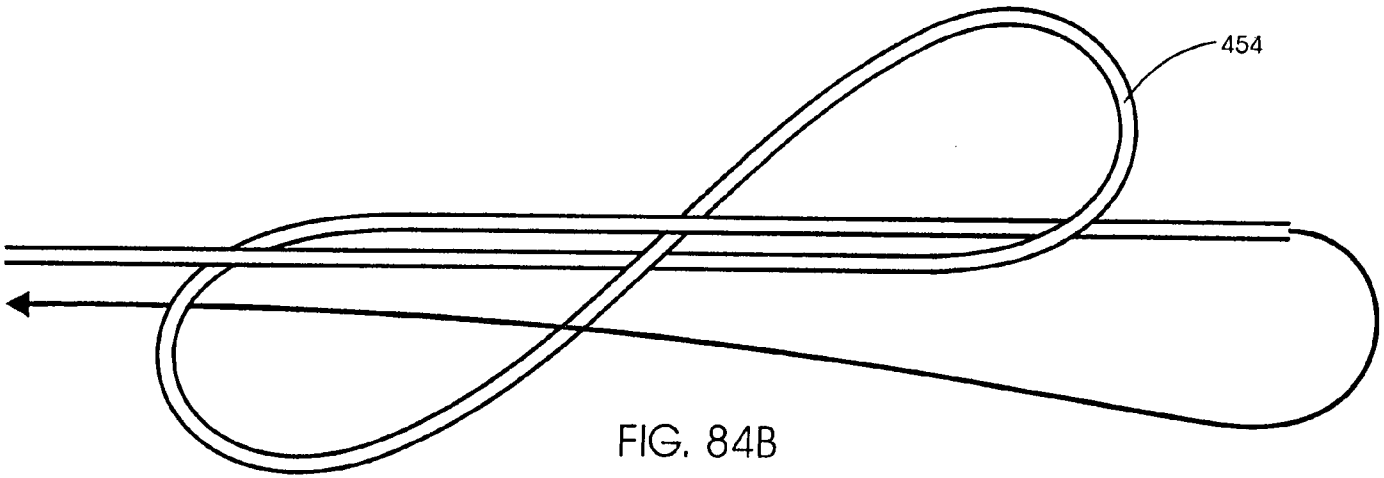
FIG. 84B is a plan view of a FIG. 12 knot, as it is completed from the FIG. 8 knot shown in FIG. 84A, used to enlarge cable ends in this present invention.
Figure 84C:
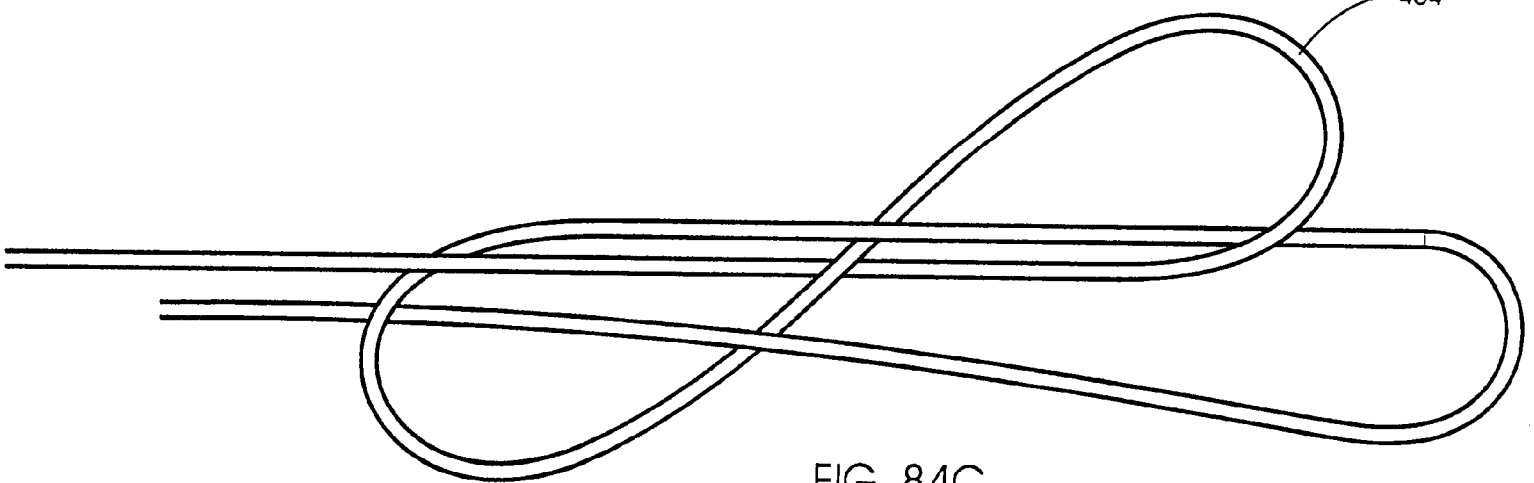
FIG. 84C is a plan view of the FIG. 12 knot of FIG. 84B after completion.
Figures 84D, 84E, 84F, 84G, 84H, 84I:
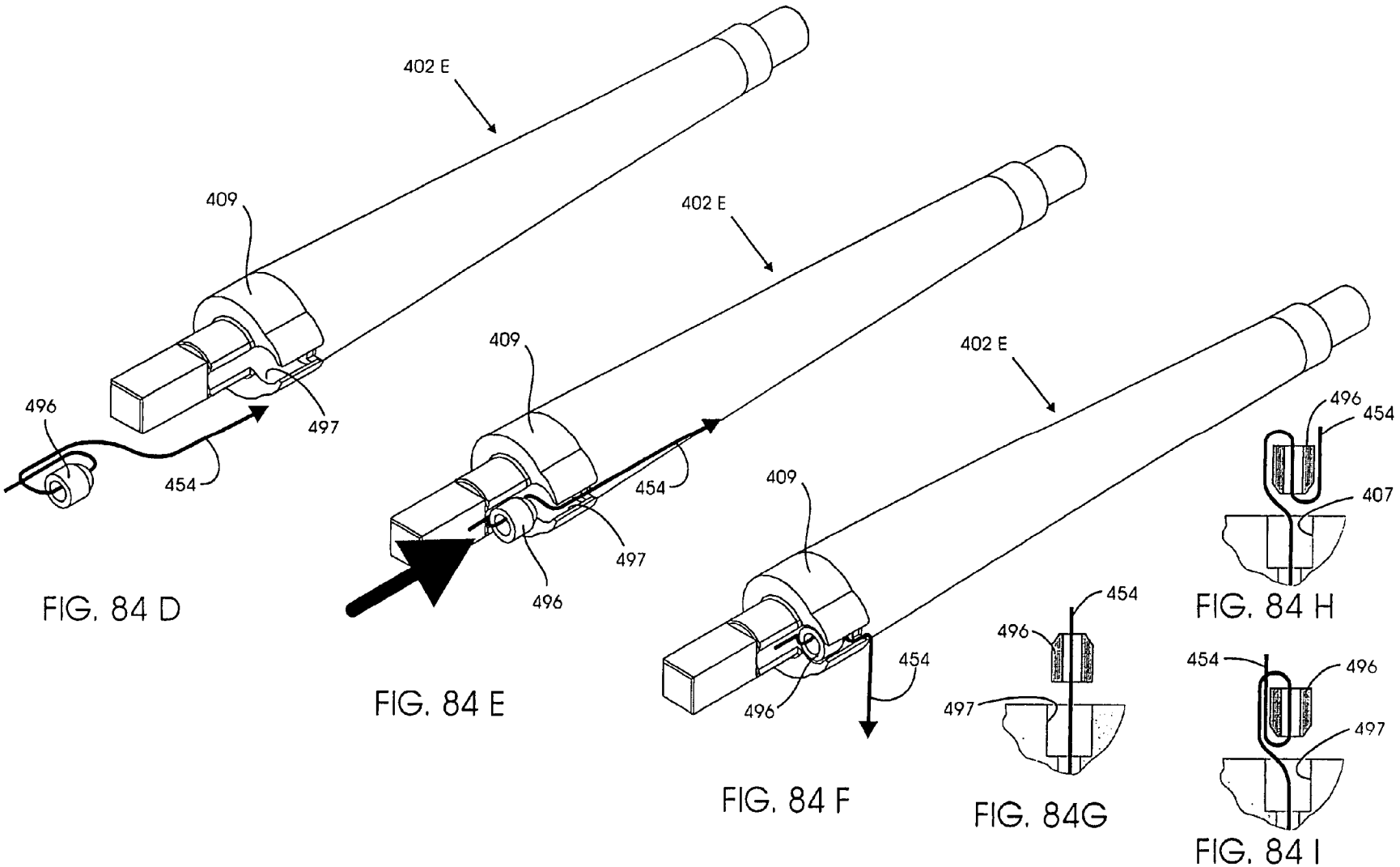
FIG. 84D is a perspective view of an alternative input shaft which may be used in a transmission, depicting an alternate method of securing the transmission cable to the shaft.
FIG. 84E is the transmission input shaft of FIG. 84D, showing how the alternate enlargement of the cable slides into the input shaft.
FIG. 84F is the transmission input shaft of FIG. 84D, with the alternate cable enlargement mechanism fully installed.
FIG. 84G is a broken away, detailed, sectional view of the alternate cable enlargement mechanism when the cord is first threaded through the enlargement bead.
FIG. 84H is a broken away, detailed, sectional view of the alternate cable enlargement mechanism of FIG. 84G when the bead is flipped 180 degrees in one direction prior to sliding into a recess.
FIG. 84I is a broken away, detailed, sectional view of the alternate cable enlargement mechanism of FIG. 84G when the bead is flipped 180 degrees in one direction (opposite the direction shown in FIG. 84H) prior to sliding into a recess.

The best way to secure this UHMW cord 454 to the driven shaft 412A and drive shaft 402A is as described above but using a specific knot, known as a FIG. 8 knot and shown in FIG. 84A. This is the simplest knot that can be tied, which will not slip, for this particular type of cord 454. For extra security or if a larger enlargement is desirable in the cord 454, a FIG. 12 knot (so called because it is a FIG. 8 knot with an extra loop), as depicted in FIG. 84C, may be used. FIG. 84B shows the intermediate step from a FIG. 8 knot in order to achieve the FIG. 12 knot.

An alternate method to secure the UHMW cord 454 to the driven shaft and the drive shaft is depicted in FIGS. 84D, 84E, 84F, 84G, 84H, and 841. Instead of a knot on the transmission cord 454, the cord 454 is threaded through a cylindrical bead 496, the bead 496 is flipped 180 degrees, and the bead 496 in turns slides into a recess 497 on the shoulder 409 of the tapered drive shaft 402E, locking the cord 454 in place. This method of securing the cord 454 depends upon several sharp turns which the cord 454 must make, which drives up the frictional forces between the cord 454, the bead 496, and the recess 497, thus preventing the cord 454 from slipping. This alternate method of securing a cord may be used wherever a cord must be secured to another component (not just a transmission cord secured to a drive shaft or a driven shaft) instead of the knots or other enlargements disclosed earlier.

To ensure that the transmission cord 454 is in the right place at the point of installation, the transmission assembly 30 must be kept under tension from the time it is initially assembled until it is fully installed in the head rail 12 with the tension of the spring motor 20 applied to it. To accomplish this tensioning, a pin 462 is inserted through a hole 464 in the end cover 422. This pin 462 locks between two teeth on the geared output end 414 of the driven shaft 412 to prevent the driven shaft 412 from rotating.

Because the transmission 30 may be installed in the head rail 12 with either side in the up position, two such locking pins 462 are installed. Once the orientation is decided, the lower pin 462 is removed just prior to installation of the transmission 30 in the head rail 12. Once the transmission 30 is installed in the head rail 12 and the spring motor(s) 20 and load are attached, the second (upper) pin 462 is removed.

Figure 91:
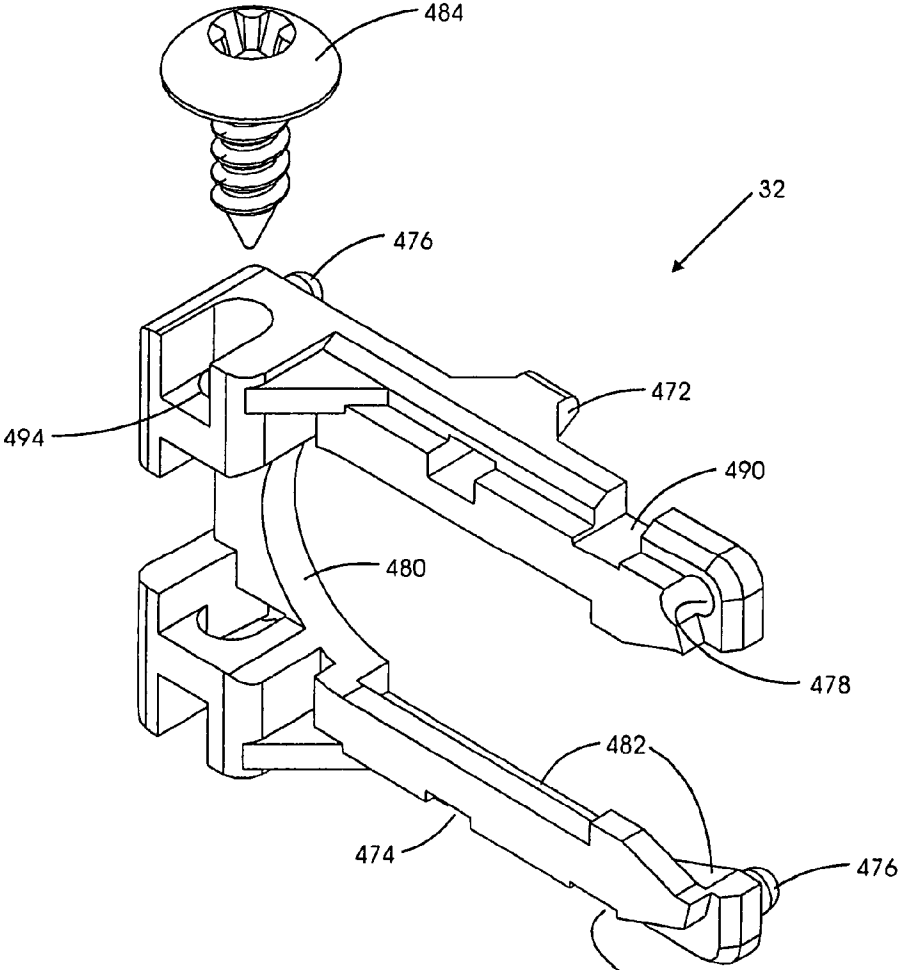
Figure 98:
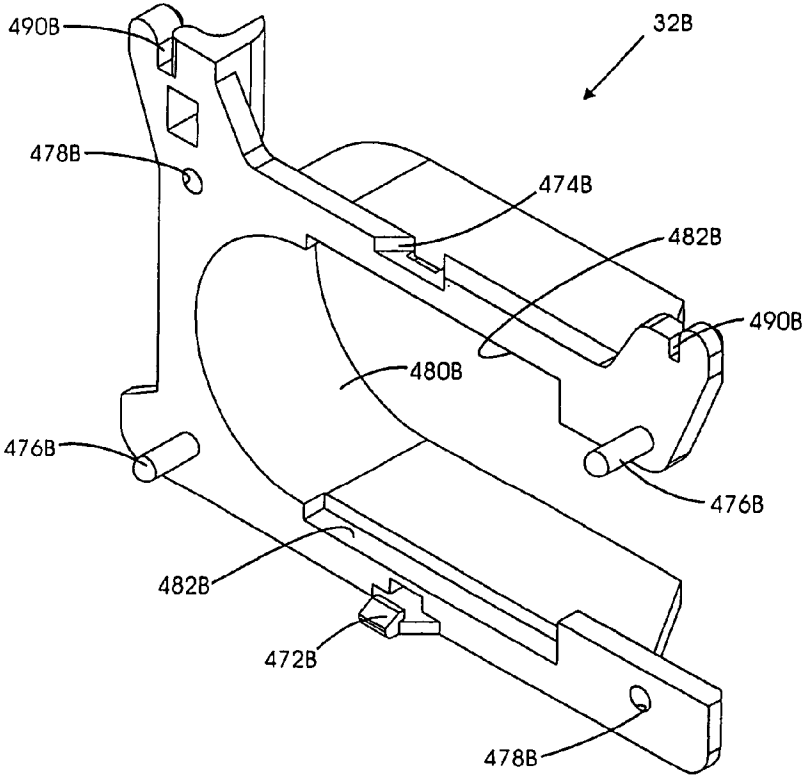
Figure 97:
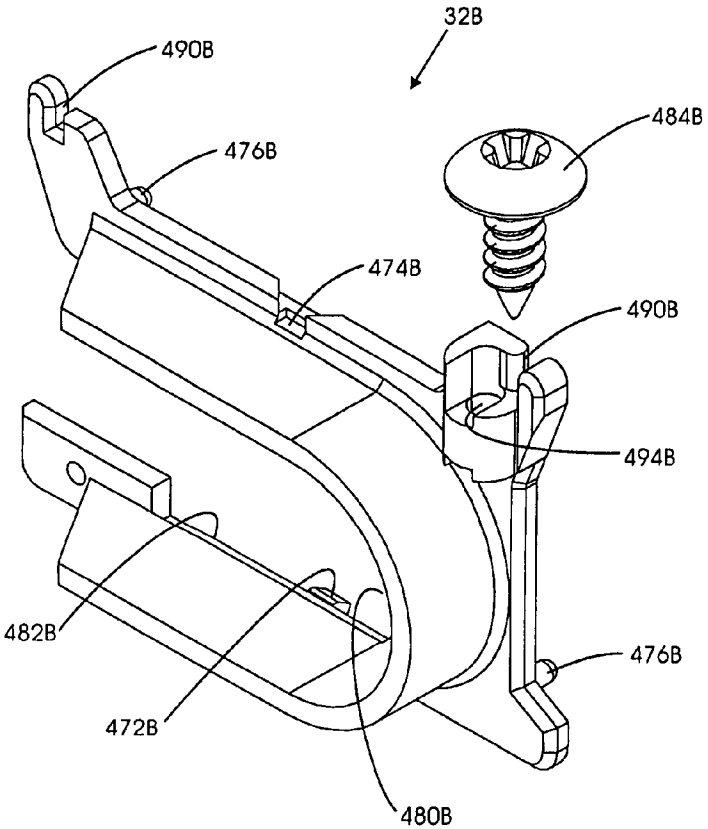

Transmission Adapter for One-Inch Head Rail:

Referring back to FIG. 1, there is an adapter 32 between the transmission 30 and the coaxial power module 20. FIG. 91 is a more detailed view of this adapter, and FIGS. 92-96 provide a more detailed and enlarged view of the assembly of the transmission 30 with the coaxial power module 20, and how they are secured in the one-inch head rail 12.

The transmission 30 includes a housing 400 onto which is mounted the adapter 32 (See FIGS. 92 and 93). As shown best in FIG. 91, the adapter 32 has a hook 472 and recess 474 that mate with the corresponding recess 244 and hook 242 of the adjacent housing half 204 of the power module 20. The adapter 32 also has cylindrical projections 476 and recesses 478 which mate with corresponding recesses 240 and projections 238 on the adjacent power module housing half 204. The adapter 32 defines a U-shaped cutout 480, which receives the U-shaped end 444 of the transmission housing 400 (See FIG. 65). Ears 444A on the U-shaped end 444 of the transmission housing 400 are received in recesses 482 of the adapter 32 (shown in FIG. 91), so that, when the adapter 32 is hooked onto the power module 20, as in FIG. 94, the ears 444A of the transmission are trapped between the adapter 32 and the power module 20, locking the transmission 30 to the power module 20.

The adapter 32 also includes a self tapping screw 484 (or other suitable fastening device) that is screwed into an opening 494 (See FIGS. 91, 95 and 96) of the adapter 32. Once the power module 20 and the transmission 30 have been assembled into a single piece by means of the adapter 32, the entire assembly is slipped into the head rail 12, and placed where desired. The adapter 32 has two recesses 490 designed to mate and cooperate with two corresponding channels 492 on the head rail 12, such that when the assembly is slipped into the head rail, the channels 492 will snap into the recesses 490, and assist in holding the entire assembly in place. The screw 484 is then screwed into the opening 494 of the adapter 32 until the screw 484 bottoms out. In the process, as shown in FIG. 96, the bottom of the screw head 486 will grab and pinch the lip 488 of the head rail 12 between the bottom of the screw head 486 and the adapter 32 itself. In this manner, the entire assembly is secured to the head rail 12.

Transmission Adapter for 2 Inch Head Rail:

As shown in FIGS. 97-103, there is a very similar adapter 32B that is used to secure a coaxial power module to a transmission for a two-inch head rail 12A. The description and method for accomplishing the task are practically identical. Thus, the same item numbers are used except for the addition of a "B" suffix to designate the two-inch head rail 12A design versus the one-inch head rail 12 design. Except for being larger in size, the power modules 20 and the transmissions 30 are essentially identical for the one-inch head rail 12 and for the two-inch head rail 12A.

Referring now to FIG. 7, the transmission 30 includes a housing, onto which is mounted an adapter 32B. The adapter 32B, shown more clearly in FIGS. 97-103, has a hook 472B and recess 474B that mate with the corresponding recess 244 and hook 242 of the adjacent power module housing half 204. The adapter 32B also has cylindrical projections 476B and recesses 478B which mate with corresponding recesses 240 and projections 238 on the adjacent power module housing half 204. The adapter 32B defines a U-shaped cutout 480B, which receives the U-shaped end 444 (See FIG. 65) of the transmission housing 400. Ears 444A on the U-shaped end 444 of the transmission housing 400 are received in recesses 482B of the adapter 32B (shown in FIG. 97), so that, when the adapter 32B is hooked onto the power module 20, as in FIG. 101, the ears 444A of the transmission 30 are trapped between the adapter 32 and the power module 20, locking the transmission 30 to the power module 20.

The adapter 32B also includes a self tapping screw 484B (or other suitable fastening device) that is screwed into an opening 494B (See FIGS. 97, 102, and 103) of the adapter 32B. Once the power module 20 and the transmission 30 have been assembled into a single piece by means of the adapter 32B, the entire assembly is slipped into the head rail 12A, and placed where desired. The adapter 32B has two recesses 490B designed to mate and cooperate with two corresponding channels 492B on the head rail 12A, such that when the assembly is slipped into the head rail, the channels 492B will snap into the recesses 490B, and assist in holding the entire assembly in place. The screw 484B is then screwed into the opening 494B of the adapter 32B until the screw 484B bottoms out. In the process, as shown in FIG. 103, the bottom of the screw head 486B will grab and pinch the lip 488B of the head rail 12A between the bottom of the screw head 486B and the adapter 32B itself. In this manner, the entire assembly is secured to the head rail 12A.

Other Transmission Adapters

Transmission Adapter for Parallel Ratchet-Type Drive:

FIG. 5 shows a power group in which a ratchet-type drive module 70 and a transmission module 30 are connected in parallel via a transmission adapter 72. This power group is shown in greater detail in FIG. 207, and FIG. 208 shows how this same adapter 72 may be used to couple one or more coaxial coil spring modules 20 in series with the parallel arrangement of transmission module 30 and ratchet-type drive module 70. The ratchet-type drive is fully described and disclosed in U.S. patent application Ser. No. 09/139-806 dated Aug. 25, 1998, hereby incorporated by reference.

Referring now to FIGS. 208A and 208B, the transmission adapter 72 for parallel ratchet-type drive includes four components: a main housing 1000, an end cover 1002, a drive gear unit 1004, and a driven gear unit 1006. The main housing 1000 has an inner surface 1008 (See FIG. 208B) and an outer surface 1010 (See FIG. 208). The inner surface 1008 has a shoulder 1012 along its perimeter, thus defining a cavity which houses the drive gear unit 1004 and the driven gear unit 1006. This cavity is closed by the end cover 1002 which has hooks 1014 which snap into recesses 1016 to hold the two parts 1000, 1002 together.

The drive gear unit 1004 is a single piece including a drive gear 1020, a stub shaft 1022 projecting from one side of the drive gear 1020, and a long shaft 1024 projecting out of the other end of the drive gear 1020. The shape of the long shaft 1024 changes from a circular profile adjacent to the gear 1020, to a square profile 1026 as it gets farther from the drive gear 1020, and finally into two barbed ends 1028.

The driven gear unit 1006 is a single piece including a driven gear 1030 and a stub shaft 1032 projecting from one side of the driven gear 1030. A short square-profiled axle 1034 extends from the shaft stub 1032. A second stub 1036 projects out of the other end of the driven gear 1030, and this stub shaft 1036 has a square recess 1038 (See FIG. 208) to mate with the square male shaft 404 projecting from the end of the drive shaft of the transmission module 30, as will be explained later.

The end cover 1002 has two openings 1022A, and 1032A whose inside diameters match the outside diameters of the shaft stubs 1022 and 1032, respectively, such that the drive gear unit 1004 and the driven gear unit 1006 are supported by and rotate in these openings 1022A, 1032A. The end cover 1002 also has the usual cylindrical projections 238 and recesses 240, hooks 242, and recesses 244 previously described with respect to the power module to achieve alignment and to quickly snap together with other modules such as the power module 20 of FIG. 15.

Projecting from the outer surface 1010 of the main housing 1000 (See FIGS. 208 and 208A) are horizontal beams 1040, 1042, a cradle 1044, arms 1046, 1048 with hooks 1050, 1052 respectively to support, cradle, grasp, and firmly secure the ratchet type drive module 70 against the outer surface 1010 of the main housing 1000. Also projecting from the outer surface 1010 of the main housing 1000 are vertical, L-shaped channels 1054, 1055 and a base 1056 for the purpose of supporting and securing the transmission module 30 against the outer surface 1010 of the main housing 1000. As in the case of the openings 1022A and 1032A in the end cover 1002, there are also openings 1024A and 1036A in the main housing 1000, whose inside diameters match the outside diameters of the shaft stubs 1024 and 1036 respectively such that the drive gear unit 1004 and the driven gear unit 1006 are supported by and rotate in these openings 1024A, 1036A. Additional tabs 1060, 1062, and hooks 1064 on the housing 1000, and notches 1066 on the end cover 1002 serve to locate and secure the transmission adapter 72 to the head rail 12A of FIG. 5.

Having described the transmission adapter 72 for parallel ratchet-type drive, we now proceed to describe its assembly and operation. The drive gear 1004 is inserted in the cavity of the main housing 1000 with the shaft 1024 projecting through the opening 1024A. Similarly, the driven gear is placed in the cavity with the shaft stub 1036 projecting through the opening 1036A. The gear diameters of the drive and driven gears 1004, 1006 are such that, when they are placed in their respective openings, their gears mesh. The end cover 1002 is snapped into place such that the stub shaft 1022 of the drive gear 1004 rests in and is supported by the opening 1022A, and the stub shaft 1032 of the driven gear 1006 rests in and is supported by the opening 1032A.

Any one or all of the following modules may be mounted on the transmission adapter 72 for parallel ratchet-type drive:

- A power module 20 may be mounted such that the female end 246 (See FIG. 208) of the power spool 208 mates with the male end 1034 of the driven gear unit 1006. Other power modules 20 may be hooked up in series with the first power module 20 (See FIG. 208).
- A transmission module 30 may be mounted such that the male end 404 of the drive shaft 402 mates with the female square recess 1038 of the driven gear unit 1006.
- A ratchet-type drive module 70 may be mounted such that the male end 1026 of the drive gear unit 1004 mates with the female output shaft of the ratchet-type drive module 70.

The entire assembly is then installed in the head rail 12A of FIG. 5, and the lift rod 26 is connected to the output shaft 418 of the transmission module 30.

Figure 6:
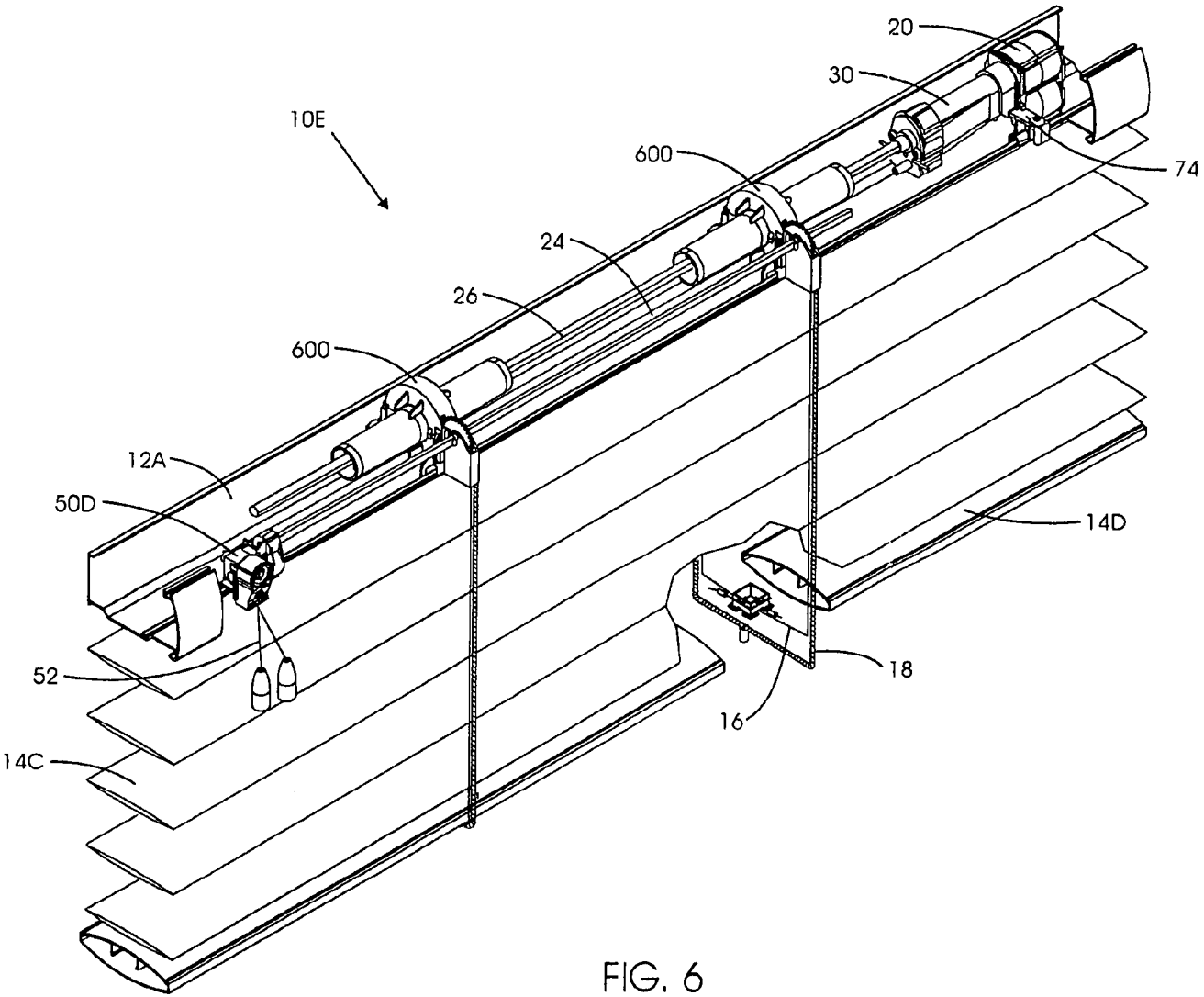
FIG. 6 is a partially broken away perspective view of a sixth embodiment of the invention, similar to FIG. 5 except that the ratchet-type drive has been replaced with a rotated coaxial coiled-spring motor.

Transmission Adapter for Rotated Coaxial Motor:

FIG. 6 shows a blind in a two-inch head rail 12A where the transmission module 30 and the coaxial motor power module 20 are both rotated 90° from their positions in FIG. 1, thanks to an adapter 74. It may be desirable to have the power group displaced to one side of the head rail 12A, as it frees up the entire length of the head rail 12A for some other purpose (such as for placing and driving tilt stations at both ends of the blind, or for placing cord or wand tilter mechanisms on either end of the blind), and the adapter 74 performs that function.

FIG. 210 provides a closer and more detailed view of the adapter 74. In fact, it does not differ much in its elements from some of the other transmission adapters disclosed earlier. The adapter 74 provides a means for locating and securing the modules it is coupling together, and also provides a means for securing the assembly to the head rail. The important difference in this instance is that the adapter 74 stands both the transmission module 30 and the power module 20 in a position in which their shafts lie one above the other instead of side by side, thereby creating a lengthwise space in the head rail. This also highlights the flexibility of the modules which permits their operation in different combinations, in different locations, and in different positions.

Lift and Tilt Stations:

Lift Station Only

As discussed earlier, architectural coverings, such as blinds 10 (See FIG. 1), may have horizontally oriented slats 14. These slats 14 are suspended from overhead head rails 12 via tilt cables 18 (used to tilt the slats 14) and lift cords 16 (used to raise or lower the slats 14). Typically, there are at least two lift cords 16 per blind 10 and it is important that these lift cords 16 be lifted up evenly so that the slats 14 are raised parallel to the head rail 12 and do not end up askew.

In the embodiment of FIG. 1, as the slats 14 are raised, the lift cords 16 are wrapped around their respective winding drum (also called a wind-up spool) which are in the lift modules 40 within the head rail 12, as will be described later. In order to ensure that the slats 14 are raised evenly, it is important that the lift cords 16 wind up on their respective wind-up spools such that successive coils of the cord 16 do not over-wrap. A number of devices have been disclosed to ensure that this over-wrap condition is avoided.

Referring to FIG. 1, the blind 10 includes a head rail 12, and a plurality of slats 14 suspended from the head rail 12 by means of lift cords 16. The lift cords 16 extend through holes 17 in the slats 14 and are fastened to the bottom slat (or bottom rail) 14A. The slats 14 are supported by ladder tapes 22, which are suspended from the head rail 12. Inside the head rail 12 are a coil spring power module 20, a transmission 30, and two lift and tilt modules 40. There are several ways the slats 14 may be tilted, as will be described later. The bottom slat (or bottom rail) 14A is heavier than the other slats 14, as is well known in the art. This particular embodiment uses a tilt control cord 52 and its associated tilt control mechanism 50. The blind 10 preferably would either include the tilt control cord 52 and its associated mechanism 50 or a tilt wand and its associated mechanism as will be described in an alternate embodiment. These mechanisms pull on one side or the other of the support ladders 22 to rotate the slats 14, as will be described later. Also housed in the head rail 12 are a tilt rod 24, and a lift rod 26, the functions of which will be described in more detail later.

FIGS. 104-106 show a preferred embodiment of a lift module 500 used in the embodiment window covering shown in FIG. 8, which is a simpler mechanism than the lift and tilt module 40 of FIG. 1. The lift module 500 is made up of three parts: a cradle 502, a wind-up spool 504 and a securing clip 506. In this preferred embodiment, each one of these three parts 502, 504, 506 is made as a single piece of injection molded plastic.

The cradle 502 includes an elongated base 512 with two end walls which we arbitrarily designate the rear end wall 514 and the front end wall 516. These end walls 514, 516 are perpendicular to the base 512 of the cradle 502, and substantially parallel to each other. Each of these end walls 514, 516 in turn defines a substantially U-shaped opening 518, 520 designed to cradle or carry the respective portion of the shaft of the wind-up spool 504 as will be described later. The rear U-shaped opening 518 and the front U-shaped opening 520 are aligned such that, when the wind-up spool 504 is assembled onto the cradle 502, the end walls 514, 516 straddle the wind-up spool 504 along its longitudinal axis, and the shaft portions of the wind-up spool 504 rest securely in the U-shaped openings 518, 520 of the cradle 502, as will be explained later. To the left (as seen from the front) of the front end wall 516 of the cradle 502 is tilt gear cradling cavity 508 the purpose of which is to cooperate with a tilt rod assembly as will be explained later in connection with another embodiment of the present invention (this cavity 508 is not needed for this embodiment and is only there for economy of tooling in order to share the same cradle with a lift and tilt embodiment described later). On the same side as this tilt gear cradling cavity 508 is a "finger" or kicker 521, which is a wedge-shaped projection from the cradle 502, and which is located such that it cooperates closely with the wind-up spool 504 as will be discussed later. Finally, through the base 512 of the spool 502, and proximate the front end wall 516 is a small opening 519 (See FIGS. 124 and 125) which acts as a guide to direct the lift cord 16 through the cradle 502 to the spool 504.

The wind-up spool 504 is a substantially cylindrical body 522 which defines a rear end 524 and a front end 526. The rear end 524 has a slotted opening 528 the purpose of which will be explained later. There is a small shoulder 530 around the circumference of the cylinder body 522 at its front end 526. The cord-receiving outer surface 532 of the cylindrical body 522 is slightly tapered (See FIG. 111), having a maximum diameter just inside the front shoulder 530. Also projecting from the rear end 524 and the front end 526, are rear shaft 534 and front shaft 536. These two shafts 534, 536 are hollow, axially aligned, and of a diameter that will allow them to rest snugly in the respective U-shaped openings 518, 520 of the cradle 502. The front shaft 536 is preferably hollow and has an interior diameter (ID) with a non-circular profile adapted to engage and cooperate with the lift rod 26 (See FIG. 1) such that rotational movement of the lift rod 26 will result in similar rotational movement of the shaft 536 and thus of the wind-up spool 504.

The front shaft 536 has a step 538 on its outside surface. This step 538 serves to locate the spool 504 on the cradle 502 by limiting its axial forward movement; since the dimensions of the opening 520 of the cradle 502 are smaller than the diameter of the step 538. The shoulder 530 on the spool 504 also serves to locate the spool 504 on the cradle 502 by limiting its rearward axial movement, since the shoulder 530 on the spool 504 will hit the kicker 521 (and an extension 521A (See FIG. 122) which is a matching rim on the cradle 502 which travels for a circumference substantially larger than the kicker 521) if the spool 504 tries to slide too much in the rearward direction. Thus, the kicker 521 is accurately positioned with respect to the spool 504 and the shoulder 530 such that the kicker 521 limits the rearward axial movement of the spool 504 in the cradle 502, and there is a very small gap of less than one cord diameter between the kicker 521 and the tapered outer surface 532 of the body 522 of the spool 504.

Furthermore, the kicker 521 is also advantageously located such that it is proximate the side of the spool 504, as opposed to being proximate the bottom of the spool 504. In fact, in this preferred embodiment of a lift module 500 (and as seen in FIG. 123), the kicker 521 is located within the boundaries defined by an angle of plus or minus 45 degrees from a horizontal plane through the axis of rotation 517 of the shaft 536 of the spool 504, and, in this particular embodiment, the kicker 521 is on the side of the cradle 502 opposite the side where the opening 519 is located.

By advantageously placing the kicker 521 in this location, any downward forces exerted by the weight of the blind 10 on the spool 504, which may cause the spool 504 to sag downwardly, result in essentially no effect on the size of the gap between the kicker 521 and the tapered outer surface 532 of the spool 504. Since this gap is essentially unaffected, the kicker 521 does not come into direct contact with the tapered outer surface 532 of the spool 504, as it might if it were located near the bottom of the spool, so the spool 504 is able to rotate freely without any increased frictional losses even if the spool sags. Also, the lift cord will not be pinched by the kicker 521, and the gap between the kicker 521 and the spool 504 will not become too large, as might occur if the kicker 521 were located in other positions.

Referring to FIG. 106, a securing hood or clip 506 makes up the last item part of the lift module 500. This clip 506 is only about ⅓ as long as the cradle 502 and has only one end wall 540. This end wall 540 has two legs 542 which, between them, form a substantially U-shaped opening 544 whose diameter is equal to the outside diameter of the shaft 536 of the spool 504 (In this and all other areas of this specification where there is a discussion of the relationship of male and female rotating parts, where it is stated that the diameter of the male part is equal to that of the female part, it is to be understood that there is enough clearance between these parts for there to be rotation without interference friction). The two legs 542 are mirror images of each other each ending in a small hook 543. The front end wall 516 of the cradle 502 has two slots 546 straddling the front U-shaped opening 520 of the front end wall 516. These two slots 546 on the cradle 502 cooperatively receive the two legs 542 on the clip 506 such that the legs 542 of the clip 506 will slide down the slots 546. Once the hooks 543 of the legs 542 pass the bottom of the slots 546, they snap and lock into place, with the opening 520 on the cradle 502 and the opening 544 on the clip 506 aligned to form a round hole having an inside diameter equal to the outside diameter of the shaft 536 of the spool 504. There is no need for a securing clip on the rear of the lift module 500 because the rear end wall 514 has an ear 548 which projects rearwardly at approximately a 45 degree angle from the plane defined by the rear end wall 514. This ear 548 is designed to partially bridge the opening 518 such that the rear shaft 534 of the spool 504 may be slid into the opening 518, but, once the securing clip 506 has locked into place, the ear 548 effectively locks the rear shaft 534 in place as well, without affecting the freedom of rotation of the shaft 534 and therefore the freedom of the spool 504 to rotate around its longitudinal axis.

Figure 2:
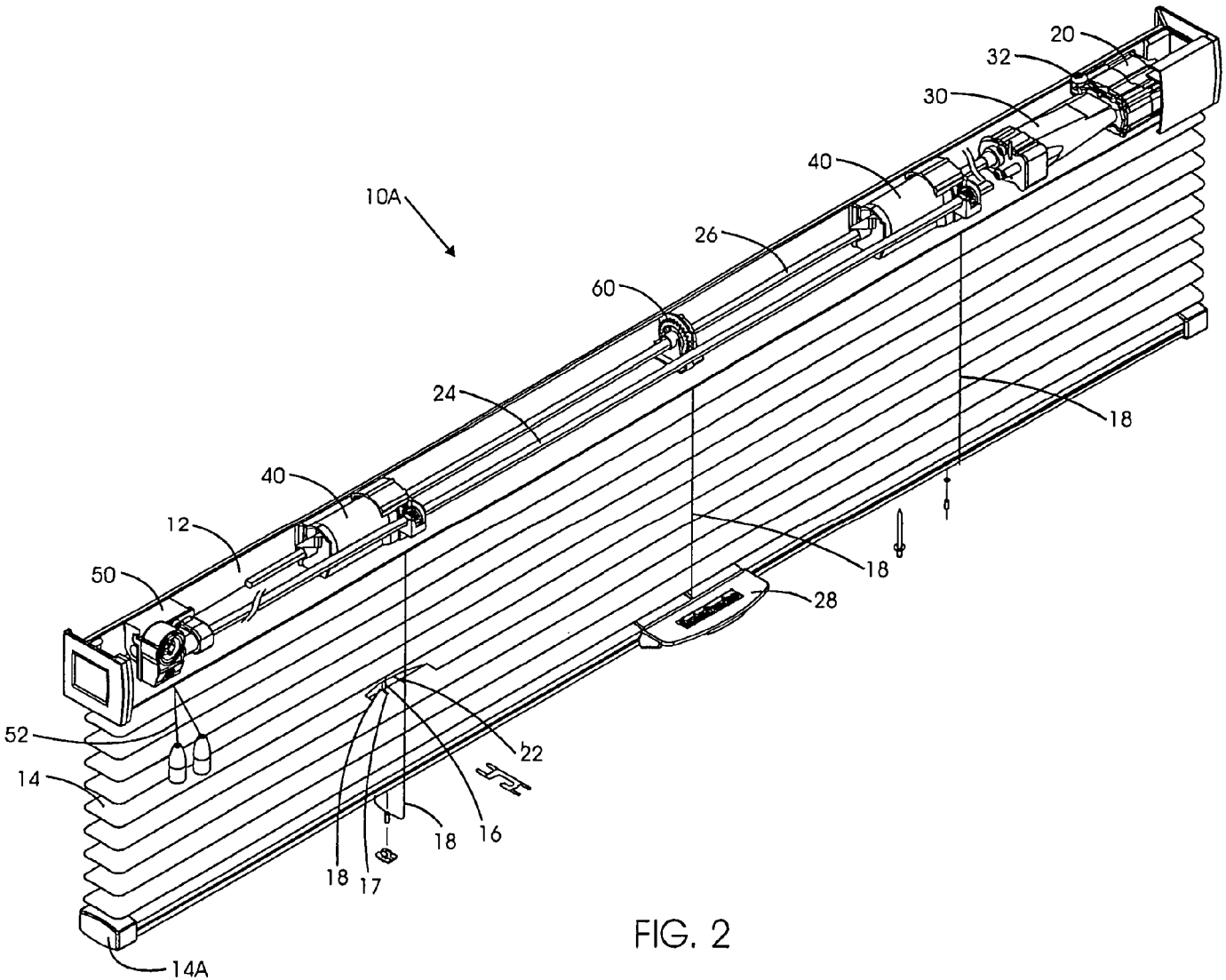
FIG. 2 is a partially broken away and partially exploded view of a second embodiment of the invention, similar to FIG. 1 except this is for a de-lighted product.

It should be noted that we have described one opening 519 in the cradle 502 which acts as a guide to direct the lift cord 16 through the cradle 502 and place the lift cord 16 on the spool 504. In fact, the cradle 502 may have a plurality of such openings, and these are depicted in FIGS. 125A through 125D, as items 519, 519A, and 519B. This gives the same cradle 502 the flexibility to have the lift cord 16 come up through the middle of the cradle 502, via opening 519A (as may be desirable for a standard rout blind as shown in FIG. 3), or it may allow the use of the offset opening 519 (as may be desirable for a "de-lighted" product as shown in FIG. 2), or even the use of offset opening 519B (as may be desirable for a standard rout product where the lift and tilt module is offset to make room for the tilt rod 24).

Having physically described this preferred embodiment of a lift module 500, we now proceed to briefly explain its assembly and operation, referring primarily to FIGS. 106 and 125A. One end of the lift cord 16 is threaded through the opening 519 in the forward portion of the cradle 502 as shown in FIG. 125A. A small FIG. 8 knot (as shown in FIG. 84A) is tied onto the end of the lift cord 16, and this figure knot is slid into the slot 528 at the rear end of the spool 504 such that the knot is inside the cylindrical body 522 of the spool 504 and the lift cord 16 extends along the body 522 and through the opening 519, as shown in FIG. 120. The knot prevents the lift cord 16 from pulling off of the spool 504. The spool 504 is placed in the cradle 502 such that the front shaft 536 is proximate the front end wall 516 and lying in the opening 520, and the rear shaft 534 is proximate the rear end wall 514 and lying in the opening 518. The securing clip 506 is slid downwardly and is snapped and locked into place such that the shaft 536 is now trapped within the hole defined by the opening 520 of the cradle 502 and the opening 544 of the clip 506. The clip 506 prevents the lift cord 16 from over wrapping since a downwardly projection 545 on the clip 506 extends such that there is less than two lift cord 16 diameters between the projection 545 and the largest diameter portion of the surface 532 of the spool 522.

Referring to FIG. 8, the assembled lift modules 500 are placed within the head rail 12, and the lift rod 26 extends through the hollow shafts 536, connecting the lift modules 500 together. As the bottom slat 14A is raised, the coaxial power module 20 causes the lift rod 26 to rotate around its longitudinal axis. This causes the spools 504 of the lift modules 500 to rotate, and the lift cords 16 begins to wind up and coil onto the spools 504 as shown in FIG. 120. As the coils form, the guide opening 519 at the base of the cradle 502 will guide the lift cord 16 to wind up onto the spool just inside the shoulder 530. As the spool 504 rotates, the lift cord 16 travels with the spool 504, moving up and around and down until it contacts the kicker 521, which pushes the lift cord 16 approximately one cord diameter axially away from the shoulder 530 and toward the narrower diameter of the tapered outer surface 532 of the cylinder body 522. This leaves a space for the next coil of the lift cord 16. This action of the guide hole 519 positioning any new cord 16 coming into the spool 504 such that it will be displaced by the kicker 521 down the tapered outer surface 532 of the cylinder body 522 ensures that no coil will remain where the new cord 16 is coming into and winding onto the spool 504, and thus ensures that there is no over-wrap, as is shown in FIG. 121. When the slats 14 are lowered, the reverse action takes place, and, since there was no over-wrap problem when the lift cord 16 was winding onto the spool 504, there will be no tangling or jamming when the lift cord 16 unwinds from the spool 504.

Current architectural covering designs put a premium on the use of ever thinner lift cords 16 in order to keep the mechanical parts as small as possible to fit in the head rail 12, and so that the lift cord 16 detracts less from the aesthetic value of the covering.

The placement of the shoulder 530, the kicker 512, and the opening 519, which accurately positions the lift cord 16 onto the wind-up spool 504, is important. The wind-up spool 504 is slightly tapered (See FIG. 111) away from the kicker 521 (which literally acts so as to kick or displace the latest coil axially to start it onto the tapered portion of the spool 504). Since the spool 504 is tapered away from the kicker 521, once the kicker 521 has "kicked" the coil away from the kicker 521, the coil will not come back up to the spot where the new cord 16 is coming to rest against the spool 504. The kicker 521 is placed along the side rather than at the bottom of the spool 504 such that the tight clearance between the kicker 521 and the spool 504 is unaffected by the downward weight force of the blind 10.

Other embodiments of lift modules will be presented later, all of which have the same principal of operation for winding the lift cord 16 onto the wind-up spool 504. The movement of the blind up and down will now be described.

Movement of the Blind Up and Down:

Looking now at the blind 10G of FIG. 8, the head rail 12 of this blind is identical to the blind 10 of FIG. 1, except that, because the pleated shade does not need to tilt, there is no tilt mechanism, and the "lift only" modules 500 are used. This blind 10G has the same coaxial spring motor 20, the same transmission 30, and the same lift rod 26 described above with respect to FIG. 1. When the blind 10G is assembled, the power spool 208 of the power module 20 is prewound and pinned, as was described earlier. The power module 20 is snapped onto the transmission module 30 using the transmission adapter 32, and the transmission module 30 is connected to the lift rod 26. The "lift only" modules 500 are slid over the lift rod 26 and snapped into place on the head rail 12. The lift cords 16 are installed on the lift only modules 500 as described above, with the blind extended and the lift cords 16 unwrapped from their spools as shown in FIG. 120. In the transmission module 30, the transmission cord 454 is wrapped on the tapered, threaded output shaft 412. The retaining pin 278 of the power module 20 is pulled out, releasing the spring 200, so that the spring 200 begins exerting a lifting force on the lift cords 16, but, since the force is stepped down through the transmission module 30, the resulting lifting force on the lift cords 16 is not sufficient to cause the blind to move up without a slight external input force.

The user operating the blind then grabs the bottom slat or bottom rail 14A (or the handle 28) and pushes upwardly with a slight force. At this point, the force exerted by the spring 200 in the power module 20, is transmitted from the output shaft 208 of the power module 20 to the drive shaft 402 of the transmission 30, through the transmission cord 454 to the transmission driven shaft 412, through the first transmission gear 414 to the second transmission gear 416 to the transmission output shaft 418, to the lift rod 26 and to the spools 504. This force causes the lift rod 26 to rotate so as to wrap up the lift cords 16 on their respective spools 504. As the blind travels upwardly, the transmission cord 454 is unwrapping from the driven shaft 412 and wrapping up on the drive shaft 402, and the spring 200 in the power module 20 is unwinding from the power spool 208. While the spring 200 continues to provide a nearly constant force to the transmission, the output force exerted through the transmission module 30 increases as the blind moves up, so that, as the lift cords 16 are supporting greater and greater weight, they have the increased force necessary to support that weight. When the user releases the handle 28 or bottom rail 14A, the blind stops and is held in that position until some other external force is applied.

When the user decides to pull the blind back down, he grabs the bottom slat or rail 14A and exerts a downward force on the lift cords 16, which causes the cords 16 to unwind from the spools 504, which drives the lift rod 26 in the opposite direction, causing the cord of the transmission to wrap back up on the threaded shaft 412 and wrapping the spring 200 back up onto the power spool 208.

These processes are repeated as the blind is raised and lowered.

Lift and Tilt Station:

FIG. 1 shows a lift module 40 made in accordance with the present invention in which the components are essentially identical to those of the lift module 500 of FIG. 8, which was described earlier, except that two additional components are included, a small drive tilt gear 560 (also referred to as a tilt gear) and a larger driven gear 570 (also referred to as a ladder gear or tilt pulley) shown in FIGS. 107-109. The purpose of these gears, as will be explained in greater detail later, is to provide a mechanism for tilting the slats 14 of the blind 10.

Referring to FIG. 109, the drive tilt gear 560 is designed to snap into place in the tilt gear cradling cavity 508 of the cradle 502, where it is allowed to rotate. The drive tilt gear 560 has a shaft 562 which is preferably hollow and has an interior diameter (ID) with a non-circular profile adapted to engage and cooperate with the tilt rod 24 (See FIG. 1) such that rotational movement of the tilt rod 24 will result in similar rotational movement of the shaft 562 and thus of the drive tilt gear 560. The tilt rod 24 provides the support for the tilt gear. The driven gear 570 also has a hollow shaft 572. The shaft 572 has a circular inner cross-section such that it will mount over the front shaft 536 of the wind-up spool 504 and spins freely on this shaft 536. Thus, the driven gear 570 is only conveniently using the shaft 536 of the spool 504, as well as the mounting and securing mechanism afforded by the cradle 502 and the clip 506, for freely spinning around its shaft 572 while being securely positioned relative to the drive tilt gear 560.

Referring to FIG. 126, the driven gear 570 has an outside diameter and is so placed relative to the driven tilt gear 560, that the teeth of the driven gear 570 mesh with the teeth of the drive gear 560. Thus, when the tilt rod 24 rotates, it causes the drive tilt gear 560 to rotate, which, in turn, causes the driven gear 570 to rotate. However, the gear teeth on the driven gear 570 do not go all the way around the entire circumference of the driven gear 570. There are two gaps 574 straddling a solid segment 576 which has no teeth cut into it. Thus, as the drive tilt gear 560 rotates and meshes with the teeth on the driven gear 570, the teeth on the drive tilt gear 560 will reach one of the gaps 574 in the teeth of the driven gear 570. The teeth on the drive tilt gear 560 will have nothing to mesh with at this point, and the solid segment 576 following the gap 574 will ensure that the driven gear 570 comes to a halt even if the drive tilt gear 560 continues to spin in the same direction. When the drive tilt gear 560 is then rotated in the opposite direction, it will again engage the teeth of the driven gear 570 until the second gap 574 is reached and the driven gear 570 once again comes to a halt, even if the tilt gear 560 continues to rotate in the same direction. Since this is the tilt mechanism, the outside diameter of the driven gear 570 and the travel between stops of the driven gear 570 are sized to correspond to the full tilt up and the full tilt down positions of the slats 14 of the blind 10 when operated as explained below.

FIG. 1 shows this embodiment of the lift modules 40 as they are installed in a head rail 12 of a blind 10. Two sets of ladder tapes 22 are shown. These ladder tapes each have two tilt cables 18, going up along the sides of the slats 14. These two cables 18 go through openings 566 in the head rail 12A (best shown in FIG. 133A) in the head rail 12, through slotted openings 578 in the cradle 502 of the lift module 40 (best seen in FIGS. 124 and 126), and up onto the pulley or sheave portion 582 of the driven gear 570 as shown in FIG. 114A. The sheave portion 582 defines an eccentric drum. Each of the two tilt cables 18 is routed so that the tilt cables 18 straddle the shafts 536 (of the spool 504) and 572 (of the driven gear 570). The ends of the cables 18 are then secured to the driven gear 570 via a FIG. 8 knot (See FIG. 84A), or some other enlargement 564 as shown in FIG. 114A, to secure the ends of both tilt cables 18 behind slots 580 and caught and held in place by the prong 581 (See FIG. 114) in the back of the driven gear 570 (similar to the way the slot 528 secures the lift cord 16 to the spool 504). The tilt cables 18 will then lie in a circumferential slot 582 (See FIGS. 113, 114, and 114A) which is concentric with the shaft 572 of the driven gear 570.

As may now be appreciated from FIG. 1, as one or the other of the tilt cords 52 is pulled, the cord tilt mechanism 50 (to be described later) makes the output tilt rod 24 rotate, causing the drive tilt gears 560 and thus the driven gears 570 to rotate. As each driven gear 570 rotates, one of the respective tilt cables 18 winds up onto its circumferential slot 582, shortening this side of the ladder tape, while the other tilt cable 18 unwinds from the same circumferential slot 582 and lengthens that side of the ladder. This action causes all the slats 14, connected to the respective ladder tape 22 to tilt and thus either close or open the blinds, depending on which tilt cord 52 is pulled. It should be noted that the clip 506 prevents the tilt cables 18 from coming out of the groove in their ladder pulley 570, because the clearance between the inside of the clip 506 and the outside diameter of the ladder pulley 570 is equal to or less than the diameter of the tilt cable 18.

Lift and Tilt Station for Two-Inch Head Rail:

FIG. 7 shows a third embodiment of a lift and tilt module 500A made in accordance with the present invention in which the components are similar to those of the first embodiment 40, except it is to be used in a two-inch head rail 12A, and the components, especially the cradle 502, and the securing clip 506, have a slightly different configuration to accommodate the differences found in this embodiment 500A. In order to simplify the description, all numbered items in this embodiment 500A have the same numbers as the corresponding items in the embodiment 500 of FIG. 8, except that a suffix "A" has been added to represent this third embodiment.

The lift module 500A, shown in more detail in FIGS. 132-135, is made up of four parts: a cradle 502A, a wind-up spool 504A, a securing clip 506A, and a ladder gear or ladder pulley 550A. In this embodiment, each one of these four parts 502A, 504A, 506A 550A preferably is made as a single piece of injection molded plastic.

The cradle 502A includes an elongated base 512A with two end walls which we arbitrarily designate the rear end wall 514A and the front end wall 516A. These end walls 514A, 516A are perpendicular to the base 512A of the cradle 502A, and substantially parallel to each other. Each of these end walls 514A, 516A in turn defines a substantially U-shaped opening 518A, 520A designed to cradle or carry the respective portion of the shaft of the wind-up spool 504A as will be described later. The rear U-shaped opening 518A and the front U-shaped opening 520A are aligned such that, when the wind-up spool 504A is assembled onto the cradle 502A, the end walls 514A, 516A straddle the wind-up spool 504A along its longitudinal axis, and the shaft portions of the wind-up spool 504A rest securely in the U-shaped openings 518A, 520A of the cradle 502A, as will be explained later. On one side of the cradle 502A a "finger" or kicker 521A is located such that it cooperates closely with the wind-up spool 504A as will be discussed later. Finally, through the base 512A of the spool 502A, and proximate the front end wall 516A is a small opening 519A (See FIG. 133) which acts as a guide to direct the lift cord 16 through the base and place the lift cord 16 on the spool 504A.

It should be noted that the cradle 502A has two upwardly projecting arms 503A the purpose of which is to snap in place and lock the module 500A in the two-inch head rail 12A. Other embodiments of this two-inch lift and tilt station 500A may do away with these arms 503A (as shown, for instance in FIG. 13 and in FIG. 133A), in which case the module preferably has hooks which project from the bottom of the cradle and through the head rail 12A to snap the module into place.

Referring to FIG. 134, the wind-up spool 504A is a substantially cylindrical body 522A which defines a rear end 524A and a front end 526A. The rear end 524A has a small slot 528A whose purpose will be explained later. The front end 526A defines a small shoulder 530A around the circumference of the cylinder body 522A at its front end 526A. The cylindrical body 522A has a slight taper having a maximum diameter at the front end 526A, just inside the shoulder 530A. Also projecting from the rear end 524A and the front end 526A, are rear shaft 534A and front shaft 536A. These two shafts 534A, 536A are hollow, axially aligned, and are of a diameter that will allow them to rest snugly in the respective U-shaped openings 518A, 520A of the cradle 502A. The front shaft is preferably hollow and has an interior surface with a non-circular profile adapted to engage and cooperate with the lift rod 26 (See FIG. 7) such that rotational movement of the lift rod 26 will result in similar rotational movement of the shaft 536A and thus of the wind-up spool 504A.

The front shaft 536A has a step 538A (not shown, but identical to step 538 of the spool 504 of module 500 shown in FIG. 106) on its outside surface. This step 538A serves to locate the spool 504A on the cradle 502A by limiting its forward axial movement since the dimensions of the opening 520A of the cradle 502A are smaller than the diameter of the shaft 536A beyond the step 538A. The shoulder 530A on the spool 504A also serves to locate the spool 504A on the cradle 502A by limiting its rearward axial movement, since the shoulder 530A on the spool 504A will hit the kicker 521A if the spool 504A tries to slide too much in the rearward direction. Thus, the kicker 521A is accurately positioned with respect to the spool 504A and the shoulder 530A such that the kicker 521A limits the rearward axial movement of the spool 504A in the cradle 502A, and the kicker 521A has a very small tolerance between the kicker and the tapered outer surface 532A of the cylindrical body 522A of the spool 504A.

Furthermore, the kicker 521A is also advantageously located such that the kicker is proximate the side of the spool 504A, as opposed to being proximate the bottom of the spool 504A. In fact, in this embodiment of a lift module 500A, the kicker 521A begins and ends within the boundaries defined by an angle of plus or minus 45 degrees from the horizontal center line through the shaft 536A of the spool 504A, and in this particular embodiment, the kicker 521A is on the side of the cradle 502A opposite the side where the opening 519A is located. By advantageously placing the kicker in this location, any downward forces exerted by the weight of the blind 10 on the spool 504A result in essentially no effect on the gap between the kicker 521A and the tapered outer surface 532A of the spool 504A. Since this gap is essentially unaffected, the kicker 521A does not come into direct contact with the tapered outer surface 532A of the spool 504A as it might if it were located near the bottom of the spool so the spool 504A is able to rotate freely without any increased frictional losses even if the spool sags. Also, the lift cord will not be pinched by the kicker 521A and the gap between the kicker 521A and the spool 504A will not become too large, as might occur if the kicker 521A were located in other positions.

In addition to the items included in the embodiment 500, this third embodiment 500A further includes a ladder pulley 550A. The ladder pulley 550A has a hollow shaft stub 552A with a small shoulder 553A at the end of the shaft stub 552A. The hollow shaft stub 552A has an interior diameter with a non-circular profile adapted to engage and cooperate with the tilt rod 24 (See FIG. 7) such that rational movement of the tilt rod 24 will result in similar rotional movement of the ladder pulley 550A. The ladder pulley 550A has two faces which are perpendicular to the longitudinal axis of the stub shaft 532A, and between these two faces there is a shallow U-shaped depression or groove 554A along the entire circumference of the pulley 550A. In this groove 554A are two slots 556A (See FIGS. 133 through 133D) through which tilt cables 18 may be threaded and tied with FIG. 8 knots or other enlargements 564 to secure the cable 18 ends (similar to the way the slot 528A secures the lift cord 16 to the spool 504A).

Referring to FIG. 135, a securing clip 506A makes up the last item part of the lift module 500A. This clip 506A is only about ⅓ as long as the cradle 502A and has only one end wall 540A. This end wall 540A has two legs 542A which, between them, form a substantially U-shaped opening 544A the diameter of which is equal to the outside diameter of the shaft 536A of the spool 504A. The two legs 542A each end in a small hook 543A whose purpose is explained later. The front end wall 516A of the cradle 502A has two L-shaped slots 546A (See FIG. 134) straddling the front U-shaped opening 520A of the front end wall 516A. These two slots 546A on the cradle 502A cooperatively receive the two legs 542A on the clip 506A such that the clip 506A will slide, snap, and lock into place by means of the hooks 543A, with the opening 520A on the cradle 502A and the opening 544A on the clip 506A lined up so that between the two openings 520A, 544A, they form a round hole the inside diameter of which is exactly equal to the outside diameter of the shaft 536A of the spool 504A. There is no need for a securing clip on the rear of the lift module 500A because the rear end wall 518A has an ear 548A which projects rearwardly at approximately a 45 degree angle from the plane defined by the rear end wall 518A. This ear 548A is designed to partially bridge the opening 518A such that the rear shaft 534A of the spool 504A may be slid into the opening 518A before the securing clip 506A is installed, but once the securing clip 506A has locked into place, the ear 548A effectively locks the rear shaft 534A in place as well, without affecting the freedom of rotation of the shaft 534A and therefore the freedom of the spool 504A to rotate around its longitudinal axis.

The front end wall 516A of the cradle 502A has a second U-shaped opening 558A, the inside diameter of which is equal to the outside diameter of the shaft stub 552A of the pulley 550A. The end wall 540A of the securing clip 506A also has a second opening 560A, the inside diameter of which is equal to the outside diameter of the shaft stub 552A of the pulley 550A. At the time of assembly, the pulley 550A is placed such that the shaft stub 552A is caught between the two openings 558A (which is at the front end wall 516A of the cradle 502A) and 560A (which is at the end wall 540A of the clip 506A) and these openings 558A, 560A are straddled by one face of the pulley 550A and the small shoulder 553A on the shaft stub 552A.

As seen in FIG. 132, the axis of the spool 504A is offset from the axis of the pulley 550A so that the tilt rod 24 goes through the pulley 550A and the lift rod 26 goes through the spool 504A.

FIG. 7 shows the installation of this two-inch lift and tilt module 500A in the head rail 12A of the blind 10. We have already discussed in detail (under the description of the first embodiment) the installation of the section relating to the lift assembly. For the tilt assembly, the tilt cables 18 of the ladder tape 22 pass through an opening 566 (shown in FIG. 133A) in the bottom of the head rail 12A. The two cables 18 straddle the shaft 552A of the pulley 550A. The ends of the cables 18 are then secured to the pulley 550A, as has already been described and is depicted in FIGS. 133B-133D.

As may now be appreciated from FIG. 7, as the tilt cords 52 are pulled, the tilt cord mechanism makes the output tilt rod 24 rotate, causing the ladder pulley 550A to rotate. As the ladder pulley 550A rotates, one of the cables 18 winds up onto the groove 554A of the pulley 550A, shortening this side of the ladder tape, while the other cable 18 unwinds from the groove 554A and lengthens that side of the ladder. This action causes all the slats 14, connected to the ladder tape 22 to tilt and thus either close or open the blinds, depending on which tilt cord 52 is pulled.

Other Variations for Lift and Tilt Stations:

There are several variations possible for the lift and tilt modules described above. These variations are described below:

Simultaneous lift/tilt action for one-inch head rail module: In many of the complete blind transport systems described in this application, a coil spring power module 20 or some other power source is available to assist in raising the blind 10. Furthermore, the system design is such that the weight of the blind may be counterbalanced by the power and power transmission group such that the architectural covering elements will remain where they are placed but require very little external force input to either raise or lower them, as has already been discussed. Using a simultaneous lift and tilt station, it is possible to take advantage of this power module 20, not only to raise and lower the blind, but to open and close the blind as well.

FIGS. 127 and 128 show a simultaneous lift/tilt module 500B which is very similar in its parts and operation to the one inch lift and tilt module 40 of FIG. 109, except that:

the ladder gear 570 is replaced by a ladder pulley 583B to be described later, the tilt rod drive gear 560 is eliminated, and an optional wavy spring washer 584B may be added.

The ladder pulley 583B has two grooves, 585B, 586B and a hollow shaft 587B with an inside diameter just large enough to slip over the shaft stub 536B of the spool 504B. The ladder tape 22 may be draped around the second ladder pulley groove 586B, so that it is free to slide over this groove 586B, or it may be secured to the ladder pulley 583B so that the ladder tape 22 is not free to slip relative to the ladder pulley 583B. The tilt cord 52 with tassels at its ends is also an optional item. If the tilt cord 52 is present, it may also be free to slide over the first groove 585B, or it may be secured to the ladder pulley 586B, so that the tilt cord 52 is not free to slip relative to the ladder pulley 583B.

In this embodiment of the lift and tilt module 500B (as shown in FIG. 3), as the bottom rail 14A is raised, the lift cord 16 winds onto the lift spool 504B, as has already been described. As the lift spool 504B rotates the frictional resistance between the inside diameter of the shaft 587B of the ladder pulley 583B and the outside diameter of the shaft stub 536B of the lift spool 504B, as well as the frictional resistance between the front end 526B of the spool 504B and the matching face of the ladder pulley 583B will also cause the ladder pulley 583B to rotate, which will also cause the tilt cables 18 of the ladder tape 22 to move, raising one tilt cable 18 while lowering the other tilt cable 18. This action will continue until the bottom rail 14A motion is stopped, or until the slats 14 are fully closed in one direction or the other. Once the slats 14 are fully closed, the tilt cables 18 can no longer continue to move in the same direction so they come to a stop as well. If the ladder pulley 583B continues to rotate, the tilt cable 18 will simply stay in place as the ladder pulley 583B slips past the tilt cable 18. If the tilt cable 18 is secured to the ladder pulley 583B such that the ladder pulley 583B is not free to slip past the tilt cable 18, then ladder pulley 538B will also be forced to stop once the slats 14 are fully closed, and the lift spool 504B will overcome the frictional resistance between the lift spool 504B and the ladder pulley 587B such that the lift spool 504B continues to rotate but the ladder pulley 583B now remains stationary. Once the direction of motion of the bottom rail 14A is reversed, the ladder pulley 583B and/or the tilt cable 18 will reverse direction and proceed to open the slats 14 until the bottom rail 14A motion is once again stopped, or until the slats 14 move totally to the opposite closed position, at which time the resistance to motion of the blinds once again exceeds the frictional resistance between the tilt cable 18 and the ladder pulley 583B, and/or the frictional resistance between the ladder pulley 583B and the lift spool 504B. In the event that the inertia of the slats 14 exceeds the frictional resistance available between the ladder pulley 583B and the lift spool 540B, a wavy spring washer 584B may be added, as shown in FIG. 127, to push against both the front end 526B of the spool 504B and the ladder pulley 583B, and thus increase the frictional resistance between the ladder pulley 583B and the lift spool 540B.

It should be noted that the use of the wavy spring washer 584B adds an axial compression force between the ladder pulley 583B and the lift spool 540B. This same desired result of increasing the friction between these two elements could be obtained by having the additional compression take place circumferentially (instead of axially) between the inside diameter of the shaft 587B of the ladder pulley 583B and the outside diameter of the shaft 536B of the spool 504B. Furthermore, if this was a releasable circumferential compression element, which would be released at either end of the tilting stroke, the counterbalanced transport system would be unloaded from this additional friction.

The optional tilt cords 52 (which may be present in none, one, or more of the lift/tilt stations) provide a manual override to the simultaneous lift/tilt action mechanism. A slight pull on one of the tilt cords 52 will cause the ladder pulley 583B to rotate, thus causing the tilt cables 18 to move so as to open or close the slats 14. The inertia of the blind transport system is much larger than the frictional resistance between the ladder pulley 583B and the lift spool 504B. Thus, the ladder pulley 583B will spin on the lift spool shaft 536B long before the rotational movement of the ladder pulley 583B causes a rotational movement of the lift spool 504B.

Simultaneous lift/tilt action for two-inch head rail module: Simultaneous lift/tilt action, in which the rotation of the lift spool also is used to tilt the blind, may also be achieved for a two-inch head rail 12A, though with a slightly different module. FIG. 136 depicts such a simultaneous lift/tilt module 500C. This module is similar to the two-inch lift and tilt module 500A shown in FIGS. 132 to 135, in which the tilt pulley 550A has an axis offset from the axis of the spool 504A. However, in this embodiment 500C, instead of driving the tilt pulley with a separate tilt rod, the tilt pulley is driven through gears by the lift rod 26.

Instead of the tilt pulley 550A, a tilt gear ladder gear 590C is driven by a tilt drive gear 588C, which is mounted on the lift rod 26, adjacent to its respective lift spool (not shown). The tilt drive gear 588C is retained in its position by the front shaft of the lift spool which is in back of the tilt drive gear 588C, and by a stop 589C, which is part of the cradle 502C.

The ladder gear 590C is very similar to the ladder gear 570 of the lift and tilt module 40. This ladder gear 590C has two gaps 574C on the tooth gear profile and a solid section 576C between the two gaps 574C. The tilt cables 18 of the ladder tape 22 are secured to the back of the ladder gear 574C in the same manner as has already been described for the ladder gear 570 of the lift and tilt module 40. The teeth of ladder gear 590C and the teeth of the tilt drive gear 588C mesh.

As the bottom rail 14A of the blind is raised, the lift spool (not shown) rotates, and so does the lift rod 26, as has already been described. As the lift rod 26 rotates, it drives the tilt drive gear 588C, which is mounted on the lift rod 26. The gear teeth of the tilt drive gear 588C are meshed with the gear teeth of the ladder gear 590C, so this causes the ladder gear 590C to rotate as well. Since the tilt cables 18 are attached to the ladder gear 590C, the slats 14 will tilt until the motion of the bottom rail 14A is stopped or until the teeth of the tilt drive gear 588C reach the gap 574C on the tooth profile of the ladder gear 590C, at which point the tilt drive gear 588C will continue to rotate together with the lift rod 26, but the ladder gear 590C will remain stationary.

When the bottom rail 14A is lowered, the entire process is reversed. The teeth of the tilt drive gear 588C will once again engage the teeth of the ladder gear 590C, thus opening the slats 14 until once again the motion of the bottom rail 14A is stopped or until the teeth of the tilt drive gear 588C reach the other gap 574C on the tooth profile of the ladder gear 590C, at which point the tilt drive gear 588C will continue to rotate together with the lift rod 26, but the ladder gear 590C will remain stationary.

In fact, this mechanism of the missing teeth on the driven gear is used advantageously throughout this invention as a timing or clutch mechanism. Several tilt modules may be installed in a single head rail, all operating to tilt the same slats 14. There is no need to try to match the position of the ladder gear in these modules at the time of installation. The first time the slats are fully closed and full opened, all the ladder gears will automatically align themselves and will remain in alignment thereafter. Thus, in this case the missing teeth act as a timing mechanism.

Furthermore, this missing teeth mechanism will not allow the tilt mechanism to continue to force the slats closed after they are fully closed (which corresponds to the position where the ladder gear presents its missing tooth profile to the drive gear), which could otherwise cause damage to the slats, the ladder tape, or the tilting mechanism. Thus, in this case the missing teeth act as a clutching mechanism to protect the various components from damage due to continued tilting action input.

It should be noted that for this timing and clutching mechanism to work, the entire tilting cycle of the slats from one direction limit to the other direction limit must be accomplished with less than one revolution of the ladder gear.

It should also be noted that the ladder gear 590C also has a hollow shaft whose internal profile matches that of the tilt rod 24. Thus, if the simultaneous lift/tilt action is not desired, the tilt drive gear 588C may be eliminated, and the tilt rod 24 may be run through the ladder gear 590C to tilt the slats 14 from another mechanism so that, in essence, one is back to the lift and tilt module 500A as is shown in FIGS. 7 and 135.

Yet another option is presented in FIG. 137, where the tilt drive gear 588C has been removed from its location on the lift rod 26, and is instead located at a new position. This allows placement of the tilt rod 24 away from the centerline of the head rail 12A which opens up room within the head rail 12A, room which may be required for other modules. In this case, the lift rod 26 only controls the lifting and lowering of the blind, and the tilt rod 24 controls the tilting of the blind.

Still another variation for any of the lift modules or combination lift and tilt modules is the two-piece wind-up spool 504D (See FIG. 120). The two-piece wind-up spool 504D includes an end cap 504E and the spool piece 523D, which is almost identical to the wind-up spool 504 of the lift module 500 except that it is missing the rear shaft 534 (See FIG. 106). In this embodiment, the rear shaft 534D is on the end cap 504E. At the cap end of the spool 523D is a groove 504F. The end cap 504E has a corresponding groove 504G, which is aligned with the groove 504F of the spool 523D when the end cap 504E is pressed into the end of the spool 523D. To install the lift cord 16 on the spool 523D, an enlargement is put onto the end of the lift cord 16. The enlargement may be a knot, a crimping bead, or other known enlargement mechanisms as have already been discussed. The lift cord 16 is then slipped into the groove 504F of the spool 523D, with the enlargement inside the spool. The lift cord 16 could alternatively be glued to the spool 523D, or the groove 504F could taper to a width less than the diameter of the lift cord 16, in which case an enlargement would not be necessary. Then the end cap 504E is pressed into the end of the spool 523 with its groove 504G aligned with the groove 504F of the spool 523D, until the flange of the end cap 504E abuts the end of the spool 523D, thereby trapping the end of the lift cord 16 on the spool 523D. The rest of the lift cord 16 extends around the spool 523D, down through an opening 519 in the cradle 502, through the bottom of the head rail 12, through the slats or pleats 14, through the bottom slat 14A, and is tied off at the bottom of the bottom slat or rail 14A. The spool 523D is then pushed down into the cradle 502 until the shaft of the end cap 504E is trapped under the projecting arm 548 of the cradle 502.

Referring again to the ladder pulley 570 of the lift and tilt module 40 shown in FIG. 109, this ladder pulley 570 has a stub shaft 572 which mounts outside and concentrically with the front shaft 536 of the wind-up spool 504. The stub shaft 572 of the ladder pulley 570 is long enough that it rests directly on the U-shaped opening 520 of the cradle 502. Thus, any weight carried by the ladder pulley 570 (and this weight increases as the blind 10 is lowered because more slats 14 are being supported by the ladder tape 22 as fewer slats 14 are supported by the bottom rail 14A) is transferred directly to the cradle 502 and thence to the head rail 12. If it were preferred to keep the weight on the spool 504 constant, regardless of the position of the blind the stub shaft 572 of the ladder pulley 570 could be shortened so that it did not rest on the cradle wall 516. The ladder pulley 570 would then be fully supported by the front shaft 536 of the wind-up spool 504, which in turn is supported by the opening 520 of the cradle 502. Then, as the blind 10 is lowered, the weight that is being removed from the lift cords 16 is shifted onto the tilt cables 18 and onto the ladder pulley 570. Since the ladder pulley 570 is supported by the wind-up spool 504, the wind-up spool 504 is always bearing the same weight, for, as the blind 10 is lowered, the lift cord 16 (which is supported by the spool 504) is shedding the weight of some of the slats 14 to the ladder tape 22. However, the ladder tape 22 is supported by the ladder pulley 570 which in turn is supported by the shaft 536 of the spool 504, so the weight is merely being shifted from the spool 504 to the shaft 536 of the spool 504, with no net change.

Tilt Only Module: FIG. 129 depicts the tilt only module 60 shown in FIG. 1. The significance of a tilt only module lies in recognizing the fact that the bottom rail 14A (which is involved in doing the lifting of the blind 10) is a stronger member than the slats 14 (which are involved in doing the tilting). Thus, in a wide blind 10, the bottom rail 14A may require fewer supports than the slats. A lift and tilt module 40 could be provided at every point where the slats 14 need the support. However, besides the added expense of this approach, there is also much more friction (and thus added system inertia which must be overcome by the power group) involved with such lift and tilt modules 40 than with a tilt only module 60. Therefore it is preferable to provide a tilt only module 60 in those places where only the slats 14 require support to prevent them from sagging but the bottom rail does not require support.

FIGS. 129-131 show one embodiment of the tilt only module 60, including a cradle 61 designed to snap into the head rail 12, and a ladder pulley 62 designed to snap into the cradle 61. The ladder pulley 62 is able to spin freely around its axis of rotation when snapped into the cradle 61. The ladder pulley 62 may have a cylindrical-profile hollow shaft 63 (as shown in FIG. 130) or a non-cylindrical-profile hollow shaft 63A (as shown in a slightly different embodiment 60A described later). This ladder pulley 62 may in fact be the very same ladder pulley driven gear 570 used in the lift and tilt module 40 (See FIGS. 112-114) which explains the presence of the gear teeth which are not required for this embodiment.

As shown in FIG. 1, the lift rod 26 goes through the hollow shaft 63 of the ladder pulley 62 and acts to support the ladder pulley 62. However, the lift rod 26 does not drive the ladder pulley 62. It simply helps support the ladder pulley 62. The tilt cables 18 are secured to the ladder pulley 62 in the same manner as has already been explained for the driven gear 570 used in the lift and tilt module 40, and the tilt cables 18 are part of the ladder tape 22 which supports the slats 14 so they will not sag. When the slats 14 are closed, the slats 14 will push down on one of the tilt cables 18 located at the tilt only module 60. This will cause the ladder pulley 62 to rotate and pull the other tilt cable 18 up, thus always maintaining the proper support for the slats 14.

FIGS. 138-140 show a second embodiment of the tilt only module 60A, in which the ladder pulley 62A has a non-cylindrical-profile hollow shaft 63A. In this case, the lift rod 26 not only goes through the hollow shaft 63A but also engages it, such that when the lift rod 26 rotates, it will cause the ladder pulley 62A to rotate as well. In this instance, the tilt cables 18 are not be secured to the ladder pulley 62A, but instead they are draped over the pulley as was discussed for the simultaneous lift/tilt module 500B (See FIG. 127). Now, as the lift rod 26 rotates, the ladder pulley 62A also rotates, pulling one tilt cable 18 up while the tilt cable 18 on the other side of the slats 14 is pushed down so as to close (or open) the slats 14. This action will continue until the lift rod 26 stops, or until the slats 14 reach a fully closed position. At that point, the resistance to continued rotation from the slats 14 will exceed the frictional resistance between the draped tilt cables 18 and the surface of the ladder pulley 62A, such that the ladder pulley 62A will continue to rotate while the tilt cables 18 slip over the ladder pulley 62A. The cradle 61A is designed to snap into the head rail 12, and a ladder pulley 62A is designed to snap into the cradle 61A. The ladder pulley 62A is designed specifically for operation with the simultaneous lift/tilt action of the lift/tilt module 500B. The ladder pulley 62A has no provision for securing the tilt cables 18 to the ladder pulley 62A. Instead, the tilt cables 18 are draped over the ladder pulley 62A, and count only on frictional resistance between the tilt cables 18 and the ladder pulley 62A for motion of the ladder tape 22 to open or close the slats 14.

Twin Spool Lift and Tilt Module:

As was mentioned in the summary of the invention, one of the methods for obtaining a de-lighted product is by eliminating the slits 17 in the center of each slat 14 (as shown in FIG. 1). The slits may be moved rearwardly, as described in provisional application Ser. No. 60/137-209 filed on Jun. 2, 1999, which is hereby incorporated by reference, or the slits may be eliminated completely. In that case there would be forward and rear lift cords 16A,B at every module, one in the front and the other in the rear of the slat 14 (the same as the ladder tapes 22 for tilting the slats 14), as shown in FIG. 5. As is the case with standard product lift cords 16, the de-lighted product lift cords 16A,B are not attached to any of the slats 14, only to the bottom rail 14A. In order to handle the two lift cords 16A,B at every station, the twin spool lift and tilt module 600 is used, as shown in FIG. 5. This twin spool module 600 is very similar in its design and operation to the single spool lift modules or lift and tilt modules described earlier.

Referring to FIG. 5, the blind 10D includes a head rail 12A, and a plurality of slats 14 suspended from the head rail 12A by means of lift cords 16A,B. The lift cords 16A,B extend along the front and rear edges of the slats 14 and are fastened at the bottom of the bottom slat (or bottom rail) 14A. The slats 14 are supported by ladder tapes 22, which are suspended from the head rail 12A, in the usual way. Inside the head rail 12A are a ratchet-type drive module 70, a transmission module 30, two twin spool lift and tilt modules 600, a cord tilter mechanism 50D, a tilt rod 24, and a lift rod 26. The bottom slat (or bottom rail) 14A is heavier than the other slats 14, as is well known in the art. This drawing shows a tilt control cord 52 and its associated tilt mechanism 50D. The blind 10D preferably would either include the tilt control cord 52 and its associated mechanism 50D or a tilt wand and its associated mechanism. These mechanisms pull on one side or the other of the support ladders 22 to rotate the slats 14, as has already been described.

FIG. 141-145 show a preferred embodiment of the twin spool lift and tilt module 600, illustrating that it is made up of six parts: a cradle 602, two wind-up spools 604, a securing clip 606, a tilt drive gear 608, and a ladder pulley 610. In this preferred embodiment, each one of these six parts 602, 604, 606, 608, and 610 is made as a single piece of injection molded plastic.

The cradle 602, shown in detail in FIGS. 146A-D, includes a base 612 with two end walls which we arbitrarily designate the rear end wall 614 and the front end wall 616. These end walls 614, 616 are perpendicular to the base 612 of the cradle 602, and substantially parallel to each other. Each of these end walls 614, 616 in turn defines a substantially U-shaped opening 618, 620 which cradles or carries the respective portion of the twin wind-up spools 604 as will be described later. A third U-shaped opening 619 is actually on a tab 622 which projects from the end wall 614 and is parallel to and between the end walls 614, 616. The bottom of the tab forms a shoulder 624. The base 602 also has one or more tabs 626, which extend perpendicularly to the long axis of the base 602 and which serve to add horizontal stability to the base and as a clearance device to preclude over wrapping of the lift cords 16 as they wind up onto the twin spools 604, as will be explained in more detail later. There are cord passage projections 628A, 628B in the base 602, which project beyond the bottom of the base 602 and through holes (not shown) cut into the head rail 12A. There are openings 630A, 630B (See FIG. 147D) through the cord passage projections 628A, 628B through which the lift cords 16 and the tilt cables 18 (if present) may pass en route from the ladder tape 22 hanging under the head rail 12A to the twin spool module 600. There are additional projecting surfaces 632 and a projecting arm 634 with a hook 636 which also extend beyond the bottom of the base 602, and which, in conjunction with the cord passage projections, cooperate to locate and releasably secure the base 602 to the head rail 12A.

The base 602 also has a cavity 638 (See FIGS. 146A and 146B) for cradling the tilt drive gear 608 (when it is present). This cavity 638 has two U-shaped openings 640, 642 used to support the stub shaft 644 of the tilt drive gear 608. The base 602 also has two channels 646, 648 which receive the legs 648A and 648B of the clip 606 to lock the clip 606 in place, and two slots 650, 652 are used for guiding the lift cords 16A,B through the openings 630A, 630B and onto the lift spools 604.

The twin spools 604 are similar to the spools described for other lift and tilt modules. Each spool 604 has a first end 654 and a second end 656. The second end 656 has a slotted opening 658 for the purpose of securing a lift cord 16A or 16B by sliding an enlargement of the lift cord, such as a FIG. 8 knot, behind the slotted opening, as has already been disclosed in prior lift modules. The first end 654 has a flange 660, a short tapered cylindrical section 662, which has its largest diameter adjacent to the flange 660, and a stub shaft 664 with a non-cylindrical internal profile to match the profile of the lift rod 26.

The ladder pulley 610 has a hollow shaft 666, the inside diameter of which matches the outside diameter of the stub shaft 664 of the lift spools 604. The ladder pulley 610 is designed to ride on the shaft formed by the abutting stub shaft 664 of two axially aligned twin spools 604. Concentric to the pulley's hollow shaft 660, but closer to the outside circumference of the ladder pulley 610, there are circumferential shoulders 667 on both sides on the ladder pulley 610. These circumferential shoulders 667 have a depth equal to that of the offset shoulder 624 on the tab 622 of the base 602. The ladder pulley 610 is thus snapped into position by elastically deforming the walls 614, 616 and the tab 622 of the base 602 until the ladder pulley 610 snaps into position with the shoulder 624 of the tab 622 mating with one of the shoulders 667 of the ladder pulley 610 to keep the ladder pulley 610 from lifting out of the base 610 and with the recess 619 of the tab supporting the stub shaft 666 of the ladder pulley 610.

The gear tooth profile on the ladder pulley 610 has an interrupted section 674 where there are no gear teeth (See FIG. 149). As has already been disclosed with respect to other lift and tilt modules, this interruption in the tooth gear profile acts both as a timing mechanism (all the modules align themselves automatically upon one complete tilting cycle) and as a clutching mechanism (the tilting action will cease upon reaching this section so that the mechanism is not struggling to tilt the slats beyond their fully closed positions). The tilt cables 18 are secured to the ladder pulley 62 by sliding an enlargement behind the slotted openings 680, in the same manner as has already been explained for the driven gear 570 used in the lift and tilt module 40.

The twin spools 604 ride on the U-shaped openings 618, 620, with the flange 660 of each spool 604 trapped just inside of the respective wall (614 for the rear spool and 616 for the front spool) of the cradle 602. The stub shafts 664 of the spools 604 are axially aligned and abut each other inside the shaft 666 of the ladder pulley 610, which is trapped between the shoulders 665 on the shaft stubs 664 and is spinning freely on these shafts stubs 664.

The tilt drive gear 608 lies in the cavity 638 of the base 602, with the tilt gear stub shafts 644 supported by the U-shaped openings 640, 642. The diameters of the tilt drive gear 608 and the ladder pulley gear 610 are such that the teeth of the tilt drive gear 608 will mesh with the teeth of the ladder pulley 610 when both are installed in their respective positions in the base 602.

The securing clip 606 is then snapped over the assembly with the arms 646A, and 648A sliding down inside the corresponding channels 646, 648 of the base 602 until the barbs 668 snap into place at the end of the channels 646, 648. The clip has tabs 670, similar to the tabs 626 on the base 602, used to prevent over wrapping of the lift cords 16 on the spools, as will be explained later. Projections 672 on the forward and rear surfaces of the cover 606 act as the kickers for the two spools 604 to displace the latest coil of lift cords 16A,B along the tapered sections 662 of the respective spools 604 in order to preclude over wrap.

As was described in the embodiments for the lift modules and lift and tilt modules, the kickers 672 for the twin-spool module 600 are advantageously located beside the spools 604 instead of above or below the spools 604, and (as seen in FIG. 123 for a kicker 521 on a lift module 500) the kickers 672 ideally begin and ends within the boundaries defined by an angle of plus or minus 45 degrees from the horizontal center line through the shafts 664 of the spools 604. Thus, if the spools 604 should sag due to the weight of the blind supported off the spools 604, the gap between the kickers 672 and the spools 604 will not be affected and the kicker 672 will still be able to perform its function of axially displacing any coils of lift cord 16A or 16B in order to avoid over wrap. The kickers 672 are wedge-shaped projections (See FIG. 145) on the cover 606 such that when the cover 607 is snapped into the cradle 612, the kickers 672 ride right against the shoulders 661 of the flanges 660 of the spools 604.

The assembly and operation of the twin spool lift and tilt module 600, are as follows: The ladder pulley 610 is snapped into position within the base 602, resting on the opening 619 and held secure by the shoulder 624. The tilt drive gear 608 (if present) is also snapped into position within its cavity 638 of the base 602. The twin spools 604 are installed such that their stub shafts 664 are axially aligned, abutting each other, and are going through the hollow shaft 666 of the ladder pulley 610. The spools 604 rest on the U-shaped openings 618, 620 of the base, and the flange 660 of each spool 604 is inside its respective wall 614, 616. This assembly is slid into place in the head rail 12, with the lift rod 26 going through both spool 604, and the tilt rod 24 going through the tilt drive gear 608, and the assembly is snapped into place in the openings (not shown) in the head rail 12. The lift cords 16A,B are fed through their respective openings 630A, 630B, along their respective slots 652, 650, and onto their respective spools 604. One lift cord 16A is directed under and around its respective spool 604, while the second lift cord 16B is directed over and around its respective spool 604 until the enlargement at the end of each lift cord 16A,B can be slid behind the slotted opening 658 of its respective spool 604. The tilt cables 18 are also fed through the same openings 630A, 630B and are secured directly to the ladder pulley 610 as has already been described. Finally, the securing clip 606 is snapped into place.

As shown in FIG. 5, the power module 70 drives the lift rod 26 which drives the twin spools 604 (Of course, other power modules, such as motor 20, could be used instead). This causes the lift cords 16A,B to wrap around the spools 604. As each new coil of the cord is wrapped onto its respective spool 604, the respective kicker 672 pushes the latest coil axially along the tapered surface 662 of the spool 604, such that new coils of lift cord 16 may be added without any over wrap. The tab(s) 626 on the base 602 and tabs 670 on the securing clip 606 provide a small radial gap between the tabs 626, 670 and the spool 604 which is less than two lift cord diameters, thus precluding any over wrap of the lift cord 16A,B.

Both lift cords 16A,B are wound onto respective spools 604 simultaneously, both being wound counter-clockwise onto their respective spools 604. Since both lift cords 16A,B are being drawn up at the same time and at the same rate, and this happens at each module 600 along the length of the head rail 12A (See FIG. 5), the bottom rail 14A is raised evenly.

As the bottom rail 14A is moved downwardly, the action is reversed. The lift cords 16A,B are unwound from the spools 604 as the lift rod rotates. If a coil spring motor module 20 were used in the place of the ratchet drive 70, this action would have caused the spring 200 to wrap around the power spool 208.

To accomplish the tilting action, the tilting mechanism 50D is actuated by pulling on one of the tilt control cords 52. This causes a rotation of the tilt rod 24 which is connected at one end to the tilting mechanism 50D, and extends through the tilt drive gears 608 of the twin spool lift and tilt modules 600. As the tilt rod 24 rotates, it rotates the tilt drive gears 608, which mesh with, and thus causes the rotation of, their respective ladder pulleys 610. As the ladder pulleys 610 rotate, they pull up on one of their respective tilt cables 18, and loosen on the opposite tilt cables 18, thus causing the ladder tapes 22 and the slats 14 to tilt. This action is fully reversible.

Variations of the Twin Spool Lift and Tilt Module:

The bottom rail 14A is the item directly involved in raising or lowering the blind, while all the slats 14 are directly involved in tilting the blind. Since the bottom rail 14A is considerably stronger and less flexible than the other slats 14 and only the bottom rail 14A is used for raising and lowering the blind, it may be possible to have fewer lift stations (modules) than tilt stations, especially for a wide blind. Thus, in some locations along the width of the head rail 12A, it may be very desirable to have only a tilt station. FIGS. 150 and 151 show a version of the twin spool module 600A in which both spools have been replaced with identical double shafted shims (or dummy spools) 676. These shims 676 are essentially no more than the first end 654 of the spool 604 with a rear stub shaft 678. These shims 676 replace the wind-up spools. Thus these shims 676 have a front stub shaft 678A, a flange 660A and a rear stub shaft 678. This new tilt only module 600A may be used where it is desirable to have tilt only capability.

Once again, due to the relative strength rigidity of the bottom rail 14A relative to the rest of the slats 14, it is also possible to use a single-spool "twin spool" design module 600B (See FIG. 148). In this instance, there would be only one lift cord 16 at each station, even when working with a de-lighted product which has no openings 17 in the slats 14. This single spool module 600B is depicted in FIGS. 148-149 and is identical to the twin spool module 600 except that one of the twin spools 604 has been eliminated and replaced with a shim 676. Either one of the twin spools 604 may be eliminated depending on the desired effect. For instance, along a length of head rail 12A, the first station may be a single spool module 600B as shown in FIG. 148, which would handle both tilt cables 18 but only the front lift cord 16A. There would be no other lift cord at this location. The next station may also be a single spool module 600B but with the opposite spool missing from that shown in FIG. 148. This module 600B would once again handle both tilt cables 18 but only the rear lift cord 16B. There would be no other lift cord at this location. The single spool lift stations 600B could continue to alternate in this fashion or, as required, may be totally replaced with a tilt only module 600A or a twin spool lift and tilt module 600 at any given station.

Manual Cord Loop Drive Module

Referring now to FIG. 13A, a blind 10M is depicted which has a pleated shade instead of slats. Thus, there is no need for a tilt mechanism. This blind 10M may be lowered by grabbing the handle 28 and pulling down on the bottom rail 14A; and it may be raised by grabbing the handle 28 and coaxing the bottom rail 14A up.

However, if the blind 10M is installed where it is difficult to access the handle 28 (perhaps because there is a piece of furniture in the way or the top of the blind 10M is too high to be able to reach to fully raise the blind 10M), an alternate drive system, the manual cord loop drive module 700, is available. This is an endless loop cord drive system where the cord itself may be as long as desired in order to reach even if the blind 10M itself is inaccessible. Pulling the cord loop in one direction raises the blind, and pulling it in the opposite direction lowers the blind.

Referring to FIGS. 159-161, the manual cord loop drive module 700 includes four parts: a housing 702, a cord pulley 704, the cord loop 706, and an end cap 708. The housing 702 includes a rectangular plate 710 which roughly divides the housing 702 into front and rear portions. Off of the rear portion of this plate 710 extend projections 712 designed to cooperate with the end of the head rail 12 such that the housing 702 may snap in place and may be held securely in the end of the head rail 12. An opening 714 extends through the approximate center of the plate 710. Concentric with and external to the opening 714 is a shoulder or flange 716 which projects forward from the front portion of the housing plate 710. This shoulder 716 extends around most of a circle and then flares open at one corner of the housing plate 710, forming guide vanes 718. There is also an inner guide vane 718A projecting from the front surface of the plate 710 which divides the opening into two paths 720 through which the cord loop 706 exits the housing. The vanes 718, 718A guide the cord loop 706 so that it does not tangle. The rectangular plate 710 also has upper and lower projecting tabs 722.

The cord pulley 704 has a hollow shaft 724 the inner profile of which matches the profile of the lift rod 26, and the outside diameter of which is just small enough to pass through the opening 714 of the housing 702. At one end of the shaft 724 is the pulley 726. While a pulley would normally have a groove with side walls, this pulley 726 has a plurality of alternating truncated, V-profile teeth 728 around its circumference, through which the cord loop 706 is wound. Each tooth 728 projects beyond the centerline of the pulley 726 (beyond what would normally be the center of the groove), so the cord 706 follows a wavy path from one tooth to the next. This design readily releases the cord loop 706 when it is pulled radially away from the pulley 726, but holds tightly to the cord loop 706 when it is pulled circumferentially around the pulley 726. The outside diameter of the imaginary circle formed by the outermost portion of the alternating teeth 728 is just small enough to fit inside the inside diameter of the shoulder 716, and the shoulder 716 extends past the teeth such that, once the cord loop 706 is caught in the alternating teeth 728, the circular shoulder 716 will not allow the cord loop 706 out except at the openings 720.

The end cap 708 is a rectangular box with top and bottom recesses 730 which engage the upper and lower tabs 722 projecting from the housing 702 so that the end cap 708 snaps onto and is securely held to the housing 702. Only the top recess 730 is shown, but the bottom recess is a mirror image of the top recess. The end cap 708 has an opening 732 which matches with the opening 720 in the housing 702, and which allows the cord loop 706 to exit the manual cord loop drive module 700.

The continuous cord loop 706 (which is broken away in FIGS. 159-161 but is properly shown as a continuous loop in FIG. 13A) is woven between the alternating teeth 728 of the cord pulley 704. The hollow shaft 724 of the cord pulley 704 is inserted through the opening 714 of the housing 702, and the end cap 708 is snapped over the assembly, with the upper and lower tabs 722 extending through their respective openings 730, encasing the cord 706 and the cord pulley 704 between the end cap 708 and the housing 702. This entire assembly, comprising the manual cord loop drive module 700, is snapped in place in the head rail 12 by inserting the projections 712 at the rear of the housing 702 into the head rail 12 profile. The lift rod 26 is inserted into the hollow shaft 724 of the cord pulley 704.

As may now be appreciated, as one end of the endless loop cord 706 is pulled, the alternating teeth 728 gripping the cord 706 causes the cord pulley 704 to rotate around its shaft 724. This causes the lift rod 26 to rotate and, depending on the direction of rotation, causes the lift module 500 to raise or lower the blind 10M as has already been described. Since the raising and lowering of the blind 10M is assisted by a power module 20 and transmission 30, very little force is required on the loop cord 706.

The guide vanes 718, 718A direct the cord 706 such that, regardless of the direction of pull by the user, the exiting portion of the cord 706 will be moving radially away from the cord pulley 726 as the cord 706 reaches the respective path 720. The portion of the cord loop 706 entering the manual cord loop drive module 700 follows the other path 70 and is caught between the alternating teeth 728 and the inside surface of the shoulder 716 on the housing 702. This inside surface of the shoulder 716 pushes the cord loop 706 radially inwardly toward the teeth 728, pressing the cord loop 706 in between the alternating teeth 728. Thus the endless cord loop 706 is continuously being released at one end, and secured at the opposite end as the cord 706 is pulled to rotate the lift rod 26. This action is fully reversible in direction.

Wand Tilter Module

FIG. 13B shows a blind which is very similar to that shown in FIG. 1 except the cord tilter module 500 has been replaced by a wand tilter module 750. A very similar wand tilter module has been fully described in U.S. Pat. No. 4,522,245 "Anderson", dated Jun. 11, 1985, which is herein incorporated by reference. The present embodiment of this wand tilter module 750 is more clearly depicted in FIGS. 162 and 163. The wand tilter module 750 includes a housing 752, a worm gear 754, and a spur gear 756. Of these components, only the housing has changed from that disclosed in the original U.S. Pat. No. 4,522,245 cited above, but it has changed in a manner which is not significant to the operation of the module 750. The housing 752 now has a long "tail" 758 and two small hooks 760. These items permit a faster and simpler installation of the module 750 into the head rail 12.

Cord Tilter Module

Figures 39A, 39B:
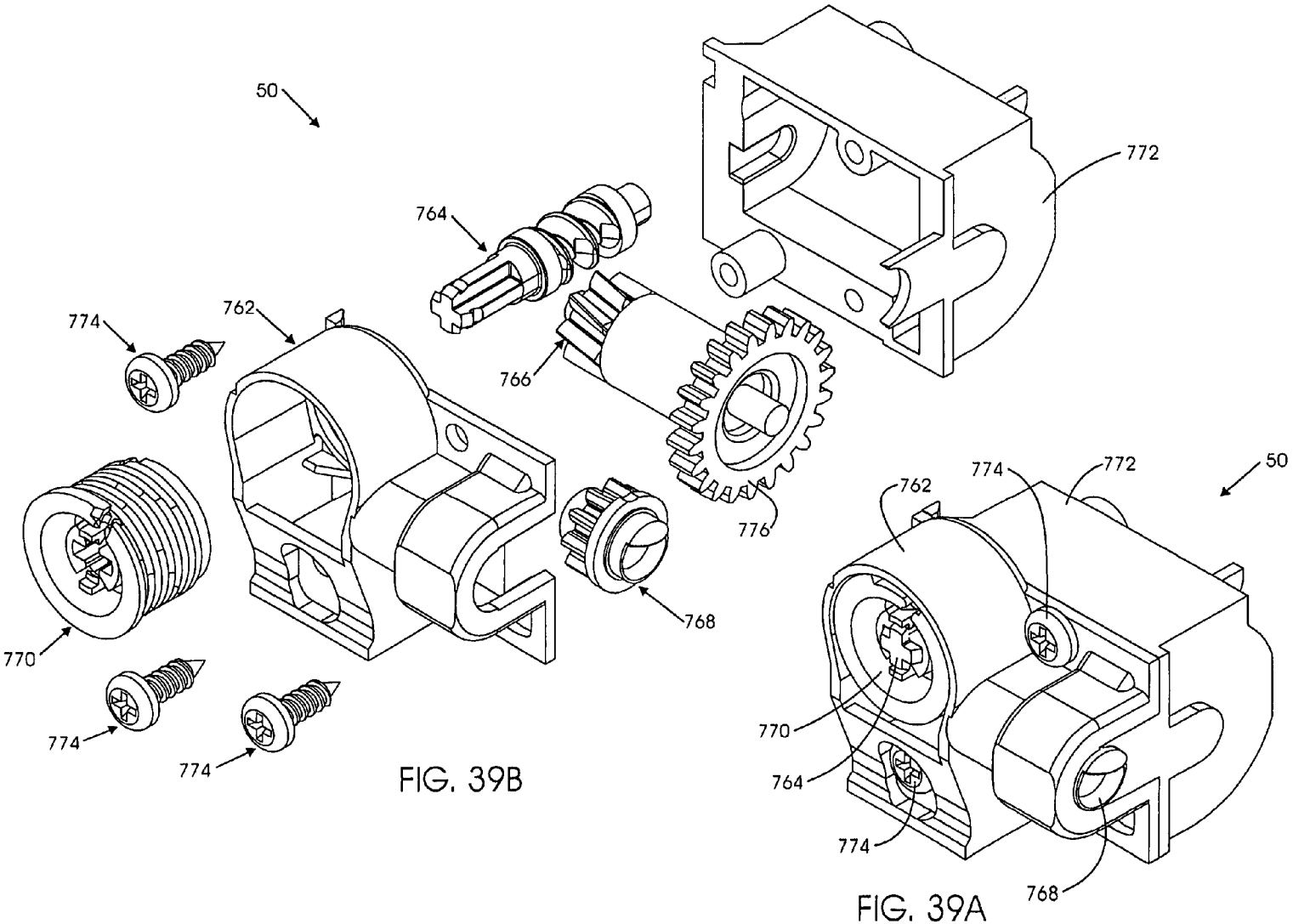
FIG. 39A is a perspective view of a cord tilter for a one-inch head rail as shown in FIG. 1.
FIG. 39B is an exploded view of the cord tilter of FIG. 39A.
Figure 40:
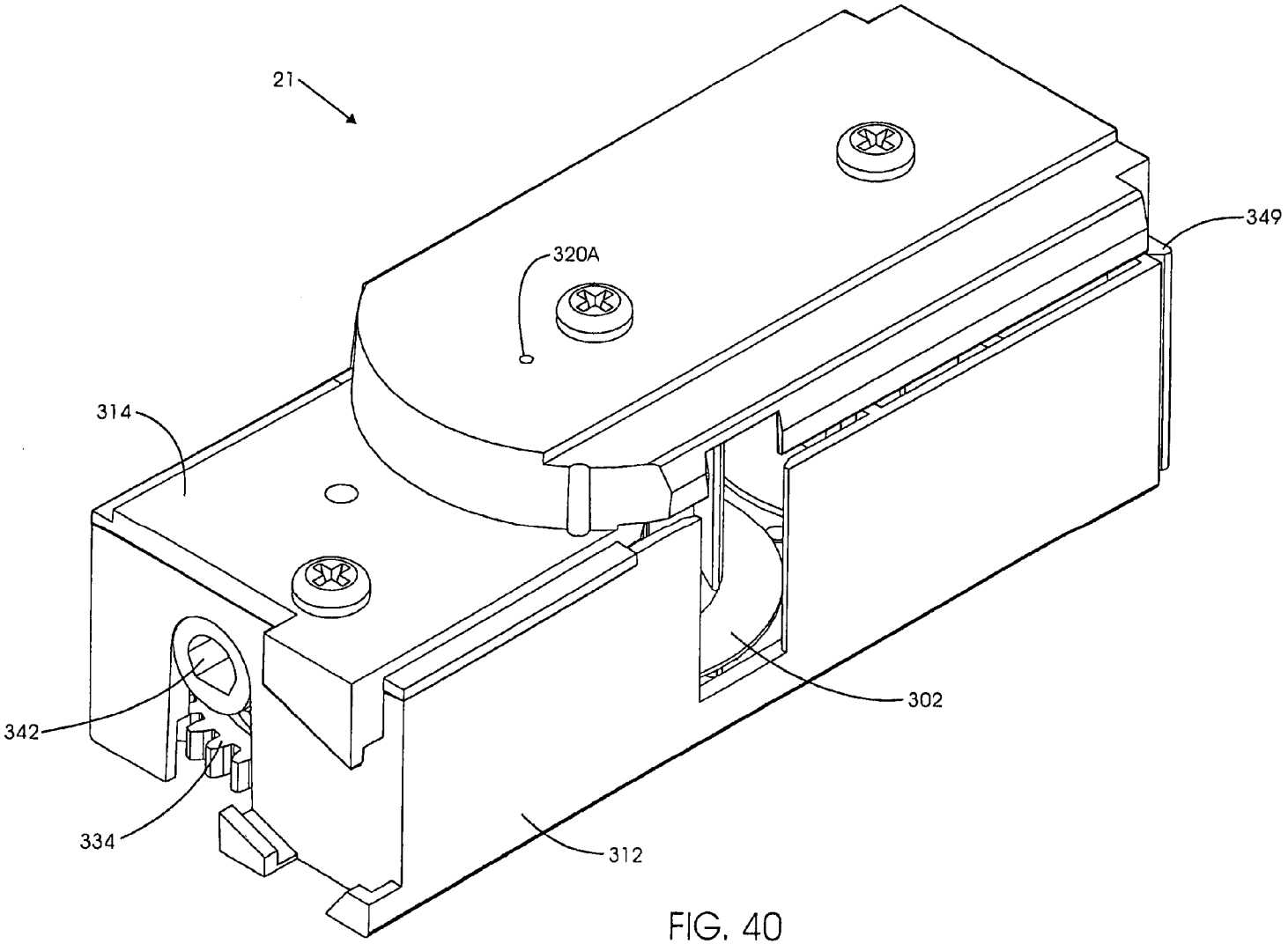
FIG. 40 is an output-end perspective view of a transaxial coiled spring motor made in accordance with the present invention and shown in the window covering assembly of FIG. 13.
Figure 42:
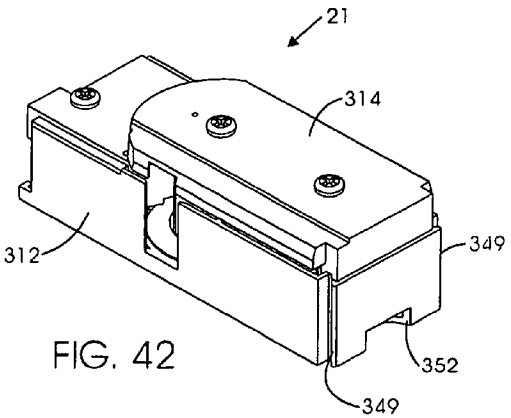
FIG. 42 is an input-end perspective view of the transaxial coiled spring motor of FIG. 41.
Figure 43:
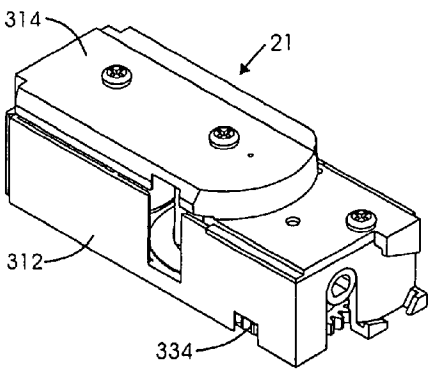
FIG. 43 is an output-end perspective view of the transaxial coiled spring motor of FIG. 41.

FIG. 7 shows a blind 10F which has a cord tilter module 760 and a two-inch head rail 12A. This two-inch cord tilter module 760 has been fully described in Canadian Patent No. 2,206,932 "Anderson", dated Dec. 4, 1997 (Dec. 4, 1997), which is hereby incorporated by reference. A smaller version of this cord tilter module 50 for use in a one-inch head rail is shown in FIG. 1, and is more clearly depicted in FIGS. 39A and 39B.

The cord tilter module 50 includes a housing 762, a worm gear 764, a spur gear 766, an output gear 768, a threaded drum 770, an end cap 772, fasteners 774, an idler gear 776 and a tilt cord (not shown). The main differences between this cord tilter and the two-inch cord tilter module 760 are the following:

The one inch cord tilter module 50 has one additional gear, the output gear 768, which meshes with an idler gear 776 which is an integral piece with the spur gear 766. The different pitch diameter of the output gear 768 relative to the idler gear 776 provides a gear ratio which doubles the rotation of the output gear 768 relative to the spur gear 766. Therefore, for a given linear distance of travel of the tilter cord 52, the output gear 768 of the one inch cord tilter module 50 rotates twice as far as that rotated by the spur gear (which is the same as the output gear) of the two-inch cord tilter module 760. Therefore, the opening and closing action is twice as fast for the one inch cord tilter module 50 as for the two-inch cord tilter module 760.

The worm gear 264 for the one inch cord tilter module 50 is made out of a one piece injection molded plastic such that the concern over the sharp flashing at the part line of the die (had it been made out of die cast zinc as in the 2 inch cord tilter module 760) is eliminated. Thus, the need for bushings to support the worm gear 264 and protect the housing 762 and end cap 772 is also eliminated. The worm gear 264 may be manufactured out of injection molded plastic, because the anticipated load for tilting the one inch blind 10 is considerably less than that for a two-inch blind.

The operation of the one inch cord tilter module 50 is essentially the same as that of the two-inch cord tilter module. As shown in FIG. 1, the one inch cord tilter module 50 is installed in the head rail 12, and the tilt rod 24 is connected to the one inch cord tilter module 50 by inserting the end of the tilt rod 24 into the non-cylindrical hollow shaft of the output gear 768. Now, as one of the tilt cords 52 is pulled, the threaded drum 770 rotates, causing similar rotation of the worm gear 764. The worm gear 764 meshes with the spur gear 766, causing the spur gear 766 and the idler gear 776 to rotate. The idler gear 776 meshes with the output gear 768, causing it to rotate, which in turn causes the tilt rod 24 to rotate. As the tilt rod 24 rotates, the tilt gears 560 (See FIG. 109) of the lift and tilt module 40 also rotate. The tilt gears 560 mesh with their respective ladder pulleys 570 which in turn rotate, pulling one of its respective tilt cables 18 up while the opposite tilt cable 18 falls, thus tilting the slats 14.

Worm Gear Lift Module

One of the advantages of the mechanism of the present invention of a modular blind transport system is that the blind can be readily formatted with the right combination of modules to achieve a counterbalanced blind transport system in which only a small external input force is required to overcome the system inertia and the gravitational forces acting on the system in order to raise or lower the blind or to open or close the slats. However, this need not necessarily be the case. In some instances, it may be desirable not to have a counterbalanced blind transport system. An example of such a non-counterbalanced blind transport system is shown in FIG. 11. In this instance, the power module is a worm gear lift module 800.

The principle of operation of this worm gear lift module 800 is predicated on the fact that, in a combination worm gear/helical gear arrangement, the worm gear is always the drive gear, and it can drive the helical gear in either direction. However, the helical gear cannot be the drive gear. If the helical gear attempts to drive the worm gear, the combination will lock up regardless of the direction of the attempted rotation of the helical gear. Thus, the worm gear lift module 800 may be used to raise or lower the blind 10J to any point by using the lift cord loop 816 which acts on the worm gear as will be explained shortly. Once there, the mechanism will lock in place and will resist any change in position by any external force acting on the blind such as pushing or pulling on the handle 28 to try to raise or lower the blind, or by gravity pulling down to lower the blind, because this external input force is acting on the helical gear to force it to drive the worm gear, causing the lock-up.

FIGS. 165A-165F and FIGS. 166-167 show the worm gear lift module 800 in different stages of assembly. The worm gear lift module 800 includes 8 items, namely a bottom housing 802, a top housing 804, a cord pulley 806, a worm gear 808, a composite helical/spur gear unit 810, a composite spur gear unit 812, an output gear 814, and the lift cord loop 816.

The lower housing 802 has two generally elongated and parallel cavities, the first cavity 818A houses the worm gear 808/cord pulley 806 assembly, and the second cavity 818B houses the train gear of the composite spur gear unit 812 and output gear 814 assembly. These two cavities 818A, 818B are connected by a web 830. First and second projections 832A,B having concave semi-circular upper edges, are used to support the hollow shaft 850 of the composite gear unit 810 which lies transversely across the two cavities 818A, 818B. The first projection 832A supports the smaller diameter end of the shaft 850 beyond the helical gear 852, and the second projection 832B supports the larger diameter portion of the shaft 850 between the gears 852, 854. The first cavity 818A is substantially T-shaped in cross section and includes a semicircular cavity 834 at one end, which is used to house the cord pulley 806. This semicircular cavity 834 has an opening 820 at its bottom through which extends the lift cord loop 816.

The upper housing 804 has shapes corresponding to the lower housing 802 in order to encapsulate the gear train, and barbs 836 to mate with recesses 822 in the lower housing 802 such that the housings 802, 804 snap together and releasably secure the entire drive train within their confines.

The cord pulley 806 has a hollow shaft with an inner profile that matches the "cross" profile of the power input shaft 840, and the outside diameter of which is just small enough to fit in the semicircular cavity 834 of the housing 802. While a pulley would normally have a groove with side walls, this pulley 806 has a plurality of truncated alternating V-profile teeth 842 around its circumference, through which the cord loop 816 is wound. Each tooth 842 projects beyond the centerline of the pulley 806 (beyond what would normally be the center of the groove), so the cord 816 follows a wavy path from one tooth to the next. This design readily releases the cord loop 816 when it is pulled radially away from the pulley 806, but holds tightly to the cord loop 816 when it is pulled circumferentially around the pulley 806. The outside diameter of the imaginary circle formed by the outermost portion of the alternating teeth 842 is just small enough to fit inside the inside diameter of the semi-circular cavity 834 of the housing 802, such that, once the cord loop 816 is caught in the alternating teeth 842, the semicircular cavity 834 (actually a fully circular cavity once the upper housing 804 is snapped onto the lower housing 802) does not allow the cord loop 816 out except at the opening 820.

The worm gear 808 has a "cross" profiled power input shaft 840 with a detent or slight indentation 844 near the end of each of the legs of the cross. The cord pulley 806 has two flexible catch arms 846 which project from the face of the pulley 806 and help form its hollow "cross" profiled opening, which receives the "cross" profiled power Input shaft 840. The catch arms 846 have enlarged heads 848 that mate with the detent 844 on the power input shaft 840. Once the enlarged heads 848 are caught in the detent 844, the cord pulley 806 is held in place and can not be removed until the catch arms 846 are released. The worm gear 808, the cord pulley 806, and the cord loop 816, all as an assembly, are installed in the first cavity 818A of the lower housing 802.

The composite helical/spur gear unit 810 has a hollow shaft 850, a spur gear 852 at one end of the hollow shaft 850, and an output spur gear 854 on the opposite end of the hollow shaft 850. The composite gear unit 810 is placed transversely across the two cavities 818A, 818B of the bottom housing 802, and with the hollow shaft 850 resting on the concave projections 832A,B of the housing 802. The helical gear 852 rests on and meshes with the worm gear 808, and the output spur gear 854 rests in the second cavity 818B of the bottom housing 802. The hollow shaft 850 has a countersunk shoulder 851 (See FIG. 166A) used to support the stub shaft 856 on the output gear 814. The output gear 814 is mounted and supported at one end by the countersunk shoulder 851 of the hollow shaft 850 of the composite gear unit 810, and by the lift rod 26 once the unit is assembled in the head rail 12. The output gear 814 and the composite gear unit 810 are both free to rotate independently of each other. The lift rod 26 provides support and alignment for the composite gear unit 810/output gear 814 assembly by extending through their hollow interiors. The output gear 814 has a non-cylindrical profile hollow shaft 864 which matches with the profile of the lift rod 26 so that the output gear 814 and the lift rod 26 rotate together.

The composite spur gear unit 812 is a single piece including a first input spur gear 858, a second output spur gear 860, and stub shafts 862 projecting from both ends of the composite spur gear unit 812. The composite spur gear unit 812 rests in the second cavity 818B of the bottom housing 802 with stub shafts 862 resting on the concave semicircular projections 824 of the bottom housing 802. The first input spur gear 858 meshes with the output spur gear 854 of the composite helical/spur gear unit 810, and the second output spur gear 860 meshes with the output gear 814. Finally, the top housing 804 is placed atop the entire assembly and snapped together with the bottom housing 802 to fully enclose, align, and support the gear train assembly.

The installation and operation of the module 800 are as follows: The cord loop 816 (which is broken away in FIGS. 165A-165F but is properly shown as an endless loop in FIG. 11) is woven between the alternating teeth 842 of the cord pulley 806. The shaft power input shaft 840 of the worm gear 808 is inserted through the hollow central opening of the cord pulley 806 until the enlargements 848 in the flexible catch arms 846 snap into the detents 844 of the power input shaft 840, uniting the cord pulley 806 and power input shaft 840. This assembly is placed in the first cavity 818A of the bottom housing, making sure that the lift cord loop 816 is fed through the opening 820 in the bottom housing 802. The composite helical/spur gear unit 810, the composite spur gear unit 812, the output gear 814, and the top housing 804 are then installed as has already been explained.

This entire assembly, comprising the worm gear lift module 800, is snapped in place in the head rail 12 as illustrated in FIG. 167. There is an opening in the bottom of the head rail 12, through which the opening 820 projects, for the lift cord loop 816 to pass through the head rail 12. The lift rod 26 is inserted through the hollow shaft 850 of the composite helical/spur gear unit 810, and through the output gear 814. The worm gear lift module 800 may be placed anywhere along the length of the head rail 12 where there may be room available, since the lift rod 26 can go right through the module 800.

As may now be appreciated, as one end of the endless loop cord 816 is pulled, the alternating teeth 842 gripping the cord 816 will cause the cord pulley 806 to rotate, causing the worm gear 808 to rotate. The worm gear is meshed with the helical gear 852, causing the composite gear unit 810 to rotate. The output spur gear 854 thus also rotates, meshing with the first input spur gear 858, and causing it to rotate as well. This causes the second output spur gear 860 to rotate, which in turn meshes with the output gear 814, causing it to rotate. As the output gear 814 rotates, the non-circular cross section lift rod 26 which is fitted into the non-cylindrical hollow opening 864 of the output gear 814 also rotates, and, depending on the direction of rotation, causes the lift module 500 to raise or lower the blind 10J as has already been described.

As one end of the endless cord loop 816 is pulled, part of the cord 816 enters the opening 820 of the bottom housing 802 while another part leaves through the same opening 820. The opening 820 directs the cord 816 such that, regardless of the direction of pull by the user, the exiting cord 816 will be moving radially away from the cord pulley 806 as the cord 816 reaches the opening 820 of the bottom housing 802. The portion of the cord 16 entering the housing 802 is caught between the alternating teeth 842 of the pulley 806 and the inside surface of the circular cavity 834 in the housing 802. This inside surface of the circular cavity 834 pushes the cord loop 816 radially inwardly toward the cord pulley 806 so the cord loop 816 is pressed in between the alternating teeth 842. Thus, the endless cord loop 816 is continuously being released at one end, and secured at the opposite end as the cord 866 is pulled to rotate the lift rod 26. The action is fully reversible in direction but only when the external force is input by the lift cord loop. If the lift rod 26 is forced to rotate by some other external force (for example gravity pulling down on the blind to attempt to cause the lift module 500 and lift rod 26 to rotate), then the helical gear 852 will be trying to drive the worm gear 808 resulting in a locking of the mechanism since the helical gear 852 is attempting to drive the worm gear 808, which is not possible.

Rod Support Module

Referring to FIG. 8, in some instances, where the material of the blind is lightweight, there may not be a need for many lift or tilt modules along the length of the head rail 12, resulting in long stretches of unsupported lift rod 26 or tilt rod 24. Should this occur, it is possible for the rod to have a tendency to whip around or sag, especially when the rod is being rotated quickly as when rapidly raising or lowering the blind. To eliminate this whipping or sagging action of the rod, a rod support module 870 may be installed.

A more detailed view of the rod support module 870 is shown in FIG. 164. It includes a first planar member 872, and a second, perpendicular planar member 874. The first planar member 872 has one opening 876 having an inside diameter just large enough for the lift rod 26 to pass through it. This first planar member 872 also has two upwardly-projecting ears 878 designed to snap underneath the lip of the head rail 12 profile. There are also two gussets 880 extending between the two planar members 872, 874 to stiffen and reinforce the connection between the two planar members 872, 874. The rod support module 870 may be installed wherever it is deemed required, with the rod extending through the opening 876.

Brake Module

As has been explained earlier, one major advantage of this modular blind transport system is that a relatively small number of individual modules may be combined so as to achieve a counterbalanced blind transport system regardless of the size or type of covering. The blind may be small and have lightweight metal or fabric slats, or it may be a very large blind with heavy, two inch wooden slats, or something in between these extremes. In all cases, it is possible to combine different modules to achieve a counterbalanced blind transport system such that only a small amount of external input force is required to raise or lower the blind.

However, it may not be practical or desirable to obtain an exact match of the required force to the available force for all blinds or for the entire working range of a particular blind. In fact, a perfect match is seldom, if ever, sought. The blind transport system will have a certain amount of system inertia caused by the mass of the blind as well as by the frictional resistance caused by all the components. This system inertia allows for an approximate match of the required and available forces in order to still have an operational counterbalanced system. For instance, when the blind is in the fully raised position, the available force to keep the blind in that raised position must be equal to or greater than weight (gravitational force) pulling down on the blind minus the system inertia which acts so as to keep the blind in the raised position. If the amount of force available at this point is insufficient, the blind will not stay in the raised position and will fall as soon as the external lifting force is released. By the same token, the force required to keep the blind in the fully lowered position must be less than the weight of the blind (which at this point is only the weight of the bottom rail 14A) plus the system inertia which acts to keep the blind in the lowered position. If the available force at this point exceeds the weight of the bottom rail 14A plus system inertia at that point, the blind will not remain in the lowered position and will be pulled up as soon as the external lowering force is released. The force required to keep the blind up when the blind is in the fully raised position is considerably higher (because of the full weight of the slats) than the force required to keep the blind down when the blind is in the fully lowered position. The entire concept of the constant force coil spring motor module 20 coupled to a transmission module 30 is to provide a force curve which approximates the requirements in all operating positions of the blind.

When it is not possible, practical, or desirable to have an adequate match of the required to the available forces with the standard modules described thus far, one solution is to add artificial system inertia to the blind transport system. This may be accomplished by the use of a one-way brake. The brake may be of the variable type, where the resistance or artificial system inertia automatically increases as the blind is raised, or it may be of the adjustable type, where the resistance is set at a certain fixed value, and this value may be manually adjusted.

Variable Brake Module:

The variable brake 900 (See FIGS. 175-182) is a one-way brake, which provides greater braking force when the blind is in the raised position and less braking force when the blind is in the lowered position. The brake 900 only provides a braking force that operates against the lowering of the blind. When the blind is being raised, the brake 900 provides no braking force.

The brake 900 includes housing portions 913, 913A, which, as with previous modules, include cylindrical projections 238 and recesses 240, hooks 242, and recesses 244 for the hooks, permitting the brake module 900 to snap together with similarly-shaped housings of other modules. There is an input shaft 914, which projects out of the housing 913 and mates with the output from the transmission module 30 (or the shaft of whatever module is adjacent to the brake module). There is an output shaft 922 which projects out the other side of the housing 913A and mates with the lift rod 26 or with an adapter which eventually connects to the lift rod 26, as shown in FIG. 195 which will be described later. The input shaft 914 mates with a cogged drive member 916, which mates with a connector shaft 918, which, in turn, mates with a worm gear 920, which mates with the output shaft 922. Thus, whenever the input shaft 914 rotates, it causes the output end 924 of the worm gear 920 and the output shaft 922 to rotate with it. This variable brake 900 also includes a brake drum 926 and a brake shoe 928. When the input shaft 914 rotates in the clockwise direction, as indicated by the arrow 930, the brake drum 926 rotates with the input shaft 914, and, when the input shaft 914 rotates in the opposite direction, the brake drum 926 spins freely relative to the input shaft 914.

The brake drum 926 is mounted to the input shaft 914 through the cogged drive 916 and a toothed drive 932. The cogged drive 916 has an extension 934, on which the toothed drive 932 rotates. The rear face of the cogged drive 916 defines a plurality of inclined planes 936 and cogs 938. The forward face of the toothed drive 932 defines corresponding inclined planes 936A and cogs 938A, which mate with the rear face of the cogged drive 916. The rear face of the toothed drive 932 defines a plurality of inclined teeth 940, which mate with corresponding inclined teeth 940A in the front face of the brake drum 926. When the input shaft 914 rotates clockwise, the inclined planes 936, 936A cause the teeth 940 of the toothed drive 932 to push against the teeth 940A of the brake drum 926. When the input shaft 914 rotates counterclockwise, the pressure is released, and the toothed drive 932 does not push against the drum 926, so the drum 926 spins freely (or remains stationary while the drive train rotates). This free-wheeling position is shown in FIG. 181.

The amount of force exerted by the brake shoe 928 against the brake drum 926 varies, depending upon the position of the blind, as follows. The brake shoe 928 is pushed against the underside of the brake drum 926 by a spring 942. The tension of the spring 942 is adjusted by a screw 944, which is threaded into threads 946 in a tension plate 948. When the screw 944 is tightened, more spring force is applied, and when the screw 944 is loosened, less spring force is applied. The non-circular head 950 of the screw 944 is received in a corresponding non-circular recess 952 in the center of a gear 954, so that the gear 954 and screw 944 rotate together. There is an upper gear 956, with a downwardly-projecting shaft 958, which extends through a hole 959 in the housing 913A. A lower gear 960 is pressed onto the shaft 958 of the upper gear 956 and is keyed to the shaft 958, so that the upper and lower gears 956, 960 rotate together (See FIG. 180).

As was explained above, the worm gear 920 rotates with the input shaft 914. The worm gear 920 is meshed with the lower gear 960, and the upper gear 956 is meshed with the gear 954, so that, as the input shaft 914 rotates back and forth, for raising and lowering the blind, it causes the worm gear 920 to rotate the lower gear 960, upper gear 956, gear 954, and screw 944, thereby tightening and loosening the screw 944, and increasing and decreasing the friction between the brake shoe 928 and the brake drum 926.

Thus, the higher the blind is raised, the greater the braking force provided by the variable brake 900, and, the more the blind is lowered, the less the braking force. The braking force does not affect lifting the blind and acts only against lowering the blind.

Adjustable Brake Module:

An alternative adjustable brake module 900A shown in FIGS. 183A-190 may be used in the same applications as the variable brake 900. The adjustable brake 900A is identical to the variable brake 900, except that the screw 944 is not automatically rotated by moving the blind up and down. In this case, the screw 944 is rotated manually to set the desired braking force, and that force then remains constant as the blind is operated, unless the operator makes another manual adjustment. Therefore, in this arrangement, the worm gear and other related gearing used to automatically adjust the screw 944 are eliminated. The input shaft 914 drives the cogged drive 916, which drives the output shaft 922, which extends out the rear opening in the housing. The toothed drive 932 is still mounted over the shaft of the cogged drive 916 and still drives the brake drum 926 in one direction, while allowing the brake drum 926 to idle in the opposite direction. The brake shoe 928 still is urged against the brake drum 926 by the force of the spring 942, which is greater if the screw 944 has been tightened into the tension plate 948 and less if the screw is loosened. The upper plate 964 is fixed relative to the housing in both the variable brake module 900 and the adjustable brake module 900A by sliding into fixed slots in the housing.

Alignment Module and Adapter Module:

FIG. 195 shows a combination of a coaxial coil spring motor module 20, a transmission module 30, a variable brake module 900, and an alignment module 902. The coaxial motor module 20 and transmission module 30 are as they were described above. The alignment module 902 (See FIGS. 193, 194) is simply a housing 904 with a pair of gears 906, 908, one of which is coupled to the output shaft of the variable brake module 900, and the other of which couples with the lift rod 26, in order to properly align the drive train with the lift rod 26. The use of the alignment module 902 is strictly on an as-needed basis. It is also important to note that, while the gears 906, 908 depicted in FIG. 194 show a hollow hexagonal opening, the profile of these openings may be any non-cylindrical type, such as the "D" type (as in Item 450 of FIG. 80), or the gears 906 may in fact have solid shafts with a non-cylindrical profile to mate into the hollow-type openings in adjacent modules.

Another adapter module 912 is shown in FIGS. 191, 192. This adapter module 912 is simply a housing 904A with two identical gears 906A and an intermediate idler gear 908A. The gears 906A show a solid hexagonal shaft 910. However, these gears could have been the gears 906 used in the alignment module 902, which have a hollow hexagonal opening 910. The adapter module 912 is used when it is desired to not only align the output shaft of a module with a lift rod 26, but to do so without inverting the direction of rotation, as does the alignment module 902.

All the modules (including the variable and adjustable brakes described above) include the hooks 242 and recesses 244 described earlier with respect to the coaxial motor module 20 (See FIG. 14), so they can simply be snapped together as desired, with the drive train extending through them all.

Wide or Designer Ladder Tapes

While ladder tapes 22 (See FIG. 1) are typically used, there are also wide designer ladders 22A, which can be mounted on the same ladder pulley of any of the embodiments described, such as Item 550A of FIG. 132, shown again in FIG. 173 but with a wide decorative tape 22A over the standard cable tape 18. In this instance, the tilt cables 18 go through the head rail 12A and hook up to the ladder pulley 550A as has already been disclosed. However, a decorative wide cloth tape 22A is secured to the tilt cables 18 to hide the tilt cables 18 and lend a more pleasing aesthetic appeal. This same arrangement is better appreciated in the perspective view shown in FIG. 174, where the cloth tape 22A ends are free to ride up and down through slots in the head rail 12A. The difficulty lies in how to efficiently secure the tilt cables 18 to the wide cloth tape 22A, how to efficiently secure the tilt cables 18 to the ladder pulley 550A, and how to terminate the ends of the wide cloth tape 22A to the head rail 12A.

FIGS. 169-173 show various arrangements for handling wide tapes 22A. In FIG. 171, a pin 970 has been put through each side of the ladder tape 22A, and forward and rear tilt cords 18 have been connected to their respective pins 970 and mounted in their respective cord lock detents on the ladder pulley 550A.

In FIG. 169, a flexible member 972 takes the place of the combination pin 970 and cord 18 of FIG. 171. This flexible member 972 has opposed barbs 974 at one end, which serve the same function as the pin 970, extending through the material of the wide tape 22A, and an enlarged bulb 976 at the other end, which mounts in the cord detent of the ladder pulley 550A.

FIG. 168 shows another variation, in which there is a barbed pin member 978 and a flexible member 980, which has a loop at one end that receives the pin 978 and a bulb 982 at the other end, which mounts in the cord detent of the ladder pulley 550A.

FIG. 170 shows another variation, in which the flexible member 980B has a wide base that is stapled to the tape 22A and a bulb 982B which mounts in the cord detent of the ladder pulley 550A.

FIG. 173 shows one possible termination of the cloth tapes 22A by simply letting them ride through and inside the head rail 12A. FIG. 172 shows an alternative arrangement wherein the cloth tape 22A is crimped inside the head rail 12A as the cloth tape 22A is caught between head rail 12A and the base 502A of the tilt module 500A.

Alternative Modular Blind Transport System Embodiments

As has been indicated several times throughout this specification, a most important feature of this invention is the modularity which permits matching of a limited number of individual modules to achieve a very wide range of operating parameters. Only a limited number of these possible combinations or permutations are listed below to give the reader a feel for how these modules may be combined. It is important to realize that, in all the cases, the connecting shafts may be male or female and may have any internal profile (circular, square, hexagonal, "D" shaped). The important point is that these connecting shafts are easily replaceable in any given module in order to match the profile of the shaft of the abutting component.

FIG. 1, provides a very good indication of a basic modular blind transport system. The blind 10 is standard rout (as opposed to a de-lighted rout), with holes through the center of the slats 14. It may be raised or lowered by manually coaxing the blind in the desired direction via the handle 28. As the handle 28 is pulled downwardly and the lift cords 16 are pulled down, they unwind from the wind-up spools 504 of the lift and tilt modules 40 (See FIG. 109), causing them to rotate, and with them the lift rod 26 also rotates. This causes the output shaft 418 of the transmission module 30 (See FIG. 65) to rotate, which meshes with the first gear 414 of the driven shaft 412, also causing them to rotate. The transmission cord 454 wraps up onto the driven shaft 412, and unwraps from the drive shaft 402, causing it to rotate as well. The drive shaft 402 of the transmission module 30 is mated to the power spool 208 of the power module 20 (See FIG. 16), such that the rotation of the drive shaft 402 of the transmission module 30 causes the rotation of the power spool 208 of the power module 20, thus causing the spring 200 to wrap onto the power spool 208. Thus the "loading" of the spring 200 onto the power spool 208 was accomplished with the help of gravity assisting the user when he pulled down on the handle 28. The spring 200 is ready at any point along the blind's operation to assist the user in raising the handle (and the blind attached to it) against the force of gravity when the action is reversed and the handle is coaxed upwardly.

A standard cord tilt mechanism 50 (See FIG. 39B) is used to tilt the slats 14. As one of the tilt cords 52 is pulled, the threaded drum 770 will rotate, causing similar rotation of the worm gear 764. The worm gear 764 meshes with the spur gear 766, also causing the idler gear 776 to rotate. This idler gear 776 meshes with the output gear 768 such that it also rotates, rotating the tilt rod 24. As the tilt rod 24 rotates, the tilt gear 560 (See FIG. 109) of the lift and tilt module 40 will also rotate. This tilt gear 560 meshes with the ladder pulley 570 which in turn rotates, pulling one of the tilt cables 18 up while the opposite tilt cable 18 falls, thus tilting the slats 14.

FIG. 1 also demonstrates the use of a tilt only module 60, used when the width of the blind is such that more tilt stations (to support the more flexible slats 14) are required than lift stations (which support the more rigid bottom rail 14A).

In FIG. 2 shows a second embodiment almost identical to the first embodiment, and shows how the same modules may be used to achieve a de-lighted product. The slotted opening 17, through which the lift cord 17 is routed, found in the middle of each slat 14 in FIG. 1 has been moved towards the back of each slat 14 in FIG. 2. Now, as the blind is fully closed, the overlap from one slat 14 to the next is sufficient to cover the slotted openings 17, resulting in a de-lighted product. This can be readily accomplished because the base 502 of the lift and tilt module 40 has several openings 519, 519A, 519B as shown in FIG. 125D through which the lift cord may be fed in order to reach the wind-up spool 504.

In FIG. 3, a third embodiment of this invention, a standard rout product uses a simultaneous lift/tilt module 500B to eliminate the need for the cord tilter module 50 of FIG. 1. As the bottom rail 14A is raised, the lift cords 16 wind onto the lift spools 504B of the lift modules 500B, as has already previously been described. As each lift spool 504B rotates, the frictional resistance between the inside diameter of the shaft 587B of the ladder pulley 583B, and the outside diameter of the stub shaft 536B of the lift spool 504B, as well as the frictional resistance between the front end 526B of the spool 504B and the side of the ladder pulley 583B, will also cause the ladder pulley 583B to rotate, which will also cause the tilt cables 18 of the ladder tape 22 to move, raising one tilt cable 18 while lowering the other tilt cable 18. This action will continue until the bottom rail 14A motion is stopped, or until the slats 14 are fully closed in one direction or the other. Once the slats 14 are fully closed, the tilt cables 18 can no longer continue to move in the same direction, so they come to a stop as well. If the ladder pulley 583B continues to rotate, the tilt cable 18 will simply stay in place as the ladder pulley 583B slips past the tilt cable 18.

Figure 4:
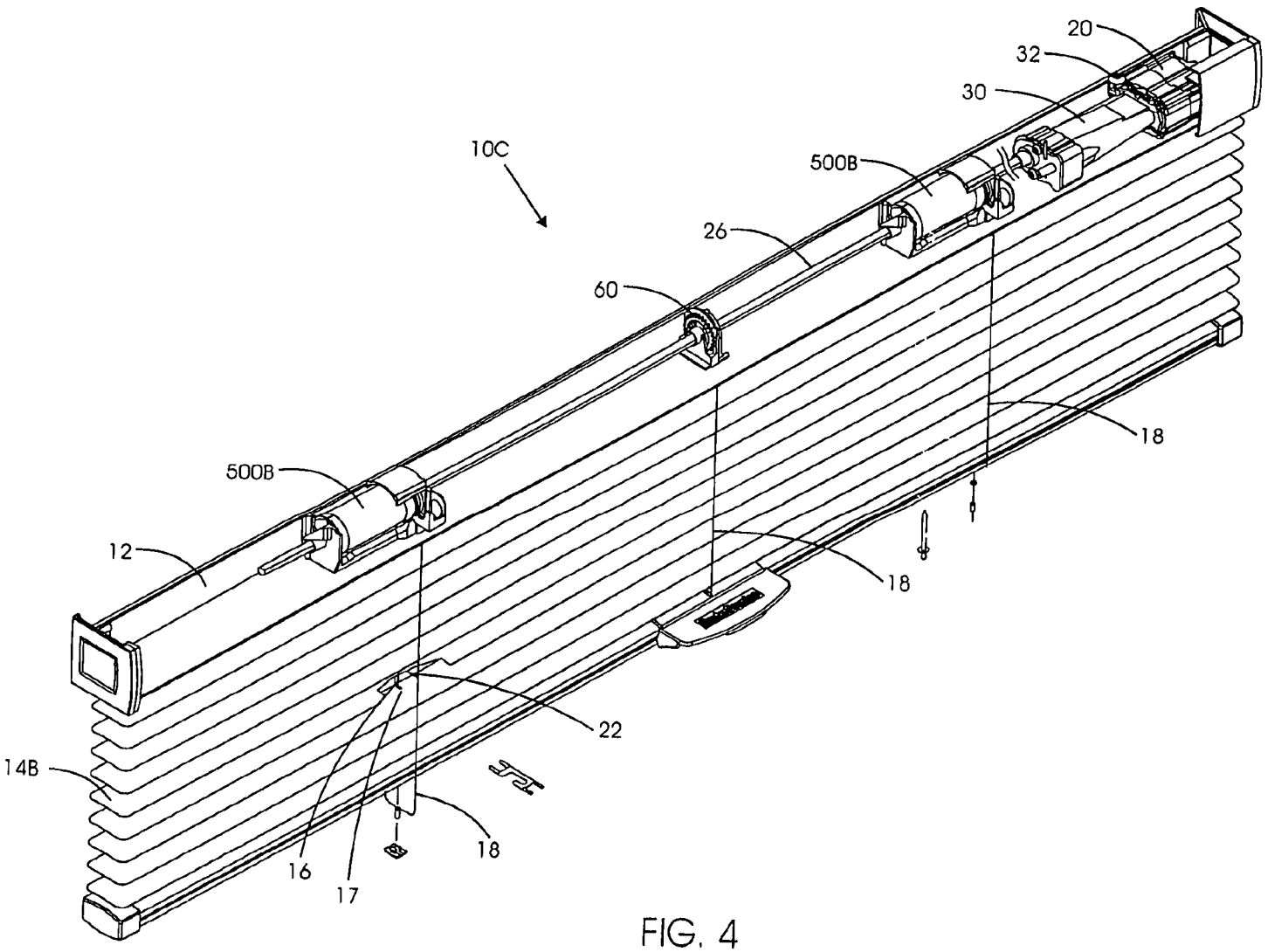
FIG. 4 is a partially broken away and partially exploded view of fourth embodiment of the invention, similar to FIG. 3 except this is for a de-lighted product.

FIG. 4 shows a fourth embodiment of this invention, which is the same arrangement as that in FIG. 3 (the third embodiment) except that the slotted openings 17 in the slats 14 are offset so as to achieve a de-lighted product in the same manner as was achieved in FIG. 2 (the second embodiment).

FIG. 5 depicts a fifth embodiment of this invention, a blind transport system for wide two-inch wide slats arranged to achieve a de-lighted product by having an inside and an outside lift cord 16A,B instead of a single lift cord going through the slats 14. This fifth embodiment uses the twin spool lift and tilt modules 600 (See FIG. 143). It could use a coaxial coil spring power module 20 and transmission module 30 as shown in the sixth embodiment in FIG. 6, but instead it uses the parallel arrangement of ratchet-type drive module 70 and transmission module 30. The blind is lowered by pulling the cord 71 of the ratchet-type drive 70 to the right. This action moves an arm 71A connected to the cord 71 which releases an internal clutch, allowing the drive to free spin. Pulling down on the bottom rail 14A, or, in many cases, just the weight of the blind lowers the blind once the clutch mechanism is released. The lift cords 16 unwrap from the twin spools 604 of the lift and tilt modules 600, rotating the lift rod 26, which causes the output shaft 418 of the transmission module 30 to rotate, which meshes with the first gear 414 of the driven shaft 412, also causing them to rotate. The transmission cord 454 wraps up onto the driven shaft 412, and unwraps from the drive shaft 402, causing it to rotate as well.

In order to raise the blind, the single cord 71 on the ratchet-type drive 70 is pulled in short strokes. The first stroke of the cord 71 will reset the arm 71A so that the internal clutch is engaged, and each stroke raises the blind part of the way. Each time the cord 71 is pulled, the ratchet mechanism is engaged and the drive gear 1004 of the adapter 72 (See FIG. 208B) is rotated. As the cord 71 comes to the end of its stroke, the operator releases the cord and it is pulled back into the ratchet-type drive module 70 where it is ready for the next stroke. With each stroke, the drive gear 1004 is rotated which in turns meshes with the driven gear 1006, which is mated to the transmission drive shaft. From here on the process is exactly the reverse of the process to lower the blind.

To accomplish the tilting action, the tilting mechanism 50D is actuated by pulling on one of the tilt cords 52. This causes a rotation of the tilt rod 24 which is connected at one end to the tilting mechanism 50D, and along its length goes through the tilt drive gears 608 of the twin spool lift and tilt modules 600. As the tilt rod 24 rotates, it will rotate the tilt drive gears 608, which mesh with, and thus causes the rotation of, their respective ladder pulleys 610. As the ladder pulleys 610 rotates, they will each pull up on one of their respective tilt cables 18, and let loose on the opposite tilt cable 18, thus causing the ladder tape 22 and the slats 14 to tilt. This action is fully reversible.

FIG. 6 shows a sixth embodiment of this invention, a blind transport system which is very similar to the system just described in FIG. 5 (the fifth embodiment) except that, instead of the parallel arrangement of the ratchet-type drive module 70 with the transmission module 30, there is a series-connected but rotated power module 20 and transmission module 30. Thus this arrangement has the power group pressed against a side of the two-inch head rail 12A instead of the location depicted in all previous embodiments, where the power module and transmission module were lying on the bottom or base of the head rail 12A. Pressed against the side in the present arrangement, the power group is more out of the way, allowing the freed up space to be used for other purposes. For instance, the tilt rod 24 could now be run all the way through from one end of the head rail 12A to the other, allowing the installation of the cord tilter mechanism at either end of the blind.

FIG. 7 shows a seventh embodiment of this invention, a two-inch blind utilizing the two-inch lift and tilt modules 500A and the two-inch cord tilter module 760. However, the installation and operation of this two-inch blind transport system are essentially identical to those of the system depicted in FIG. 1 (the first embodiment).

FIG. 8 shows an eighth embodiment of this invention, a system which is essentially identical to that depicted in FIG. 3 (the third embodiment), with the exception that, since the slats 14 have been replaced with a dual pleated fabric, there is no need for a tilting capability. Thus, the tilt only module 60 is replaced by a rod support module 870, the simultaneous lift/tilt modules 500B are replaced by lift only modules 500, and the ladder tape 22, with its associated tilt cables 18, is eliminated. FIGS. 9 and 10 show almost identical systems (ninth and tenth embodiments respectively of this invention) to that shown in FIG. 8 (eighth embodiment), except that the dual pleated fabric is replaced by regular pleated fabric in FIG. 9 (ninth embodiment) and pleated shades in FIG. 10 (tenth embodiment). There is still no need for tilting capability, thus the rest of the system remains unchanged.

FIG. 11 depicts an eleventh embodiment of this invention, a blind transport system which is very similar to that shown in FIG. 3 (third embodiment) except that the power group (including the power module 20 and the transmission module 30 as shown in FIG. 3) has been replaced with a worm gear lift module 800 (See FIG. 166) in which is an endless cord loop drives a worm drive. This embodiment is included as an example of a system which will not fully function as drawn as is explained below.

As was stated earlier, in the description of the worm gear lift module 800, as long as the external force input is coming from the cord 816, then the worm gear 808 will be driving the spur gear 810, all the gears will rotate as intended and the lift rod 26 will also rotate, causing the wind-up spools 504B to rotate and the lift cords to wrap or unwrap (depending on which direction the endless loop cord 816 is being pulled) from the wind-up spools 504B, thus raising or lowering the bottom rail 14A.

The presence of the tilt only module 60 and the absence of any tilter mechanism would indicate that the intent is for the lift stations to act as simultaneous lift/tilt modules 500B. However, one must remember that, for the modules to operate, the user must grab the handle 28 (or the bottom rail 14A) and coax the bottom rail 14A up or down. This initial movement of slightly raising or lowering the blind also simultaneously opens or closes (tilts) the blind. However, in this arrangement the action has the effect of an external force input coming, not from the cord 816, but from the opposite end of the system, the handle 28 (or the bottom rail 14A). The worm gear lift module 800 reacts as intended and immediately locks up since the spur gear 810 can not be driving the worm gear 808.

Thus, in this arrangement, the only way to tilt the blind, once the blind has been raised or lowered to the desired location, is by pulling on the cord 816 in the opposite direction just long enough to open or close the blind as desired. Thus; the handle 28 in this embodiment is totally unnecessary as it may never be used, and would only serve a decorative purpose.

It is interesting to note that when the worm gear lift module 800 is used in a system, the system need not be counterbalanced since the blind will always stay where it is last placed by the action of the pulling on the cord 816 of the worm gear lift module 800. An external force input, such as a user or even gravity, acting directly on the blind itself will have no effect as the mechanism will lock against any input which tends to make the spur gear 810 attempt to drive the worm gear 808.

Figure 12:
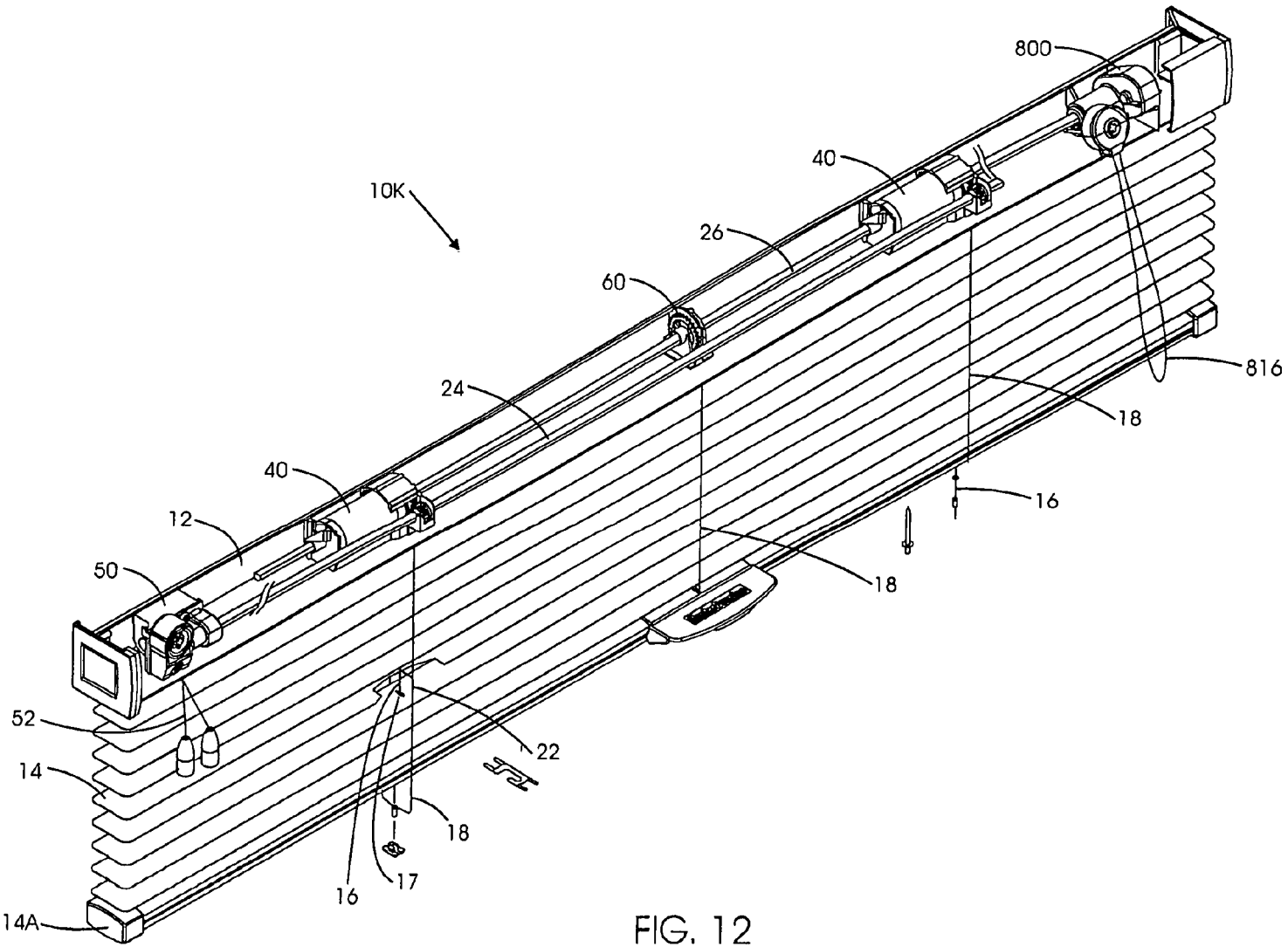
FIG. 12 is a partially broken away and partially exploded view of a twelfth embodiment of the invention, similar to FIG. 1 except the motor and transmission have been replaced by an endless loop cord drive.

FIG. 12 shows a twelfth embodiment of this invention, a system which provides a manual cord tilter 50 for the system of FIG. 11 (eleventh embodiment). In this instance, the simultaneous lift/tilt feature has been eliminated and the worm gear lift module 800 is used strictly to raise or lower the blind. The cord tilter 50 is used to open or close the blinds as has already been described.

FIG. 13 shows a thirteenth embodiment of this invention, an embodiment of the blind transport system which is quite similar to that shown in FIG. 7 (seventh embodiment), except that the coaxial coil spring motor power module 20 has been replaced with a transaxial coil spring motor power module 21.

FIG. 13A shows a fourteenth embodiment of this invention, an embodiment which is quite similar to that depicted in FIG. 8 (eighth embodiment), except that an endless cord loop drive module 700 has been added as a system override. Thus, the blind in this embodiment may be raised or lowered either by coaxing it up or down with the handle 28, or by pulling on the cord loop 706 of the endless cord loop drive module 700.

FIG. 13B depicts a fifteenth embodiment of this invention, an embodiment which is identical to that shown in FIG. 2 (second embodiment) except that the cord tilter module 50 has been replaced with a wand tilter module 750. The operation is thus also identical except that, in order to open or close the blind, the user will rotate the wand instead of pulling on one of the tilt cords 52.

Figure 13C:
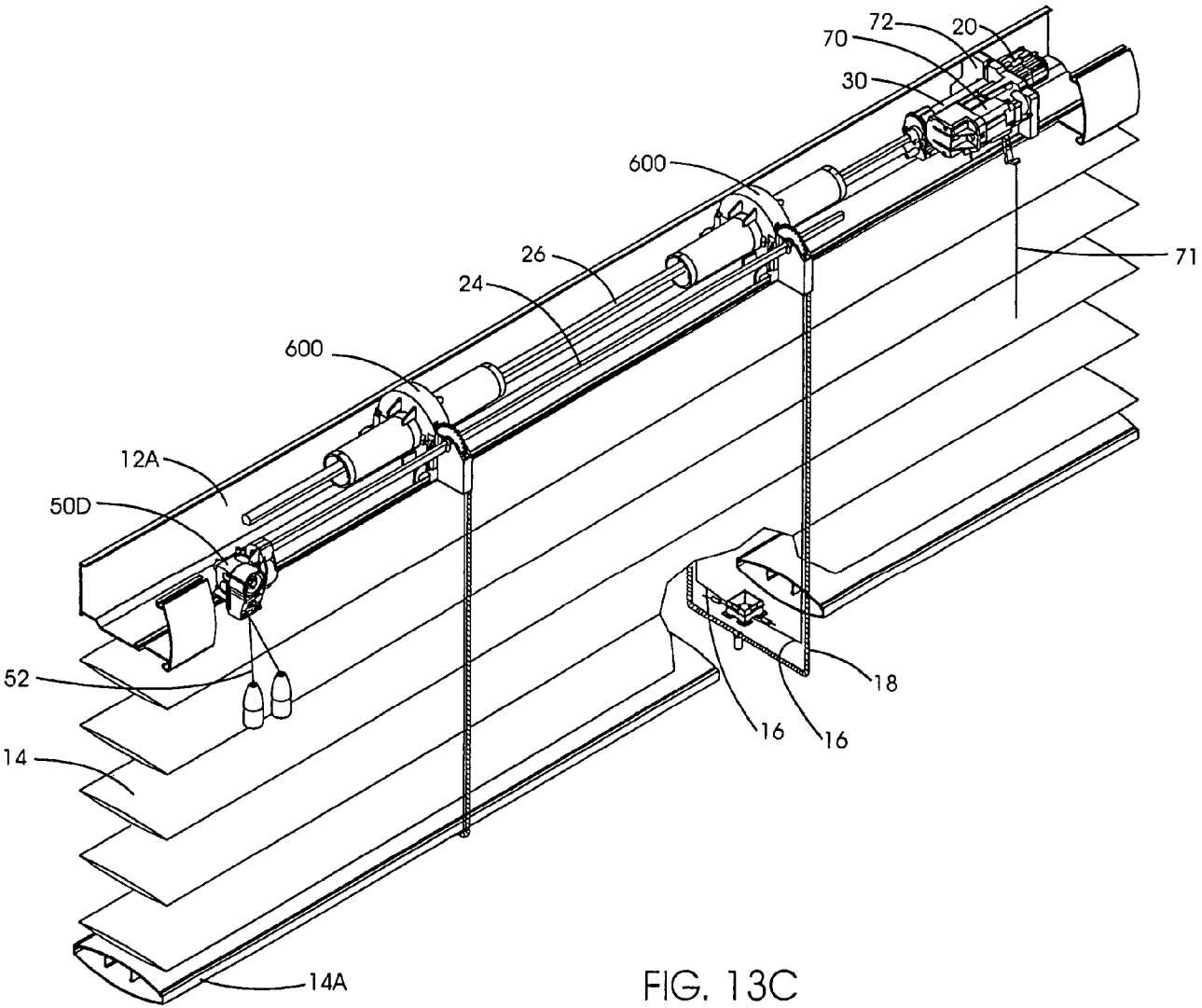
FIG. 13C is a partially broken away perspective view of a sixteenth embodiment of the invention, similar to FIG. 5 except a coaxial power module has been added, in series, to the ratchet-type drive and transmission arrangement.

FIG. 13C shows a sixteenth embodiment of this invention, an embodiment which is identical to that shown in FIG. 5 (fifth embodiment) except that a coaxial power module 20 has been added, in series, to the ratchet-type drive 70 and transmission module 30 arrangement. The operation is identical to that of the system shown in FIG. 5 (fifth embodiment) except that the coaxial power module 20 now provides assistance to help raise the blind when the cord 71 of the ratchet-type drive 70 is pulled cyclically.

Other Embodiments

It is not practical to enumerate and describe all possible embodiments due to the large number of possible combinations. A representative number of complete blind transport systems has already been outlined above. Following is a sampling of possible combinations specifically for the power group, to give the reader a better appreciation for the variety and range of this power group.

FIGS. 155A through 155D show a detail, from four different angles, of a power group including a coaxial spring motor power module 20 and a transmission module 30 connected to a twin spool lift and tilt module 600. This is very similar to the system of the sixth embodiment (FIG. 6) except that the power group is flat against the bottom of the head rail 12A instead of flat against the side of the head rail 12A.

FIGS. 156A through 156D show a detail, from four different angles, of the power group used in the fifth embodiment (FIG. 5), including the ratchet-type drive module 70, the transmission module 30 and the adapter 72.

FIGS. 157A through 157D show a detail, from four different angles, of the cord tilter 50D used in the fifth embodiment (FIG. 5), showing how the twin spool lift and tilt module 600 and the cord tilter 50*b* share room in the head rail 12A.

FIGS. 158A through 158D show a detail, from four different angles, of the power group used in the sixth embodiment (FIG. 6), including the power module 20, the transmission module 30, and the adapter 74 which rotates the power group to a position in which the transmission shafts lie one over the other.

FIG. 196 depicts a simple power group including a power module 20, a transmission module 30, and an adapter 32 which connects the power module 20 to the transmission 30.

FIG. 197 shows the same power group as in FIG. 196 except that a second coaxial power module 20 has been added. This is useful when more force is required to overcome a heavier blind, for instance. The two power modules 20 simply snap together.

FIG. 198 shows the power group of FIG. 196, except that a one-way variable brake 900 is inserted between the power module 20 and the transmission module 30. This is useful when the spring force of the power module 20 is not sufficient to keep the blind in position against the force of gravity at all positions. More system inertia needs to be added, and this can be done with the variable brake 900 which only acts to brake when pulling down on the blind. This braking force automatically adjusts itself to increase as the blind is raised.

FIG. 199 shows a power group including an endless cord loop drive module 700 and a variable brake 900. Since the endless cord loop drive 700 will act to raise or lower the blind, but will not lock the blind in place where it is last positioned, the variable brake 900 may be added and adjusted such that it will provide enough system inertia to keep the blind wherever it is placed, without falling back down due to the force of gravity.

FIG. 200 shows a power group including an endless cord loop drive 700 connected to a power module 20, which is in turn connected to a transmission 30 through an adapter 32. As shown in FIG. 200, the shaft 724 of the cord pulley 704 of the endless cord loop drive 700 has a non-circular opening 724A to receive a stub shaft or a projection from an adjacent module, such as the projection 248 on the power spool 208 of the power module 20 (See FIG. 16). The endless cord loop drive 700 can provide a manual override to raise or lower the blind, as shown in the fourteenth embodiment (FIG. 13A), instead of having to coax the bottom rail 14A up or down. This may be useful, for instance, where the position of the blind, perhaps behind a large desk or credenza, and/or the height of the blind, make it difficult or impossible to reach the bottom rail 14A, but the end of the blind (where the endless loop cord drive 700 is located and where the cord loop 706 is hanging) is more readily accessible.

FIG. 200A shows the same components in the power group as those shown in FIG. 200. However, the order of placement is different. In this instance, the endless cord loop drive module 700 is connected to the transmission module 30 instead of to the power module 20. This is the actual arrangement depicted in the fourteenth embodiment (FIG. 13A). In this case, pulling on the cord loop 706 at a constant speed will result in raising (or lowering) the blind at a constant speed, but the amount of force which needs to be exerted would vary. If the arrangement is as shown in FIG. 200, pulling on the cord loop 706 at a constant speed will result in raising (or lowering) the blind with a relatively constant effort, but the speed of the raising or lowering of the blind will vary.

FIG. 201 shows a power group including a transaxial power module 21 and a transmission module 30 as described in the thirteenth embodiment (FIG. 13). Since a transaxial power module 21 is typically more powerful than a similar-size coaxial power module 20, this arrangement is useful when a heavier blind (such as a longer blind, a wider blind, a two-inch blind, or a wooden blind) needs to be handled.

FIG. 202 shows a power group including two transaxial power modules 21B and 21C, and a transmission module 30, useful when even more power is needed than can be afforded by a single transaxial power module 21.

FIG. 203 shows a power group including an endless cord loop drive module 700, a transaxial power module 21 and a transmission module 30, similar to the arrangement of FIG. 200 except a transaxial power module 21 is used instead of a coaxial power module 20.

FIG. 204 shows a power group including a low power electric motor module 80, a transmission module 30 and an adapter 32, which provides an electrically powered blind.

FIG. 205 shows a power group including an endless cord loop drive 700, a transmission module 30, and an adapter 32, similar to the arrangement depicted in FIG. 200 except the power module 20 has been eliminated.

FIG. 206 shows the power group of FIG. 196, except that a ratchet-type drive module 70 has been added. The ratchet-type drive module 70 may be used wherever the endless cord loop drive module 700 or the worm gear lift module 800 are used. However, the ratchet-type drive 70 has the advantage that it has no cord loop, and the single cord 71 may be placed so it is out of reach to children and pets.

FIG. 207 shows the power group depicted in the fifth embodiment (FIG. 5).

FIG. 208 shows the power group of FIG. 207 except that two coaxial power modules 20 have been added, in series, with the transmission module 30/ratchet-type drive module 70 parallel arrangement.

FIG. 209 shows a power group including a transaxial transmission and a variable brake 900.

FIG. 210 shows the power group of the sixth embodiment (FIG. 6), where the power module 20 and the transmission 30 are pressed against the side of the head rail 12A by means of the adapter 74, so as to free up room in the head rail 12A for other items, such as for running a tilt rod 24 the entire length of the head rail 12A.

FIG. 211 shows the power group of FIG. 196 except that it is for a two inch head rail 12A.

FIGS. 212 and 213 depict a power group including a power module 20 and an adapter module 912, useful for repositioning the output shaft (and possibly for changing the type of output shaft, say from a female square profile to a female "D" profile as pictured) while maintaining the same direction of rotation.

FIG. 214 shows an alternative embodiment of a covering for an architectural opening in which the covering is made in two parts. The entire covering is supported by a head rail 12. An upper covering portion (not shown) extends between the head rail 12 and an intermediate rail 12A. A lower covering portion extends between the intermediate rail 12A and a lower rail 14A. The transport system, including a spring motor power unit 20, a transmission 30, a lift rod 26, and lift stations 40, is mounted in the intermediate rail 12A and travels up and down with the covering.

FIG. 215 shows another alternative embodiment of a covering for an architectural opening, in which the covering is made in two parts. A head rail 12 is mounted at the top of the architectural opening, and the transport system, including a spring motor power unit 20, a transmission 30, a lift rod 26, and lift stations 40, is mounted in the head rail 12. The upper portion of the covering (not shown) is mounted on the lift cords 16, which extend to the intermediate rail 14. A lower portion covering extends down below the intermediate rail 14 and is supported by that intermediate rail 14.

FIG. 216 shows another alternative embodiment. In this case, the covering is made up in three parts. An upper portion (not shown) extends from the head rail 12 to the first intermediate rail 12A. An intermediate portion extends from the first intermediate rail 12A to the second intermediate rail 14A, and a lower portion (not shown) extends from the second intermediate rail 14A to the bottom rail 14B. The transport system, including a spring motor power unit 20, transmission 30, lift rod 26, and lift stations 40, is mounted on the first intermediate rail 12A and rolls up the upper lift cords 16.

FIGS. 217-220 show coverings for architectural openings in which the covering itself rolls up onto an elongated spool rather than rolling up lift cords onto individual spools. In these embodiments, the single elongated spool functions both as the spools and as the lift rod of the previous embodiments. FIG. 217 shows an arrangement in which the covering 1068 rolls onto the elongated spool 1070. The spool 1070 is mounted for rotation relative to an architectural opening such as a window by means of hubs (not shown) which are fixed relative to the opening. In this embodiment, the spool 1070 is driven by a spring motor power unit 20, which is also fixed relative to the architectural opening. The output shaft of the motor 20 drives a first gear 1072, which, in turn, drives a second gear 1074, that is fixed to the spool 1070, thereby driving the spool 1070.

FIG. 218 also has a spool 1070 mounted for rotation relative to the architectural opening. In this embodiment, the spool 1070 is driven by a motor 20, which is fixed relative to the architectural opening. The motor 20 drives a first pulley 1072A, which, through a belt, 1076, drives a second pulley 1074B that is fixed to the spool 1070, thereby driving the spool 1070.

FIG. 219 has the motor 20 mounted inside the spool 1070. In this case, the motor 20 is fixed relative to the architectural opening. The output shaft of the motor drives a first gear 1072B, which drives a second gear 1074B fixed to the spool 1070, thereby driving the spool 1070.

FIG. 220 also has the motor 20 mounted inside the spool 1070. In this case, the motor 20 is fixed to the spool 1070, and the output shaft 1078 is fixed relative to the architectural opening, so that, as the motor 20 drives its output shaft 1078, the motor 20 and spool 1070 rotate relative to the architectural opening.

It will be obvious to those skilled in the art that modifications may be made to the embodiments described above without departing from the scope of the present invention.

What is claimed is:

1. A lift and tilt station for a covering for an architectural opening, comprising:

a cradle;

a first lift spool rotationally supported on said cradle and having a first axis of rotation;

a lift rod driving said lift spool;

a tilt gear also rotationally supported on said cradle and having a second axis of rotation;

a tilt rod driving said tilt gear;

a tilt pulley rotationally supported on said cradle so as to rotate about said first axis of rotation independently of the rotation of said lift spool, and an outwardly-projecting tooth profile fixed on said tilt pulley and meshed with said tilt gear so that said tilt gear drives said tilt pulley.

2. A lift and tilt station as recited in claim 1, wherein said tilt pulley is supported directly on said cradle.

3. A lift and tilt station as recited in claim 1, wherein said tilt pulley is supported on said lift spool. which is supported by said cradle.

4. A lift and tilt station as recited in claim 1, wherein said outwardly-projecting tooth profile on said tilt pulley includes at least one gap large enough so that, when the tilt gear reaches the gap, the tilt gear stops driving said tilt pulley.

5. A lift and tilt station as recited in claim 4, wherein said outwardly-projecting tooth profile on said tilt pulley includes two of said gaps and an outwardly-projecting stop between the two gaps.

6. A lift and tilt station as recited in claim 1, and further comprising a hood mounted on said cradle and projecting over said tilt pulley.

7. A lift and tilt station as recited in claim 1, and further comprising a tilt cable wrapped onto said tilt pulley, wherein the circumference of the tilt pulley is larger than the linear length of travel required by the tilt cable to tilt the covering from a completely open position to a completely closed position.

8. A lift and tilt station as recited in claim 7, wherein said tilt pulley defines an eccentric drum.

9. A lift and tilt station comprising:

a lift rod defining a first axis of rotation;

a tilt rod defining a second axis of rotation;

a cradle;

a lift spool mounted for rotation on said cradle and driven by said lift rod;

a tilt pulley mounted for rotation about said first axis on said cradle and driven by said tilt rod; and a tilt cable wrapped onto said tilt pulley.

10. A lift and tilt station as recited in claim 9, and further comprising a tilt gear mounted for rotation on said cradle and driven by said tilt rod; wherein said tilt pulley defines an outwardly-projecting tooth profile fixed on said tilt pulley and meshed with said tilt gear so that said tilt gear drives said tilt pulley.

11. A lift and tilt station as recited in claim 10, wherein said outwardly-projecting tooth profile on said tilt pulley includes at least one gap large enough so that, when the tilt gear reaches the gap, the tilt gear stops driving said tilt pulley.

12. A lift and tilt station as recited in claim 9, and further comprising a hood mounted on said cradle and projecting over said tilt pulley.

13. A lift and tilt station comprising:

a lift rod defining a first axis of rotation;

a tilt rod defining a second axis of rotation;

a cradle;

a lift spool mounted for rotation on said cradle and driven by said lift rod;

a tilt pulley mounted for rotation on said cradle and driven by said tilt rod; and a tilt gear mounted for rotation on said cradle and driven by said tilt rod, wherein said tilt gear drives said tilt pulley, and wherein said tilt pulley is supported on said lift spool, which is supported by said cradle.

14. A lift and tilt station comprising:

a lift rod defining a first axis of rotation;

a tilt rod defining a second axis of rotation;

a cradle;

a lift spool mounted for rotation on said cradle and driven by said lift rod;

a tilt pulley mounted for rotation on said cradle and driven by said tilt rod; and a tilt gear mounted for rotation on said cradle and driven by said tilt rod, wherein said tilt pulley defines an outwardly-protecting tooth profile fixed on said tilt pulley and meshed with said tilt gear so that said tilt gear drives said tilt pulley;

wherein said outwardly-protecting tooth profile on said tilt pulley includes two gaps large enough so that, when the tilt gear reaches the gap, the tilt gear stops driving said tilt pulley;

and an outwardly-projecting stop between the two gaps.

15. A lift and tilt station comprising:

a lift rod defining a first axis of rotation;

a tilt rod defining a second axis of rotation;

a cradle;

a lift spool mounted for rotation on said cradle and driven by said lift rod;

a tilt pulley mounted for rotation on said cradle and driven by said tilt rod; and a tilt gear mounted for rotation on said cradle and driven by said tilt rod, wherein said tilt gear drives said tilt pulley, and further comprising a tilt cable wrapped onto said tilt pulley, wherein the circumference of the tilt pulley is larger than the linear length of travel required by the tilt cable to tilt the covering from a completely open position to a completely closed position.

16. A lift and tilt station comprising:

a lift rod defining a first axis of rotation;

a tilt rod defining a second axis of rotation;

a cradle;

a lift spool mounted for rotation on said cradle and driven by said lift rod;

a tilt pulley mounted for rotation on said cradle and driven by said tilt rod; and a tilt pear mounted for rotation on said cradle and driven by said tilt rod, wherein said tilt pear drives said tilt pulley, and wherein said tilt pulley defines an eccentric drum.

17. A lift and tilt station as recited in claim 9, and further comprising a second lift spool also mounted for rotation on said cradle and driven by said lift rod.

18. A lift and tilt station as recited in claim 9, wherein said tilt pulley is supported directly on said cradle.

* * * * *

UNITED STATES PATENT AND TRADEMARK OFFICE

CERTIFICATE OF CORRECTION

PATENT NO. : 7,311,133 B2
APPLICATION NO. : 11/194990
DATED : December 25, 2007
INVENTOR(S) : Richard Anderson et al.

It is certified that error appears in the above-identified patent and that said Letters Patent is hereby corrected as shown below:

Column 9, line 51, delete “FIG. 8 knot” and insert therefor --figure 8 knot--.
Column 9, line 54, delete “FIG. 12 knot” and insert therefor --figure 12 knot--.
Column 9, line 54, delete “FIG. 8 knot” and insert therefor --figure 8 knot--.
Column 9, line 57, delete “FIG. 12 knot” and insert therefor --figure 12 knot--.
Column 29, line 57, delete “FIG. 8 knot” and insert therefor --figure 8 knot--.
Column 29, line 61, delete “FIG. 12 knot” and insert therefor --figure 12 knot--.
Column 29, line 61, delete “FIG. 8 knot” and insert therefor --figure 8 knot--.
Column 29, line 63, delete “FIG. 8 knot” and insert therefor --figure 8 knot--.
Column 29, line 64, delete “FIG. 12 knot” and insert therefor --figure 12 knot--.
Column 36, line 39, delete “FIG. 8 knot” and insert therefor --figure 8 knot--.
Column 39, line 38, delete “FIG. 8 knot” and insert therefor --figure 8 knot--.
Column 41, line 48, delete “rational” and insert therefor --rotational--.

Signed and Sealed this

Twelfth Day of August, 2008

JON W. DUDAS
*Director of the United States Patent and Trademark Office*